US006588976B2

(12) United States Patent
Quenzi et al.

(10) Patent No.: US 6,588,976 B2
(45) Date of Patent: Jul. 8, 2003

(54) CONCRETE PLACING AND SCREEDING APPARATUS AND METHOD

(75) Inventors: Philip J. Quenzi, Atlantic Mine, MI (US); Carl B. Kieranen, Laurium, MI (US); Jeffrey W. Torvinen, Painesdale, MI (US); Charles A. Hallstrom, Calumet, MI (US); Mark A. Pietila, Atlantic Mine, MI (US)

(73) Assignee: Delaware Capital Formation, Inc., WIlmington, DE (US)

( * ) Notice: Subject to any disclaimer, the term of this patent is extended or adjusted under 35 U.S.C. 154(b) by 0 days.

(21) Appl. No.: 10/041,642

(22) Filed: Jan. 8, 2002

(65) Prior Publication Data

US 2002/0076279 A1 Jun. 20, 2002

Related U.S. Application Data

(63) Continuation-in-part of application No. 09/738,617, filed on Dec. 15, 2000.

(60) Provisional application No. 60/172,499, filed on Dec. 17, 1999.

(51) Int. Cl.[7] ..... E01C 23/07; E01C 19/12

(52) U.S. Cl. ..... 404/84.8; 404/101; 404/109

(58) Field of Search ..... 404/85, 86, 100, 404/101, 108, 109, 111, 84.8

(56) References Cited

U.S. PATENT DOCUMENTS

| | | | | |
|---|---|---|---|---|
| 613,910 | A | 11/1898 | Rich | |
| 1,778,099 | A | 10/1930 | Webb | |
| 1,974,123 | A | 9/1934 | Poulter | 61/63 |
| 2,176,891 | A | 10/1939 | Crom | 61/63 |
| 2,325,355 | A | 7/1943 | Yost | 169/24 |
| 2,331,373 | A | 10/1943 | Campbell | 299/57 |
| 2,392,004 | A | 1/1946 | Sherman | 212/34 |
| 2,432,417 | A | 12/1947 | Heath | 180/14 |
| 2,704,162 | A | 3/1955 | Johnson | 214/84 |
| 2,846,813 | A | 8/1958 | Giardina | 46/244 |
| 2,852,888 | A | 9/1958 | Howard | 46/244 |
| 3,061,201 | A | 10/1962 | Rienecker | 239/281 |
| 3,217,620 | A | 11/1965 | Mindrum | 94/39 |
| 3,324,963 | A | 6/1967 | Stroot et al. | 180/6.2 |
| 3,374,717 | A | 3/1968 | Reynolds, Jr. | 94/45 |
| 3,392,641 | A | 7/1968 | Kessel | 94/44 |
| 3,675,721 | A | 7/1972 | Davidson et al. | 169/24 |
| 3,744,719 | A | 7/1973 | Wallick | 239/199 |

(List continued on next page.)

FOREIGN PATENT DOCUMENTS

| | | | |
|---|---|---|---|
| DE | 3037182 | 2/1983 | B05B/15/08 |
| DE | 3335506 A1 | 5/1985 | E01C/19/00 |
| EP | 400759 A | 12/1990 | E01C/19/40 |
| JP | 438396 A | 2/1992 | E21C/9/00 |
| SU | 0260528 | 12/1969 | |
| WO | 9300479 | 1/1993 | E01C/23/06 |

*Primary Examiner*—Robert E. Pezzuto
*Assistant Examiner*—Alexandra K. Pechhold
(74) *Attorney, Agent, or Firm*—Van Dyke, Gardner, Linn & Burkhart, LLP

(57) ABSTRACT

A concrete placing apparatus is provided for placing uncured concrete on a support surface, such as an elevated deck of a building. The apparatus comprises a movable base unit and a movable support unit, with a conduit assembly extending therebetween. A supply end of the conduit assembly is positioned at the base unit and is connected to a supply line for uncured concrete or other material, while a dispensing end of the conduit assembly is supported by the movable support and extends outwardly therefrom to dispense uncured concrete or other material through a discharge outlet. The movable support is movable arcuately and/or radially relative to the base unit to dispense the concrete in a generally uniform manner over a targeted area. The apparatus may further include a plowing and/or screeding device at the discharge outlet to grade, level, compact and smooth the concrete as it is placed.

76 Claims, 67 Drawing Sheets

U.S. PATENT DOCUMENTS 3,789,869 A 2/1974 Morris ..... 137/351
3,830,325 A 8/1974 Tarter ..... 180/14 A
3,893,780 A 7/1975 Gutman et al. ..... 404/91
3,966,533 A 6/1976 Goldsworthy et al. ..... 156/380
3,979,152 A 9/1976 Morey et al. ..... 302/17
4,007,646 A 2/1977 De Jonge ..... 74/501
4,080,602 A 3/1978 Hattori et al. ..... 343/225
4,162,708 A 7/1979 Johnson ..... 172/4.5
4,222,522 A 9/1980 Kubo et al. ..... 239/160
4,244,123 A 1/1981 Lazure et al. ..... 37/193
4,273,196 A 6/1981 Etsusaki et al. ..... 172/4.5
4,371,287 A 2/1983 Johansson ..... 404/84
4,482,960 A 11/1984 Pryor ..... 364/424
4,519,768 A 5/1985 Murai et al. ..... 425/456
4,557,626 A 12/1985 McKay et al. ..... 404/90
4,655,633 A 4/1987 Somero et al. ..... 404/75
4,690,328 A 9/1987 Roehl ..... 239/227
4,734,021 A 3/1988 Maddock ..... 425/60
4,930,935 A 6/1990 Quenzi et al. ..... 404/75
4,978,246 A 12/1990 Quenzi et al. ..... 404/84
5,039,249 A 8/1991 Hansen et al. ..... 404/84
5,217,320 A 6/1993 Cioffi ..... 404/133.2
5,263,790 A 11/1993 Bickley et al. ..... 404/107
5,328,295 A 7/1994 Allen ..... 404/84.1
5,362,176 A 11/1994 Sovik ..... 404/72
5,393,167 A 2/1995 Fujita et al. ..... 404/84.1
5,419,654 A 5/1995 Kleiger ..... 404/101
5,448,479 A 9/1995 Kemner et al. ..... 364/424.02
5,476,341 A 12/1995 Johnson et al. ..... 404/101
5,556,226 A 9/1996 Hohmann, Jr. ..... 404/84.1
5,570,754 A 11/1996 Stimson ..... 180/234
5,868,156 A 2/1999 Korthaus ..... 137/240

CONCRETE PLACING AND SCREEDING APPARATUS AND METHOD

CROSS REFERENCE TO RELATED APPLICATIONS

The present application is a continuation-in-part of U.S. patent application, Ser. No. 09/738,617, filed Dec. 15, 2000 by Philip J. Quenzi et al. for CONCRETE PLACING AND SCREEDING APPARATUS AND METHOD, which claims priority on U.S. Provisional application Ser. No. 60/172,499, filed Dec. 17, 1999 by Philip J. Quenzi et al. for CONCRETE PLACING AND SCREEDING APPARATUS AND METHOD, which are hereby incorporated herein by reference in their entireties.

BACKGROUND OF THE INVENTION

This invention relates generally to concrete placing devices and, more particularly, to a low profile concrete placing and screeding apparatus for placing concrete in floors of buildings or in other areas where overhead obstructions preclude or limit the use of a boom truck.

It is known to use a pumping truck and pipe or a boom truck to place concrete at a targeted site. The boom truck, which comprises an articulated boom and pipe apparatus, where the pipe sections are pivotable about one or more generally horizontal axes, may be used to reach areas which are at a greater distance from the pumping truck or which are at a different height, such as an upper floor of a building or the like. However, it is difficult to use conventional boom trucks between floors of buildings because there may not be enough clearance between the floor and the overhead structures to reach the entire floor with the boom. The boom of the boom truck may also not be sufficiently long to reach distant areas of the targeted floor, thus requiring additional pipes to carry and place the concrete at those areas. An additional concern with boom trucks is that these trucks are typically too heavy to be driven onto raised or elevated slabs in order to be able to reach upper floors or levels of buildings.

In areas where boom trucks cannot reach or where a pumping truck is available while a boom truck is not, a movable pipe or multiple sections of pipe may be connected to the concrete pump and extended therefrom in order to reach the targeted area. Although such systems are capable of reaching remote areas from the pumps, it is difficult to manage the large and heavy pipes in order to properly place the concrete. Although several devices have been proposed which provide a mounting base for a movable pipe assembly to pivotally extend therefrom, it is still difficult to manage such devices, since the base must be manually moved once the pipes have spread the concrete at each particular location.

Additionally, after the pumping truck or boom truck has placed the concrete at the targeted areas via pipes or a boom, a screeding device must be positioned at the targeted areas to compact and smooth the concrete before it cures. Typically, the concrete may be placed in a targeted region of a floor and then the screeding device may be positioned at this region to smooth and pack the concrete while the placing system is moved to the next targeted region. This may require further movement of the placing apparatus in order to make room for the screeding apparatus, prior to placing the concrete at the next, typically adjacent, targeted location.

Accordingly, there is a need in the art for a low-profile placing apparatus which is easy to manage and/or maneuver in areas where there is low overhead clearance. The apparatus must be capable of reaching areas of a construction site which are remote from the location of a pumping truck. Additionally, the apparatus must be of relatively low weight, in order to be operable on raised or elevated slabs so as to be able to place concrete on upper floors or levels of buildings. There is also a need for an improved, more efficient method and apparatus for screeding the poured and/or placed concrete in such remote, difficult to reach areas, especially where overhead clearance is low, or on raised, elevated slabs.

SUMMARY OF THE INVENTION

The present invention is intended to provide a concrete placing and screeding apparatus which is especially useful and operable in areas with low overhead clearance, or on raised, elevated slabs, or in other locations where the support of high weight apparatus is difficult. The apparatus is easily maneuverable to place the appropriate amount of concrete in each targeted area. Additionally, a screeding device may be implemented with the placing apparatus, in order to combine the placing and screeding operations.

According to a first aspect of the present invention, a concrete placing apparatus for placing uncured concrete at a support surface comprises a conduit having a supply end and a discharge end, a movable wheeled base unit which supports the supply end of the conduit and a movable wheeled support unit which movably supports the discharge end of the conduit. The supply end of the conduit is adaptable to receive a supply of uncured concrete, while the discharge end is adapted to discharge the uncured concrete onto the support surface. At least one of the movable wheeled units includes a frame and two wheels which are adjustably mounted to the frame. The two wheels are adjustable between a laterally outward position and laterally inward position relative to frame. The concrete placing apparatus thus may be reduced in size via adjusting the wheels to their laterally inward position and retracting the extendable conduit to a retracted position, such that the concrete placing apparatus may be easily maneuverable and transportable between worksites.

In one form, the wheels of wheeled units are adjustable relative to the frame via pivotal movement of the wheels about a generally vertical pivot axis at opposite sides of the frames. The wheels are correspondingly adjustable about their respective vertical pivot axes to steer the wheeled units over the support surface. The wheels may be pivotally adjusted via a double ended hydraulic cylinder, where one end of the cylinder extends and retracts to pivot one of the wheels relative to the frame and the other end of the hydraulic cylinders correspondingly retracts and extends to pivot the other one of the wheels relative to the frame. Preferably, each of the wheels are independently drivable.

The conduit is preferably an extendable conduit and is extendable and retractable to adjust an overall length or reach of the placing apparatus. The extendable conduit has at least two sections which are extendable and retractable relative to one another. In one form, the extendable conduit has three sections. The extendable conduit is extendable and retractable by an extension and retraction device which preferably is operable to extend and retract the three sections generally correspondingly with respect to one another. The extension and retraction device may extend a middle section relative to an inner section via a rotatable drive member rotating along a track secured to the base unit, while a pulley system is operable to cause corresponding movement of the outer section relative to the middle section.

The concrete placing apparatus may further include a screeding device or plow assembly for at least partially smoothing and spreading out the uncured concrete over the support surface after the uncured concrete has been discharged by the placing apparatus. The discharge end of the conduit may further include a discharge tube, which may be flexible or curved to swing or move a discharge end of the flexible tube arcuately back and forth with respect to the wheeled support unit. The plow assembly may also be mounted to the support unit and may be laterally movable with the discharge end of the discharge tube. In one form, the plow assembly may include a plow which is movable back and forth to smooth or spread the uncured concrete in either direction. The plow assembly may also be vertically adjustable relative to the support unit and may be vertically adjustable in response to a laser leveling system.

According to another aspect of the present invention, a method for placing uncured concrete at a support surface comprises providing a concrete placing apparatus which includes a two-wheeled base unit and a two-wheeled support unit. The two-wheeled unit support opposite portions of an extendable conduit assembly. The lateral position of each of a pair of wheels for each of the two-wheeled units is adjustable between a laterally inward state and a laterally outward state. A supply of uncured concrete is connected to a supply end of the extendable conduit. The uncured concrete is discharged from a discharge end of the extendable conduit onto the support surface. The at least two-wheeled units are moved while discharging the uncured concrete over the support surface.

The lateral position of the pair of wheels for each of the wheeled units is adjustable to facilitate transportation and movement of the concrete placing apparatus over the support surface. When positioned in the laterally inward state, the concrete placing apparatus has a relatively narrow profile, which allows the apparatus to fit within a conventional manlift or the like to facilitate movement of the apparatus between worksites or elevated floors or decks without requiring complete disassembly of the apparatus.

According to a another aspect of the present invention, a concrete placing device for placing uncured concrete at a support surface comprises a base unit, a conduit, and a movable support. The conduit comprises a supply end and a discharge end, wherein the discharge end comprises a discharge outlet and is generally opposite the supply end. The supply end is mounted to the base unit and is connectable to a supply of uncured concrete. The conduit is operable to dispense the uncured concrete through the discharge outlet. The movable support is operable to movably support the discharge end of the conduit at a position remote from the base unit. Preferably, the conduit is an extendable tube which is extendable and retractable relative to the base unit. Preferably, the base unit comprises a base portion and a swivel portion rotatably supported by the base portion. The supply end of the extendable tube is mounted to the swivel portion, such that the discharge end of the extendable tube is movable arcuately and/or radially relative to the base unit. Preferably, the concrete placing device further comprises a screeding device positioned at the discharge end of the conduit.

In one form, the movable support comprises a wheeled vehicle, preferably having four wheels. In another form, the movable support comprises an air cushion device. In yet another form, the movable support comprises a plurality of wheel trolleys which are rotatable about a generally closed path via a drive motor and drive member such that the trolleys and the movable support are movable in a direction generally axially relative to the wheels of the wheel trolleys.

According to another aspect of the present invention, a concrete placing and screeding apparatus comprises a movable support, a conduit having a supply end and a discharge end, and a screeding device at the discharge end of the conduit. The supply end of the conduit is generally opposite the discharge end and is connected to a supply of uncured concrete to be placed. The conduit is supported by the movable support.

According to yet another aspect of the present invention, a concrete apparatus for placing and/or screeding uncured concrete at a support surface comprises one or both of a concrete supply unit and/or a screeding device, as well as an air cushion support unit. The concrete supply unit provides uncured concrete to the support surface, while the screeding device is operable to grade and smooth the uncured concrete on the support surface. The air cushion support unit is operable to support one or both of the concrete supply unit and/or the screeding device.

In one form, the concrete supply unit comprises a conduit having a supply end for receiving uncured concrete for discharging the uncured concrete on the support surface. Preferably, the conduit is extendable between the extended and retracted position relative to a base unit. The extendable conduit may be a telescopingly extendable tube, which is mounted to a pivotable base unit. The extendable conduit may otherwise be an articulated tube which comprises at least two sections which are pivotable about a joint, with the supply end of the conduit being mounted to a generally fixed base unit. The conduits, support units and/or base units are operable to move the discharge end of the conduit and/or the screeding device both arcuately and radially with respect to the base unit.

According to yet another aspect of the present invention, a concrete placing apparatus for placing uncured concrete at a support surface comprises an extendable conduit having a supply end and a discharge end, at least one air cushion support unit, which is operable to support the extendable conduit, and a base unit which is operable to support the supply end of the extendable conduit. The extendable conduit is operable to receive a supply of uncured concrete and discharge the uncured concrete to the support surface via the discharge end of the conduit.

In one form, the base unit is substantially fixed, and may be secured via two or more adjustable cables. Preferably, the extendable conduit is an articulated conduit having at least two sections pivotable about a generally vertically axis relative to one another. In one form, the articulated conduit may comprise at least three sections, with at least two air cushion supports supporting two of the sections of the conduit. In another form, the conduit may be flexible in a horizontal direction, while substantially precluding upward and downward flexing, such that the conduit may be bent or pivoted relative to the base unit about one or more generally vertical axes.

In another form, the extendable conduit may be telescopingly extendable to radially extend and retract the discharge end with respect to the base unit. The extendable conduit may further be arcuately movable with respect to the base unit.

Preferably, the extendable conduit is mounted to the air cushion support with a trunnion which allows for pivotal movement of the extendable conduit about a generally horizontal axis, while also allowing pivotal movement of the conduit about an axis extending generally along the extendable conduit.

Accordingly, the present invention provides a placing and/or screeding apparatus which is easily maneuverable and which may be easily implemented in areas where a boom truck cannot reach, such as remote areas of buildings or areas with low overhead clearance, or raised or elevated decks or slabs where weight may be a concern. The pivotable wheels allow for the placing apparatus to be adjusted between a narrow profile apparatus for moving the apparatus to a work site and a wider profile apparatus for greater stability of the apparatus at the work site. The air cushion devices function to movably support the concrete supply and/or a screeding device and spread the load of the units over a larger area via a cushion of air, such that the pressure exerted by the movable units on the support surface is substantially reduced. The air cushion units also facilitate movement of the conduit and/or screeding device over areas which are already covered with uncured concrete, such that concrete may be placed or smoothed in those areas without disturbing the already placed uncured concrete. The conduits are preferably extendable and may be extended and retracted relative to a base unit, such that the discharge end of the conduit and/or the screeding device may be moved throughout the targeted area to place or screed concrete in substantially all locations within the targeted area.

These and other objects, advantages, purposes and features of this invention will become apparent upon review of the following specification in conjunction with the drawings.

DESCRIPTION OF THE PREFERRED EMBODIMENTS

Figure 1:
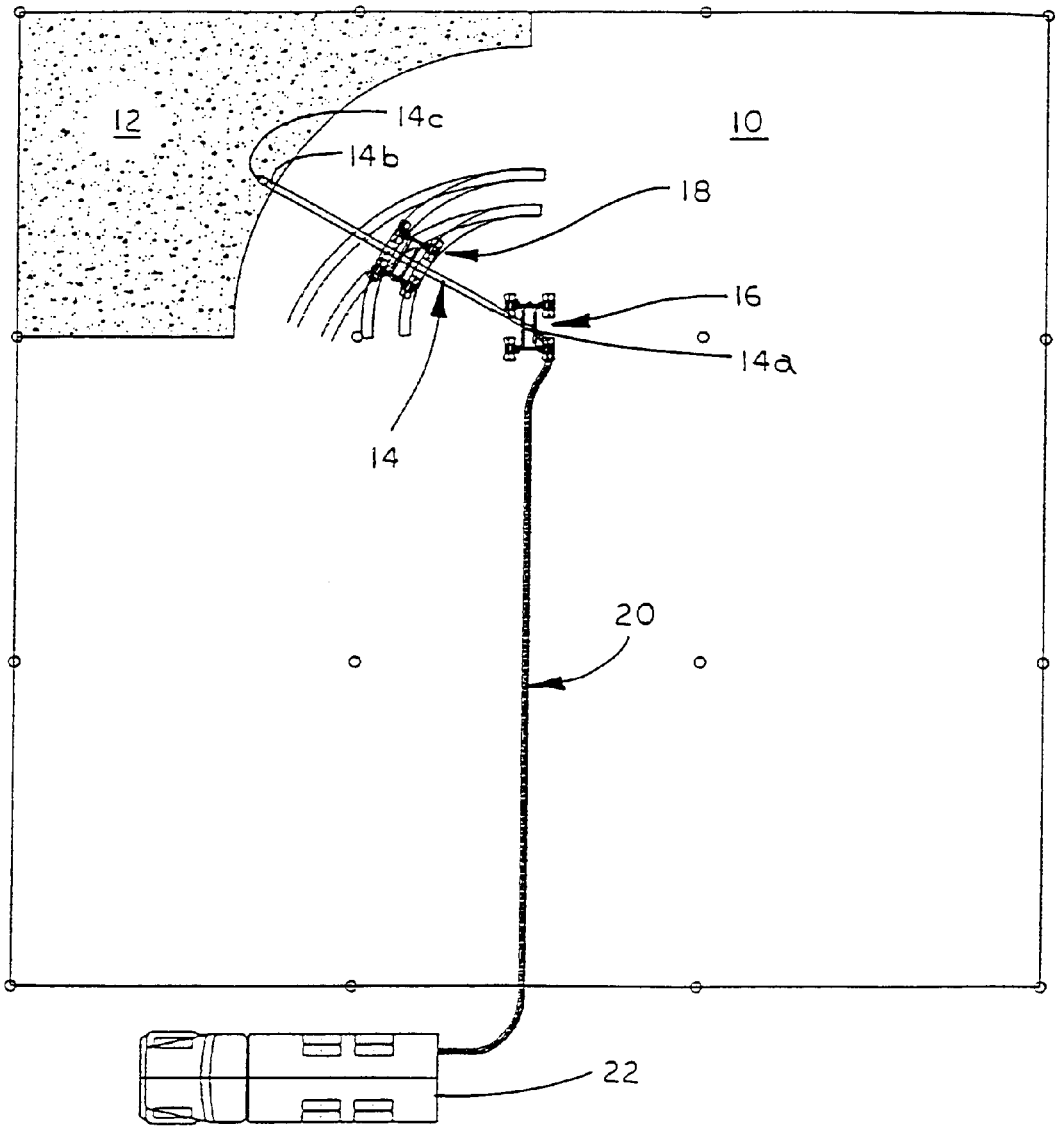
FIG. 1 is a plan view of an embodiment of the present invention as it may be used to place concrete.

Referring now specifically to the drawings, and the illustrative embodiments depicted therein, a placing apparatus 10 for placing concrete 12 in a targeted or designated area comprises a tube assembly, 14, a base unit 16, and a lead unit or movable support 18 (FIG. 1). Concrete placing device 10 is a low profile device and is thus usable in various locations, such as on different levels or floors of buildings or the like which may have low overhead clearance. The tube assembly 14 is preferably extendable and retractable, and is connectable at a supply end 14*a* to a concrete supply tube 20, which is connectable to a pumping truck 22 or other means for supplying uncured concrete through the supply tubes 20. Supply end 14*a* is preferably adapted to be connectable to a conventional supply hose or pipe, such as a 5 inch or 6 inch diameter concrete supply hose or pipe. The extendable tube assembly 14 places the concrete 12 via a discharge outlet 14*c* at an outer end 14*b* of tube assembly 14. Outer end 14*b* of tube assembly 14 is movably supported by movable support or lead vehicle 18, while supply or inner end 14*a* is preferably pivotally supported at base unit 16. Concrete placing device 10 is operable to extend and retract the extendable tube assembly 14 and to pivot the tube assembly relative to the base unit 16, in order to move discharge outlet 14*b* of tube assembly 14 both arcuately and radially relative to base unit 16 while concrete is being dispensed therefrom. The terms tube, pipe, conduit and the like are used herein to describe any means for conveying uncured concrete or the like from a supply of uncured concrete to a discharge outlet of the placing apparatus, and may include cylindrical pipes/tubes, open channels or troughs, hoppers or bins, or any other form of conduit, unless otherwise noted, without affecting the scope of the present invention. Although described herein as an apparatus for placing and/or screeding uncured concrete, the present invention may otherwise place or dispense other materials, such as sand, gravel, or the like, onto a support surface.

Wheeled Units

Preferably, base unit 16 and lead unit or movable support 18 both comprise a four wheeled vehicle, as shown in FIGS. 1–4. Base unit 16 and lead unit 18 both comprise a frame 16*d* and 18*d*, which houses a power source 28 (FIG. 5). Preferably, the power source 28 of each vehicle is an hydraulic pump which is interconnected with a reservoir 38 and a plurality of solenoid controls 40. A plurality of electronic controls 42 are provided to actuate one or more of the solenoids 40 to pressurize one or more hydraulic fluid lines and thus control driving the wheels, steering the wheels, and/or extension and retraction of one or more of the tubes of tube assembly 14, as discussed below. Power source 28 preferably is operable to drive or rotate each of the wheels 24 independently of the others via an hydraulic motor 44 at each wheel (FIG. 5). Each pair or set of wheels is rotatably mounted to an axle 26. Each pair of wheels on a given axle may be turned or steered together to change the direction of base or lead unit 16 or 18.

Figure 8:
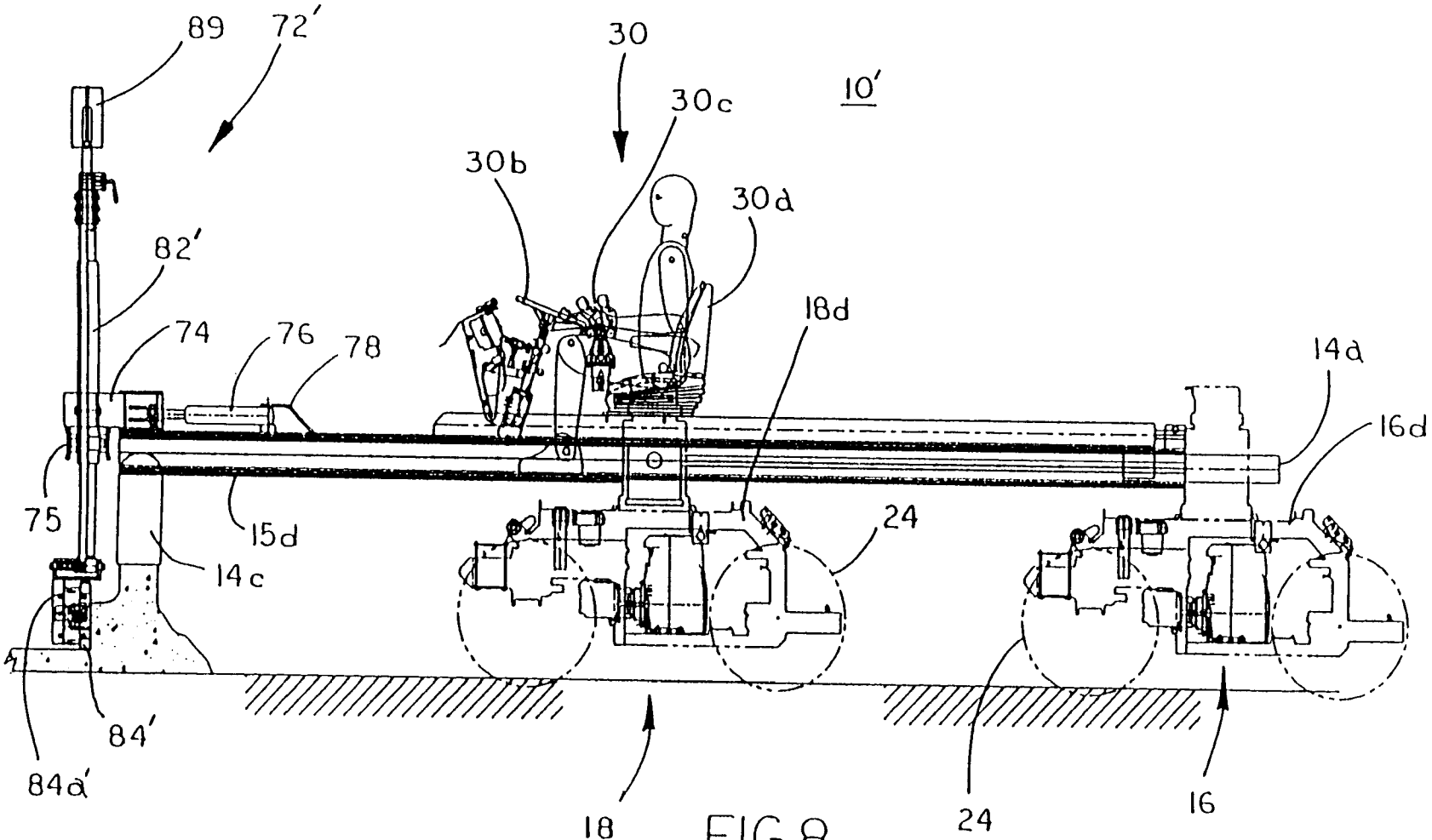
FIG. 8 is a side view of the wheeled embodiment shown in FIG. 7, with an operator control positioned at the lead vehicle, shown in its retracted state.

Because both the base and lead units 16 and 18 are four wheel drive and are steerable by both axles, the units may be easily maneuvered into the desired area, even when there may be obstructions, such as vertical support columns or the like, present in the area. The lead vehicle 18 may be driven outwardly from base unit 16 to extend the tubes and then driven arcuately relative to base unit 16 to pivot tube assembly 14 relative to base unit 16. Lead unit 18 may be remotely controlled via wire or radio controls (not shown) or may further comprise an operator seat or station 30 and controls for an operator to sit or stand on the lead vehicle and drive or otherwise control it while also controlling the placing of the concrete, as shown in FIG. 8. Alternately, the lead unit 18 may be controlled via a programmable control, such that the unit 18 is driven along a planned pattern relative to the base unit 16, without any manual intervention required.

Preferably, both base unit 16 and movable support 18 further comprise a swivel portion 16*a* and 18*a*, respectively. Swivel portions 16*a* and 18*a* are rotatably mounted to respective base portions 16*b* and 18*b*, such that each may be rotated 360° relative to the respective base portions of base unit 16 and movable support 18. Swivel portions 16*a* and 18*a* each preferably comprise a pair of upwardly extending supports or trunnions 16*c* and 18*c*, which further include a notch or groove for receiving corresponding pivot/support pins 14*d* and 14*e*, respectively, on tube assembly 14, as discussed below.

Figure 3:
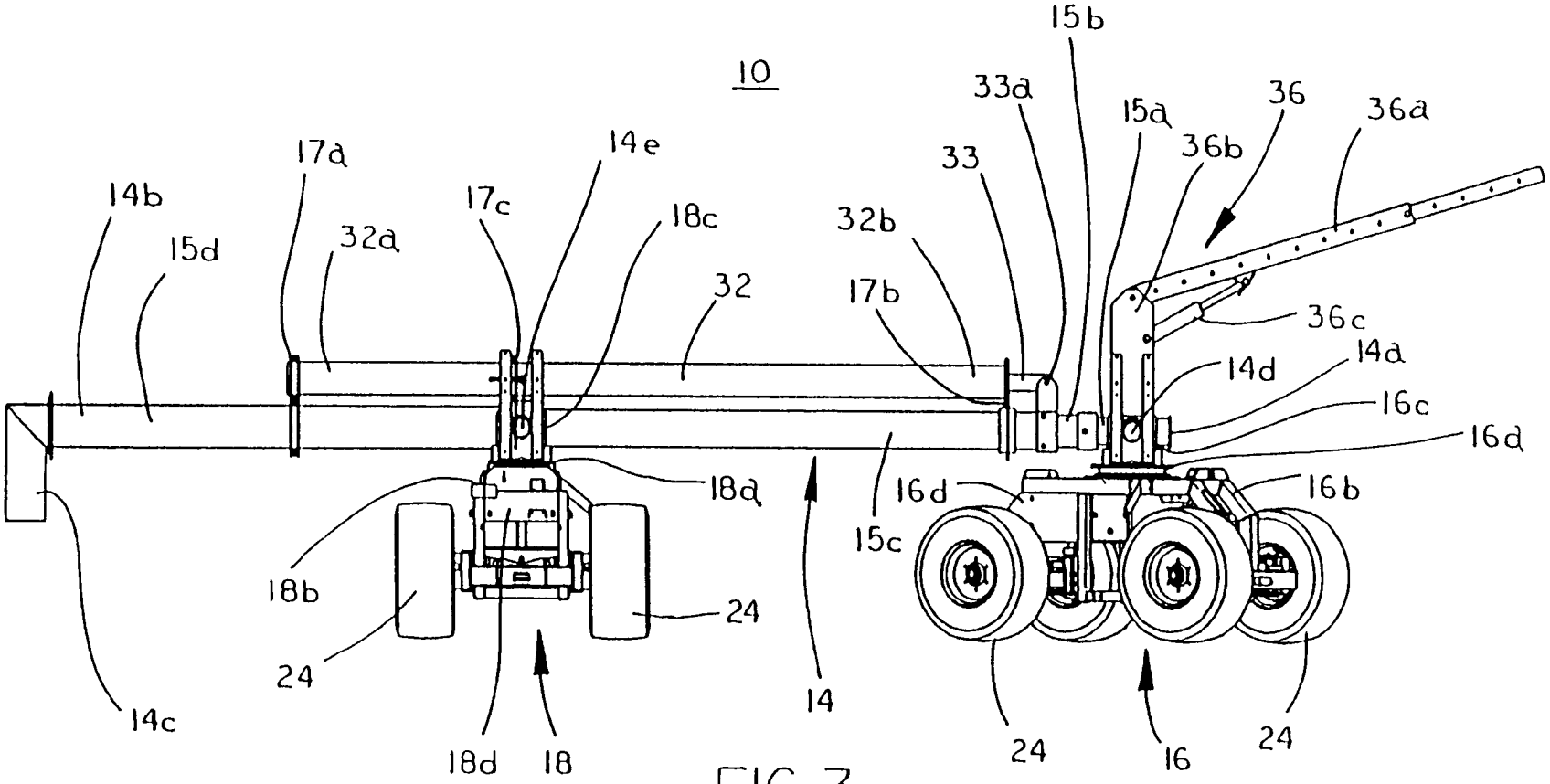
FIG. 3 is a side view of the apparatus of FIG. 2, and further includes a crane assembly mounted at the base unit.

As shown in FIG. 3, base unit 16 may further comprise a crane device 36, which is operable to lift and move sections of the supply hose or pipe 20, thereby easing the process of disconnecting and reconnecting supply end 14*a* of tube assembly 14 to the supply tube 20 when base unit 16 is moved to a new location. Crane member 36 comprises an extendable arm 36*a*, which is pivotally mounted to a base portion 36*b*, which is further mounted to swivel portion 16*a* of base unit 16. The base portion 36*b* is preferably mounted to trunnion 16*c* on swivel portion 16*a* and thus pivots with tube assembly 14 relative to base portion 16*b* of base unit 16. Extendable arm 36*a* may then be raised or lowered via an hydraulic cylinder 36*c* to lift or lower sections of the supply tube or pipe 20, which may or may not be filled with concrete at the time. Hydraulic cylinder 36*c* is preferably operable via the hydraulic pump 28 positioned on base unit 16.

Figure 2:
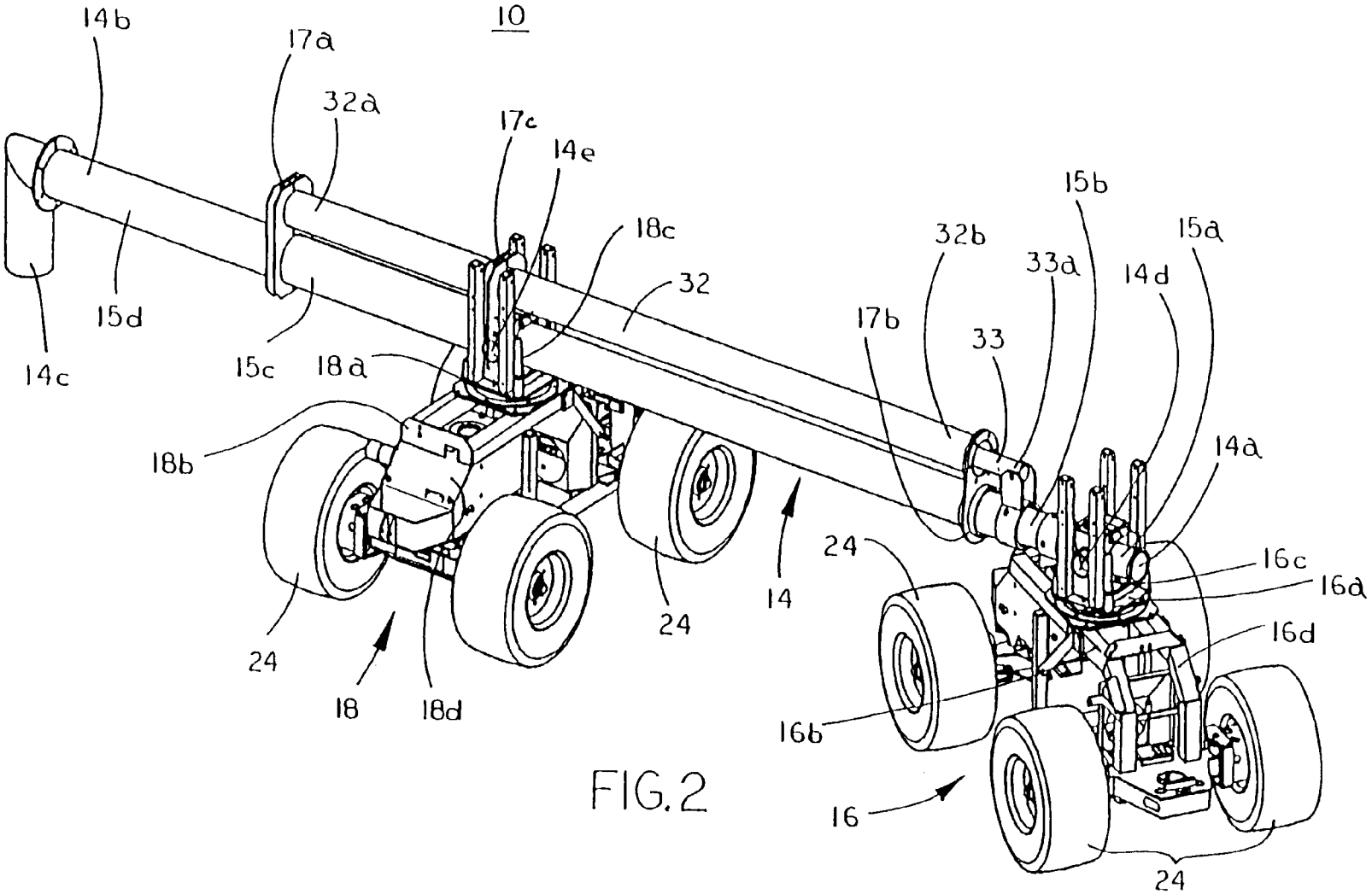
FIG. 2 is a perspective view of the embodiment shown in FIG. 1, with the apparatus in a retracted state.
Figure 4:
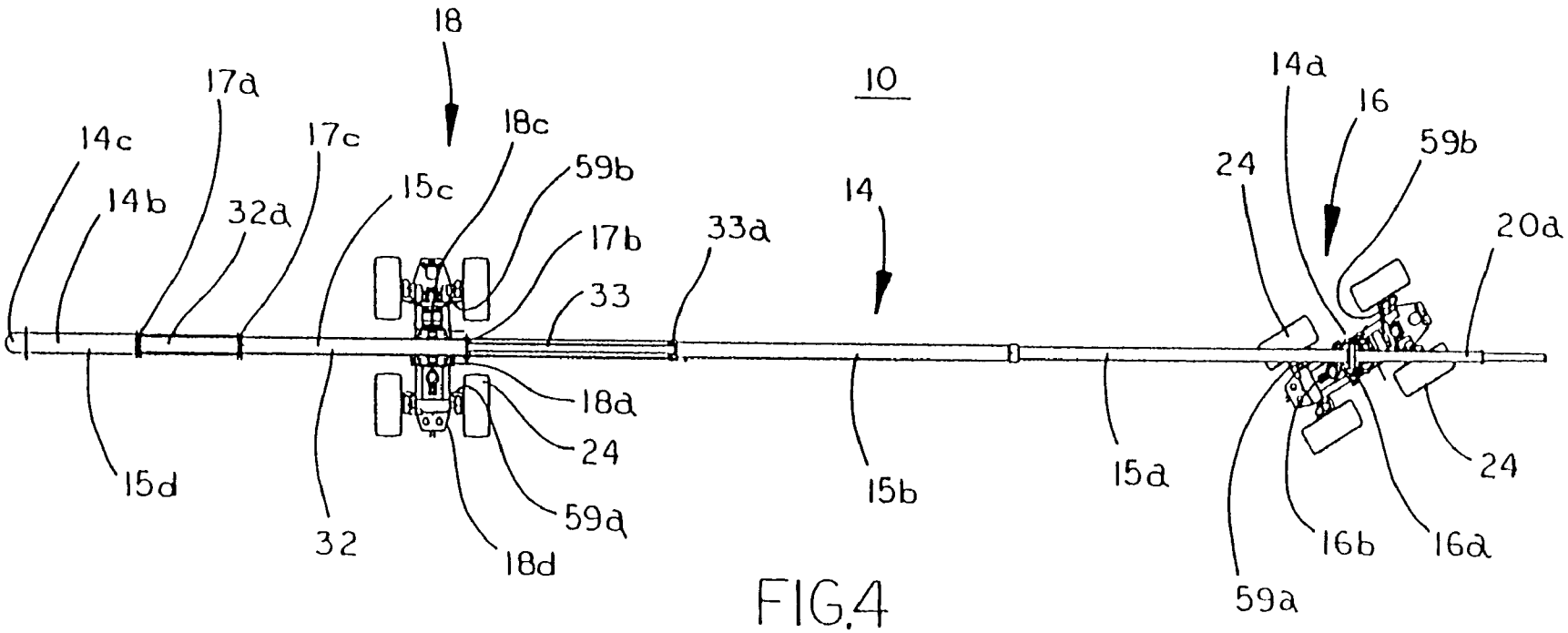
FIG. 4 is a plan view of the embodiment of FIGS. 1–3, shown in an extended state.
Figure 5:
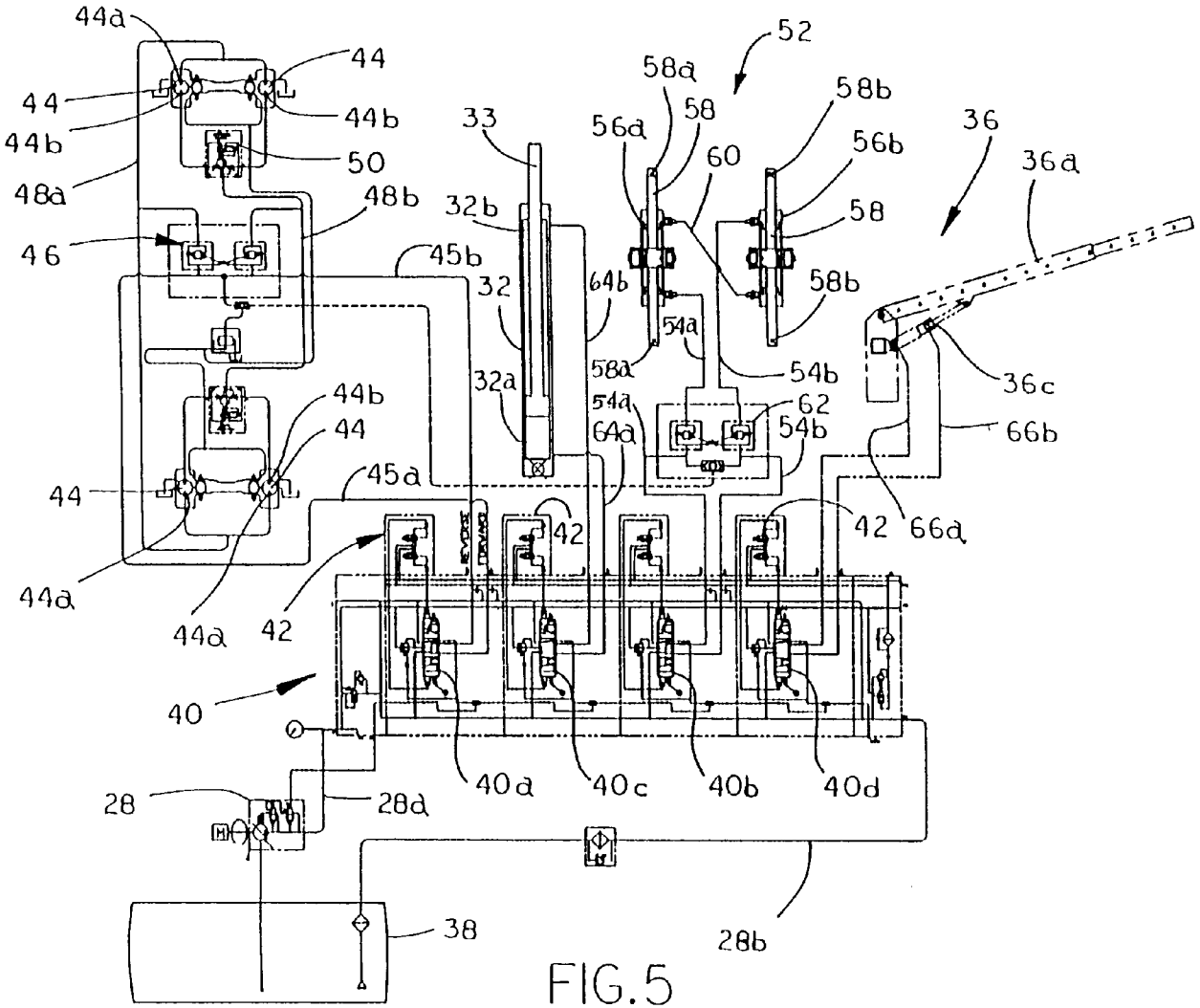
FIG. 5 is a hydraulic schematic of the embodiment shown in FIG. 3.

Tube assembly 14 is preferably extendable and comprises a plurality of nested or telescoping pipes or tubes, 15*a*, 15*b*, 15*c* and 15*d*, which slidably engage one another to extend and/or retract the tube assembly relative to base unit 16, as best shown in FIGS. 2–4. An innermost tube 15*a*, which also comprises the supply end 14*a* of tube assembly 14, preferably further includes a pair of cylindrical support pins 14*d* extending laterally outwardly from either side of tube 15*a* at supply end 14*a*. Inner tube 15*a* is pivotally mounted to a swivel portion 16*a* of base unit 16 via support pins 14*d* being received in the grooves of trunnions 16*c*. The pins 14*d* may pivot about a horizontal axis to allow for raising or lowering of one of the units relative to the other in areas where uneven terrain is encountered by placing apparatus 10. Additionally, because the pipe 15*a* is mounted to swivel portion 16*a* of base unit 16, the pipe assembly 14 may pivot or swivel about a vertical axis relative to base portion 16*b* of base unit 16. The tube assembly is thus preferably mounted to base unit 16 via a two axis mounting structure. However, other means for mounting the tube assembly to the base unit may be implemented, without affecting the scope of the present invention.

Preferably, the tubes are nested within one another and slidable relative to each of the other tubes to telescopingly extend and/or retract tube assembly 14 in response to actuation of one or more controls on either the lead or base unit 18 or 16. Preferably, as best shown in FIG. 4, three of the tubes 15*a*, 15*b* and 15*c* of telescoping tube assembly 14 are positioned between base unit 16 and lead unit 18 such that they extend and retract in response to relative movement of the base and lead units 16 and 18. The telescopic pipes are arranged so the concrete passes from the smallest pipe 15*a* at the concrete inlet to successively larger diameter pipes toward the discharge end 14*b*. This provides an "accumulator" effect and reduces surging due to the periodic concrete pump cycle.

The third tube 15*c* preferably includes a pair of cylindrical support pins 14*e*, which extend laterally outwardly from either side of tube 15*c* toward an outer end thereof. The support pins 14*e* of outer or third pipe 15*c* are preferably pivotally mounted within the grooves or openings of trunnions 18*c* of swivel portion 18*a* of lead unit 18, in a similar fashion as base unit 16, such that pipe assembly 14 is also pivotable or rotatable about both a vertical axis and a horizontal axis relative to base portion 18*b* of lead unit 18.

Preferably, a fourth, outermost tube or pipe 15*d* is positioned outwardly of lead unit 18 and is further extendable and retractable relative thereto via a powered extending device 32, such as an hydraulic cylinder or the like. The discharge outlet 14*c* is positioned at an outer end of outer pipe 15*d*, and is preferably directed generally downwardly to facilitate placing of concrete at the desired locations. Extending device 32 preferably comprises a conventional hydraulic cylinder 32 and a rod and piston assembly 33, as is known in the art. An outer end 32*a* of cylinder 32 is fixedly mounted to a bracket 17*a* on outer tube 15*d* while an inner end 32*b* of cylinder 32 is slidably mounted on the next inner tube 15*c* via a bracket or collar 17*b*. A third bracket 17*c* is provided at an inner end of outer tube 15*d* and fixedly secures cylinder 32 at the inner end of the outer tube 15*d*. An end 33*a* of rod 33 is then fixedly mounted at an inward end of the next inwardly positioned tube 15*c* such that extension of rod 33 relative to cylinder 32 causes outward movement of outer tube 15*d* along inner tube 15*c*, as hydraulic cylinder 32 moves longitudinally outwardly with respect to tube 15*c*, while the sliding collar 17*b* slides along tube 15*c*. Brackets 17*a* and 17*c* support cylinder 32 and push outer tube 15*d* outwardly along tube 15*c* as cylinder 32 is moved outwardly via extension of rod 33. Preferably, hydraulic cylinder 32 is powered by power source or hydraulic pump 28 positioned on lead unit 18. The other tubes 15*a*–15*c* may be extended and retracted by driving the lead vehicle in a generally longitudinal direction with respect to the tube assembly 14, and/or may be extended and retracted via one or more hydraulic cylinders, as discussed in detail below. Although not shown, concrete placing device 10 further comprises a valve or the like in tube assembly 14 to control the flow of concrete therethrough independently of the controls of the pumping truck 22, as is known in the art.

In the illustrated embodiments, the tubes 15*a*–15*d* are retractable such that placing apparatus 10 is approximately 17 feet long from supply end 14*a* to discharge end 14*b* of tube assembly 14. Preferably, tube assembly 14 is positioned on lead vehicle 18 such that tube 15*c* and outer tube 15*d* extend approximately 8 feet from their connection point (at support pins 14*d* on tube 15*c*) on lead vehicle 18 when tube 15*d* is fully retracted. The tube assembly 14 is then extendable a total of approximately 31 feet such that the placing apparatus 10 spans approximately 48 feet from supply end 14*a* to discharge end 14*b* when extended. Inner tubes or pipes 15*a*, 15*b* and 15*c* extend such that lead unit 18 may travel approximately 24 feet from its initial, retracted position, while outer pipe 15*d* is further extendable via hydraulic cylinder 32 approximately 7 additional feet from pipe 15*c* and lead vehicle 18.

Referring now to FIG. 5, concrete placing apparatus 10 preferably includes at least one open loop, closed center hydraulic system for operation of all of the fluid motors and fluid cylinders on each of the base and lead units 16 and 18. FIG. 5 shows the hydraulic system for the lead unit 18, with the solenoid and cylinder for the crane 36 of the base unit 16 shown in phantom. An hydraulic pump 28 is provided which draws hydraulic fluid from a reservoir or tank 38. The pump 28 may be powered by a battery or diesel or gasoline powered internal combustion engine (not shown). The pump 28 provides hydraulic fluid under pressure through an hydraulic line 28*a* to a bank or series of hydraulic control valves 40, which are also positioned on the respective units 16 or 18. Each of the control valves 40 includes a series of individual, three position valves which may be shifted to open, close or reverse the hydraulic fluid flow through the appropriate motor or cylinder via actuation of an electronic control 42. Each of these valves further includes a flow control valve which may be adjusted or opened or closed to vary the speed of the hydraulic fluid flow through the valve to control the speed of operation of the respective mechanism. Fluid is returned to reservoir 38 via a return line 28*b*.

As shown in FIG. 5, a first control valve 40*a* may control the drive motors 44 for individually driving the wheels 24 of the respective unit via hydraulic lines 45*a* and 45*b*. Hydraulic line 45*a* provides fluid to a first port 44*a* on each motor 44, via a counterbalance valve 46 and hydraulic line 48*a*, for driving the wheels in a forward direction, while hydraulic line 45*b* is connected to second ports 44*b* on motors 44, via counterbalance valve 46 and hydraulic line 48*b*, for driving the wheels in a reverse direction. A dual counterbalance or load control valve 46 is provided in the hydraulic lines 45*a* and 45*b* which is generally a dual piloted relief valve with pilot pressure for one line being supplied from the opposite port of the motor. This provides counterpressure to the lines in order to prevent the vehicle from excessively accelerating or running away when driving the respective unit downhill. For example, if the vehicle is travelling forward, pressurized fluid in line 45*a* travels through a forward portion 46*a* of load control valve 46 and into the forward ports 44*a* of motors 44 via hydraulic line 48*a*. If the unit begins travelling downhill rapidly in the forward direction, the pressure at the forward ports 44*a* would decrease toward zero, as the motors rotate at a faster rate than the fluid is being provided by pump 28. This drop in pressure causes a corresponding reduction in pilot pressure to the outlet or reverse ports 44*b* of motors 44 and in the reverse hydraulic lines 48*b*, which function to return the fluid toward reservoir 38 when the vehicle is being driven in a forward direction. When the pilot pressure is reduced to or near to zero p.s.i., the load control valve is at its maximum setting and thus provides back pressure to the reverse line to slow down the rotation of the wheels and thus prevent the machine from travelling too fast or getting away.

Additionally, a traction control valve 50 may also be provided at each axle 26 to divide the flow of fluid to the left and right wheels of each axle in order to prevent a wheel from spinning freely if it encounters an area with poor traction. Each traction control valve 50 comprises a solenoid operated bypass valve that is normally open. When poor traction conditions are encountered, the solenoid valve may be energized to split the flow and variably adjust the lines to prevent slippage of one of the wheels. A third traction control valve (not shown) may also be provided to divide the flow between the front and back axles, in order to further improve the traction of the vehicles.

A second hydraulic solenoid valve 40*b* is also provided to control the steering system 52 via a pair of hydraulic lines 54*a* and 54*b*. As shown in FIG. 5, this may be accomplished via a pair of hydraulic cylinders 56*a* and 56*b* at opposite axles of the respective unit. Each steering cylinder 56*a* and 56*b* comprises a double ended piston and rod assembly 58. Each rod end 58*a* and 58*b* of the respective rods connects to a corresponding wheel control arm 59*a* and 59*b* (FIG. 4) at an opposite end of the respective axle. Preferably, rod ends 58*a* of a front cylinder 56*a* are connected to control arms 59*a* positioned rearwardly of the front axle, while rod ends 58*b* of a rear cylinder 56*b* are connected to control arms 59*b* positioned forwardly of the rear axle, such that the cylinders are operable to pivot or steer the wheels at each axle in a generally opposite direction to the wheels of the other axle. Alternately, the control arms may be positioned outwardly from their respective axles, such as forwardly of the front axle and rearwardly of the rear axle, to accomplish the same steering effect. This approach is operable to turn or steer all four wheels together to facilitate a tighter turning radius and thus improve maneuverability of the base and lead units. The steering cylinders are equipped with piston mounted bypass shuttle valves (not shown), which open when the cylinders reach full stroke in either direction. This allows the wheels to be resynchronized at full steer in the event of cylinder leakage.

As pressurized fluid is supplied through one of the lines 54*a*, the piston/rod assembly 58 in the front cylinder 56*a* moves along the cylinder to move control arms 59*a* and thus cause the wheels on the front axle of the vehicle to pivot together relative to their axle. A connecting hydraulic line 60 connects one end of front cylinder 56*a* to an opposite end of the other, rear cylinder 56*b*, so as to cause a corresponding movement of the piston/rod assembly 58 within the other cylinder 56*b*, thereby moving the control arms 59*b* and causing the wheels on the rear axle of the vehicle to pivot in tandem with the first wheels, but in a generally opposite direction. This is accomplished by positioning the control arms toward opposite ends of the vehicle with respect to their axles, such as one set being forwardly of the rear axle while the other set is rearwardly of the front axles, as is known in the art. Although described as having a front and rear axle, clearly the units 16 and 18 are drivable in either direction.

A dual counterbalance or load control valve 62 is further provided to prevent unwanted steering caused by one or more of the wheels hitting obstructions as the vehicle travels along the ground. The counterbalance 62 is operable in a similar manner as load control valve 46 discussed above with respect to the wheel drive system. Although shown as providing steering to each axle simultaneously, clearly the present invention may be operable to steer the wheels on only one axle at a time, or to provide a "crab" steer mode, as would be obvious to one skilled in the art, without affecting the scope of the present invention.

With respect to the lead unit or movable support 18, a third solenoid control valve 40*c* may be provided to provide pressurized fluid to hydraulic cylinder 32 in order to extend or retract outer pipe 15*d* relative to movable support 18. Solenoid valve 40*c* may provide pressurized fluid to outer end 32*a* of hydraulic cylinder 32 to cause extension of the piston/rod 33 via an hydraulic line 64*a*, while a second hydraulic line 64*b* is connected at inward end 32*b* of hydraulic cylinder 32 to allow fluid to return to reservoir 38 as piston/rod assembly 33 extends from hydraulic cylinder 32. Solenoid control valve 40*c* is also operable to pressurize hydraulic line 64*b*, such that the piston assembly 33 is moved in the opposite direction to retract outer tube 15*d* relative to movable support 18 and the inner tubes 15*a*, 15*b* and 15*c*.

With respect to the base unit 16, an additional solenoid control valve 40*d* may be provided to control extension and retraction of the hydraulic cylinder 36*c* on the crane device 36, if applicable, via a pair of hydraulic lines 66*a* and 66*b*. Preferably, the hydraulic system of base unit 16 includes crane device cylinder 36*c* while the hydraulic system of lead unit 18 includes the extension cylinder 32. As would be obvious to one skilled in the art, the hydraulic cylinder 36*c* is extendable and retractable by selectively pressurizing one of the hydraulic lines 66*a* and 66*b*, respectively, while the other line functions to return hydraulic fluid to reservoir 38 via solenoid valve 40*d* and return line 28*b*.

Screeding Device

Referring now to FIGS. 6–10, another embodiment 10' of the present invention further comprises a screeding device 72 positioned at an outer end 14*b* of the extendable tube assembly 14. The tube assembly 14 is substantially similar to tube assembly 14 discussed above with respect to placing apparatus 10 and will not be discussed further in detail herein. The tube assembly 14 is pivotally mounted to swivel portions 18*a* and 16*a* of a lead vehicle 18 and a base vehicle 16 in the same manner as discussed above. Base unit 16 and lead unit 18 are also identical to the units discussed above with respect to placing apparatus 10 and thus will not be discussed again in detail. Optionally, the base unit 16 may include a crane device 36 for raising and lowering sections 20*a* of the supply pipe 20. Optionally, one or more movable units may support and transport a screeding device independent of any concrete supply conduit, such that the units are operable to smooth, level and/or grade concrete that has already been placed at the support surface.

Preferably, the screeding device 72 is a laser controlled screed mounted at the outer end 14*b* of the tube assembly 14, and adjacent to the discharge nozzle 14*c*. The screeding device 72 is pivotally mounted at the outer end 14*b* so as to be pivotable from side to side in order to compact and smooth the concrete being placed by the placing and screeding apparatus. Preferably, screed 72 comprises a mounting beam 75, which is mounted on an arm 74, which is pivotally mounted at outer end 14*b* of tube assembly 14 and is pivotable about a pivot axis or swivel point 74*a* at the end of the tube. An hydraulic cylinder 76 is pivotally mounted at one end to a mounting bracket 78 on tube assembly 14 and pivotally mounted at an opposite end to a bell crank type arm or bracket 80, such that extension and retraction of the hydraulic cylinder 76 pivots the entire screed 72 and arm 74 about swivel 74*a*.

Figure 9:
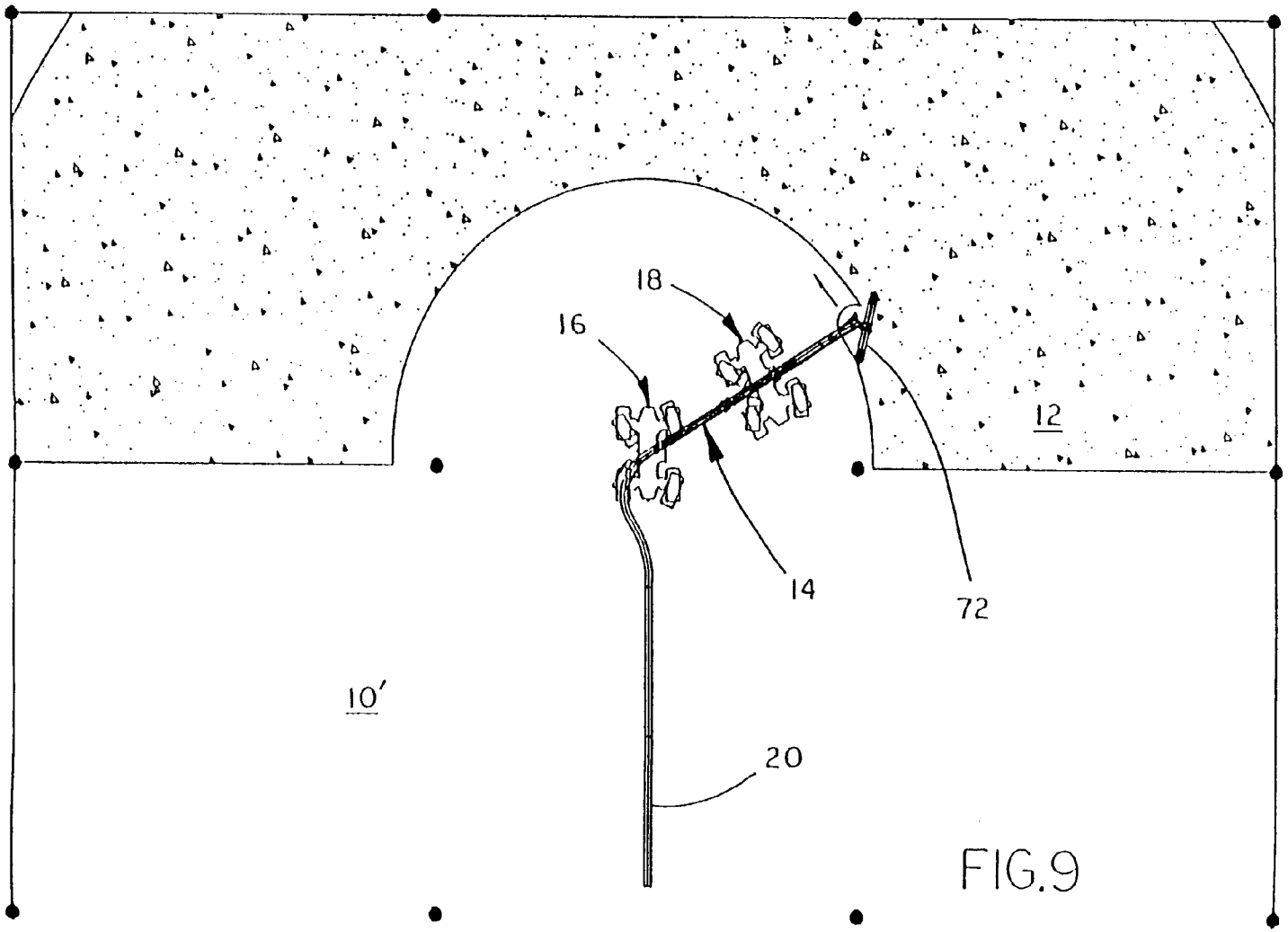
FIG. 9 is a plan view of the apparatus of FIGS. 6 and 7, as the apparatus is used to place and smooth concrete within a given targeted area.

The screeding device 72 is pivotable relative to tube assembly 14 in order to provide proper orientation of a plow 84 and/or other screeding components as the lead unit 18 and pipes 14 pivot arcuately relative to base unit 16. For example, as shown in FIG. 9, the screeding device 72 may be pivoted 45° in one direction as the tubes are rotated in a first direction, and then pivot 90° for an opposite orientation with respect to the tube assembly 14, to provide proper orientation for arcuate movement in the opposite direction.

Figure 6:
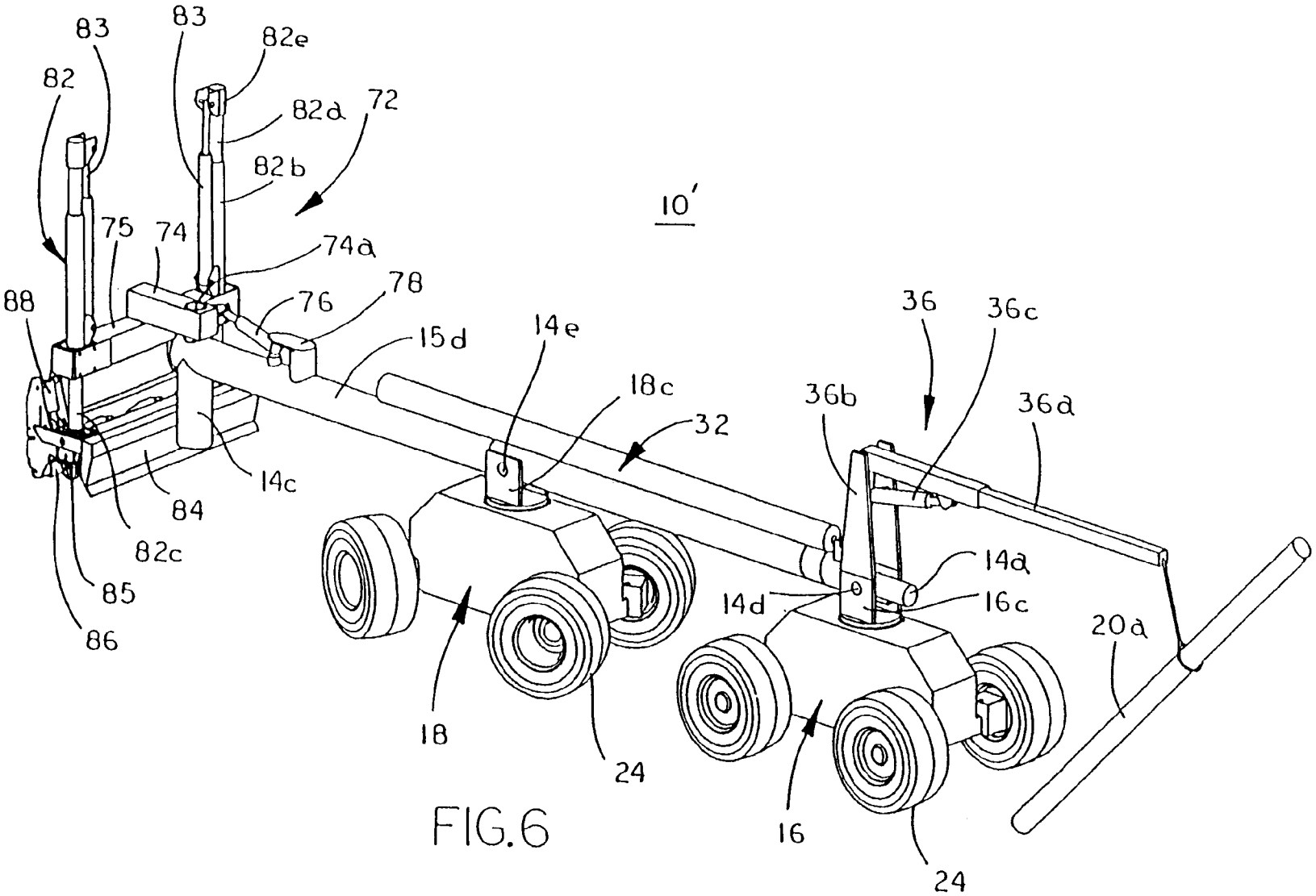
FIG. 6 is a perspective view of an alternate embodiment of the present invention in a retracted state, with a screeding device positioned at a discharge end of the pipe assembly.
Figure 6A:
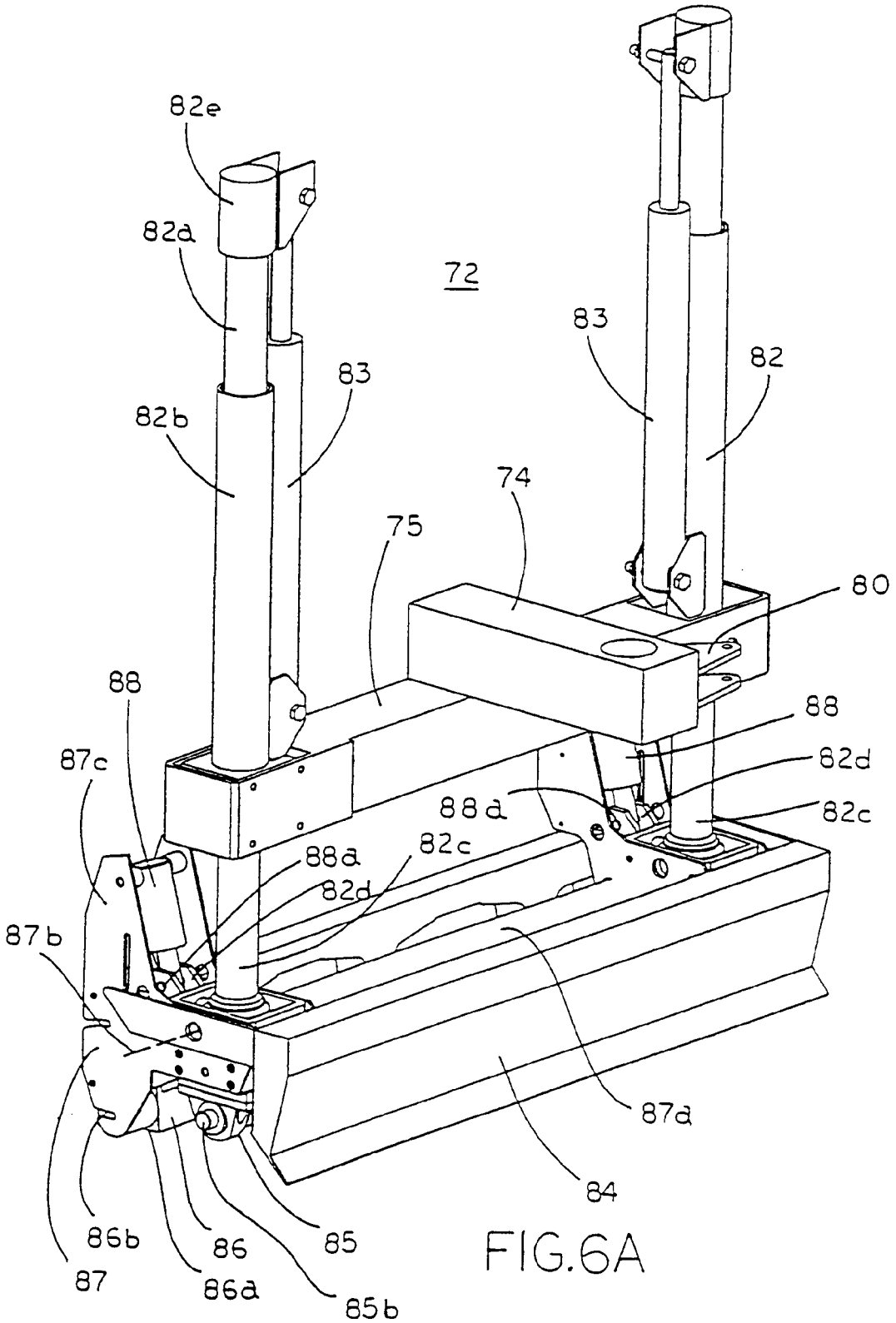
FIG. 6A is an enlarged view of the screeding device shown in FIG. 6.

Screeding device 72 may be a conventional screeding device, or may be a laser controlled screed similar to the types disclosed in commonly assigned U.S. Pat. No. 4,655,633, issued to Somero et al., and/or U.S. Pat. No. 4,930,935, issued to Quenzi et al., the disclosures of which are incorporated herein by reference. Preferably, as shown in FIGS. 6 and 6A, screed 72 is substantially similar to the screeding device disclosed in U.S. Pat. No. 4,930,935 and comprises a pair of generally vertical adjustable supports 82 which are adjustable via extension and retraction of a pair of hydraulic cylinders 83. As cylinders 83 are extended or retracted, an inner support rod 82*a* is movable along and within an outer cylindrical sleeve 82*b*, which is fixedly secured to mounting beam or cross member 75, such that a lower end 82*c* of supports 82 is vertically adjustable with respect to beam 75 and tube assembly 14.

Because screed assembly 72 is preferably substantially similar, but to a smaller scale, to the screed assembly disclosed in U.S. Pat. No. 4,930,935, a detailed discussion of the screed assembly will not be repeated herein. Suffice it to say, as best seen in FIG. 6A, screed assembly 72 preferably includes an elongated plow 84, an auger 85 and a vibratory screed 86. Plow 84, auger 85 and screed 86 are all mounted to an end frame 87 at each end, each of which are connected to one another by a horizontal cross member 87*a*. Plow 84 is rigidly secured to frames 87 and is operable to establish a rough grade of the uncured concrete dispensed via dispensing nozzle 14*c*. Auger 85 is a spiral, continuous auger which is rotated via a shaft 85*b* rotatably driven by a motor 85*a* (FIG. 10) to further smooth the concrete and to carry excess concrete toward one end of screed assembly 72. Vibratory screed 86 comprises a screed strip or plate 86*a* and a rotatable shaft 86*b* which is driven via an hydraulic rotation motor 86*c*. A series of weights (not shown) are secured concentrically to the shaft 86*b* such that rotation of shaft 86*b* causes vibration of the screed strip 86*a* to smooth and compact the concrete. Vibration of the motor 86 and plow 84 is isolated from the remainder of the screed assembly 82 by a plurality of rubber mounts (not shown) which absorb the vibration and prevent vibration of the remainder of the plow, auger, screed assembly and the placing and screeding apparatus 10'.

As discussed in U.S. Pat. No. 4,930,935, end frame 87 is preferably pivotally mounted at lower end 82*c* of supports 82 to allow pivoting of the frames 87 about a generally horizontal axis 87*b*. A pair of self-leveling cylinders 88 are mounted at an upwardly extending mounting plate 87*c* at each end frame 87, with their opposite or rod end 88*a* mounted to a bracket 82*d* positioned at lower end 82*c* of supports 82. Self-leveling cylinders 88 may then be extended or retracted to pivot end frames 87 about axis 87*b*, to maintain a level interface between plow 84, auger 85 and screed 86 and the uncured concrete, preferably in response to an electronic leveling sensor (not shown). By maintaining the proper angle and orientation of the plow and screed with respect to the concrete, the plow is substantially precluded from digging into the concrete surface as it moves thereal-ong. The electronic level sensor detects when the plow pivots about horizontal axis 87*b* and provides a signal to the controls of the hydraulic cylinders 88 such that they extend or retract to counter the detected rotation of the plow, in the same manner as disclosed in U.S. Pat. No. 4,930,935 referenced above.

Preferably, screed assembly 72 further includes a pair of laser receivers (not shown), preferably mounted at an upper end 82*e* of vertical supports 82. The hydraulic cylinders 83 are extendable and retractable to maintain the screed and plow assembly at the appropriate level with respect to a signal from a laser beacon projector, as disclosed in U.S. Pat. No. 4,655,633, referenced above. The laser receivers detect a reference plane generated by the projector, and the controls of screeding device 10' automatically adjust the hydraulic cylinders 83 accordingly.

Figure 7:
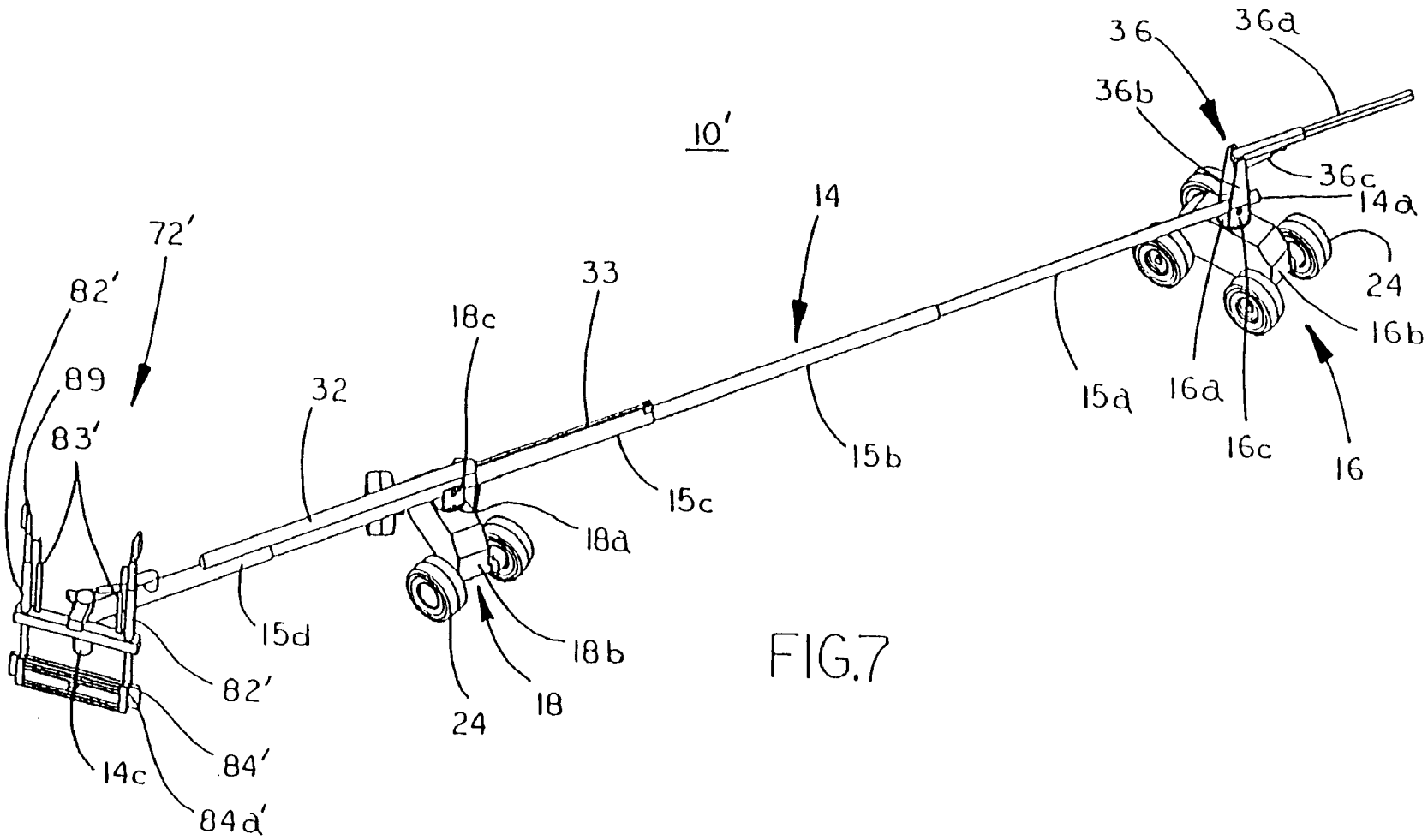
FIG. 7 is a perspective view of the embodiment of FIG. 6, with an alternate screeding device, shown in its extended state.

As shown in FIGS. 7 and 8, a simplified screed assembly 72' may be pivotally mounted at outer end 14*b* of pipe assembly 14 of placing and screeding apparatus 10'. Screed 72' is similar to screed 72 and preferably comprises a pair of vertical adjustable supports 82' and a vibratory plow 84', which is movably mounted at a lower end of each of the supports 82'. Similar to the vibratory screed 86, discussed above, the vibratory plow may vibrate horizontally along pins 84*a'* in response to actuation of a vibrating motor (not shown). Preferably, vertical supports 82' comprise laser beacon receivers 89, which are 360° omni-directional receivers which detect the position of a laser reference plane such as that provided by a long range rotating laser beacon projector (not shown). A control (not shown) receives and processes signals from the laser receivers and is operable to automatically adjust the level of the vibratory plow 84' via a pair of hydraulic cylinders 83' positioned along each vertical support 82'.

As discussed above with respect to placing apparatus 10, placing and screeding apparatus 10' may be remotely controlled via a wire or radio signal, or may include an operating station 30 on the base or lead units 16 or 18 for an operator to drive and control the placing and screeding apparatus, as shown in FIG. 8. The operating station 30 may comprise a seat 30*a*, steering wheel 30*b*, and controls for actuating the various solenoids 40 in order to control all aspects of the placing and screeding apparatus.

Figure 10:
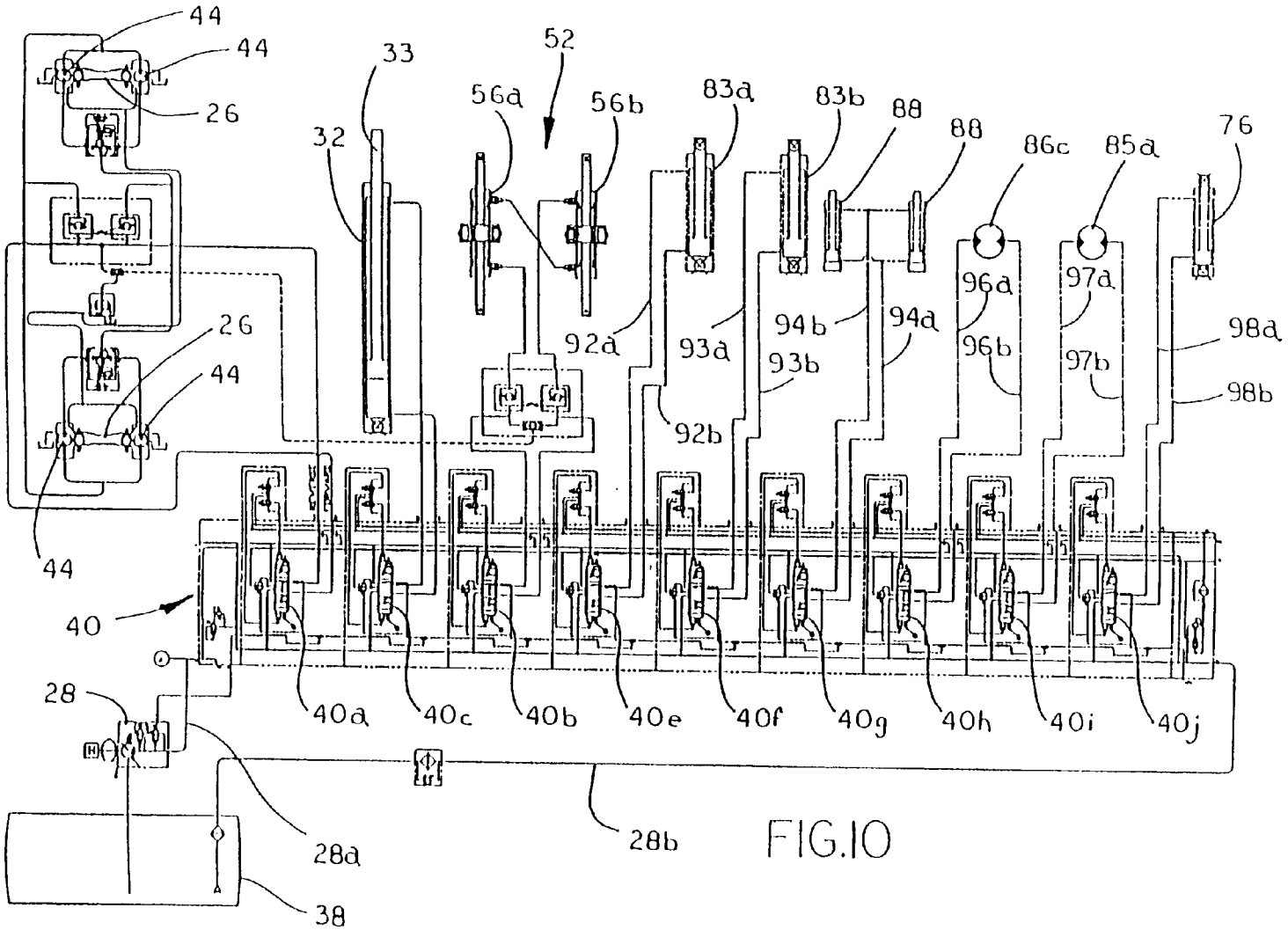
FIG. 10 is a hydraulic schematic of the embodiment shown in FIGS. 6 through 9.
Figure 11:
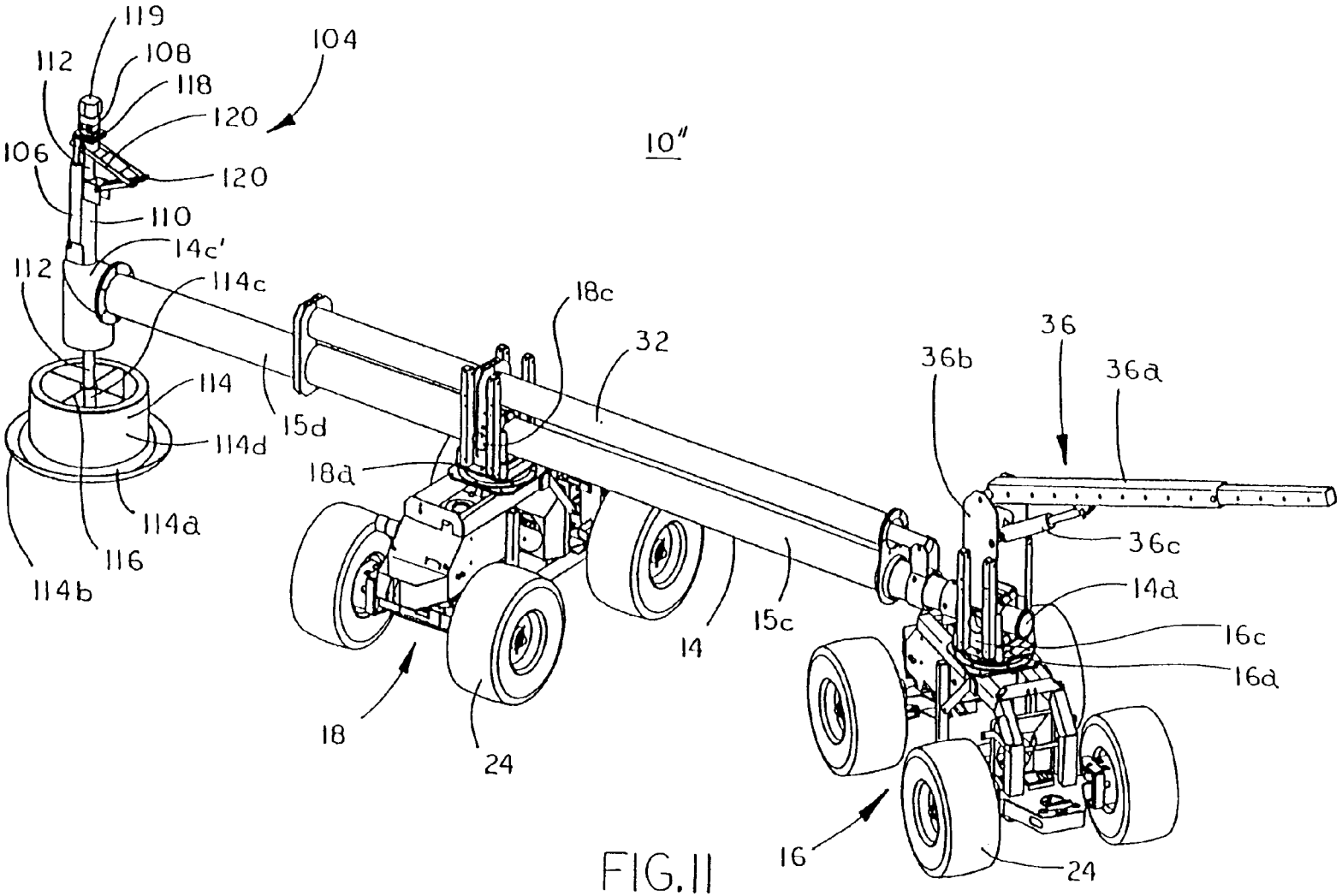
FIG. 11 is a perspective view of another alternate embodiment of the present invention with a rotatable screeding head positioned at the discharge end of the tube assembly, shown in a retracted state.
Figure 12:
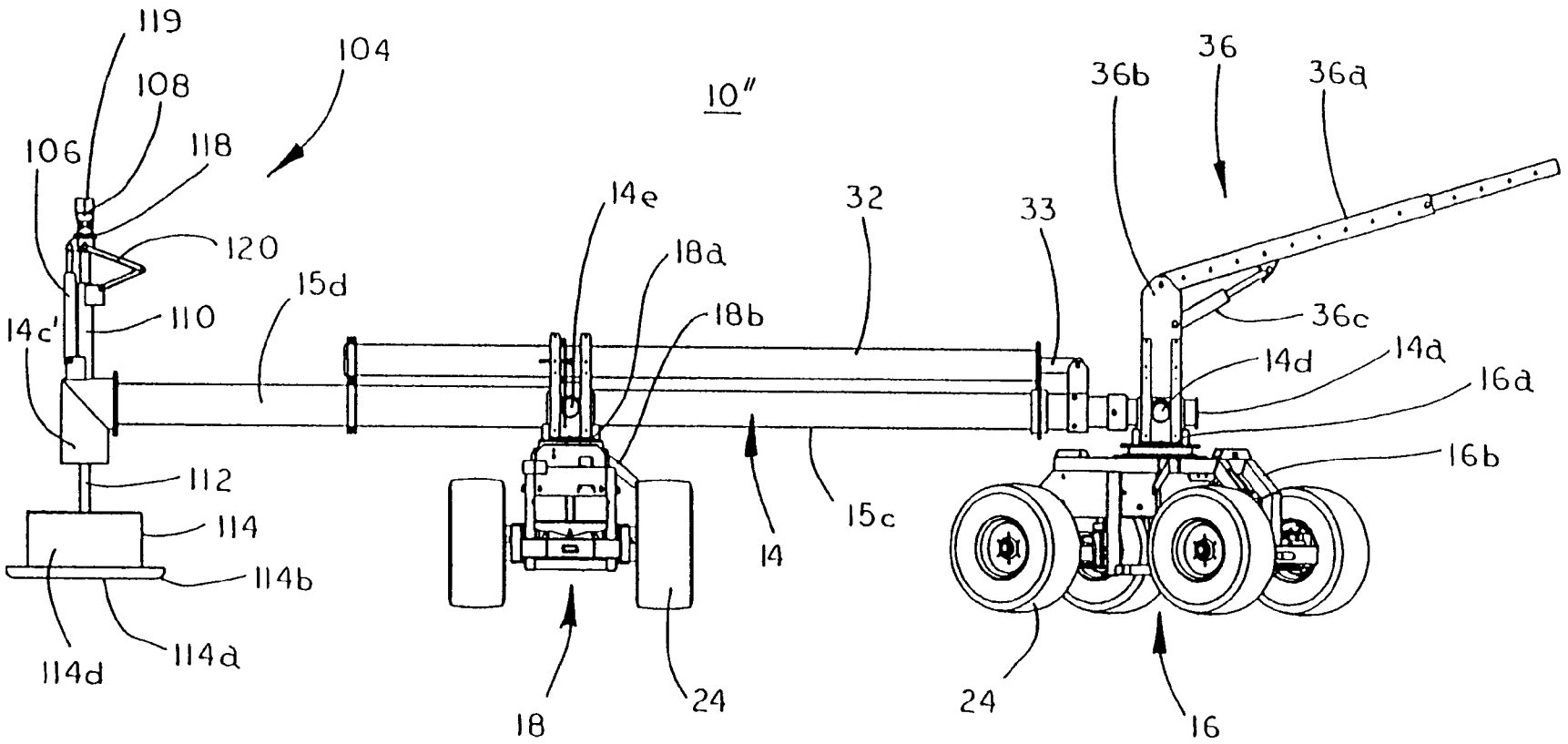
FIG. 12 is a side view of the embodiment shown in FIG. 11.
Figure 13:
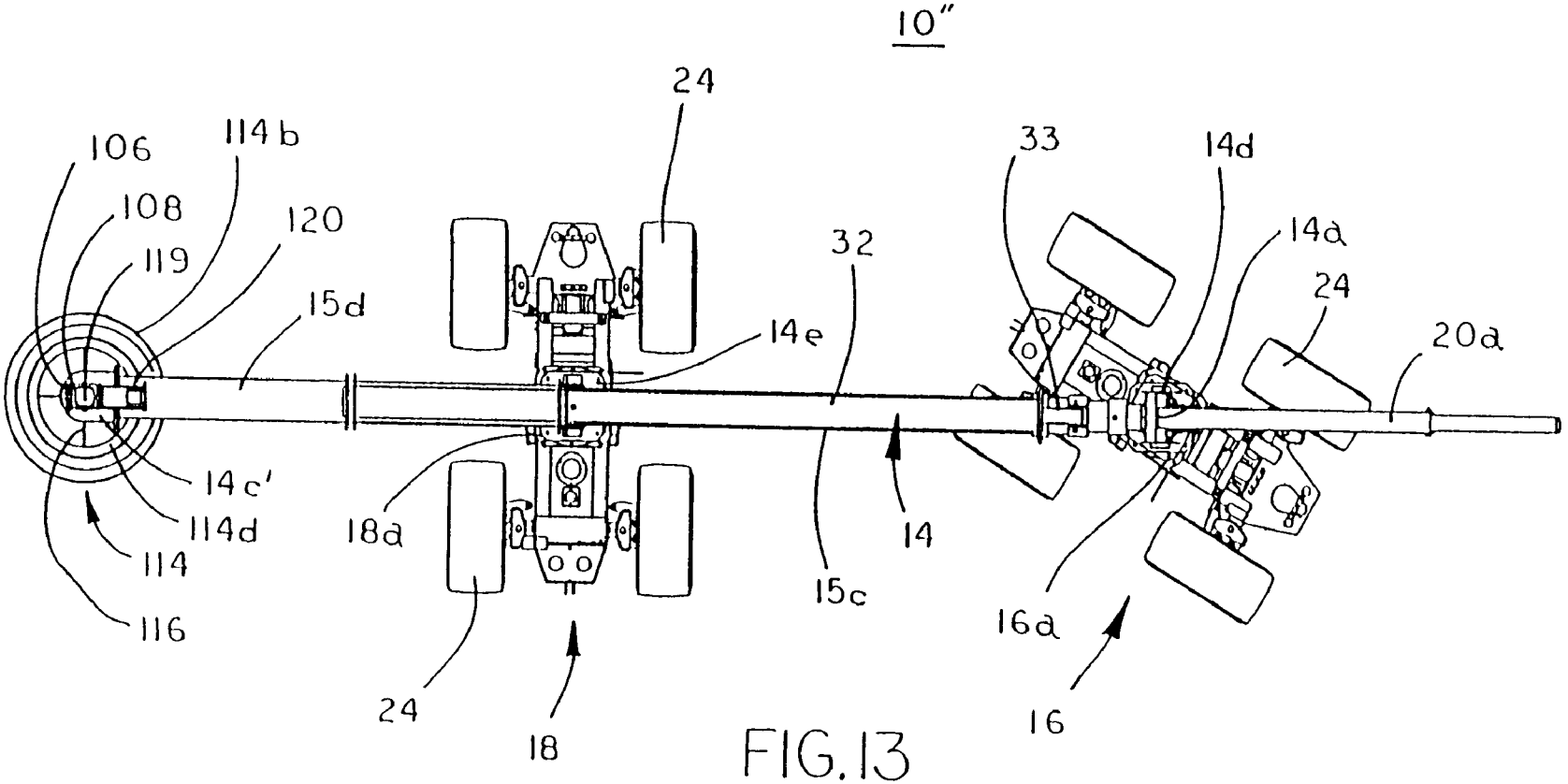
FIG. 13 is a top plan view of the embodiment shown in FIG. 11.

Referring now to FIG. 10, an hydraulic schematic for lead unit 18 of placing and screeding apparatus 10' is shown. The drive motors 44 and hydraulic cylinders 56*a* and 56*b* of steering system 52, and pipe extending cylinder 32 are operable via solenoid valves 40*a*, 40*b* and 40*c* and pump 28, in the same manner as discussed above with respect to FIG. 5. Operation of the screeding assembly 72 or 72' is preferably also provided via hydraulic pump 28 and associated hydraulic lines, cylinders, and motors, as discussed below. Pump 28, reservoir 38, and hydraulic solenoids 40 are preferably positioned in movable support 18, in order to minimize the length of the hydraulic lines necessary to reach from the solenoids 40 to the hydraulic cylinders on the outer tube or on the screeding device.

In order to raise or lower screed 72, a pair of hydraulic solenoids 40*e* and 40*f* is provided which provides pressurized fluid to a right and/or left screed elevation hydraulic cylinder 83*a* and 83*b* via a corresponding pair of hydraulic fluid lines 92*a* and 92*b* and 93*a* and 93*b*, respectively. Preferably two solenoids are provided to separately raise and lower each side of the screed assembly in order to change the angle of the plow and screed assembly, if desired. The hydraulic cylinders 83*a* and 83*b* function in a known manner to raise or lower either or both sides of the vibratory plow relative to the ground.

Furthermore, the screed self-leveling cylinders 88, which are operable to level the plow 84 and screed 86 in response to a signal from the level sensor, are extended and retracted via pressurized fluid lines 94*a* and 94*b* and another hydraulic solenoid 40*g*. The two hydraulic cylinders 88 are plumbed together such that each cylinder extends and retracts the same amount as the other, thereby providing even and uniform pivoting of the plow, auger, and screed assembly. This provides a more uniform surface of concrete and further reduces the possibility of digging one end of the plow or screed into the uncured concrete.

Additionally, the vibratory motor 86*c* of screeding device 86 is preferably an hydraulically actuated motor and is actuated via a pair of hydraulic lines 96*a* and 96*b* and another hydraulic solenoid 40*h*. As hydraulic line 96*a* is pressurized, motor 86*c* causes rotation of shaft 86*b* which further causes vibration of screed 86, in order to compact and smooth the concrete after it has been placed by the dispensing nozzle 14*b*. Hydraulic motor 85*a* for rotating or driving auger 85 is similarly actuated via a pair of hydraulic lines 97*a* and 97*b* and an hydraulic solenoid 40*i*.

In order to pivot the screeding device 72 relative to tube assembly 14, hydraulic cylinder 76 may be extended or retracted via a pair of hydraulic fluid lines 98*a* and 98*b* and another hydraulic solenoid 40*j*. Hydraulic cylinder 76 is also preferably a conventional cylinder and may be extended and retracted in a known manner, as discussed above. Because screed 72 is preferably positioned at outer end 14*b* of tube assembly 14, which is extendable and retractable relative to lead unit 18 via outer tube 15*d*, hydraulic lines 92*a*, 92*b*, 93*a*, 93*b*, 94*a*, 94*b*, 96*a*, 96*b*, 97*a*, 97*b*, 98*a* and 98*b* are preferably extendable and retractable with outer tube 15*d*. Preferably, the hydraulic lines are wound or coiled about a spring biased hydraulic hose reel (not shown), such that the hydraulic lines may extend and retract corresponding to extension or retraction of tube assembly 14. The hose reels are spring biased to recoil the hydraulic lines as the outer tube, and thus dispensing nozzle 14*c*', is retracted relative to movable support 18. The hydraulic lines may be joined and wound about a single hose reel or may be separately wound around separate hose reels, without affecting the scope of the present invention. Alternately, the hydraulic lines may be telescoping tubes or may otherwise extend and retract in any known manner between movable support 18 and screeding device 72.

Rotatable Screed Head

Referring now to FIGS. 11–14, a placing and screeding apparatus 10" may comprise a rotatable screeding device 104 positioned at an outer dispensing nozzle 14*c*' of tube assembly 14. Preferably, base unit 16, movable support 18, and tube assembly 14 are substantially similar to those described above with respect to placing apparatus 10, such that no further discussion of their structural components and operation is required herein. At an outer end of the tube assembly 14, a dispensing nozzle 14*c*' is mounted which includes a 90° elbow for directing the concrete in a generally downwardly direction. An opening is provided in an upper portion of nozzle 14*c*' for a shaft 112 of screeding device 104 to pass therethrough, as discussed below.

Rotatable screed 104 comprises a lift cylinder 106, a rotational motor 108, a vertical support 110 and a rotatable shaft 112 which extends through vertical support 110 and dispensing nozzle 14*c*' to connect to a rotatable screed head 114. Rotatable head 114 is a generally cylindrically shaped tube with an open top and bottom and a lower ring 114*a*, which is upwardly turned at an outer edge 114*b* thereof. A plurality of ribs 116 extend from a center portion 114*c* of rotating head 114 outwardly, where shaft 112 is secured, to an outer, cylindrical ring 114*d* which defines the cylindrical head 114. The lower ring 114*a* functions to compact the concrete as the head 114 is moved over the placed, but uncured concrete.

Hydraulic motor 108 is mounted to a bearing block 118, which is secured between a pair of articulating support arms 120, such that bearing block 118 and motor 108 are substantially precluded from rotating, while the motor may cause rotation of the shaft 112 of screeding device 104. Hydraulic cylinder 106 is mounted at one end to an upper portion of dispensing nozzle 14*c*' and at another end to motor 108, such that extension and retraction of hydraulic cylinder 106 lifts and lowers motor 108 and thus shaft 112 and rotating head 114, while articulating arms 120 extend or fold in response to such vertical movement of motor 108. Preferably, lift cylinder 106 is operable to automatically raise or lower motor 108, shaft 112 and head 114, in response to a signal from a laser receiver 119, which is preferably mounted at an upper end of screeding device 104. Lift cylinder 106 is controlled in response to the laser signal in a similar manner to the lift cylinders 83 and 83' of screeding devices 72 and 72', discussed above.

During operation, concrete is provided through dispensing nozzle 14*c*' and received within cylindrical portion 114*d* of rotating head 114. As the movable support 18 moves arcuately and/or the tubes 14 extend and/or retract, the screeding device 104 places concrete in the particular targeted areas and is operable to simultaneously spread and smooth the concrete as it moves therealong. Rotation of shaft 112 by motor 108 causes corresponding rotation of rotating head 114 to spread and smooth the concrete as the head is moved over the newly placed concrete. The lower ring 114*a* provides a generally smooth and flat surface which smoothes the uncured concrete as the head is rotated and moved radially and arcuately relative to the base unit 16. Because the lower screed head 114 is generally circular and curved upwardly around the entire circumference of head 114, screeding device 104 is operable to smooth and compact uncured concrete via movement in any direction, such that the screed device does not have to be pivoted 90° when lead unit 18 reverses its direction.

Figure 14:
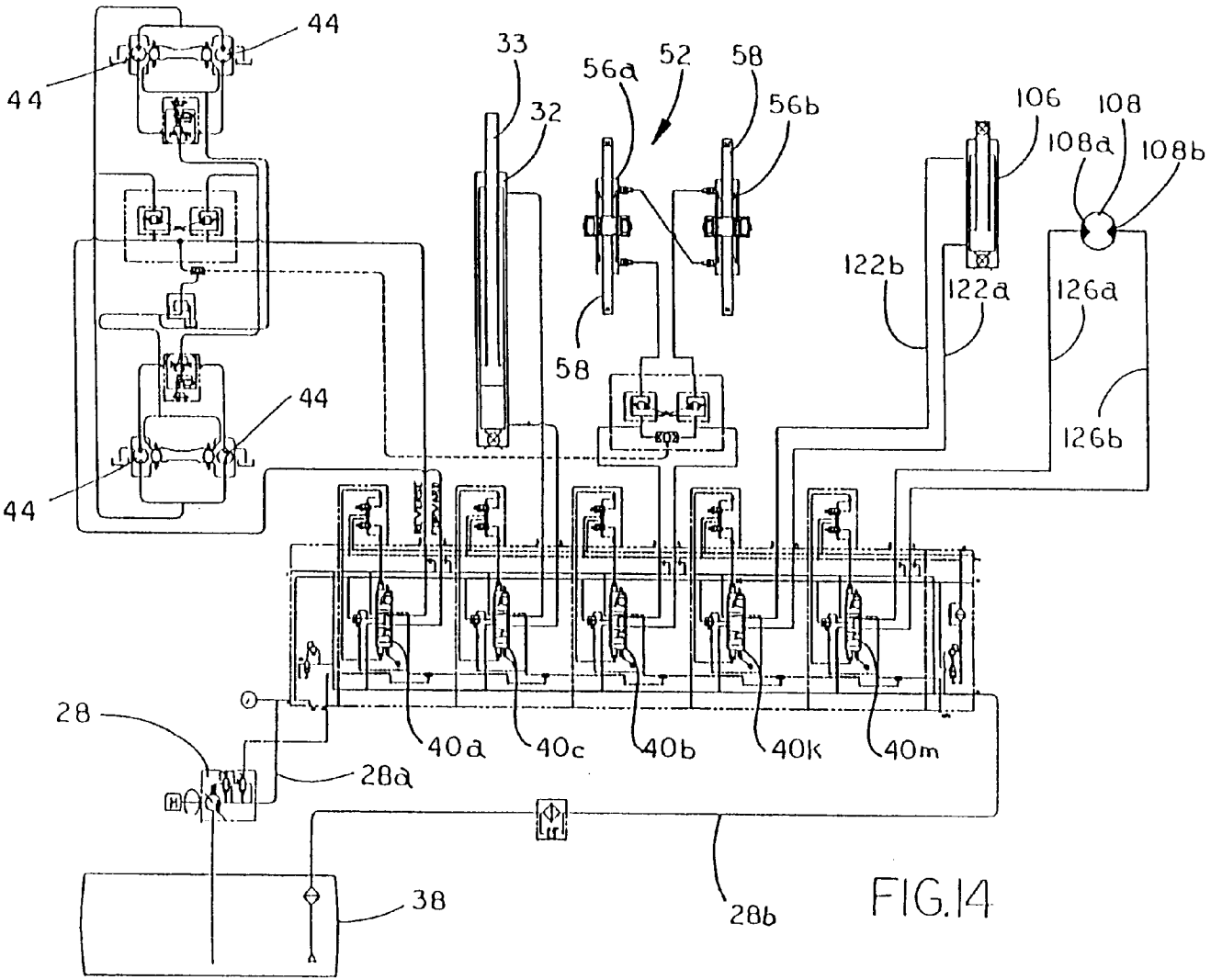
FIG. 14 is a hydraulic schematic of the embodiment of the present invention shown in FIGS. 11–13.

Referring now to FIG. 14, an hydraulic schematic is shown for the movable support 18 of placing and screeding apparatus 10". Because the drive system motors 44, the cylinders 56*a* and 56*b* of the steering system 52, and tube extension cylinder 32 are identical to those discussed above with respect to placing apparatus 10, the details of these systems will not be repeated herein. Hydraulic cylinder 106 of screeding device 104 is extendable and retractable via a pair of hydraulic fluid lines 122*a* and 122*b* and an hydraulic solenoid 40*k*. Hydraulic solenoid 40*k* may be manually actuated, or preferably electronically actuated in response to a signal received from laser receiver 119 on screeding apparatus 104. Additionally, hydraulic motor 108 is operable to rotate the rotatable head 114 of screeding device 104 in response to pressurized fluid being supplied to one of its ports 108*a* and 108*b* via hydraulic fluid lines 126*a* and 126*b*, respectively, and an hydraulic solenoid 40*m*. Because outer tube 15*d* of tube assembly 14 is extendable relative to movable support 18, hydraulic lines 122*a*, 122*b*, 126*a* and 126*b* preferably comprise roll-up hoses, which are wound or coiled about a spring biased hydraulic hose reel (not shown), similar to the hydraulic lines of placing and screeding apparatus 10', discussed above.

Air Cushion Units

Referring now to FIGS. 15–20, an alternate embodiment 200 of the present invention comprises an extendable tube assembly 214, a lead unit or movable support 218 and a base unit 216. Base unit 216 and lead unit 218 of concrete placing apparatus 200 are air cushion devices, which comprise one or more lift fans 217, which are operable to raise the units above the support surface via a cushion of air between the unit and the support surface. Because these units travel on a cushion of air and thus do not require wheels or the like travelling along the ground, these units may be used in areas where concrete has already been placed, in order to add more concrete or to screed the placed concrete, without damaging or displacing any of the already-placed concrete. Also, the cushion of air functions to spread out the weight of the units over a large area or foot print, which minimizes the pressure of the units on the support surface or ground. Due to the low ground pressure of these units, they are well suited to operation in areas with limited load holding capability, such as corrugated metal decks of elevated slabs. Similar to the movable wheeled units discussed above, the air cushion units are operable to support and move either a discharge conduit or pipe for placing uncured concrete or a screeding device for smoothing/grading already placed concrete, or both, without affecting the scope of the present invention.

Figure 18:
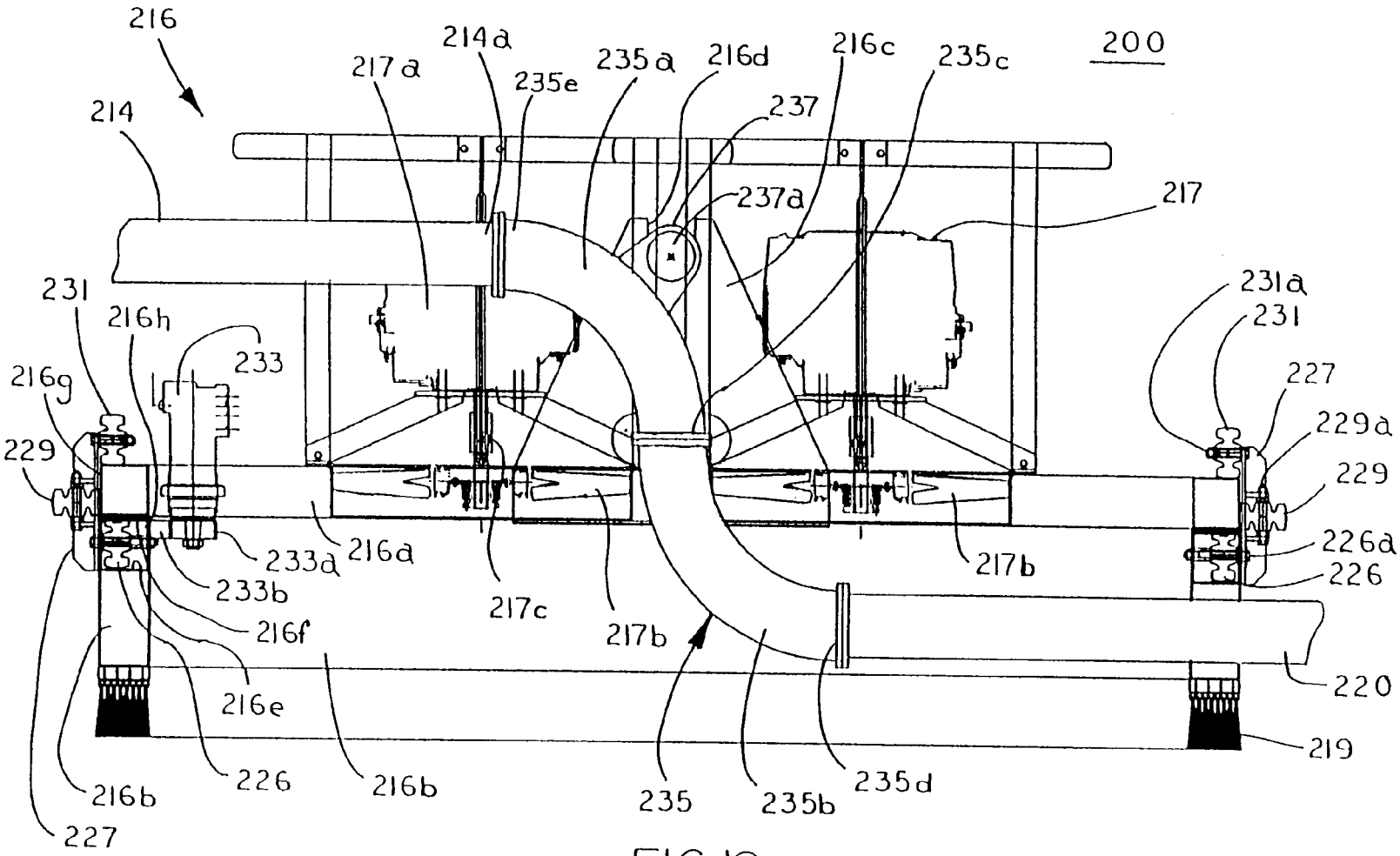
FIG. 18 is a sectional view of the base unit, taken along the line XVIII—XVIII in FIG. 17.
Figure 19:
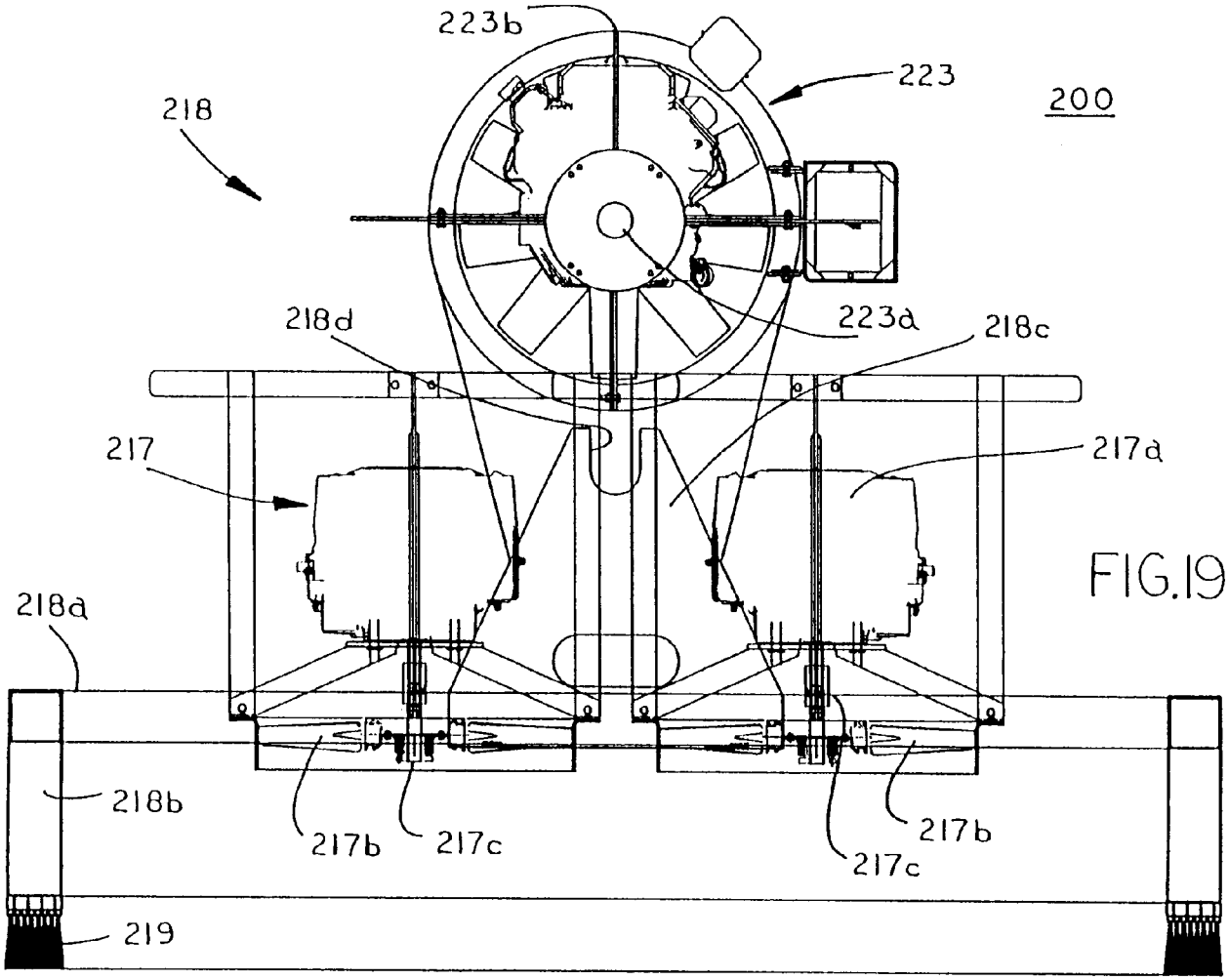
FIG. 19 is a sectional view of the lead unit taken along the line XIX—XIX in FIG. 17, with the pipe removed from the lead unit and a directional fan positioned thereon.

As shown in FIGS. 15–17 and 19, movable support or lead unit 218 may be generally disc shaped, with an upper disc portion 218*a* and a cylindrical side wall 218*b* extending downwardly therefrom. However, as shown in FIGS. 35–40 and 47, the air cushion units may be generally rectangular-shaped, or hexagonal-shaped, or may be any other shape, without affecting the scope of the present invention. Movable support 218 may comprise two or four fans 217, or any other number of fans which are capable of lifting the unit off the ground. A brush-skirt seal 219 extends around the lower circumference of each unit to at least partially restrict or contain the cushion of air beneath the movable support and to prevent excessive dust and the like from blowing outward when the fans are activated. Fans 217 comprise a motor 217*a* which is operable to rotate blades 217*b*. Fans 217 are preferably pivotally mounted about a horizontal axes or pin 221, such that as the fans pivot slightly, the change in direction of air flow causes movement of the unit 218 along the ground, while still pushing enough air to support the unit above the ground. Preferably, the pivot axes 221 are generally parallel to one another and parallel to tube assembly 214, such that pivoting of the fans causes a movement of the unit 218 generally normal to tubes 214. Fans 217 are preferably mounted to lead unit 218 with their shafts 217*c* (FIG. 18) extending generally vertically, such that the fan blades 217*b* are oriented generally horizontally with respect to the ground. Preferably, fans 217 are conventional fan and motor units, such as a Kohler 25 horsepower motor with a Crowley fan, or any other known and preferably commercially available fans and motors. Optionally, as shown in FIG. 19, a directional fan 223 may be provided atop lead unit 218. Directional fan 223 may be pivotally mounted to lead unit 218 such that a shaft 223*a* extends generally horizontally and supports and drives generally vertically oriented fan blades (not shown). Directional fan 223 may then be pivotable about a vertical axis or pivot 223*b* to push lead unit 218 in a direction generally opposite to the direction in which the fan blades are directed.

Movable support 218 further comprises a pair of upwardly extending brackets or trunnions 218*c*, which are fixedly mounted to disc portion 218*a*. Trunnions 218*c* further include a notch or groove 218*d* for receiving a support pin 214*e* on an outermost tube 215*d* of tube assembly 214. Trunnions 218*c* are oriented to receive the tube assembly 214 such that tubes 214 extend generally between the two or four fans and motors and preferably generally parallel to the pivot axes 221 of the motors 217.

Figure 16:
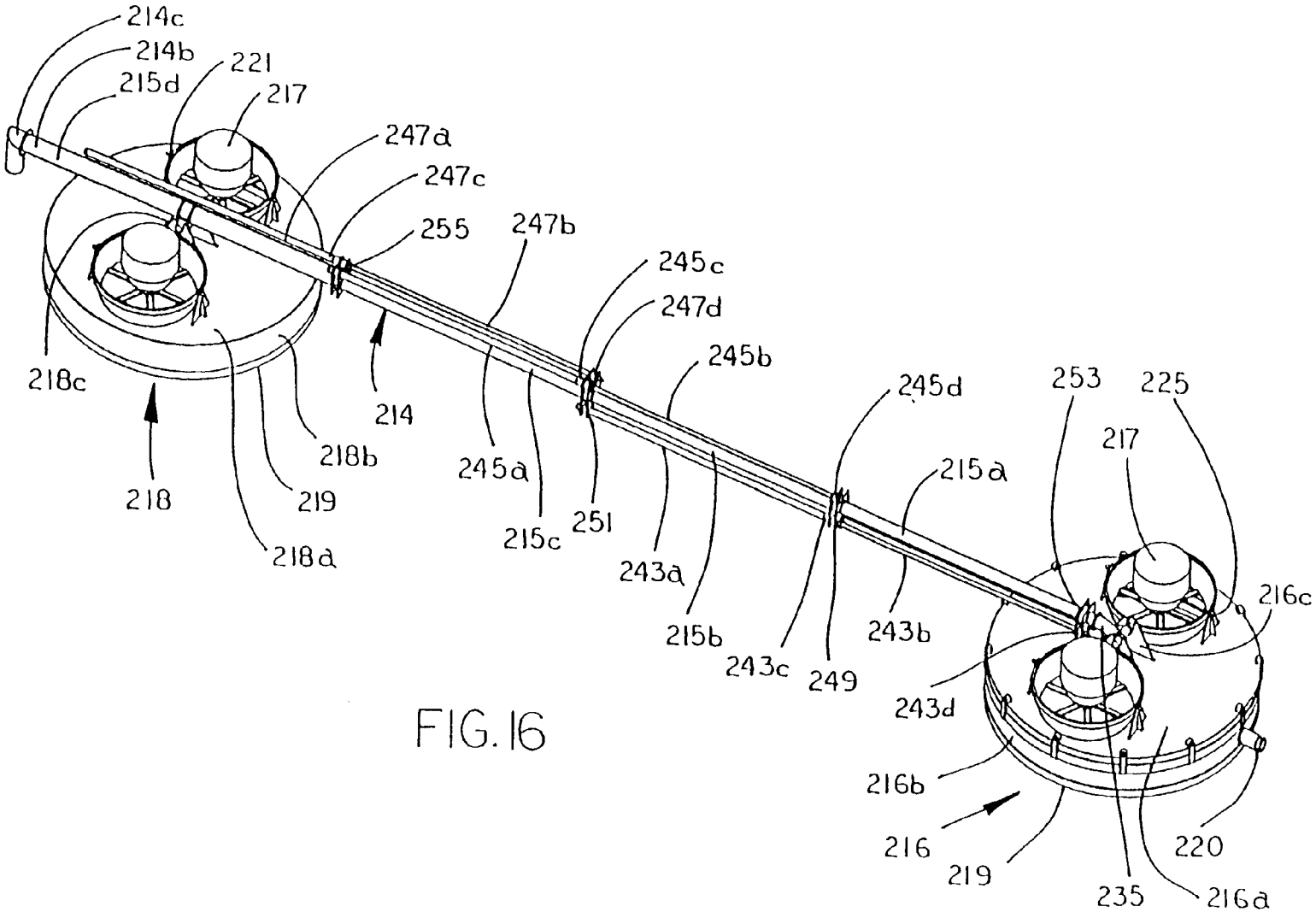
FIG. 16 is a similar perspective view as FIG. 15, with the apparatus shown in its extended state.
Figure 16A:
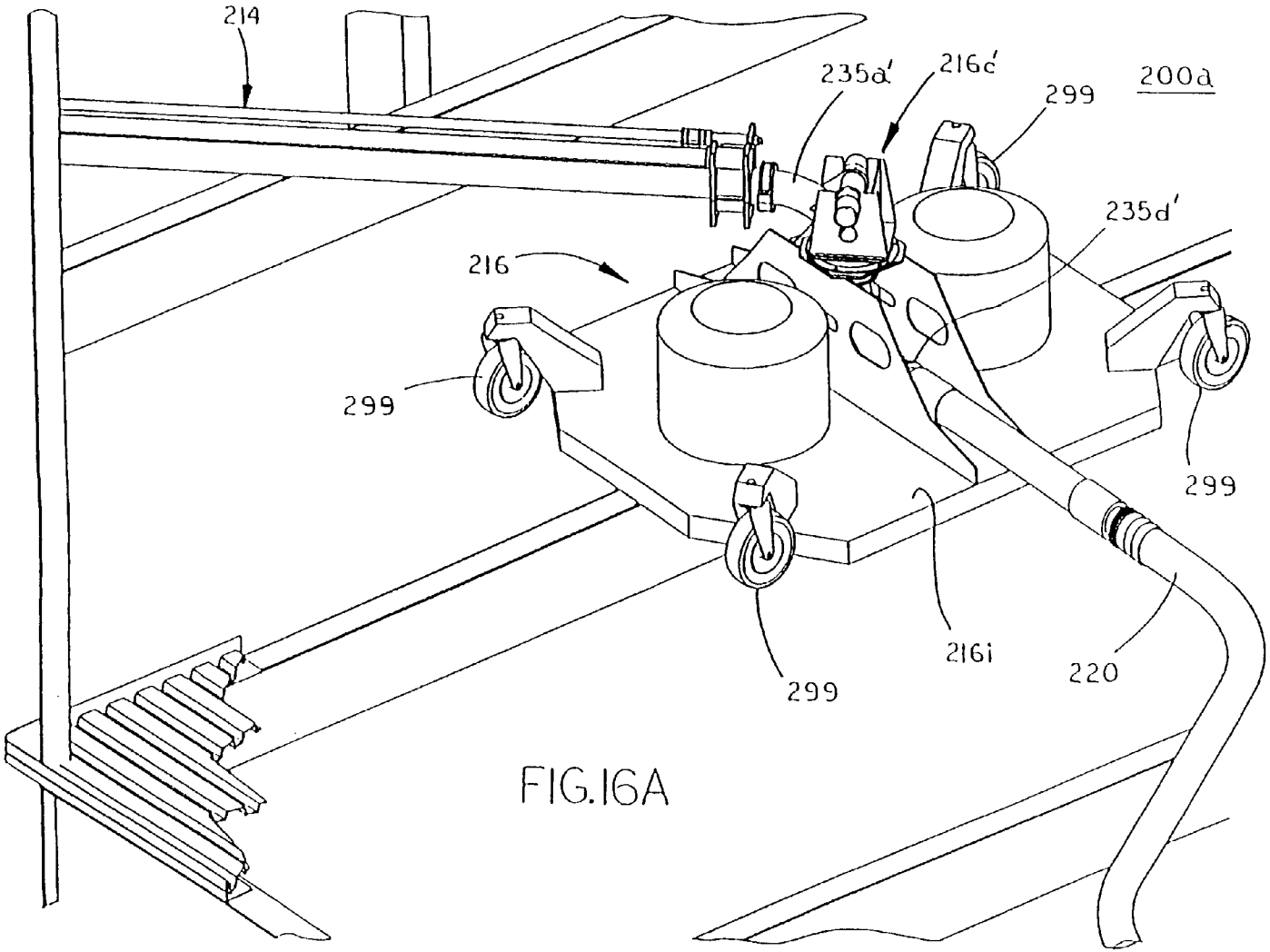
FIG. 16A is a perspective view of the base unit of FIGS. 15 and 16, with the pipe assembly pivotally mounted to the base unit and casters positioned around the base unit.
Figure 17:
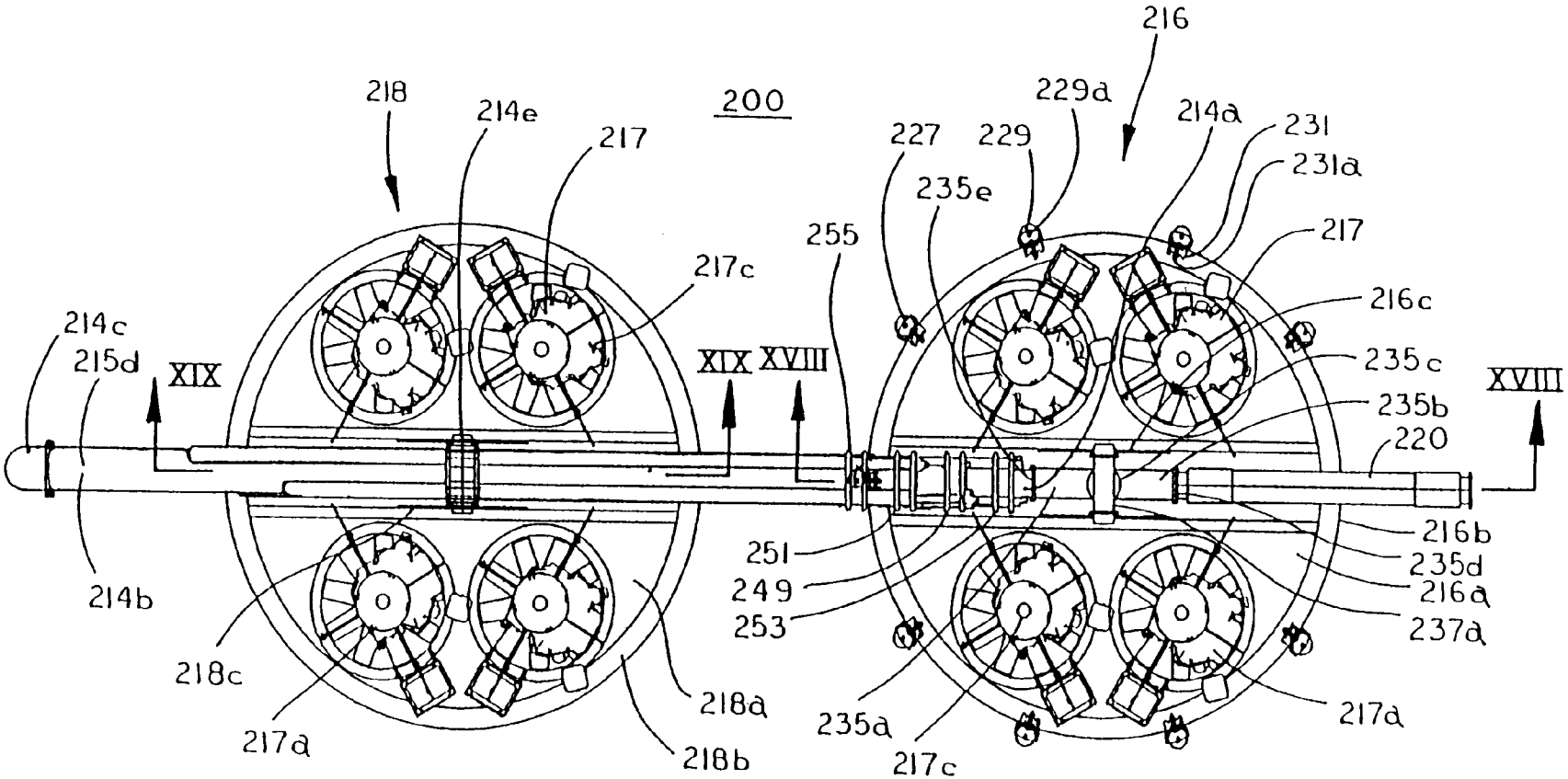
FIG. 17 is a plan view of an alternate embodiment of the embodiment shown in FIGS. 15–16, with each air cushion device comprising four lift fans, shown in its retracted state.

Base unit 216 is similar to lead unit 218 in that it comprises two or four fan/motor assemblies 217 for lifting and supporting base unit 216 on a cushion of air above the ground. Base unit 216 further comprises an upper, disc shaped, swivel portion 216*a* and a lower, cylindrical side walled, base portion 216*b*, wherein the upper swivel portion 216*a* is rotatably mounted at an upper end of base portion 216*b*. A brush skirt 219 extends around a lower circumferential edge of the base portion 216*b* to provide a generally uniform engagement of the unit to the ground and to prevent excessive dust from being blown into the air when the fans are activated. Similar to lead unit 218 discussed above, each of the fan/motor assemblies 217 are preferably pivotally mounted to swivel portion 216*a* of base unit 216 along a pivot pin or axis 225, such that a slight rotation of the fan motors relative to base unit 216 may cause the base unit 216 to move along the ground in a direction generally normal to the pivot axes 225. Additionally, as shown in FIG. 16A, base unit 216, and/or movable support 218, may include a plurality of casters, rollers or wheels 299 mounted to the frame of the air cushion units to ease manual movement of the units when the engines are shut down.

Base unit 216 further comprises an S-shaped pipe connector 235 which further comprises an upper elbow 235*a* and a lower elbow 235*b*, which are pivotally connected together in a known manner via a pivotable connector 235*c* (FIG. 18). An opening is provided through the side wall of base portion 216*b* for a passageway for supply tube 220. A supply hose or pipe section 220 is then connectable to a lower and outer end 235*d* of lower elbow 235*b*, while extendable pipe assembly 214 is connectable to an outer and upper end 235*e* of upper elbow 235*a*. Upper elbow 235*a* further comprises a mounting bracket 237 which extends upwardly therefrom and includes a cylindrical pivot or mounting pin 237*a* extending outwardly from each side of bracket 237. Similar to lead unit 218, base unit 216 includes tube mounting trunnions 216*c*, which are mounted to an upper portion of swivel portion 216*a* and include a notch or groove 216*d* for receiving the pivot pin 237*a* of bracket 237 on upper elbow 235*a*, thereby pivotally securing upper elbow 235*a* to swivel portion 216*a*. Upper elbow 235*a* may then pivot about a generally horizontal axis, in order to accommodate changes in the level of tube assembly 214 when lead unit 218 may be positioned at a different height from base unit 216. Clearly, other means for pivotally mounting connector 235 to base unit may be implemented, without affecting the scope of the present invention.

In order to secure swivel portion 216*a* of base unit 216 to base portion 216*b*, while allowing for relative rotation therebetween, a plurality of rollers are positioned around an outer, circumferential edge of base unit 216. More particularly, as shown in FIG. 18, base portion 216*b* comprises a plurality of lower, vertically oriented rollers 226, which are positioned between an upper portion of cylindrical base portion 216*b* and an outer edge of swivel portion 216*a* and which are rotatable about horizontal pivot pins 226*a*. Rollers 226 engage an upper edge 216*e* of base portion 216*b* and a lower surface 216*f* of swivel portion 216*a* in order to support swivel portion 216*a* on base portion 216*b*, while allowing relative rotation therebetween. Furthermore, a plurality of brackets 227 extend upwardly from the upper portion of base portion 216*b* and provide vertical mounting pins 229*a* for mounting horizontal rollers 229 in spaced locations around an outer, circumferential edge 216*g* of swivel portion 216*a*. Rollers 229 function to prevent lateral movement of swivel portion 216*a* relative to base portion 216*b*, while still allowing relative rotation therebetween. Additionally, a plurality of upper rollers 231 are rotatably mounted to horizontal pins 231*a* on brackets 227 to also prevent vertically upward movement of swivel portion 216*a* relative to base portion 216*b*, while again allowing relative rotation therebetween.

Preferably, an hydraulic rotation motor 233 (FIG. 18) may be provided on base unit 216 to drive or rotate swivel portion 216*a* relative to base portion 216*b*, in order to cause arcuate movement of dispensing end 214*b* of tube assembly 214. Preferably, as shown in FIG. 18, motor 233 is mounted to swivel portion 216*a* and includes a toothed pinion 233*a*, which is rotatable via actuation of motor 233 and which engages a correspondingly toothed gear 233*b* extending around an inner circumferential edge 216*h* of base portion 216*b*. Actuation of motor 233 causes rotation of pinion 233*a*, which causes subsequent movement of gear 233*b* relative to motor 233, such that swivel portion 216*a* is thus rotated about base portion 216*b* while being supported and guided by rollers 226, 229 and 231. Motor 233 may be operable in either direction, such that dispensing end 214*b* may be arcuately driven back and forth with respect to base unit 216. Base portion 216*b* is substantially non-rotatable even when raised above the ground because the concrete supply pipes 220 are connected through the opening in base portion 216 and thus substantially preclude rotation of base portion 216*b*. Preferably, base unit 216 further comprises an hydraulic pump 228 and reservoir 238 (FIG. 20), which is operable as a power source for rotation motor 233 and a plurality of tube assembly extenders, as discussed below.

Optionally, as shown in FIG. 16A, pipe assembly 214 may pivot via a pivotable trunnion 216*c*' which is pivotable about a generally vertical axis via a turntable mounting arrangement of trunnion 216*c*' to base unit 216. In the illustrated embodiment 200*a*, the upper pipe elbow 235*a*' is mounted to trunnion 216*c*' and is pivotally connected to a connector pipe section (not shown). The connector pipe section and a lower elbow (also not shown) are mounted to or supported at an upper portion or surface 216*i* of the air cushion unit, while a lower end 235*d*' of the lower elbow is connected to supply pipe 220, which is also at least partially supported along the upper portion or surface of the air cushion base unit.

Figure 15:
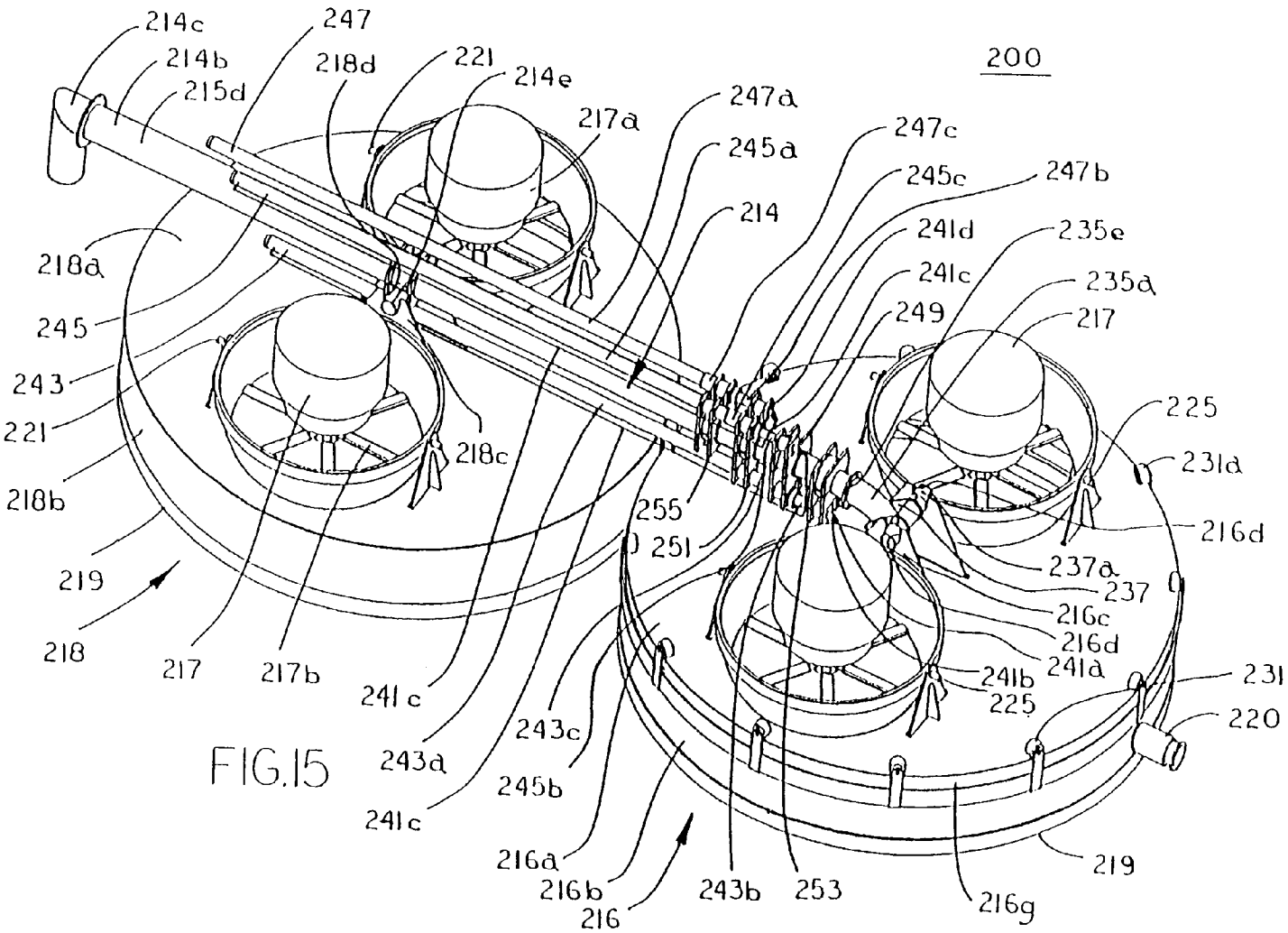
FIG. 15 is a perspective view of another alternate embodiment of the present invention, with the base and lead units comprising a two-fan air cushion device, shown in its retracted state.

Extendable pipe assembly 214 is generally similar to extendable pipe assembly 14, discussed above with respect to placing apparatus 10, in that it preferably comprises a plurality of nested or telescoping pipes 215*a*, 215*b*, 215*c* and 215*d*. However, because lead unit 218 may not be operable to travel radially outwardly from base unit 216, pipes 215*a* 215*d* are extendable and retractable relative to one another via a plurality of hydraulic extending devices 243, 245 and 247. As best shown in FIGS. 15 and 16, each hydraulic device 243, 245 and 247 comprises an hydraulic cylinder 243*a*, 245*a*, and 247*a* and a rod/piston 243*b*, 245*b*, and 247*b*, respectively. An inward end 243*c* of hydraulic cylinder 243*a* is fixedly mounted to a bracket or collar 249 at an inner end of second tube 215*b*, while hydraulic cylinder 243*a* is also slidably supported within another collar or bracket 251 mounted at an inner end of third tube 215*c*. An end 243*d* of rod 243*b* is also mounted to an inner end of first tube 215*a* via a bracket 253. Similarly, an inner end 245*c* of hydraulic cylinder 245*a* is fixedly mounted to bracket 251, while the cylinder 245*a* is slidably supported within another bracket 255, which is fixedly mounted to an inner end of outer tube 215*d*. An end 245*d* of rod 245*b* is then mounted to bracket 249 on second tube 215*b*. Similarly, an inner end 247*c* of hydraulic cylinder 247*a* is secured to bracket 255 on outer tube 215*d*, while an inner end 247*d* of rod 247*b* is secured to bracket 251 on the third tube 215*c*.

Figure 20:
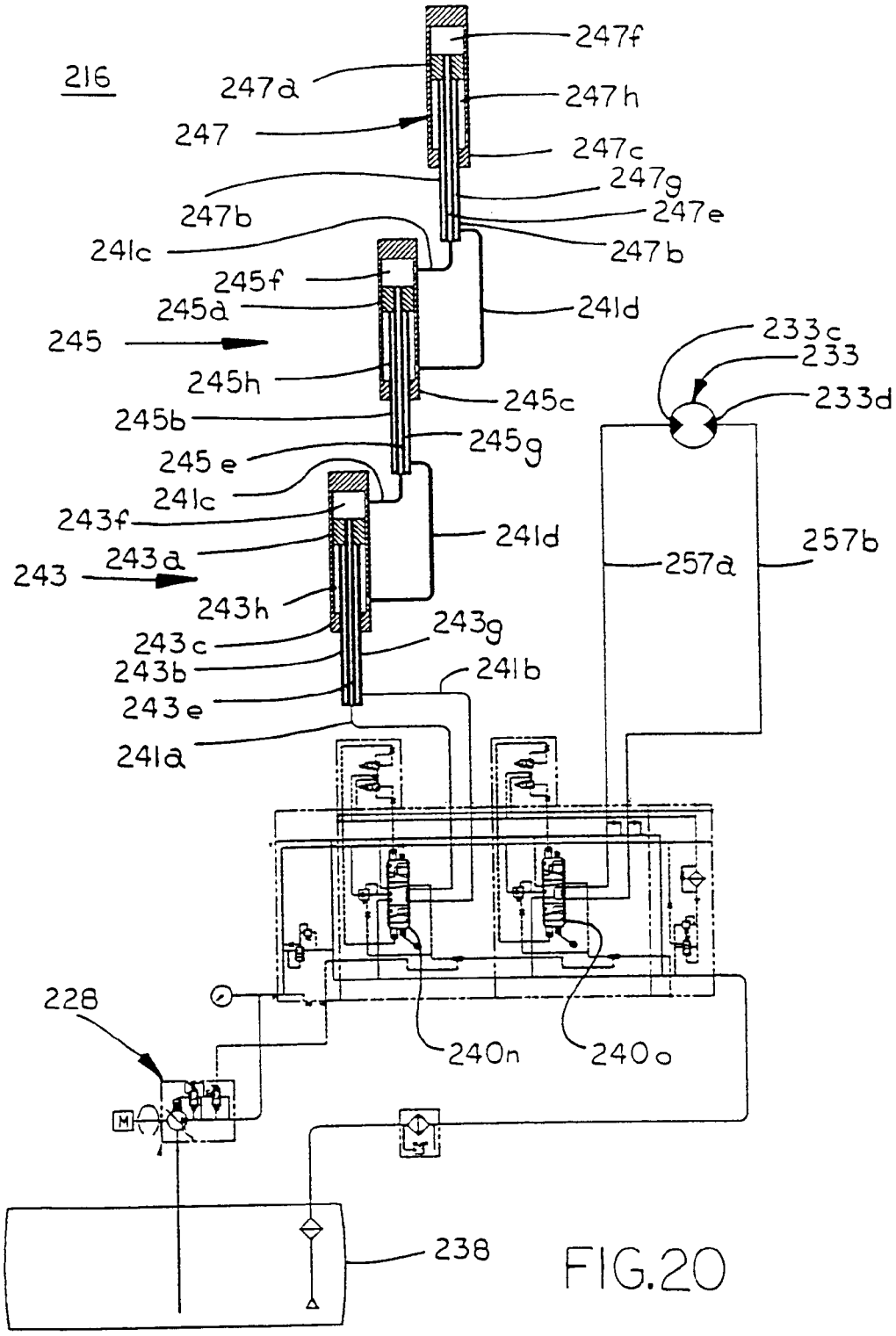
FIG. 20 is a hydraulic schematic of the embodiment shown in FIGS. 15 though 19.

Accordingly, as best shown in FIG. 16, as rod 243*b* is extended from hydraulic cylinder 243*a*, second tube 215*b* is moved outwardly from innermost tube 215*a*. Similarly, as rod 245*b* is extended from cylinder 245*a*, third tube 215*c* is moved outwardly from second tube 215*b*, while collar or bracket 251 slides along cylinder 243*a*. Likewise, as rod 247*b* is extended from cylinder 247*a*, outer tube 215*d* and lead unit 218 are moved outwardly from tube 215*c*, while bracket 255 slides along cylinder 245*a*. Preferably, as discussed below with respect to FIG. 20, each of the hydraulic cylinders 243, 245, and 247 are plumbed in series such that each rod is moved relative to its respective cylinders in a similar amount as the other rods and cylinders. The rods of the hydraulic cylinders preferably provide a dual passageway for fluid to pass through the rod and into the appropriate receiving cavity within the cylinder, as shown in FIG. 20. Accordingly, an hydraulic line 241*d* need only be provided from an inner end of one cylinder to the rod end of the next outer cylinder, while a second hydraulic line 241*c* is provided from an outer end of each inwardly positioned hydraulic cylinder inwardly along the cylinder to connect to the rod end of the next outwardly positioned cylinder, such that the hydraulic lines 241*c* and 241*d* remain fixed relative to their respective hydraulic cylinders and/or rod ends and thus do not require spring biased hose reels and hoses or the like to extend or retract the lines with the tube assembly 214 (FIGS. 15 and 20). Although shown and described as being extendable and retractable via a plurality of hydraulic cylinders plumbed in series, the tube assembly may alternately be extendable and retractable via conventional hydraulic cylinders or any other known means, and may even be individually extendable and retractable relative to one another, without affecting the scope of the present invention.

Referring now to FIG. 20, an hydraulic schematic is shown for base unit 216. Power source or pump 228 is operable to draw hydraulic fluid from reservoir 238 and to extend and retract the hydraulic cylinders 243, 245 and 247 via an hydraulic solenoid 240*n* and a pair of hydraulic fluid lines 241*a* and 241*b*. Preferably, pressurized fluid may be provided through hydraulic line 241*a* in order to extend the tubes, while pressurized fluid may be provided through hydraulic line 241*b* in order to retract the tubes. More particularly, hydraulic line 241*a* is preferably connected with a passageway 243*e* extending longitudinally through rod 243*b*, such that the pressurized fluid is received in an outer end portion or receiving cavity 243*f* of the hydraulic cylinder 243*a*. Similarly, hydraulic line 241*b* is connected to a second, outer passageway 243*g* through rod 243*b* to provide fluid to an inner end receiving cavity 243*h* of hydraulic cylinder 243*a*. Each of the cylinders 245 and 247 are similarly plumbed, with an hydraulic line 241*c* connecting the outer end cavity 243*f*, 245*f* of the inwardly positioned hydraulic cylinders 243, 245 to the central passageway 245*e*, 247*e* of the rod of the next outwardly positioned hydraulic cylinder 245, 247, while a second line 241*d* connects the inner cavity 243*h*, 245*h* of the inwardly positioned hydraulic cylinder 243, 245 to the outer passageway 245*g*, 247*g* of the rod of the next outwardly positioned hydraulic cylinder 245, 247. Accordingly, as pressurized fluid is provided through hydraulic line 241*a* or 241*b*, the rods 243*b*, 245*b* and 247*b* extend from or retract into their respective cylinders uniformly with the other rods and cylinders.

Hydraulic pump 228 is also operable to actuate hydraulic rotational motor 233 to rotate swivel portion 216*a* relative to base portion 216*b* of base unit 216. Rotational motor 233 is preferably operable via a solenoid 240*o* and a pair of hydraulic fluid lines 257*a* and 257*b*, which are connected to ports 233*c* and 233*d*, respectively, of motor 233. The rotational direction of the motor 233 is determined by which line 257*a* or 257*b* is pressurized by pump 228 and solenoid 240*o*, as would be apparent to one skilled in the art. As one of the fluid lines 257*a* or 257*b* is pressurized, rotational motor 233 functions to rotate pinion 233*a* to cause rotation of swivel portion 216*a* relative to base portion 216*b* via gear 122*b*, thereby swinging movably support 218 and outer end 214*b* of tube assembly arcuately with respect to base portion 216.

Figure 21:
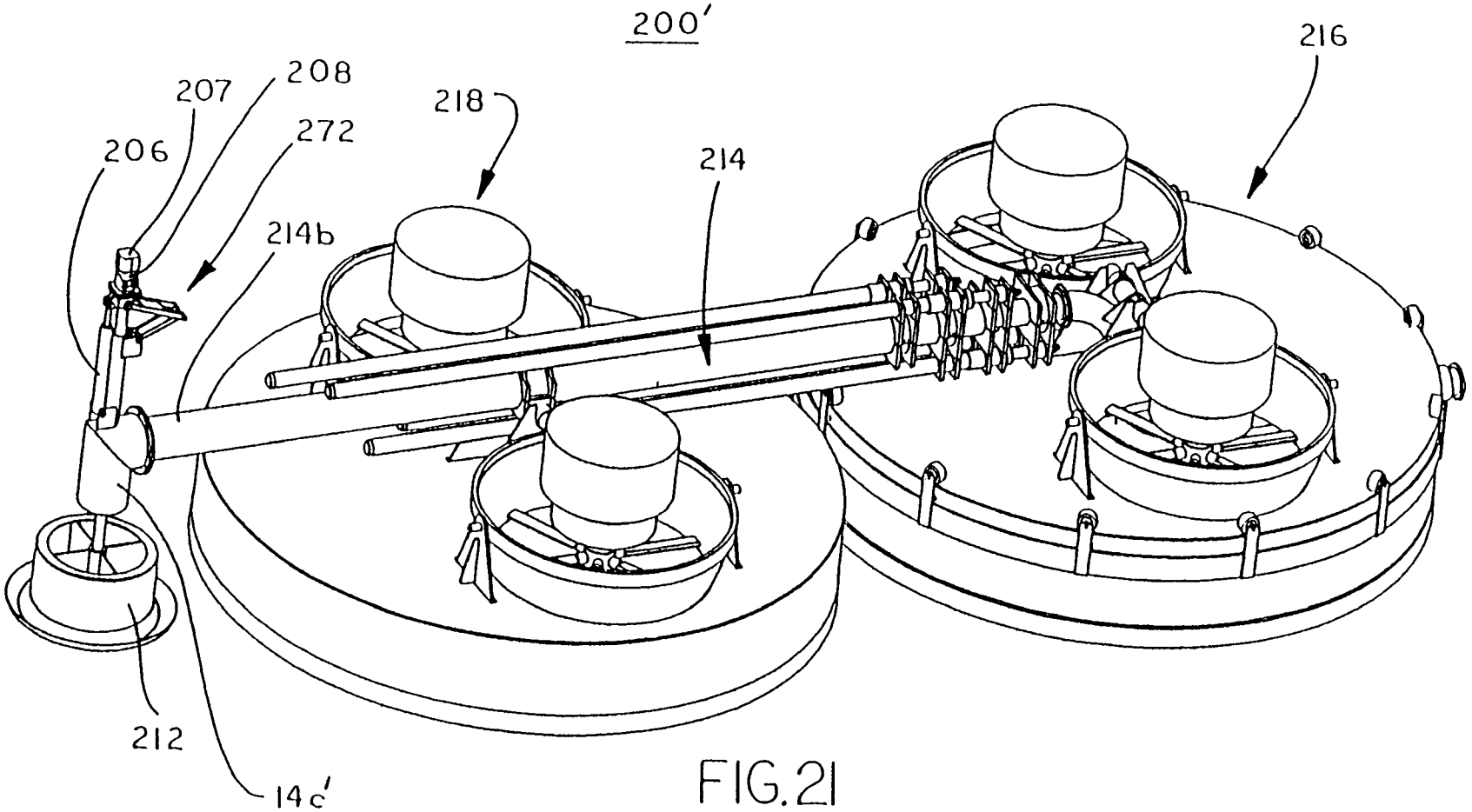
FIG. 21 is an alternate embodiment of the present invention shown in FIGS. 15–20, with a screeding device positioned at the discharge end of the tube assembly, shown in its retracted state.
Figure 22:
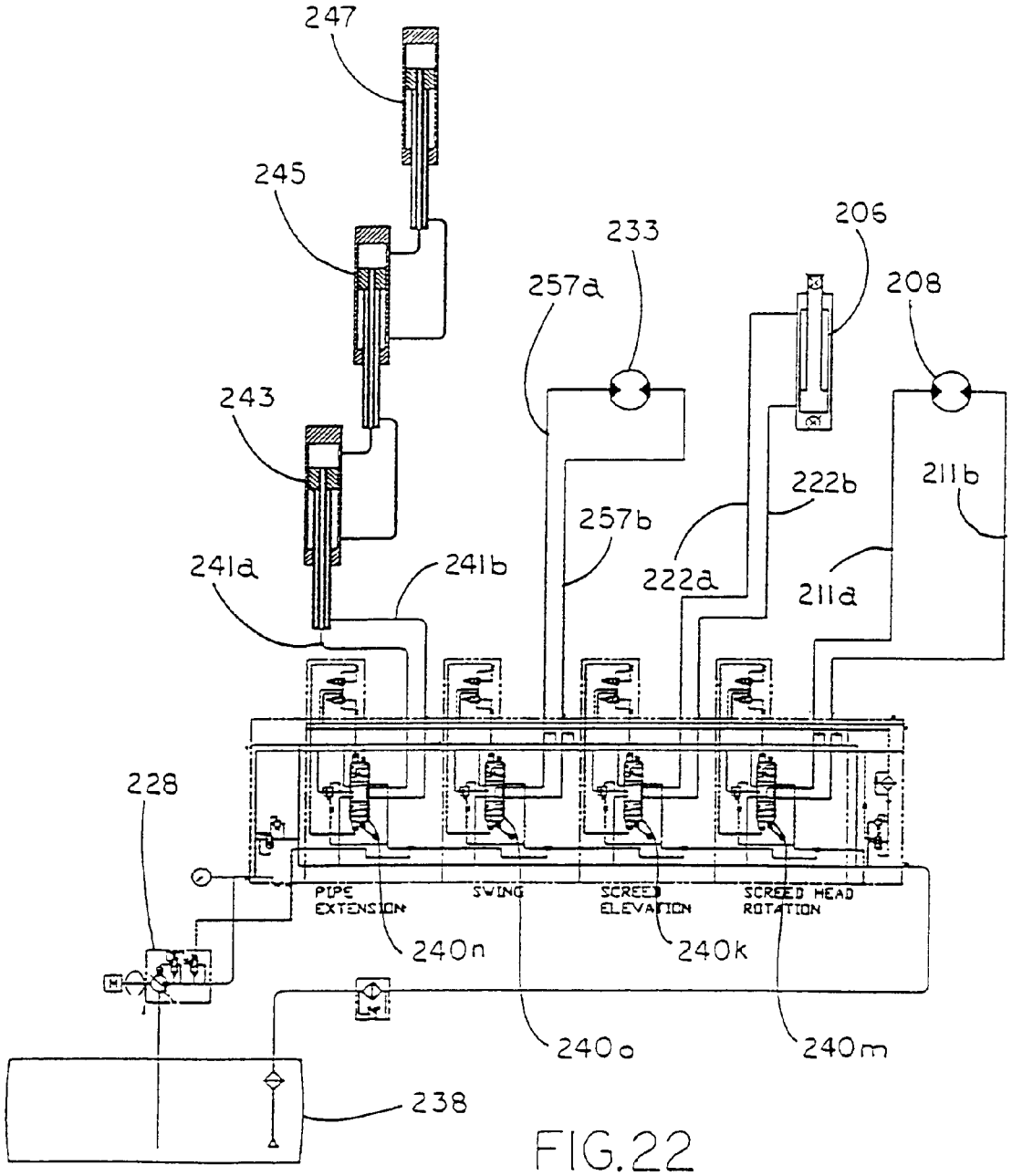
FIG. 22 is a hydraulic schematic of the embodiment shown in FIG. 21.

Referring now to FIGS. 21 and 22, an alternate embodiment 200' is shown which is substantially identical to placing apparatus 200, discussed above, except placing and screeding apparatus 200' further comprises a screeding device 272 positioned at an outer end 214*b* of pipe assembly 214. Screeding device 272 may be a conventional screeding apparatus, a plow, auger and vibratory screed assembly or a vibratory plow assembly, as discussed above with respect to placing and screeding apparatus 10', or may be a rotating head screed, similar to screeding device 104, discussed above with respect to placing and screeding apparatus 10", and as shown in FIG. 21, or may be any other known means for compacting and smoothing the uncured concrete as it is placed by the dispensing nozzle of tube assembly 214. Because each of the screeding devices were already discussed above, a detailed description of their components and functions will not be repeated herein.

As shown in FIG. 22, the hydraulic schematic for placing and screeding apparatus 200' is substantially similar to the schematic for apparatus 200, discussed above and shown in FIG. 20. However, hydraulic pump 228 of placing and screeding apparatus 200' may be further operable to raise and lower a rotating screed head device 272 via an hydraulic cylinder 206. Hydraulic cylinder 206 may be extended or retracted by pressurized fluid being provided thereto via lines 222*a* and 222*b*, respectively. Hydraulic lines 222*a* and 222*b* are pressurized via an hydraulic motor 228 and hydraulic solenoid 240*k*, which may be actuated in response to a signal received from a laser receiver 207, or may be manually actuated via a control panel or the like which may be mounted to base unit 216 or may be remotely located from the placing and screeding apparatus 200'.

Similar to screeding device 104 of placing and screeding apparatus 10", rotation of rotatable screed head 212 (FIG. 21) is accomplished via a rotational motor 208, which is actuatable via of an hydraulic solenoid 240*m* and hydraulic fluid lines 211*a* and 211*b*, in a similar manner as discussed above with respect to FIG. 14. Alternately, however, the hydraulic system of placing and screeding apparatus 200' may control other elevation cylinders, pivot cylinders, leveling cylinders, and/or vibratory motors, depending on the specific screeding device implemented, without affecting the scope of the present invention. Because the screeding device is extendable and retractable relative to the hydraulic pump located on base unit 216, the hydraulic lines required to raise, lower and/or rotate or pivot the screed head preferably comprise a plurality of hydraulic hoses coiled on at least one spring-biased hose reel (not shown) mounted at the base unit. Alternately, the hydraulic system could be mounted on the lead vehicle to eliminate the need for hose reels or the like. However, other means for providing actuation and control of the screeding device may be implemented, without affecting the scope of the present invention.

Figure 23:
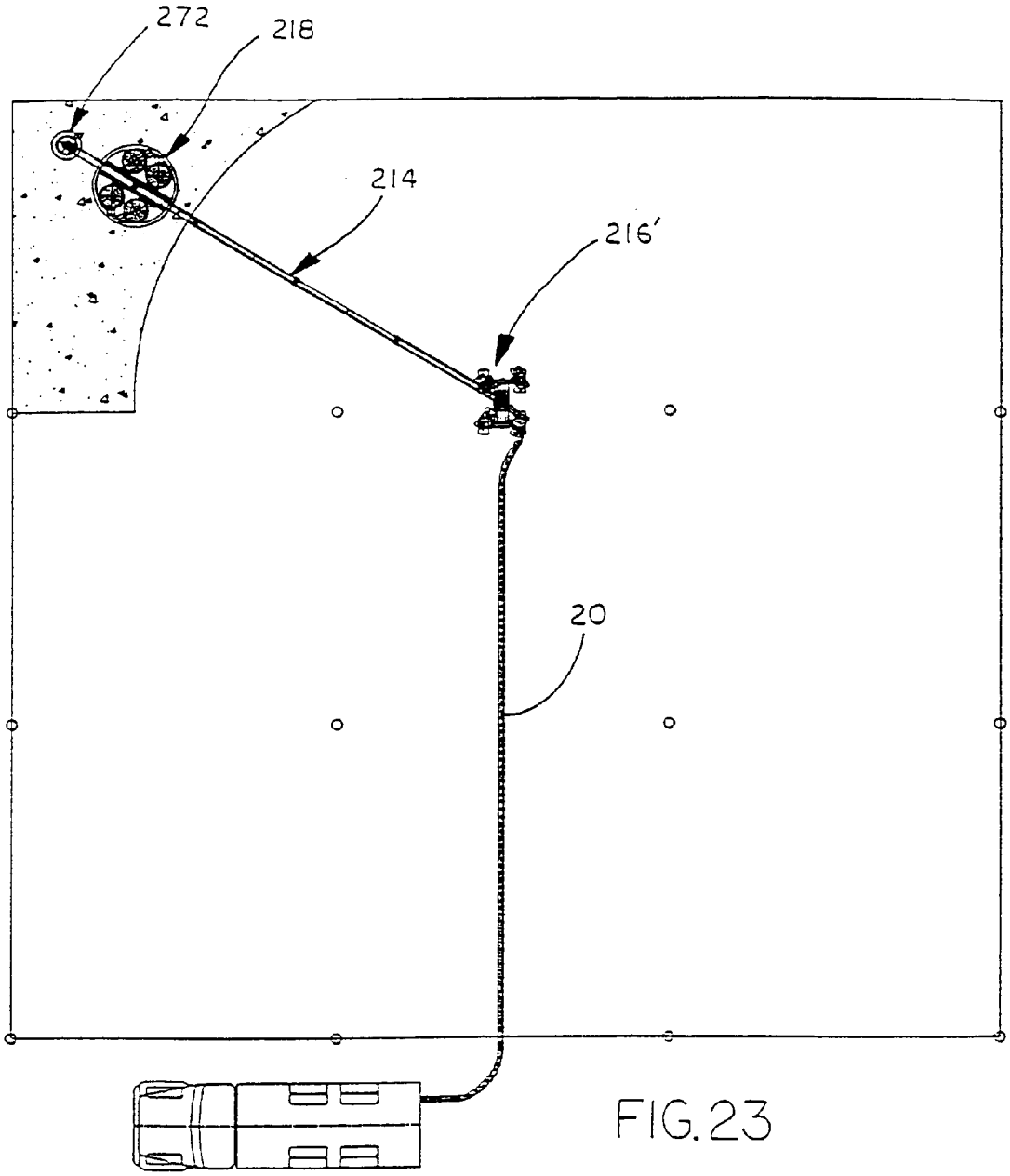
FIG. 23 is a plan view of an embodiment comprising an air cushion lead vehicle and screeding device, showing that the air cushion device may be movable over areas where the concrete has already been placed.

Although depicted and described above as being connected to an air cushion base unit 216, air cushion lead unit 218 may otherwise be implemented with a wheeled base unit 216', as shown in placing and screeding apparatus 200" in FIG. 23, which is substantially similar to base unit 16 discussed above. Base unit 216' is preferably a four-wheeled drive and four-wheel steered unit and includes an hydraulic pump which is operable to drive and steer the wheels and which is further operable to extend and retract the pipe assembly 214 in a similar manner as discussed above with respect to base unit 216 of placing apparatus 200. As shown in FIG. 23, air cushion lead unit 218 may be extended out over a region where concrete has already been placed to add more concrete to a particular region, or to further smooth and compact the uncured concrete, if a screeding device is implemented on apparatus 200", while avoiding contact and disturbance of the already placed concrete.

Swing Tractor

Figure 25:
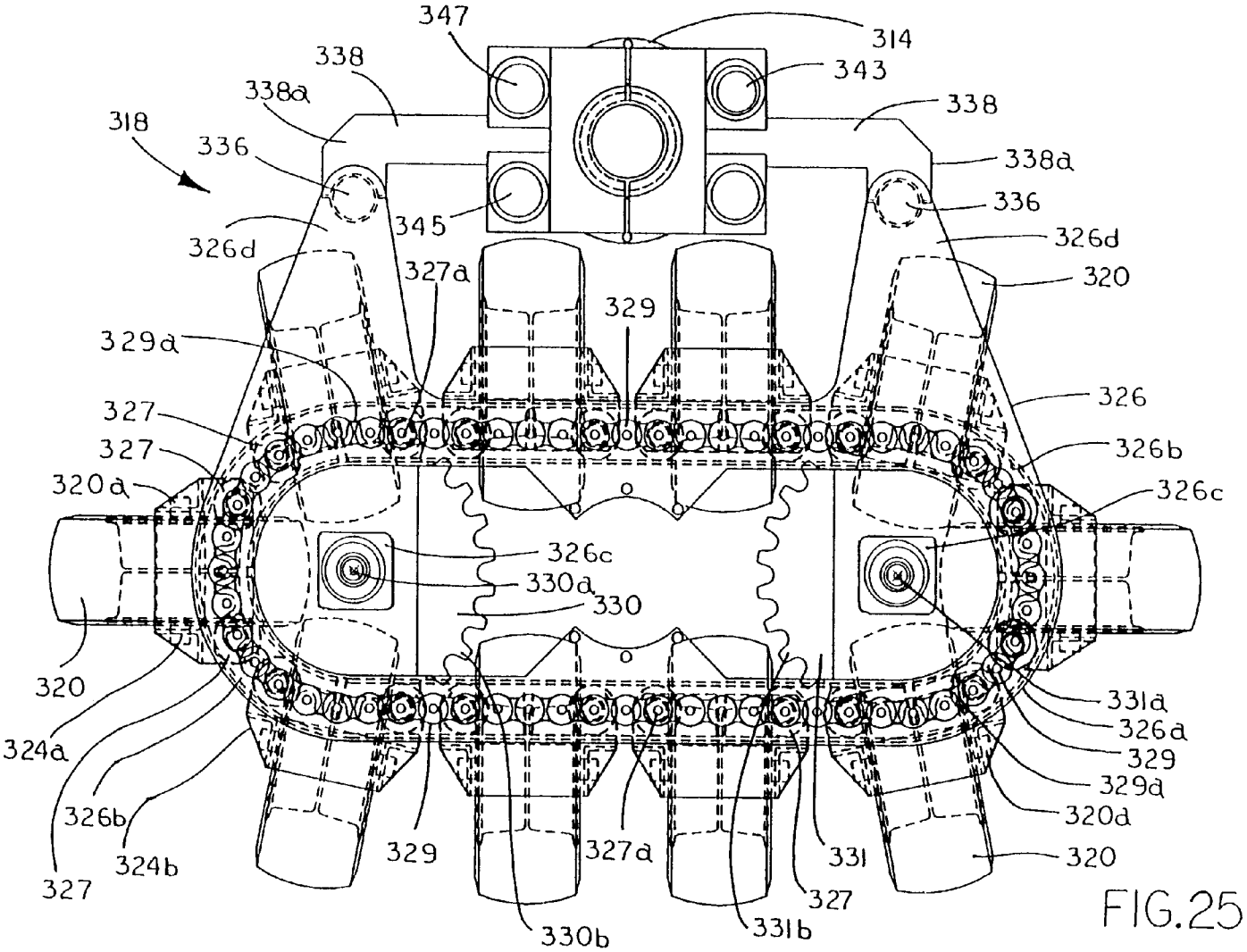
FIG. 25 is an end view of the lead unit shown in FIG. 24 as viewed from the line XXV—XXV in FIG. 24.
Figure 26:
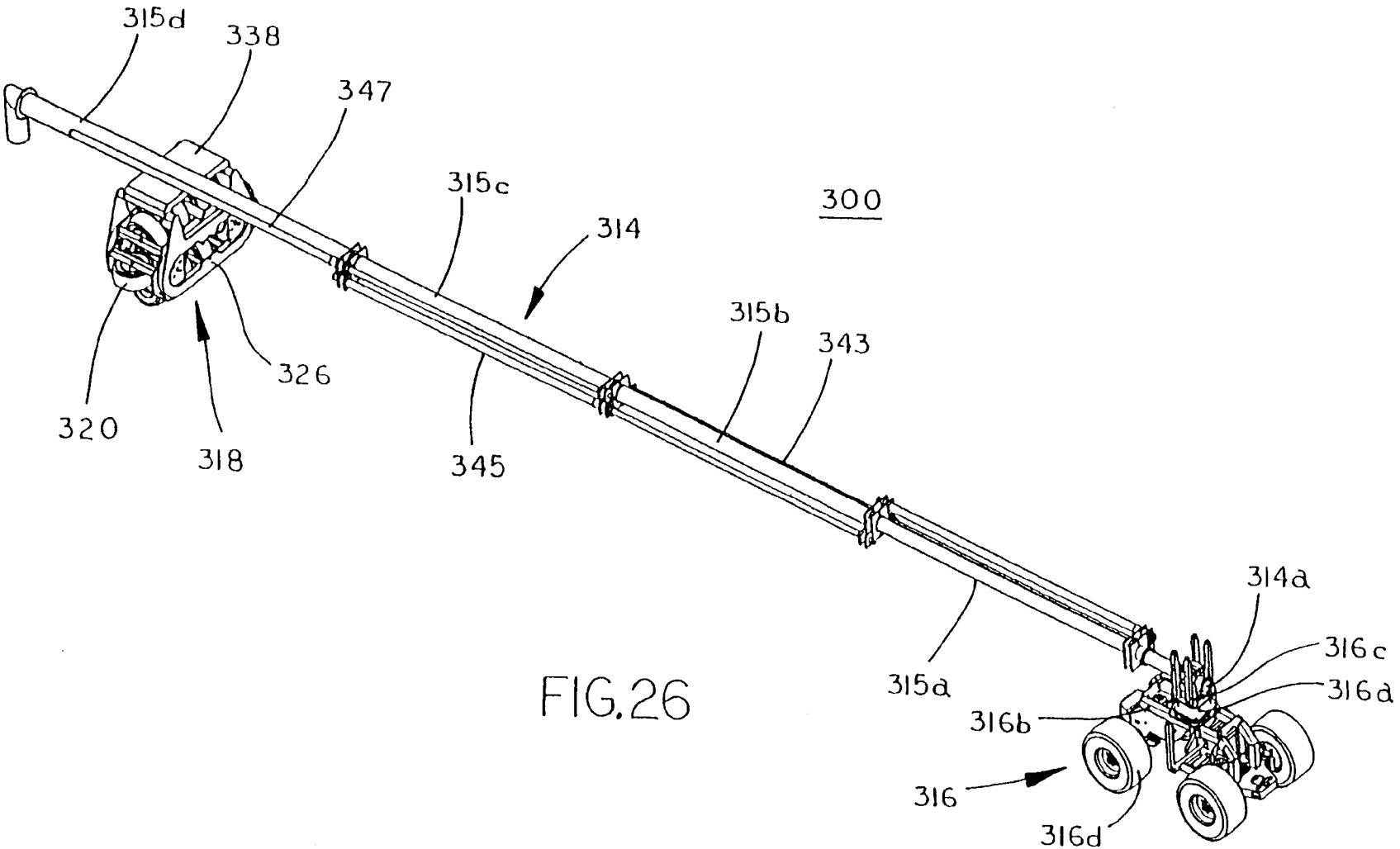
FIG. 26 is a perspective view of the embodiment shown in FIG. 24 in its extended state.
Figure 27:
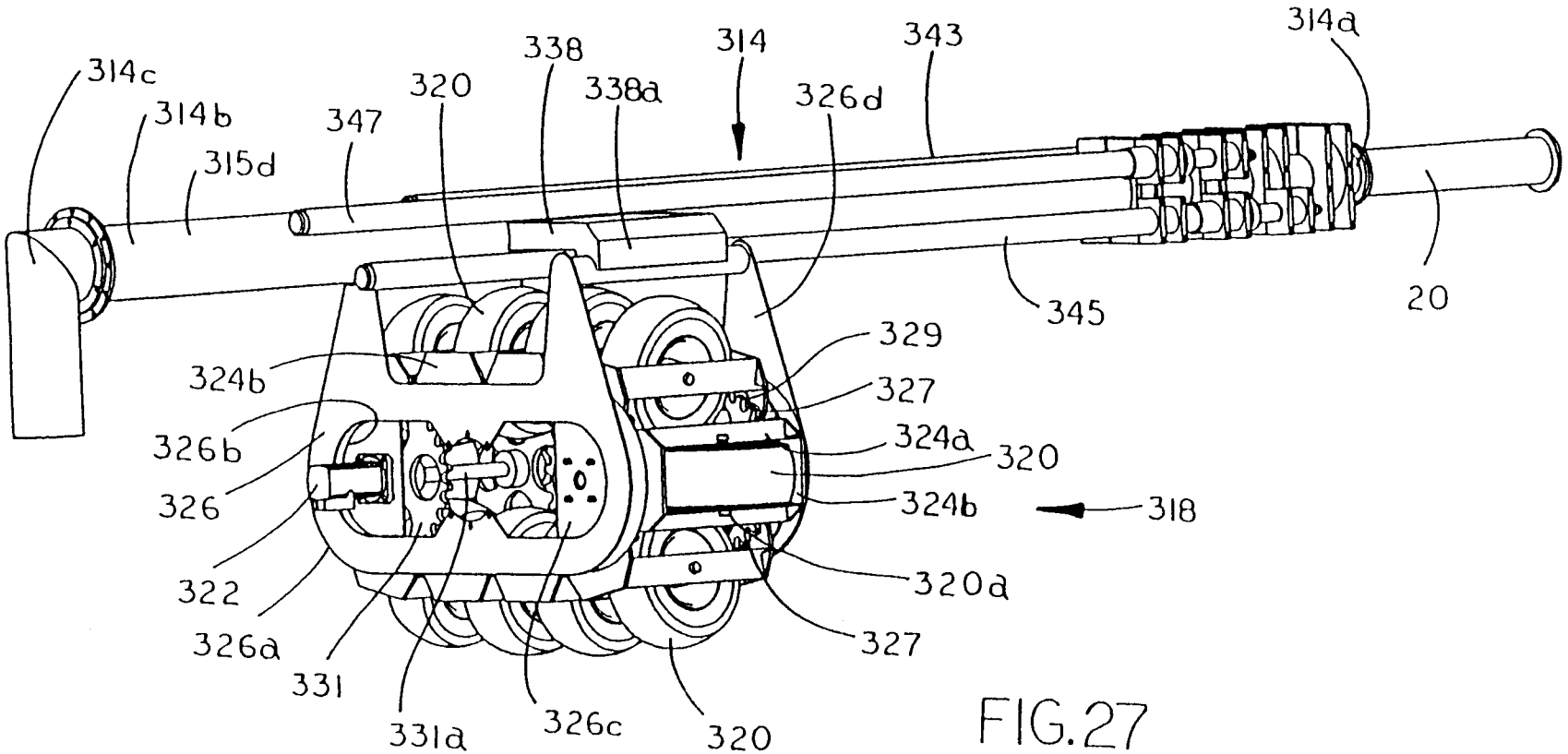
FIG. 27 is an end perspective view of the embodiment shown in FIGS. 24 though 26.
Figure 28:
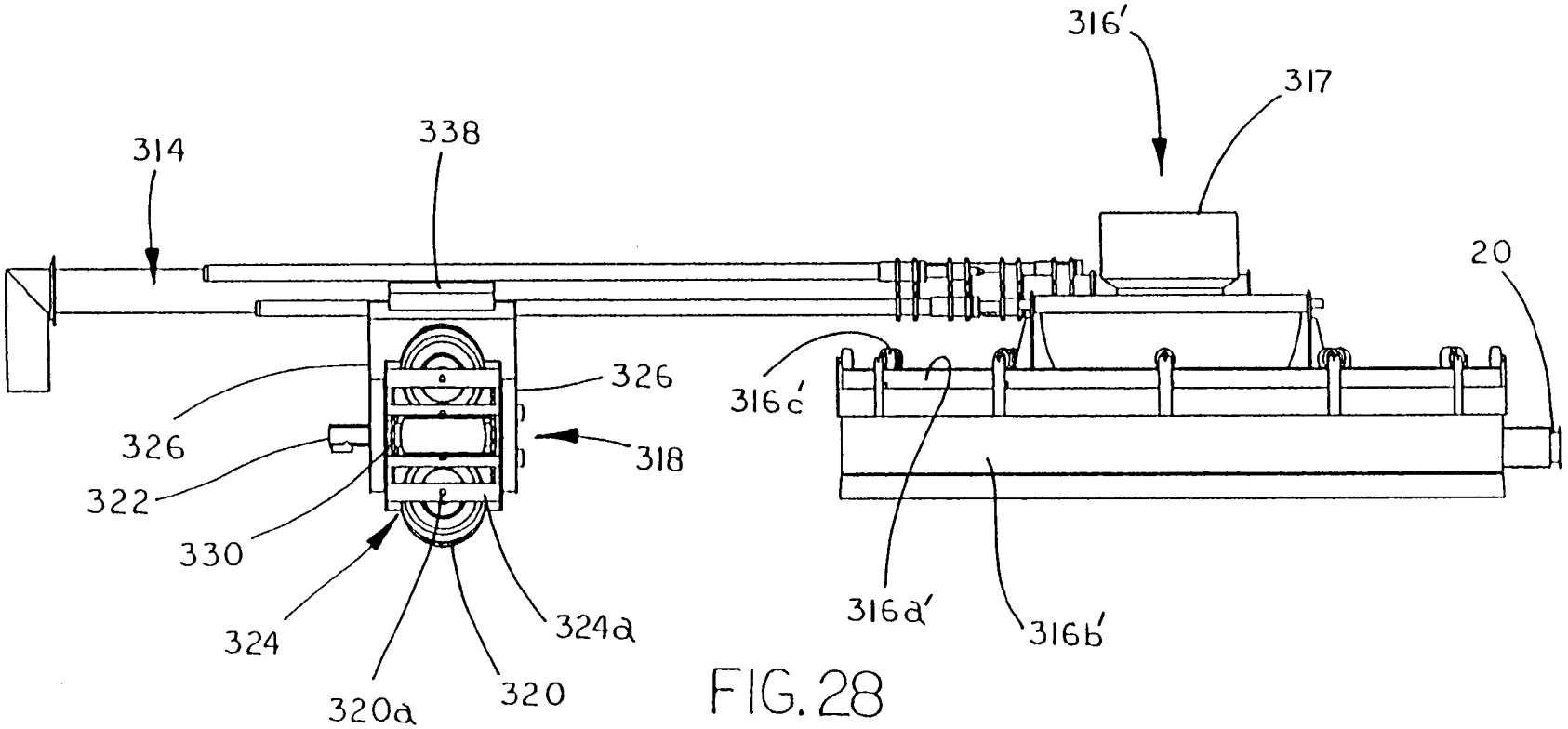
FIG. 28 is a side view of an alternate embodiment of the invention shown in FIGS. 24–27, with the base unit comprising an air cushion device, shown in its retracted state.

Referring now to FIGS. 24–28, an alternate embodiment 300 of the present invention comprises a wheeled base unit 316, a telescopic extendable tube assembly 314 and a movable support or lead unit 318. Base unit 316 and tube assembly 314 are substantially similar to the base units and tube assemblies discussed above with respect to placing apparatus 10 and placing apparatus 200, respectively, such that a detailed description of these components need not be repeated herein. Lead unit 318 comprises a swing tractor, which is operable to support an outer end 314*b* of tube assembly 314 by freely rolling on wheels 320 as the tubes are extended outwardly from base unit 316. Arcuate movement or rotation of tube assembly 314 relative to base unit 316 is accomplished by axial movement of the wheels 320 of lead unit 318 via a rotational motor 322 (FIGS. 27 and 28).

Figure 24:
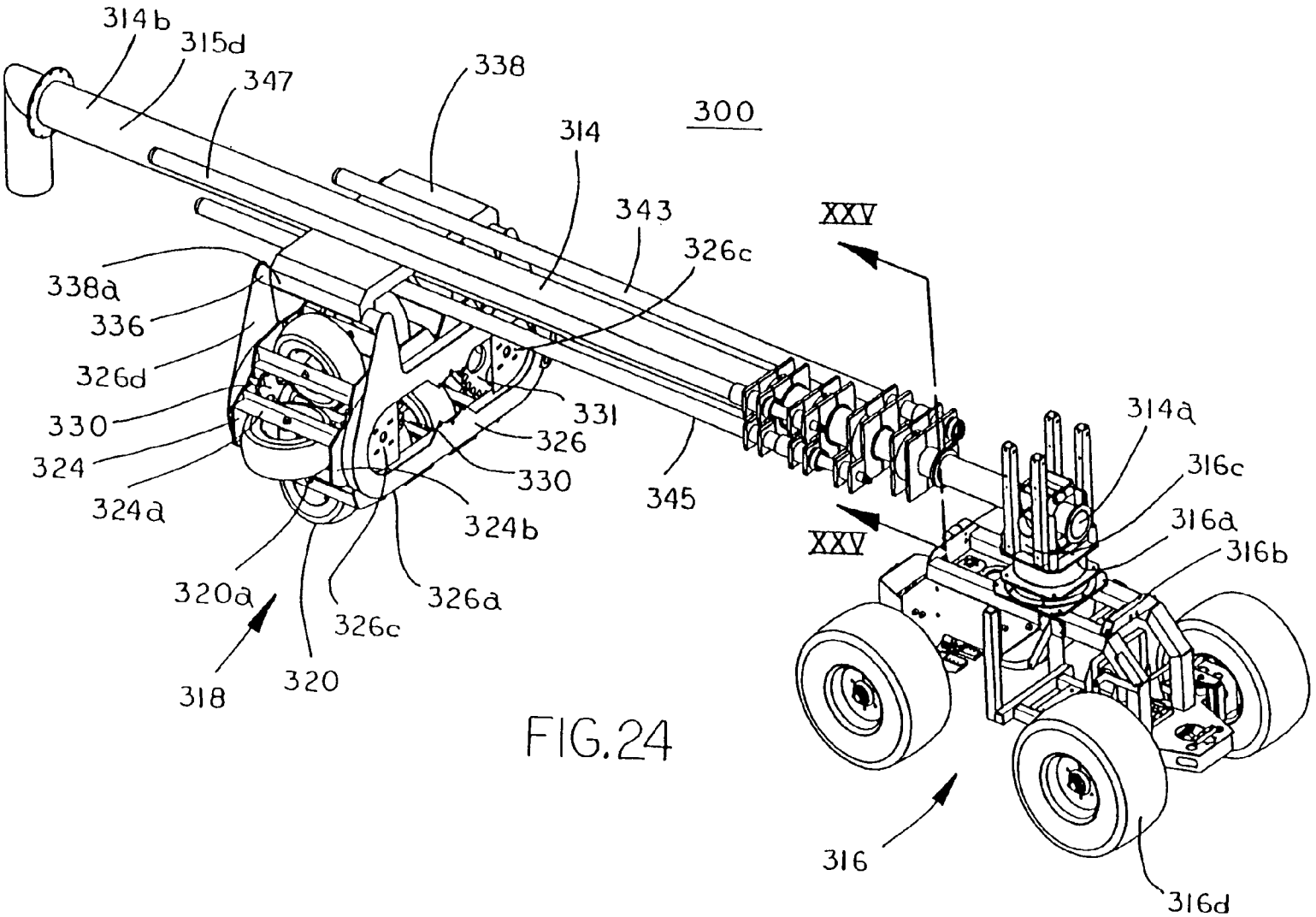
FIG. 24 is a perspective view of another alternate embodiment of the present invention which has a lead unit which comprises a plurality of wheel trolleys which are movable in a generally axial direction to move the tube assembly arcuately relative to the base unit.

As best shown in FIGS. 24 and 25, lead unit 318 comprises a plurality of wheel trolleys 324 positioned about a circumferential edge 326*a* of an end frame or plate 326 of lead unit 318. Each wheel trolley 324 comprises a wheel 320, which is rotatably mounted on an axle 320*a*. The wheel trolleys 324 are defined by a pair of opposite side frame members 324*a* and a pair of opposite end frame members 324*b*, which generally surround their respective wheel 320. Each axle 320*a* of wheels 320 is mounted at each end to trolley side frame members 324*a*, such that the wheels 320 are freely rotatable within their frames 324*a* and 324*b*. Each end plate 324*b* of trolleys 324 further comprise a pair of rollers 327 rotatably mounted thereto on axles 327*a* extending outwardly from end plates 324*b*.

Each end frame 326 of lead unit 318 has a generally U-shaped track or channel around its circumference, in order to provide a continuous, generally circular or oval-shaped track 326*b* extending around its circumference. Trolleys 324 are positioned between end frames 326, such that rollers 327 of wheel trolleys 324 rotatably engage channel 326*b* at each end of wheel trolleys 324. The wheel trolleys may thus travel around track or channel 326*b* in a direction which is generally axial relative to wheels 320. Each of the wheel trolleys 324 is connected to a next, adjacent wheel trolley via a drive chain or linkage 329, which is secured to each trolley 324 at each roller axle 327*a*. Preferably, each of a pair of chains 329 may be secured to rollers 327 on wheel trolleys 324 at an opposite end of wheel trolleys 324, to provide uniform driving of the wheel trolleys at each end thereof, thereby substantially precluding binding of the wheel trolleys as they are moved along channel or track 326*b* of end frames 326.

End frames 326 of lead unit 318 further comprise a pair of upwardly extending arms 326*d*. Each arm 326*d* is connected to a corresponding arm 326*d* on the opposite end frame 326 via a generally cylindrical bar or rod 336. An outer tube 315*d* of tube assembly 314 preferably further includes a pair of laterally outwardly extending mounting arms or extensions 338 which extend from tube 315*d* and engage rods 336 on lead unit 318 for mounting the tube assembly 314 to lead unit 318. Mounting arms may be clamped, welded or otherwise secured to tube 315*d*. Arms 338 preferably further comprise downward-extending mounting portions 338*a*, which are correspondingly formed to uniformly engage the generally cylindrical rods 336, thereby substantially uniformly supporting tube assembly 314 on lead unit 318.

Preferably, lead unit 318 is generally oval shaped and comprises a pair of gears or sprocket wheels 330 and 331 positioned substantially adjacent to each of the end plates 326 of lead unit 318. Sprocket wheels 330 and 331 are each rotatably mounted on an axle 330*a* and 331*a*, respectively, each of which is secured at opposite ends to axle mounting brackets 326*c* of end frames 326. Each of the sprocket wheels 330 and 331 comprises a plurality of gear teeth 330*b* and 331*b*, respectively, along their outer circumferential edges. Teeth 330*b* and 331*b* engage gaps 329*a* in chains 329, as the chains, and thus the wheel trolleys, are routed and driven around sprockets 330 and 331.

Figure 30:
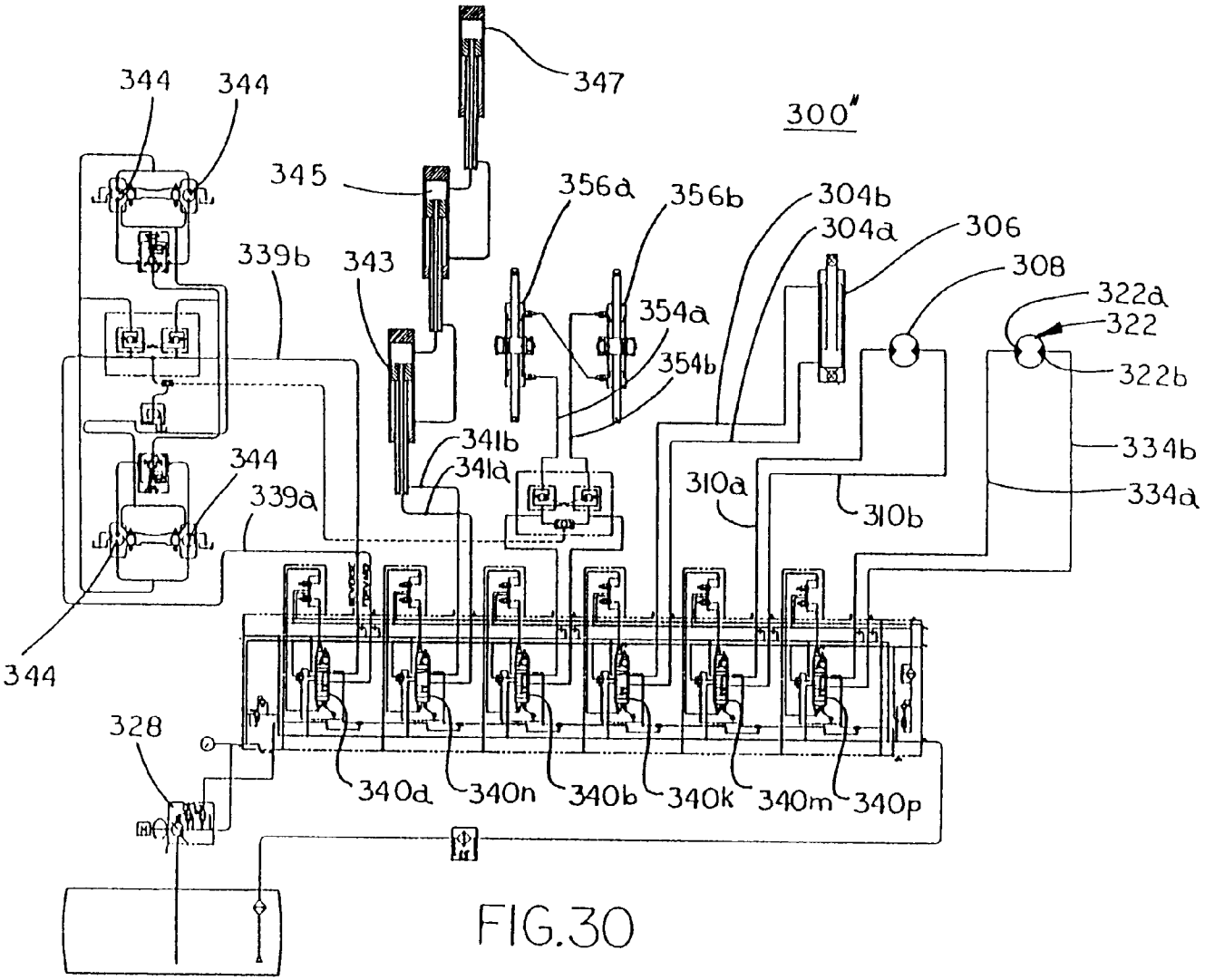
FIG. 30 is a hydraulic schematic of the embodiment shown in FIG. 29.

Preferably, at least one of the sprocket wheels 330 and 331 or axles 330*a* and 331*a* is rotatably driven by a rotational motor 322 (FIGS. 27, 28 and 30), which is positioned at one of the ends of at least one of the axles 330*a* and 331*a*. As shown in FIG. 27, motor 322 may be mounted on axle 331, while axle 330*a* and thus sprocket wheels 330 are freely rotatable relative to frame 326. Accordingly, rotation of axle 331*a* by motor 322 causes rotation of sprocket wheels 331, thereby causing movement of drive chains 329 about the respective sprocket wheels 331, which further drives the rotation of the other sprocket wheels 330. The movement of chains 329 further drives the wheel trolleys 324 around channel 326*b* of end frames 326. As the wheel trolleys 324 are driven in a generally axial direction relative to axis 320*a*, wheels 320 function to sequentially engage the ground and pull the unit 318 laterally or sidewardly relative to tube assembly 314, thereby moving tube assembly 314 arcuately with respect to base unit 316. Preferably, rotational motor 322 is an hydraulic rotational motor and is interconnected to an hydraulic pump 328 on base unit 316 via a pair of hydraulic fluid lines 334*a* and 334*b* (FIG. 30).

Because wheels 320 are not rotatably driven on lead unit 318, extension and retraction of the tube assembly 314 is preferably provided via a plurality of hydraulic cylinders 343. 345, and 347, similar to hydraulic cylinders 243, 245, and 247, discussed above with respect to placing apparatus 200. Preferably, the hydraulic cylinders 343, 345, and 347 are likewise plumbed in series, as discussed above with respect to hydraulic cylinders 243, 245, and 247. However, other means for extending and retracting the tubes 315*a*, 315*b*, 315*c* and 315*d* relative to base unit 316 may be implemented without affecting the scope of the present invention.

As shown in FIGS. 24 and 26, lead unit 318 may be implemented with a wheeled base unit 316, which comprises four wheels 316*d* which are drivable and steerable via hydraulic pump 328, motors 344 and hydraulic cylinders 356*a* and 356*b*, in a similar manner as placing apparatus 10, discussed above. Likewise, a supply end 314*a* of pipe assembly 314 is preferably mounted to a trunnion 316*c* on a swivel portion 316*a*, which is rotatably mounted to a base portion or frame 316*b* of base unit 316. As discussed above, swivel portion 316*a* may further include a crane device (not shown) for lifting and positioning the supply pipes and hoses (also not shown) for connection to or detachment from supply end 314*a* of pipe assembly 314.

As shown in FIG. 28, lead unit 318 may otherwise be implemented with an air cushion base unit 316', which is substantially identical to the base units of placing apparatus 200 and placing and screeding apparatus 200', discussed above. Similar to those units, base unit 316' may comprise two or more fans and motors 317, to provide proper lift for the air cushion device. An hydraulic motor (not shown) and a plurality of rollers 316*c'* (and other rollers not shown) are preferably included on base unit 316', to facilitate rotation of an upper portion 316*a'* relative to a lower portion 316*b'*, in a similar manner as discussed above with respect to placing apparatus 200.

Figure 29:
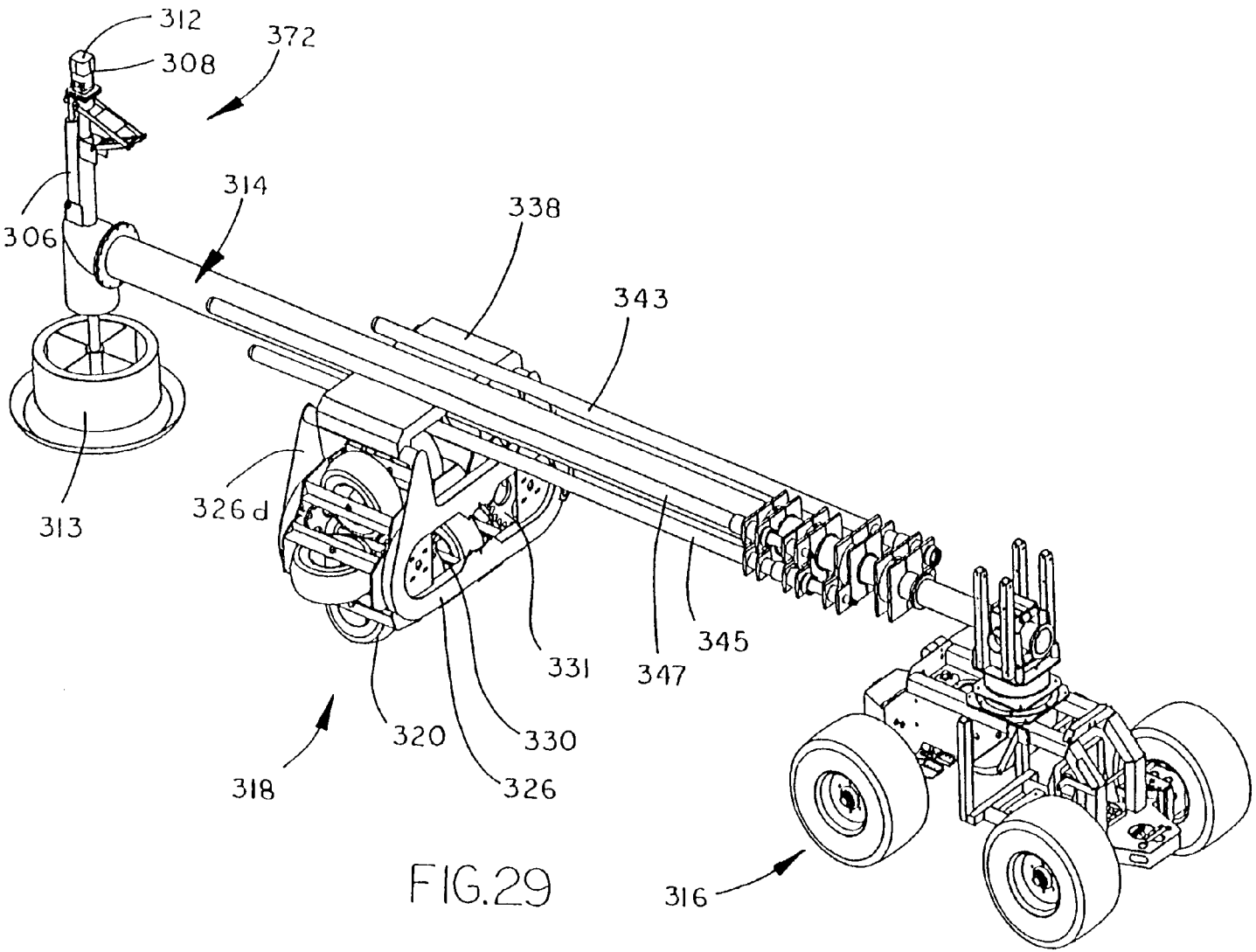
FIG. 29 is a perspective view of another alternate embodiment of the present invention which comprises a screeding device positioned at the discharge end of the tube assembly, shown in its retracted state.

Additionally, lead unit 318 may be implemented with a screeding device 372 for smoothing and compacting the concrete as it is dispensed from dispensing end 314*b* of tube assembly 314, as shown in FIG. 29. Screeding device 372 may be a conventional screeding device, a plow, auger and screeding device similar to the device disclosed in U.S. Pat. No. 4,930,935, referenced above and discussed with respect to screeding device 72, the simplified screeding device 72' with a vibratory plow, or a screeding device with a rotational head 314, as shown in FIG. 29, and as discussed above with respect to screeding device 104 of placing and screeding apparatus 10". However, other devices or means for smoothing and compacting uncured concrete as it is dispensed from the dispensing end 314*b* of the tube assembly 314 may be implemented, without affecting the scope of the present invention. It is further envisioned that a swing tractor unit may support only a screeding device for smoothing/grading uncured concrete that has already been placed at a targeted area of the support surface. The screeding device may be supported at the swing tractor, or may be supported by an extended or extendable support member extending from the swing tractor.

Referring now to FIG. 30, an hydraulic schematic of the power source and motors and cylinders for a placing and screeding apparatus 300", as shown in FIG. 29 and discussed above. The drive system and motors 344 for the wheeled vehicle 316 are controlled via an hydraulic pump 328, an hydraulic solenoid 340*a* and hydraulic fluid lines 339*a* and 339*b*, which are identical to the drive system and motors 44 discussed above with respect to placing device 10 and FIG. 5. The steering cylinders 356*a* and 356*b* of base unit 316 are also operable via an hydraulic solenoid 340*b* and fluid lines 354*a* and 354*b*, in an identical manner as discussed above with respect to placing device 10 and FIG. 5. Because wheeled unit 316 is implemented with a movable support which is not operable to extend and retract the tube assembly 314, hydraulic motor 328 is further operable to actuate a solenoid 340*n* to pressurize hydraulic fluid lines 341*a* or 341*b* in order to extend and retract hydraulic cylinders 343, 345, and 347, in the same manner as discussed above with respect to placing apparatus 200 and FIG. 20.

Furthermore, because wheeled base unit 316 is implemented with the swing tractor lead unit 318, hydraulic pump 328 is also operable to actuate an hydraulic solenoid 340*p* to provide pressurized fluid to one of hydraulic fluid lines 334*a* and 334*b*, in order to rotatably drive hydraulic motor 322 on lead unit 318, thereby driving wheels 320 axially around sprockets 330 and 331. Hydraulic fluid line 334*a* is connected to port 322*a* of motor 322 and may be pressurized to cause rotation of a motor shaft in one direction to drive the wheel trolleys 324 to pivot tube assembly 314 about base unit 316 in a first direction, while hydraulic fluid line 334*b* is connected to an opposite port 322*b* of motor 322 and may be pressurized to cause opposite rotation of wheel trolleys 324 and rotation of motor 322 and thus an opposite direction of movement of lead unit 318 and tube assembly 314.

As shown in FIG. 29, placing and screeding device 300" may comprise a screeding device 372 with a rotating head 313, which is driven by a motor 308 and raised and lowered by an elevation cylinder 306. Accordingly, hydraulic motor 328 of base unit 316 is further operable to actuate an hydraulic solenoid 340*k*, which pressurizes an hydraulic line 304*a* or 304*b* to raise or lower the rotating head 313 via cylinder 306. Preferably, raising and lowering of the rotatable head 313 is performed automatically in response to a signal received from a laser receiver 312 positioned at an upper end of screeding device 372. However, the raising and lowering of the rotatable screeding head 313 may be performed manually, or in response from a signal from another type of leveling sensor or system, without affecting the scope of the present invention. Additionally, hydraulic motor 328 is operable to actuate a solenoid 340*m* for pressurizing hydraulic fluid lines 310*a* and 310*b* for rotatably driving hydraulic motor 308 and thus the rotatable screeding head 313 on screeding device 372.

Because tube assembly 314 is extendable and retractable relative to base unit 316 while motors 322 and 308, along with hydraulic cylinder 306, are positioned toward a remote end of the tube assembly, hydraulic fluid lines 304*a*, 304*b*, 310*a*, 310*b*, 334*a* and 334*b* are preferably hydraulic fluid hoses which may be wound on multiple spring-biased hydraulic hose reels (not shown) to allow the hoses to unwind and thus extend outwardly with the tube assembly, and to wind back up or retract as the tube assembly is retracted.

Method for Placing Concrete

Figure 31:
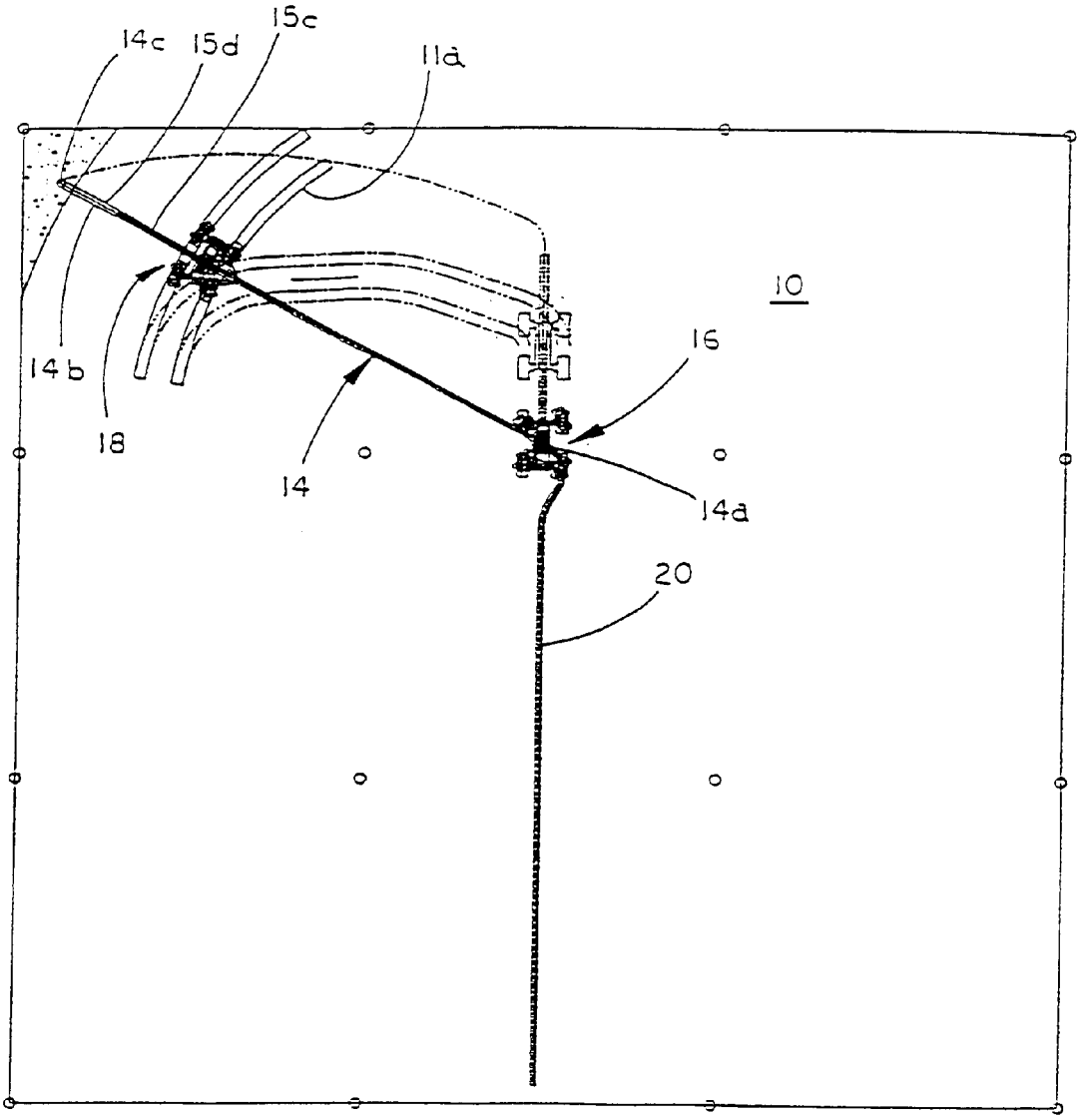
FIGS. 31–34 are plan views of the present invention and show a portion of the process for placing concrete in a targeted area.
Figure 32:
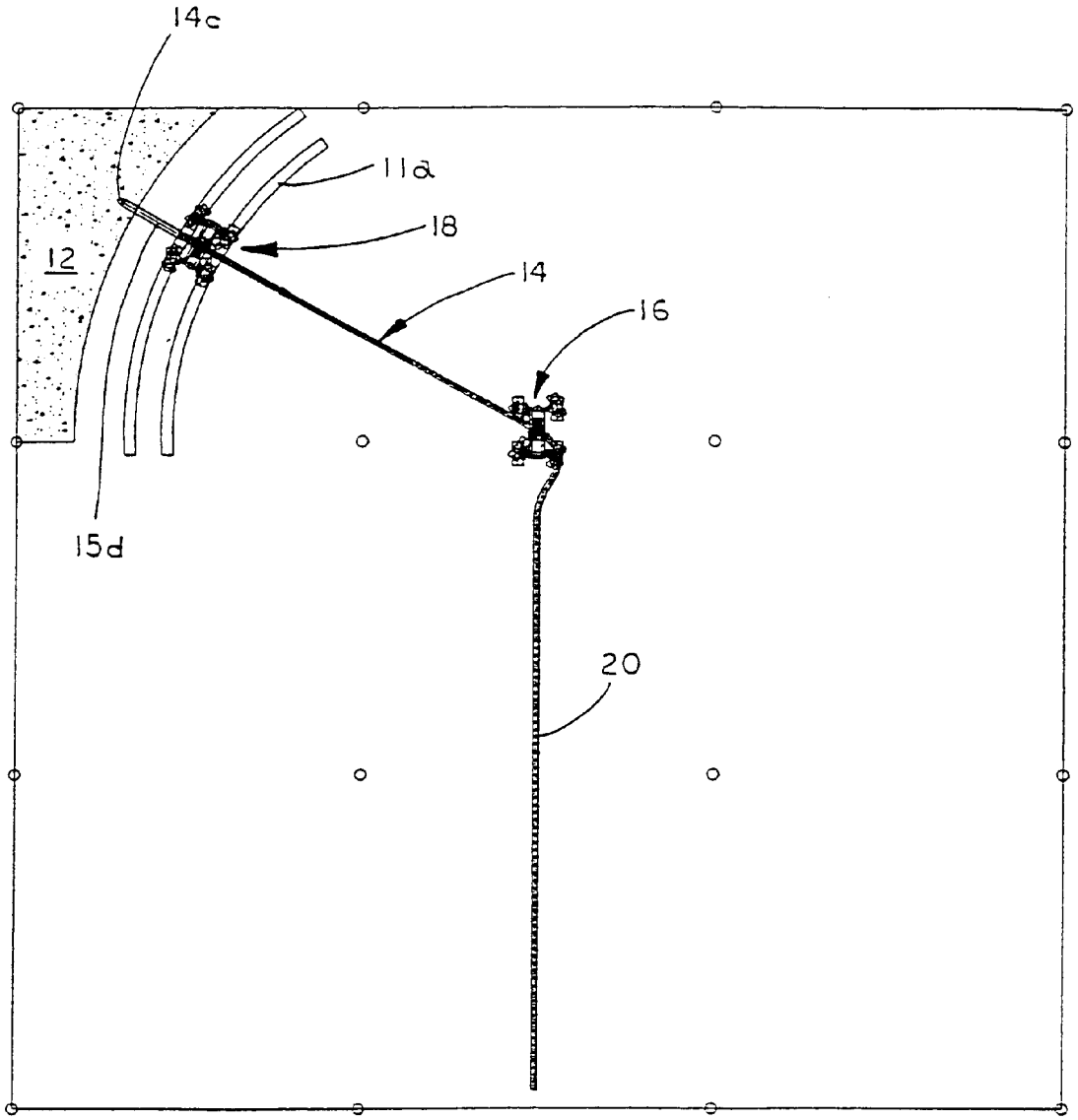

Referring now to FIGS. 31–34, the process of placing concrete in a targeted area is shown with placing apparatus 10. The base unit 16 is positioned such that dispensing nozzle 14*c* at outer end or dispensing end 14*b* of telescopic tube assembly 14 may reach the farthest corner of the targeted area. The lead vehicle is driven to a point where the tubes 14 are fully extended, and then turned and oriented in a direction generally normal to the longitudinal direction of the tube assembly 14. The lead vehicle 18 is then driven arcuately back and forth along path 11*a* with respect to base vehicle 16 to place concrete within an area proximate to the dispensing end 14*b* of tube 14 while outer tube 15*d* is fully extended from lead unit 18, as shown in FIG. 31. Outer tube 15*d* may then be partially or fully retracted relative to lead unit 18, while lead unit 18 again travels arcuately along substantially the same path 11*a*, to further place concrete in the region immediately adjacent to and radially inward from the first area, as shown in FIG. 32. As lead unit 18 is driven back and forth, along generally the same arcuate path, outer tube 15*d* may be retracted approximately 2½ feet with each pass, such that the preferred 7 feet of extension is fully retracted after three passes of lead unit 18.

Figure 33:
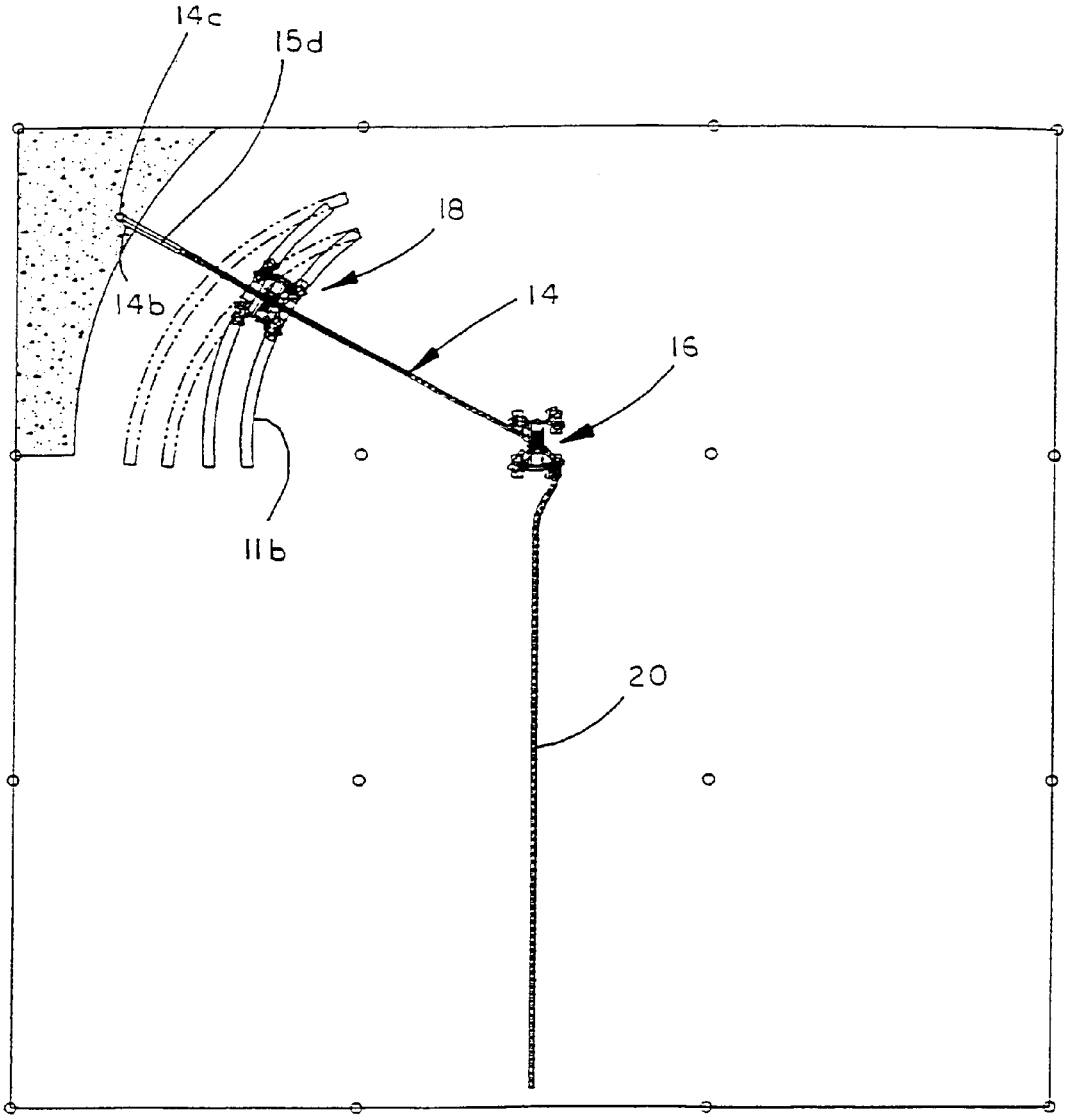
Figure 34:
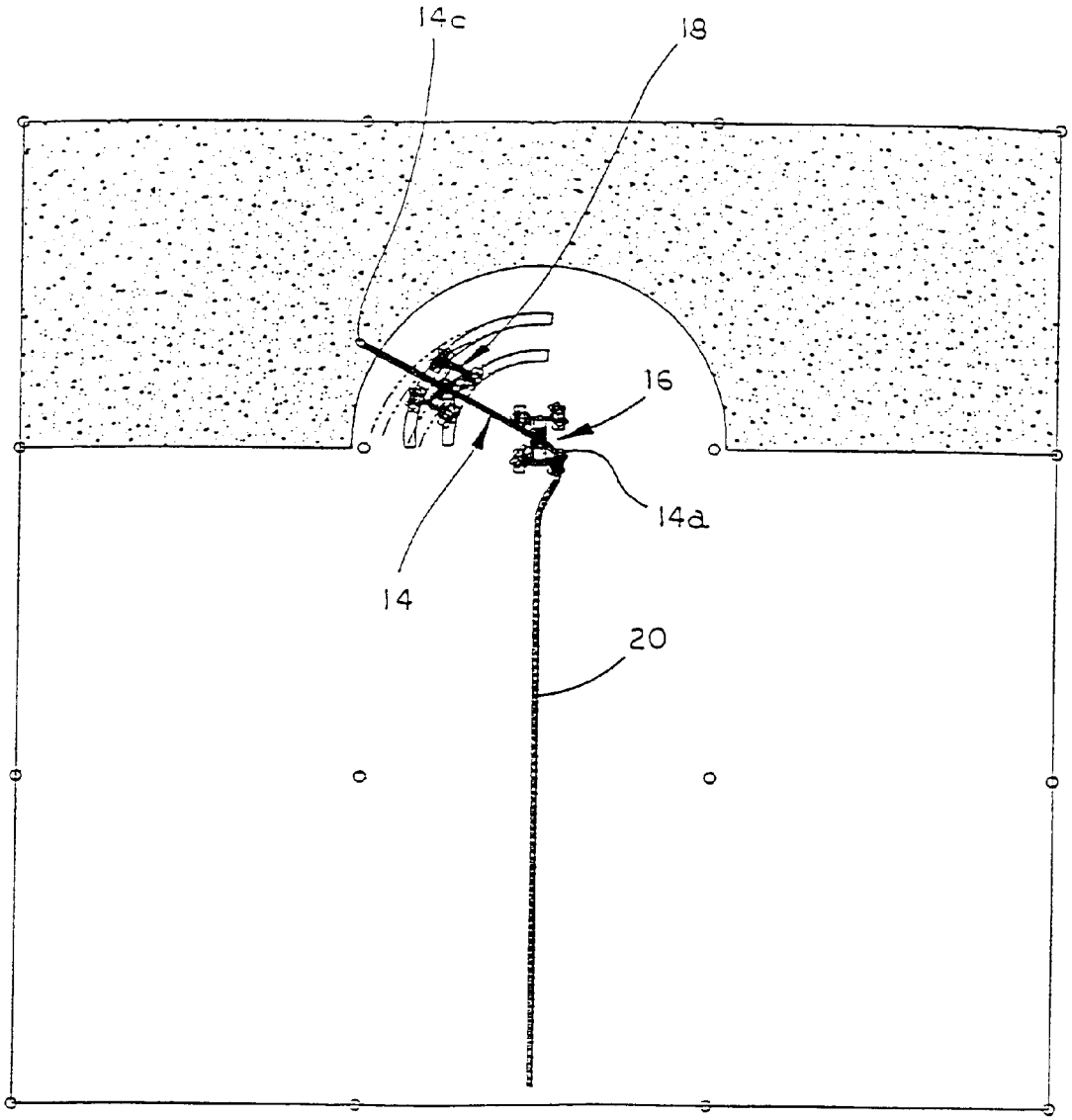

Upon completion of the first region, the lead unit 18 is driven back toward base unit 16, while still travelling along a generally arcuate path relative to the base unit, such that the tube assembly 14 is partially retracted, as shown in FIG. 33. Preferably, the lead unit 18 is moved radially back toward base unit 16 approximately 7 feet, such that after lead unit 18 is moved radially inwardly toward base unit 16, outer tube 15*d* may again be extended from tube 15*c* and lead unit 18 to position dispensing nozzle 14*c* proximate to the already placed concrete. Lead unit 18 may then be driven back and forth along a second path 11*b*, while outer tube 15*d* is partially retracted after each pass. The processes described with respect to FIGS. 31 and 32 may then be repeated for the next sections or regions of the targeted area, without any gaps or insufficient concrete being placed in or between any of the regions. This process is repeated until all of the tubes are completely retracted and concrete has been dispensed over the entire targeted area, as shown in FIG. 34. The supply end 14*a* of tube assembly 14 may then be disconnected from the supply hose or tubes 20, several sections of the supply pipe may be removed, and the base unit 16 may be repositioned and reconnected to the supply line. Upon reconnection, the telescoping tubes may be extended such that the lead unit is again ready to begin placing concrete at the next targeted area.

Because the extension and retraction of the tube assembly may be continuously adjusted while the tubes are traveling arcuately back and forth relative to the base unit, the dispensing end of the tube assembly may provide concrete to every location in the targeted area, thereby uniformly distributing the concrete and substantially precluding the possibility of an insufficient amount of concrete being dispensed in any given area. Although described with pipes of a preferred length and movement of the lead unit a preferred distance, clearly the scope of the present invention includes other placing and/or screeding apparatus' which have different length pipes and/or are moved a different distance when in use. Also, although FIGS. 31–34 show the process for placing concrete with wheeled vehicles, the process is substantially similar if the lead unit is an air cushion device or a swing tractor and/or if the base unit is an air cushion device. The telescopic tubes are then operable to radially extend and retract the tubes and air cushion or swing tractor support unit while the movable support unit and/or the base unit, whether it is an air cushion device or wheeled vehicle, are operable to move or to rotate or swivel to arcuately move the support unit and tube relative to the base unit.

Articulated Pipe Assembly

Referring now to FIGS. 35–48, an alternate placing apparatus 400 comprises an articulated pipe or tube assembly 414, a generally fixed or non-movable base unit 416, and a plurality of movable air cushion supports or units 418. As used herein, the term "articulated" describes a jointed or bendable tube or pipe assembly which folds or bends between a retracted position, where the joints are substantially angled or bent, and an extended position, where the tube assembly is substantially straight or linear. A supply end 414*a* of articulating tube assembly 414 is connected to a concrete supply tube 20 at base 416. Tube assembly 414 comprises a plurality of pivotable pipe sections 415*b*, 415*c* and 415*d*, which are pivotable relative to a generally fixed supply end 414*a*, an inner or supply pipe section 415*a* and base 416, such that movable supports 418 and a discharge end 414*b* of tube assembly 414 are movable relative to base 416 to place uncured concrete at substantially all locations within a targeted area in the vicinity of base 416. Each pipe section 415*a*, 415*b*, 415*c* and 415*d* is connected to an adjacent section or sections via corresponding flexible hoses or tubes 415*e*, which bend or flex to allow pivotal movement between the pipe sections to define joints 431*a*, 431*b* and 431*c*. Additionally, a screeding device (not shown), such as the screeding devices discussed above with respect to placing and screeding apparatus 10', may be mounted at discharge end 414*b* of tube assembly 414 to grade and smooth the uncured concrete as it is placed at the support surface by discharge end 414*b*.

Movable supports 418 are generally similar to the movable air cushion units described above with respect to placing apparatus 200, such that a detailed description will not be repeated herein. Suffice it to say that movable supports 418 comprise a pair of lift fans 418*a* and a body 418*b* which is movably supported by a cushion of air generated by the lift fans 418*a* between body 418*b* and the support surface. Each movable support 418 further includes a mounting trunnion 429 positioned at an upper surface 418*c* of the body 418*b* of movable supports 418. Trunnions 429 include a pair of notches or grooves 429*a* (FIG. 39) for pivotally receiving a pair of pins 425*d* of a mounting bracket 425 at each pipe section 415*b*, 415*c* and 415*d*, as discussed below. Movable supports 418 function to support each pipe section 415*b*, 415*c* and 415*d* remotely from the base unit 416 and allow the pipe sections to be movable relative to one another to move the discharge end 414*b* about a targeted area of the support surface, as discussed in detail below.

Figure 41:
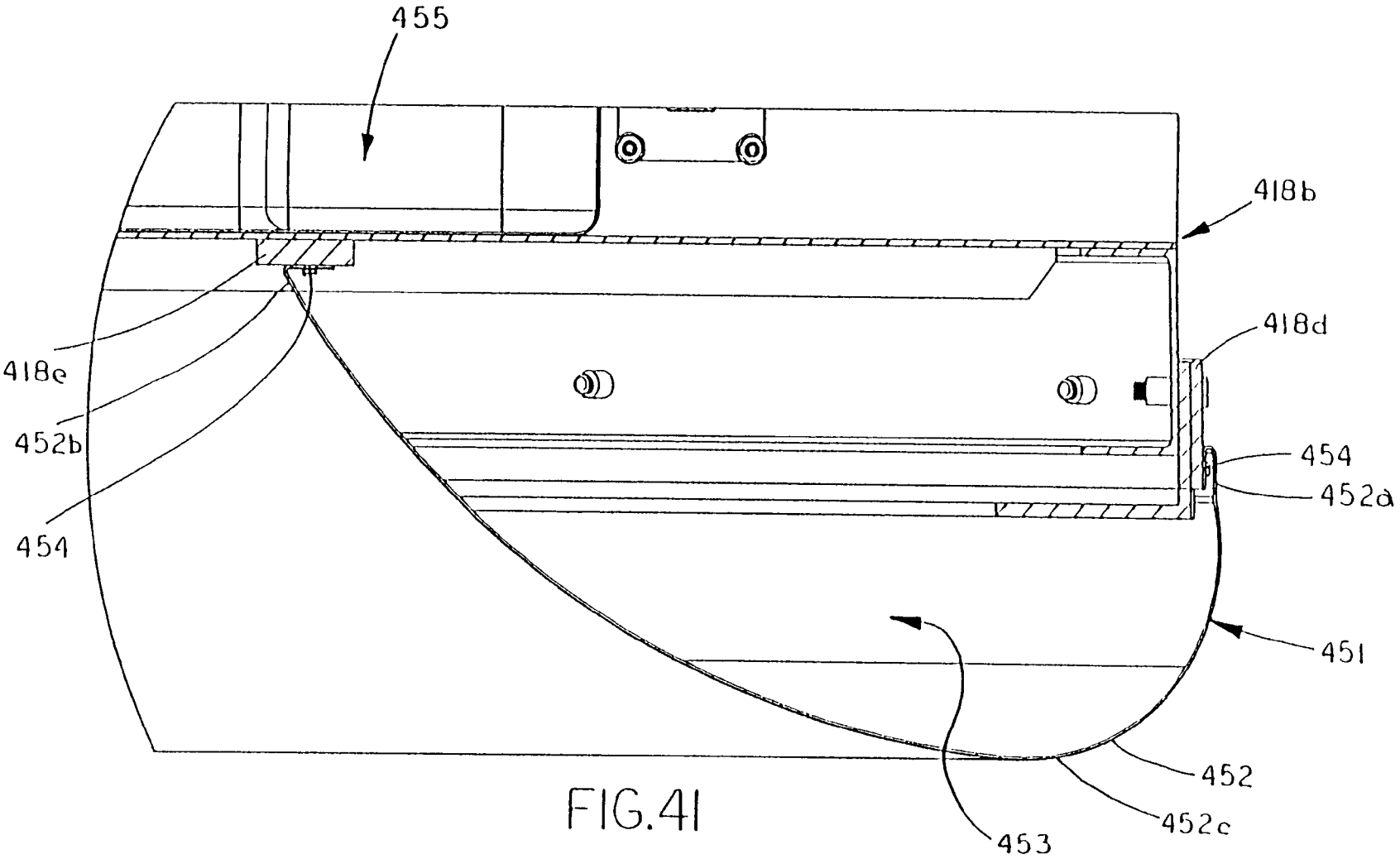
FIG. 41 is a sectional view taken along the line XLI—XLI in FIG. 40.

Movable support 418 further includes a lower seal 451 (FIGS. 40 and 41), which extends around the lower circumference of each unit to at least partially restrict or contain the cushion of air beneath the movable support when the lift fans are activated. Lower skirt 451 may comprise a brush skirt seal, such as the brush skirt seal 219 of movable support 218, discussed above, or may comprise an inflatable seal 451. Inflatable seal 451 comprises a flexible bladder, wall or seal 452, which comprises a rubber-like material, such as Polyurethane coated nylon fabric or the like. Flexible wall 452 extends around a lower circumference 418*d* of movable support 418 and defines an inflatable cavity 453 therebeneath (FIG. 41). Preferably, flexible wall 452 is secured at an outer edge 452*a* to lower circumferential region 418*d* of body 418*b* of movable support 418, while an inner edge 452*b* is secured along an inner ring 418*e* at a lower surface of body 418*b*. Flexible wall 452 may be secured at its respective locations via a plurality of fasteners 454, such as bolts or screws, such as self tapping screws or the like. Flexible wall 452 is positioned circumferentially around the entire circumference of the lower portion of body 418*b*, such that inner edge 452*b* extends radially inwardly of at least a portion of the fans 418*a* of movable support 418. Accordingly, when fans 418*a* are activated, air is blown through a passageway 455 of body 418*b* and into cavity 453, such that a portion of the air from the fans functions to inflate seal 451, while the remainder of the air from the fans raises and supports movable support 418 above the ground or support surface. Inflatable seal 451 at least partially contains the air beneath the movable support and thus assists in supporting movable support 418 as the support unit is moved over the corrugated decking or concrete at the support surface. Similar to the air cushion units of placing apparatus 200, casters, wheels or rollers (not shown in FIGS. 35–42) may be mounted on the frame of the air cushion units to ease manual movement of the units when the engines are shut down.

Because the seal 451 is flexible and rounded, as shown in FIG. 41, seal 451 functions to glide over placed concrete, and substantially reduces or precludes pushing or plowing of any already placed uncured concrete and accumulating the concrete around the outer edge of the movable support as it is moved along the placed concrete of the support surface. When operable, fans 418*a* are capable of raising and supporting movable support 418, such that there is a gap of approximately one and one-half to two inches between a lower surface 452*c* of inflatable seal 452 and the corrugated decking of the support surface or other support surface. Preferably, movable support 418 is operable to be raised and supported at least approximately one-half inch above any concrete which may be placed at the support surface. If rebar or other additional materials are placed above the corrugated decking, the air cushion support preferably also provides clearance over such materials. The movable support unit is, thus, capable of floating above the support surface and above any previously positioned rebar, or any already placed concrete, without damaging the preplaced concrete surface. Therefore, movable supports 418 may move over the support surface while placing and/or screeding the concrete at the targeted area of the support surface, without disrupting the concrete that has already been placed and/or screeded at that area.

Figure 39:
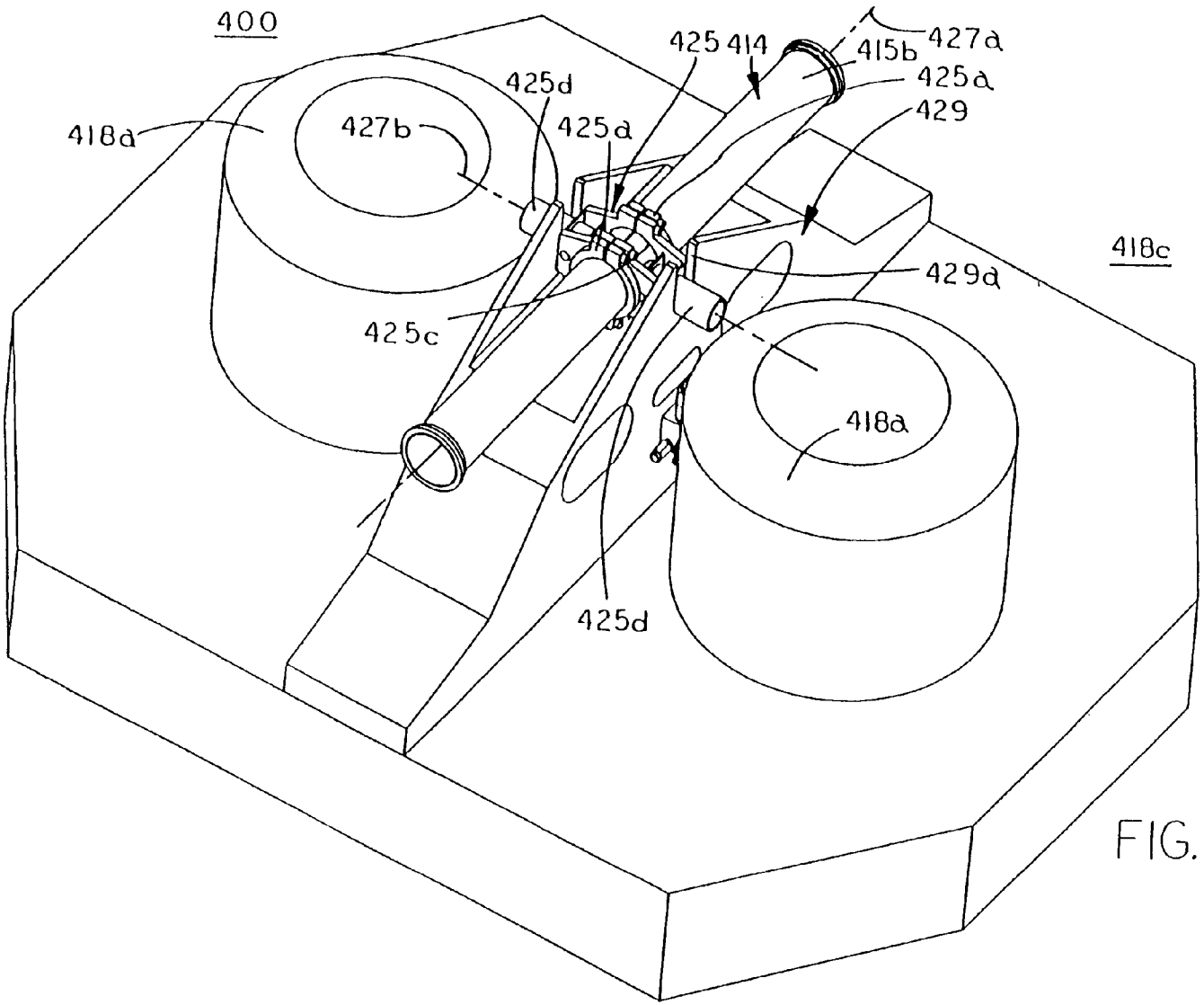
FIG. 39 is a perspective view of a mounting trunnion useful with the air cushion units of the present invention.
Figure 40:
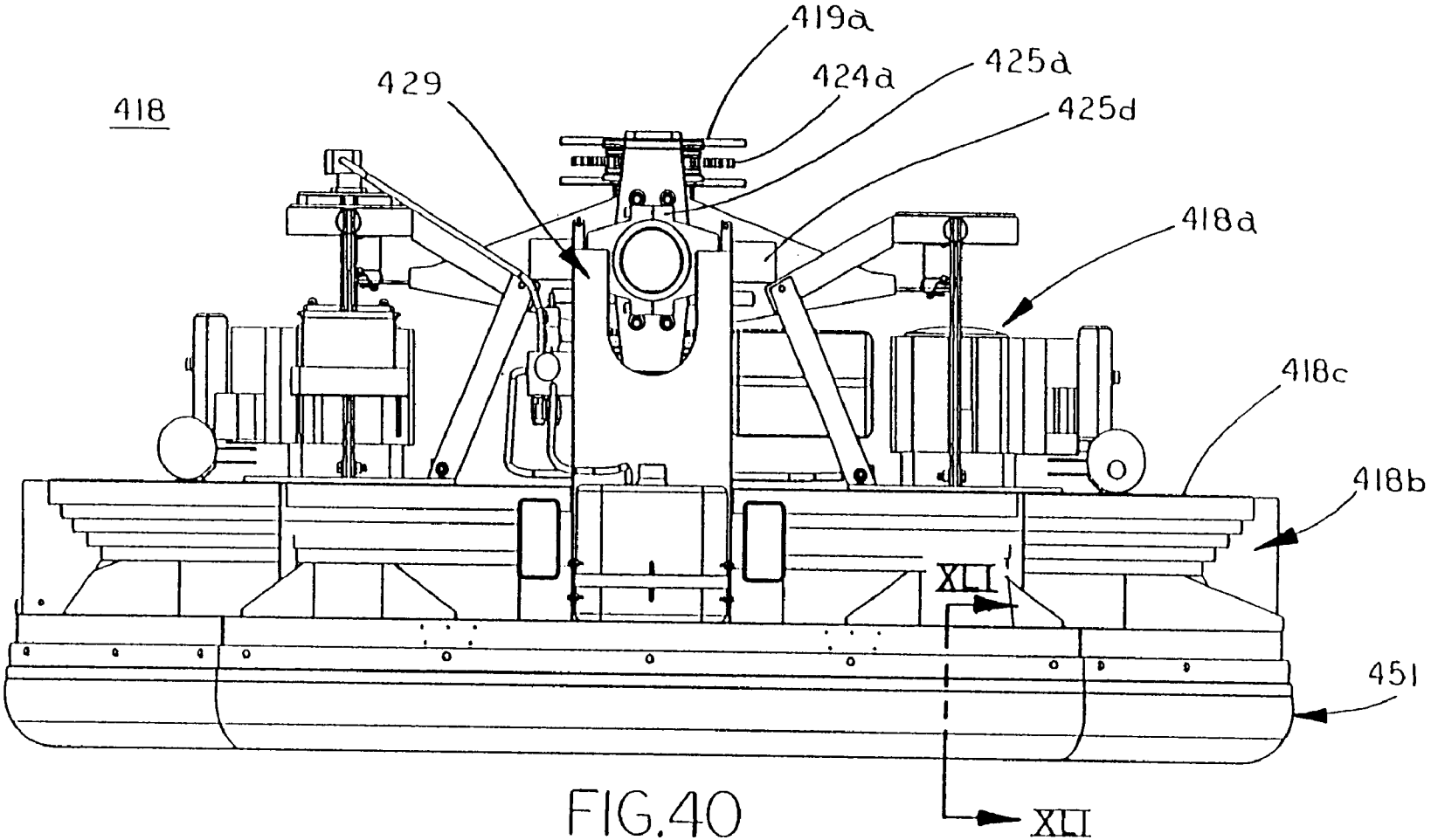
FIG. 40 is an end view of one of the air cushion support units of FIG. 35.

Referring to FIG. 39, each pipe section 415*b*, 415*c*, 415*d* of tube assembly 414 is pivotally mounted to trunnion 429 at upper surface 418*c* of each movable support 418. A pivotable trunnion mount or bracket 425 is clamped to each pipe section 415*b*, 415*c* and 415*d* generally near a midpoint thereof via a pair of clamps 425*a*. Clamps 425*a* are pivotally secured to the trunnion mount 425, which defines an opening 425*c* therethrough generally adjacent to clamps 425*a*. Openings 425*c* are formed to be larger diameter than the diameter of the pipe sections 415*b*, 415*c* and 415*d*, such that the pipe sections are insertable through openings 425*c* and are pivotable therein. Because the pipe sections are secured to clamps 425*a*, which are pivotably secured to mount 425, the pipe sections are pivotable with respect to mount 425, and thus movable support 418, about an axis 427*a* extending longitudinally along the respective pipe section. Trunnion mount 425 further includes a pair of oppositely extending generally cylindrical pins, axles or tubes 425*d*, which extend laterally outwardly from each side of trunnion mount 425. Cylindrical pins 425*d* are insertable within a pair of grooves or channels 429*a* of trunnion 429 and are pivotable about an axis 427*b* defined by pins 425*d* of mount 425. Accordingly, pipe sections 415*b*, 415*c* and 415*d* are pivotably mounted to each movable support 418, such that the pipe sections are pivotable about a pair of axes 427*a* and 427*b*, which are generally perpendicular to one another. This allows the pipe sections to pivot relative to movable supports 418 to accommodate for changes in the height or orientation of the movable supports as they may encounter uneven areas at the support surface or ground.

Figure 35:
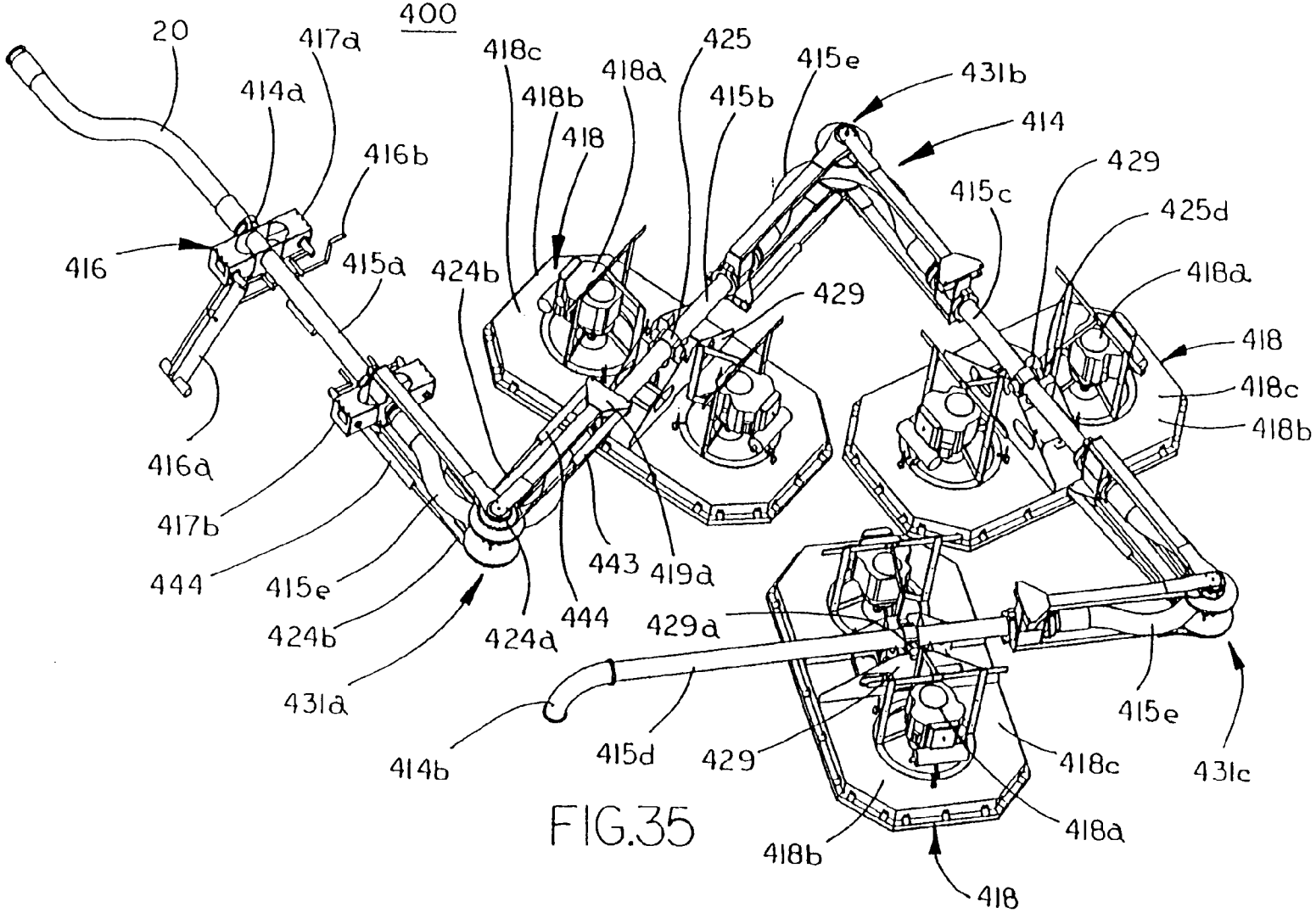
FIG. 35 is an upper perspective view of another embodiment of a placing apparatus of the present invention, with multiple movable air cushion support units supporting an articulated tube assembly.
Figure 36:
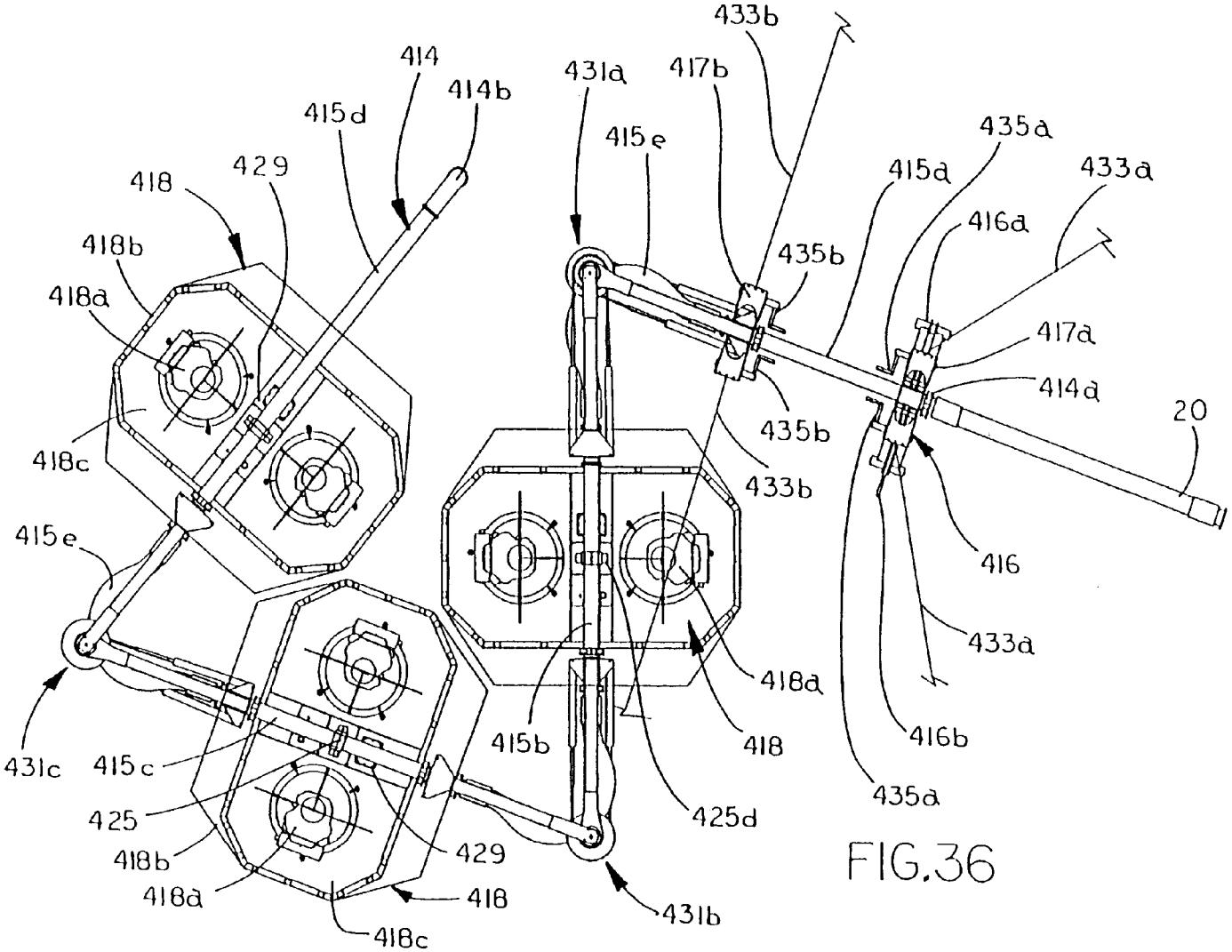
FIG. 36 is a top plan view of the placing apparatus of FIG. 35.
Figure 38:
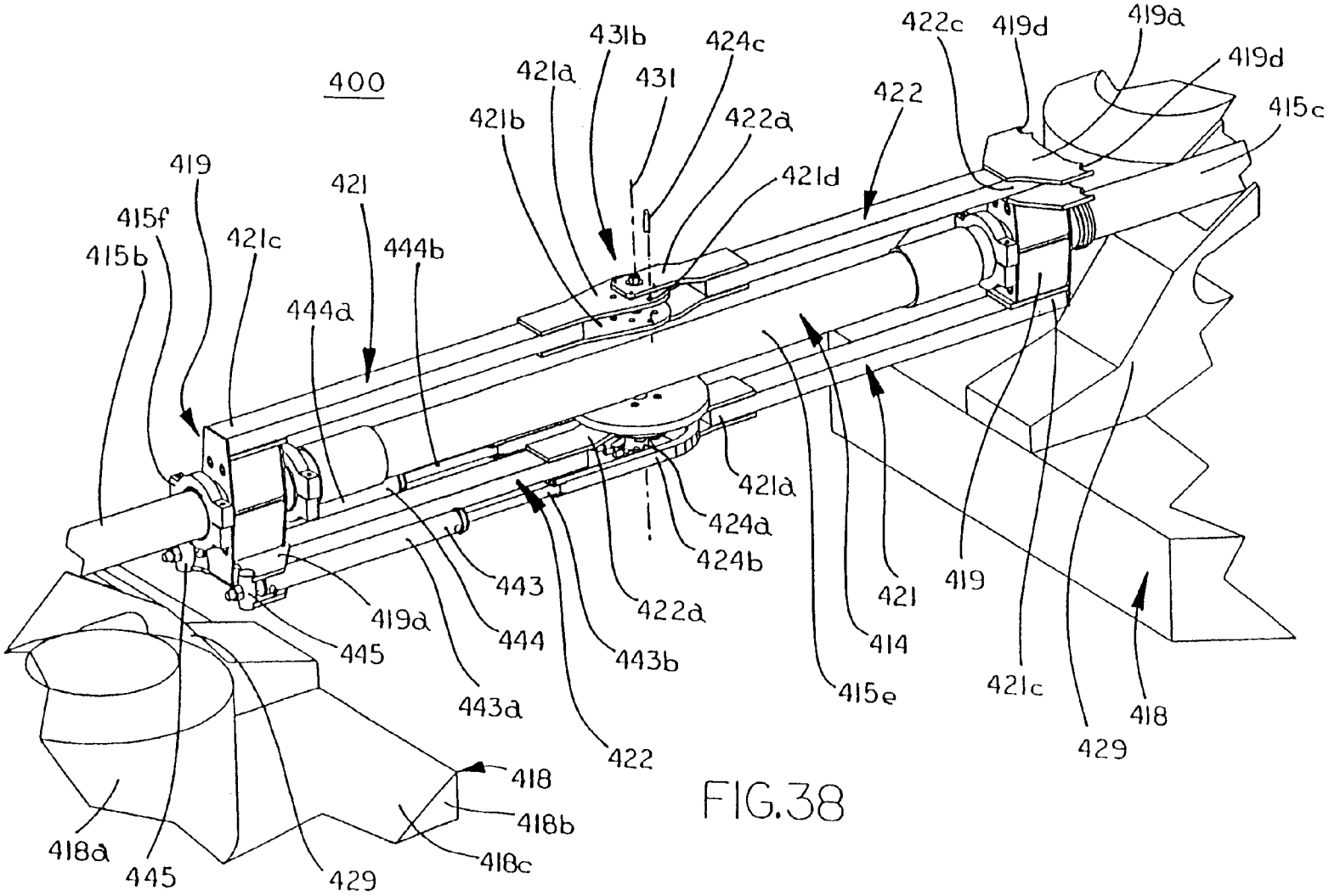
FIG. 38 is an enlarged view of one of the joints of the articulated tube assembly with the tube assembly in its extended or straightened orientation.

Each pipe section 415*a*, 415*b*, 415*c* and 415*d* is connected at one or both ends to a hose section 415*e* (FIGS. 35, 36 and 38), such that a hose section is connected to the opposed ends of each adjacent set of pipe sections. Each hose section 415*e* is secured to the respective end of the pipe sections via a clamp 415*f* or any other known clamping means. Hose sections 415*e* are flexible and allow the adjacent pipe sections 415*a*, 415*b*, 415*c* and 415*d* to pivot with respect to one another, as shown in FIGS. 35 and 36, and define respective joints 431*a*, 431*b* and 431*c*. As best shown in FIG. 38, pipe sections 415*b*, 415*c* and 415*d* are pivotable relative to each other about a generally vertical axis 431 at each joint 431*a*, 431*b* and 431*c* via flexing or bending tube sections 415*e*, which are vertically supported by a pair of pivotable linkages or members 421 and 422. Pivotable members 421 and 422 extend along each hose 415*e* and above and below each hose section 415*e* and are connected to the corresponding opposed ends of the adjacent pipe sections, such as 415*b* and 415*c*. Each joint 431*a*, 431*b*, and 431*c* is thus defined by a pair of upper pivotable members and a pair of lower members which are preferably substantially similar, such that only one set will be described in detail, with the other set being similarly mounted to placing apparatus 400. The pivotable linkages 421 and 422 are secured to the opposed ends of the adjacent pipe sections by a mounting member 419 clamped to each pipe section 415*a*, 415*b*, 415*c* and/or 415*d*. Each mounting member 419 comprises a mounting bracket structure 419*a* for mounting a powered actuating or extending device, such as a pair of hydraulic cylinders 443, 444, which are cooperatively operable to cause pivotable movement of the pipe sections, as discussed below. As shown in FIG. 38, the mounting bracket 419*a* may be positioned at an upper or lower end of each mounting member 419. The mounting members 419 may then be reversibly mounted at the opposed ends of the adjacent pipe sections to allow one set of hydraulic cylinders to be mounted above the hose 415*e* and a second set of hydraulic cylinders to be mounted below the hose 415*e*.

As is best seen in FIG. 38, each pivotable linkage 421, 422 comprises a substantially rigid beam or member, and is pivotally interconnected with the other linkage to define the vertical axis 431 positioned generally in the vicinity of a midpoint of each flexible tube 415*e*. Opposite ends 421*c*, 422*c* of members 421, 422 are fixedly secured to mounting members 419, while connecting ends 421*a*, 422*a* are pivotally secured together. Preferably, connecting end 421*a* of pivotable linkage 421 may be inserted within a forked connecting end 422*a* of linkage 422 and pivotably secured thereto. Preferably, one or both of the upper and lower pivotable members 421 further include a gear member 424*a*, which is fixedly secured at end 421*a* of pivotable member 421. Gear member 424*a* may be fixedly mounted to member 421 via insertion of the gear 424*a* within a slot or gap 421*b* of member 421, and insertion of pins 424*c* through a plurality of openings 421*d* in gear 424*a*, in order to pin or otherwise secure gear 424*a* within slot 421*b*. However, gear 424*a* may be mounted to member 421 via any other known means, without affecting the scope of the present invention.

Gear member 424*a*, and thus member 421, is rotatable relative to member 422 via the pair of hydraulic cylinders 443 and 444. Each hydraulic cylinder 443, 444 comprises a cylinder 443*a*, 444*a* and a rod end 443*b*, 444*b*, which is extendable and retractable relative to the respective cylinder via pressurized fluid, as discussed above with respect to hydraulic cylinder 32. A flexible belt 424*b* or chain linkage or the like is routed around gear member 424*a* and connected at each end to rod end 443*b*, 444*b* of hydraulic cylinders 443 and 444. Hydraulic cylinders 443*a* and 444*a* may be secured to mounting bracket 419*a* via engagement of a generally cylindrical mounting member 445 at an end of cylinders 443*a*, 444*a* with corresponding notches or recesses 419*d* formed in brackets 419*a* (FIG. 38). Hydraulic cylinders 443 and 444 cooperatively extend and retract, such that as rod end 444*b* of cylinder 444 extends, rod end 443*b* of hydraulic cylinder 443 correspondingly retracts, and vice-versa. Because gear member 424*a* is fixedly secured to structural member 421, while being pivotable relative to structural member 422, pulling on belt or chain 424*b* by either hydraulic cylinder 443 or 444 results in pivotal movement of gear 424*a* relative to member 422, which further results in pivoting of structural member 421 relative to member 422, and thus pivoting of the adjacent pipe sections and movable supports relative to one another. As shown at joint 431*a* in FIG. 35, both the upper and lower pair of pivotable linkages 421, 422 may include a gear member 424*a* and hydraulic cylinders 443 and 444, which cooperatively extend and retract to pivot pipe section 415*b* relative to pipe section 415*a*. The additional pair of hydraulic cylinders may be beneficial or necessary to generate enough pulling force at the belts or chains 424*b* to pivot all three movable air cushion supports 418 relative to fixed pipe section 415*a* and base unit 416 about the corresponding vertical axis 431 of joint 431*a*. As shown in FIG. 35, two pair of hydraulic cylinders may be positioned between the base unit and first movable support at joint 431*a*, while only one set may be required to pivot or move the other movable supports relative to one another at the outer joints 431*b* and 431*c*.

Base unit 416 of placing apparatus 400 is preferably substantially fixed relative to the support surface and supply tube 20. Base 416 preferably has two or more legs 416*a* which extend generally downwardly to support base 416 and supply end 414*a* of pipe section 415*a* of tube assembly 414 above the support surface. Preferably, legs 416*a* are adjustable, such as via a hand crank 416*b* or the like, such that the angle between the legs may be adjusted to correspondingly adjust the height at which base unit 416 supports the supply end 414*a* of tube assembly 414. The hand crank 416*b* may be threaded and one of the legs 416*a* may be correspondingly threaded, such that rotation of crank 416*b* pulls the legs toward each other or pushes them away in order to adjust the height of the base unit 416.

Figure 37:
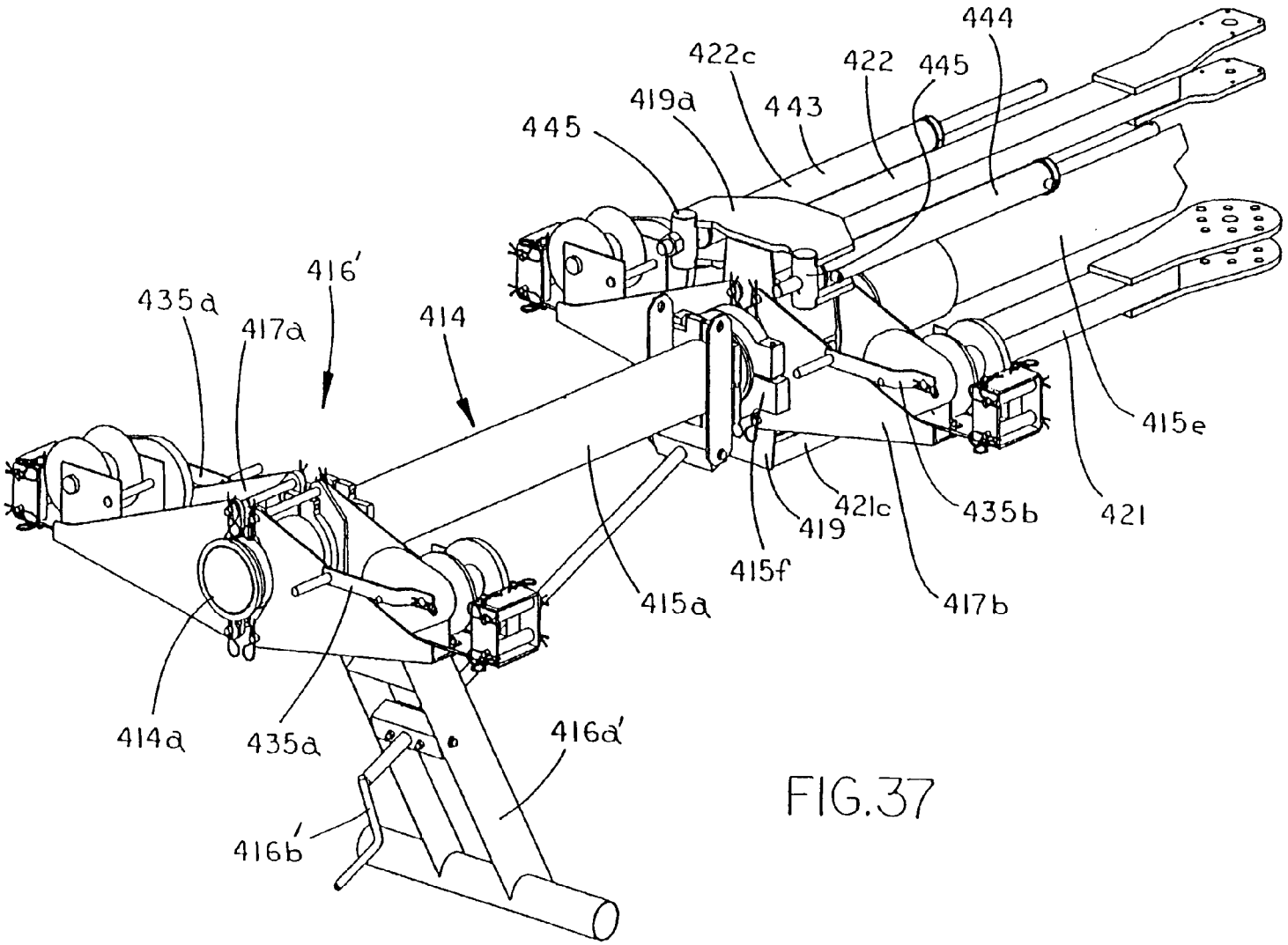
FIG. 37 is a perspective view of a base unit useful with the placing apparatus of FIG. 35.
Figure 42:
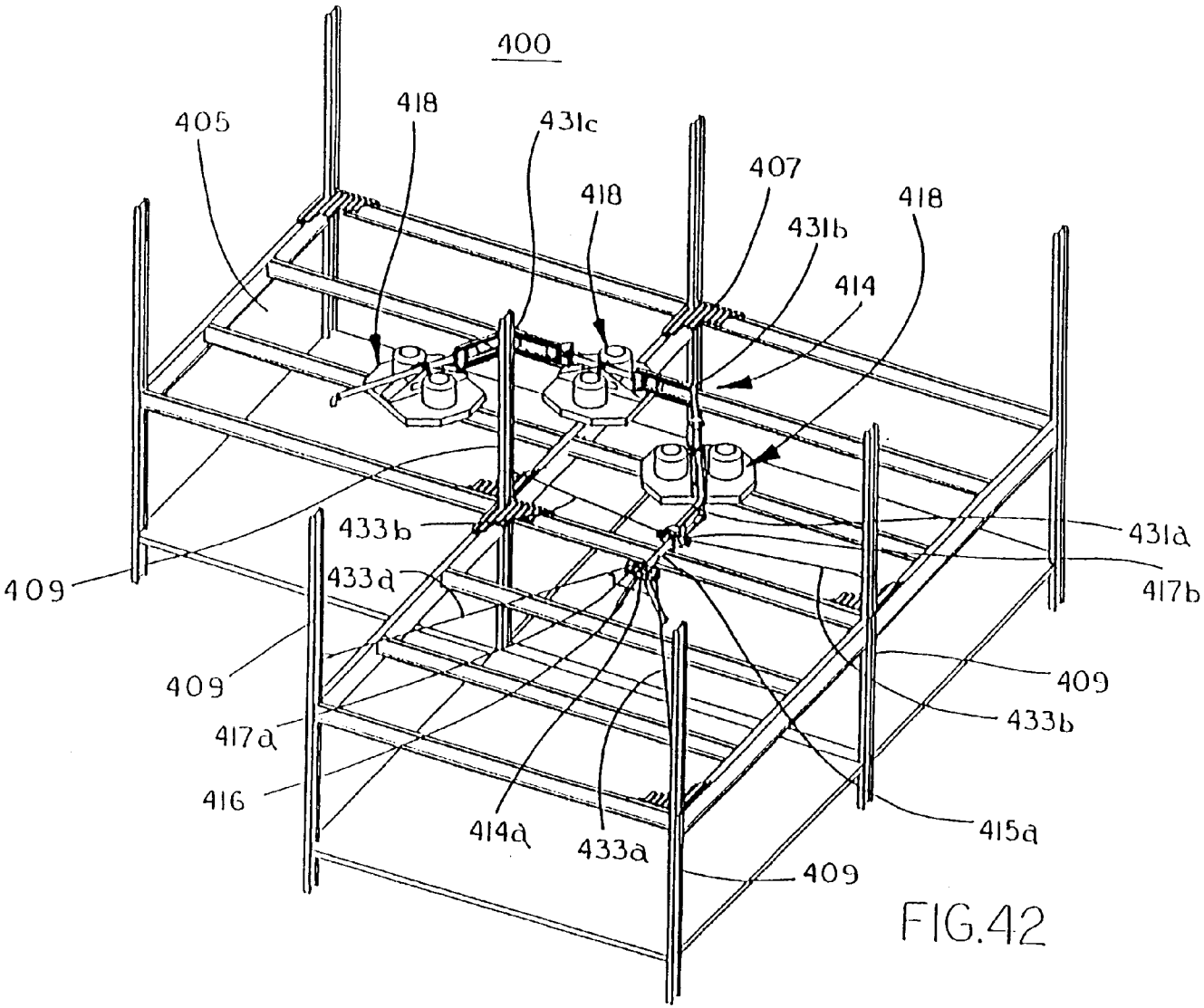
FIG. 42 is a perspective view of the placing apparatus of FIG. 35, as implemented on an elevated support surface.
Figure 43:
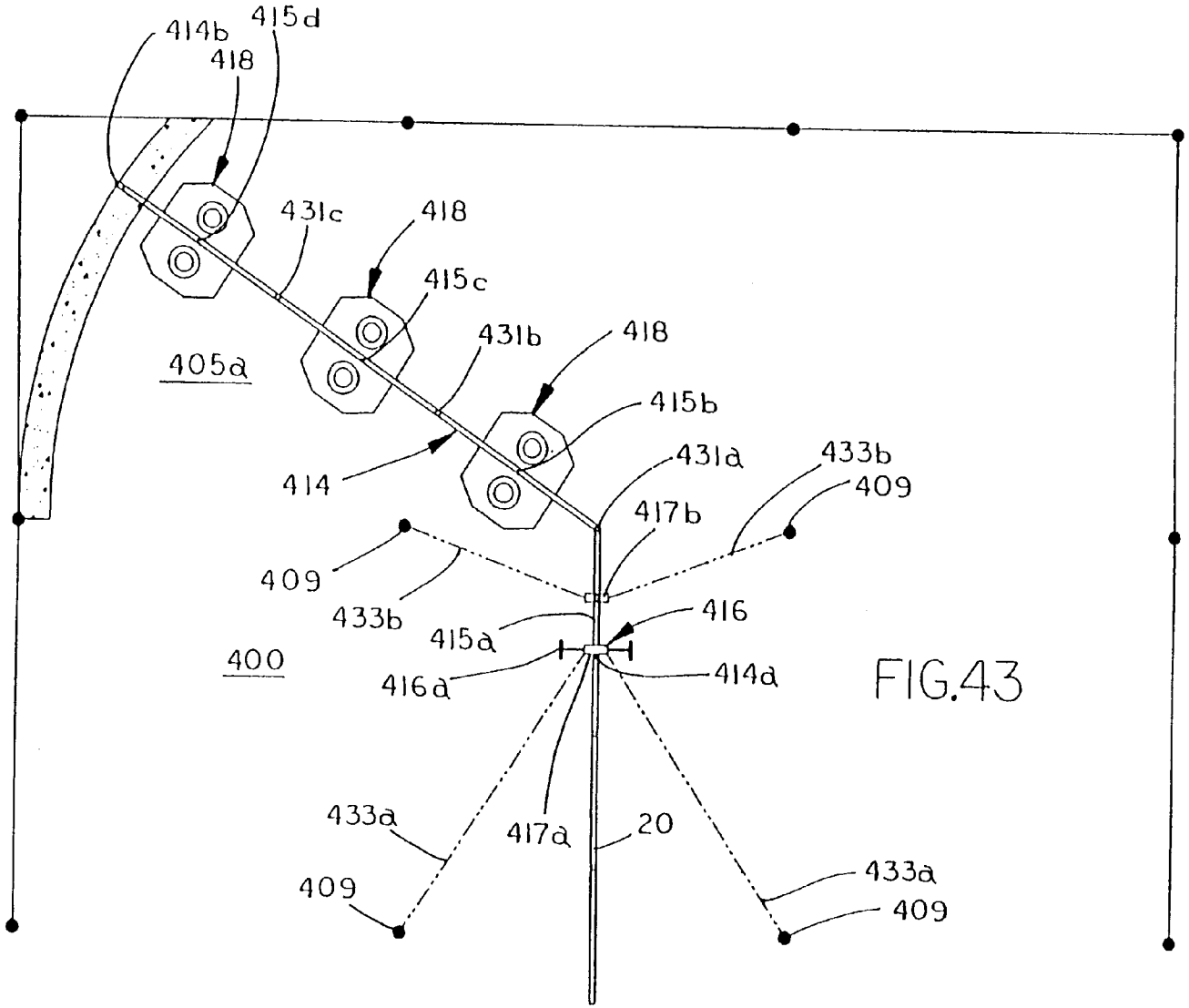
FIGS. 43–48 are plan views of the present invention and show a portion of the process for placing concrete in a targeted area.

Preferably, base 416 (FIGS. 35–37) is fixedly positioned at the support surface, such that supply end 414*a* and supply pipe section 415*a* of tube assembly 414 are substantially immobilized by base unit 416. Preferably, base unit 416 is secured via at least one restraining device 417*a* and/or 417*b* (FIGS. 35, 36 and 42–48). Preferably a pair of restraining devices 417*a* and 417*b* are mounted at supply pipe section 415*a* at or near opposite ends thereof. A base restraining device 417*a* includes a pair of cables 433*a* (FIGS. 36 and 42) extending therefrom. The cables 433*a* may be extended and retracted via corresponding hand cranks 435*a* (FIG. 37), such that the tension in the cables may be adjusted to substantially limit lateral movement of supply end 414*a* and thus secure base unit 416 in the selected position. As shown in FIG. 42, cables 433*a* may be secured to a fixed structure, such as steel columns 409 or the like, at the support surface. Preferably, a second restraining device 417*b* is mounted at an outer end of supply section 415*a* of tube assembly 414 and provides a second pair of cables 433*b* which extend outwardly from opposite sides of restraining device 417*b*. The cables 433*b* may be adjusted and tightened via rotation of corresponding hand cranks 435*b* at restraining device 417*b* (FIG. 37). By connecting cables 433*a* and 433*c* to fixed structures 409, and then tightening each cable by the associated hand cranks, the cables may be tightened to substantially preclude movement of base 416 relative to the support surface. As shown in FIG. 42, the cables may be secured to spaced apart structures, such that the pairs of cables extend in generally opposite longitudinal directions to further limit longitudinal movement of base 416 and supply pipe section 415*a*.

As shown in FIG. 37, a base unit 416' may alternately comprise a single leg 416*a*', which is adjustable relative to base 416' and pipe section 415*a* via a hand crank 416*b*' or the like to adjust the height of supply end 414*a* of tube assembly 414. Similar to base 416, a rearward restraining device 417*a* of base 416' is positioned at supply end 414*a* of tube 414, while a second restraining device 417*b* is positioned at an opposite outer end of supply section 415*a* of tube assembly 414. Preferably, the hand cranks 435*a* and 435*b* are common parts such that they may be reversibly mounted to each side of their respective restraining devices 417*a* and 417*b* at pipe section 415*a* and base 416 or 416', as shown in FIG. 37.

Method for Placing Concrete

Referring now to FIGS. 42–48, placing apparatus 400 may be implemented at an elevated surface 405 to place concrete at that surface. Because the movable air cushion supports 418 spread out the load of the units and pipe assembly, thereby reducing the pressure on the support surface, the air cushion supports may be implemented at a corrugated metal deck 407, such as the type typically used in construction of elevated slabs, without damaging the corrugated decking 407. The movable support units 418 move and support the tube assembly 414 over the deck as the placing apparatus dispenses and places concrete at a targeted area of the support surface 405.

When placing apparatus 400 is set up at a targeted location, base unit 416 is first secured relative to the targeted support surface by tightly securing cables 433*a* and 433*b* to fixed structures, such as vertical columns 409 of the building or structure, to substantially fix base unit 416 and prevent movement thereof as movable units 418 are pivoted relative to one another and base unit 416. As best shown in FIGS. 43–48, base unit 416, first restraining device 417*a* and second restraining device 417*b* are positioned relative to the columns 409 or other fixed structure such that cables 433*a* pull in one direction, while cables 433*b* pull in substantially the opposite direction, to prevent both lateral and longitudinal movement of pipe section 415*a* during placing of the concrete. The supply end 414*a* of fixed or supply pipe section 415*a* is connected to a supply pipe or hose 20, which provides a supply of uncured concrete to placing apparatus 400.

Initially, each joint 431*b* and 431*c* between the movable supports 418 may be substantially straight (FIG. 43), to allow maximum extension of discharge end 414*b* from base unit 416 and joint 431*a*. Concrete may then be placed along a generally arcuate path of a first targeted area 405*a* via pivotable movement about the first joint 431*a* between fixed pipe section 415*a* and the first movable support 418.

Figure 44:
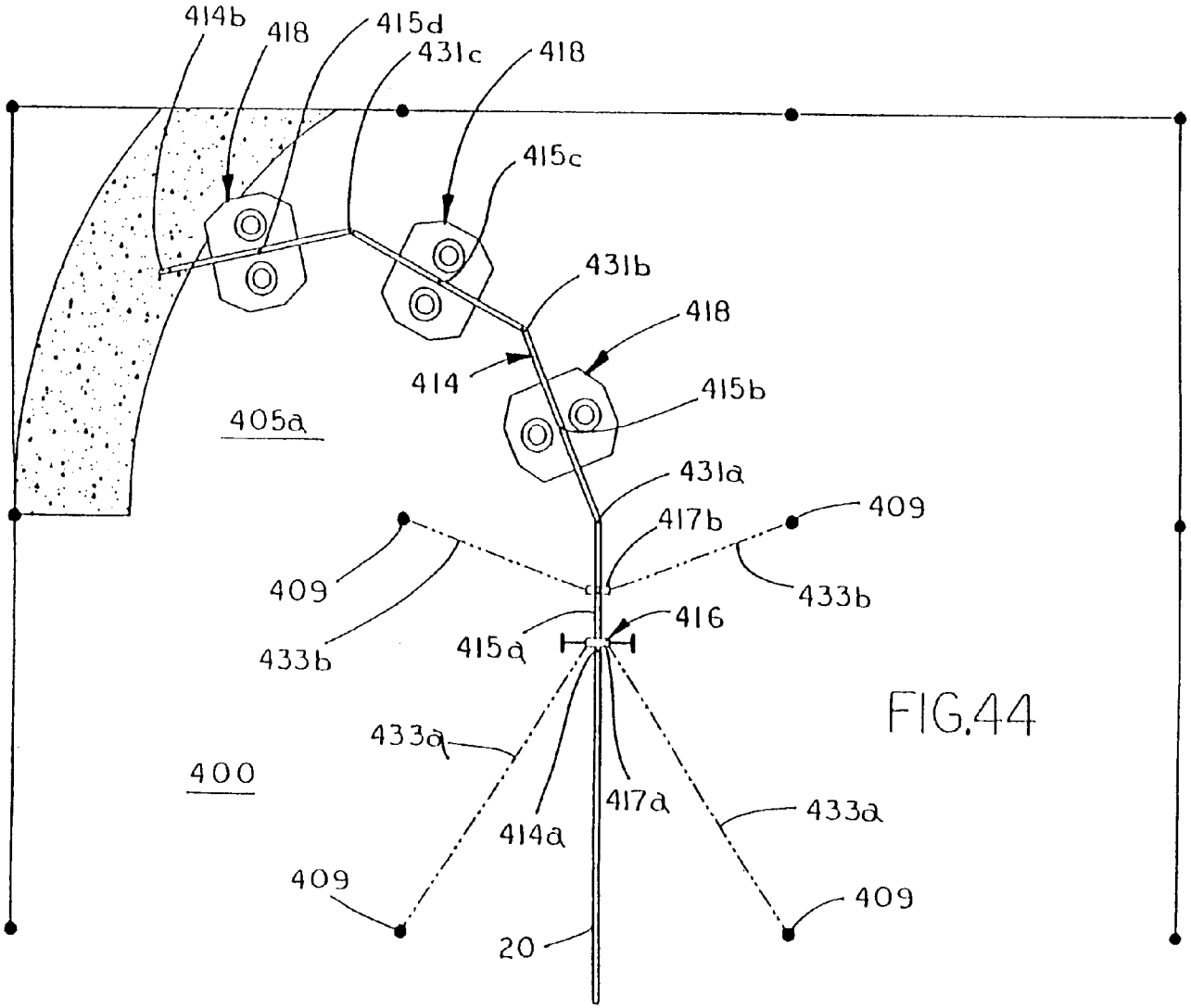
Figure 45:
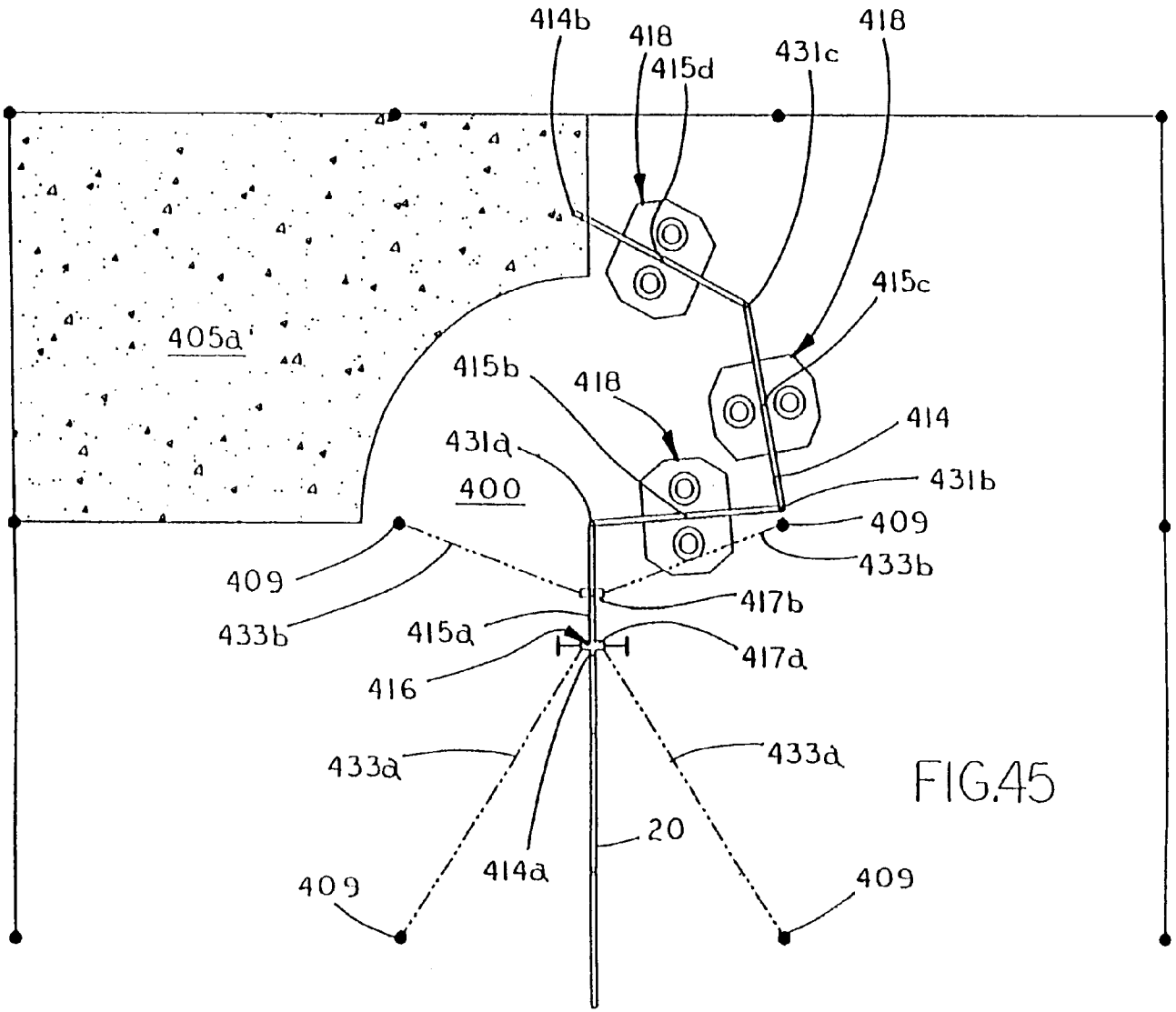
Figure 46:
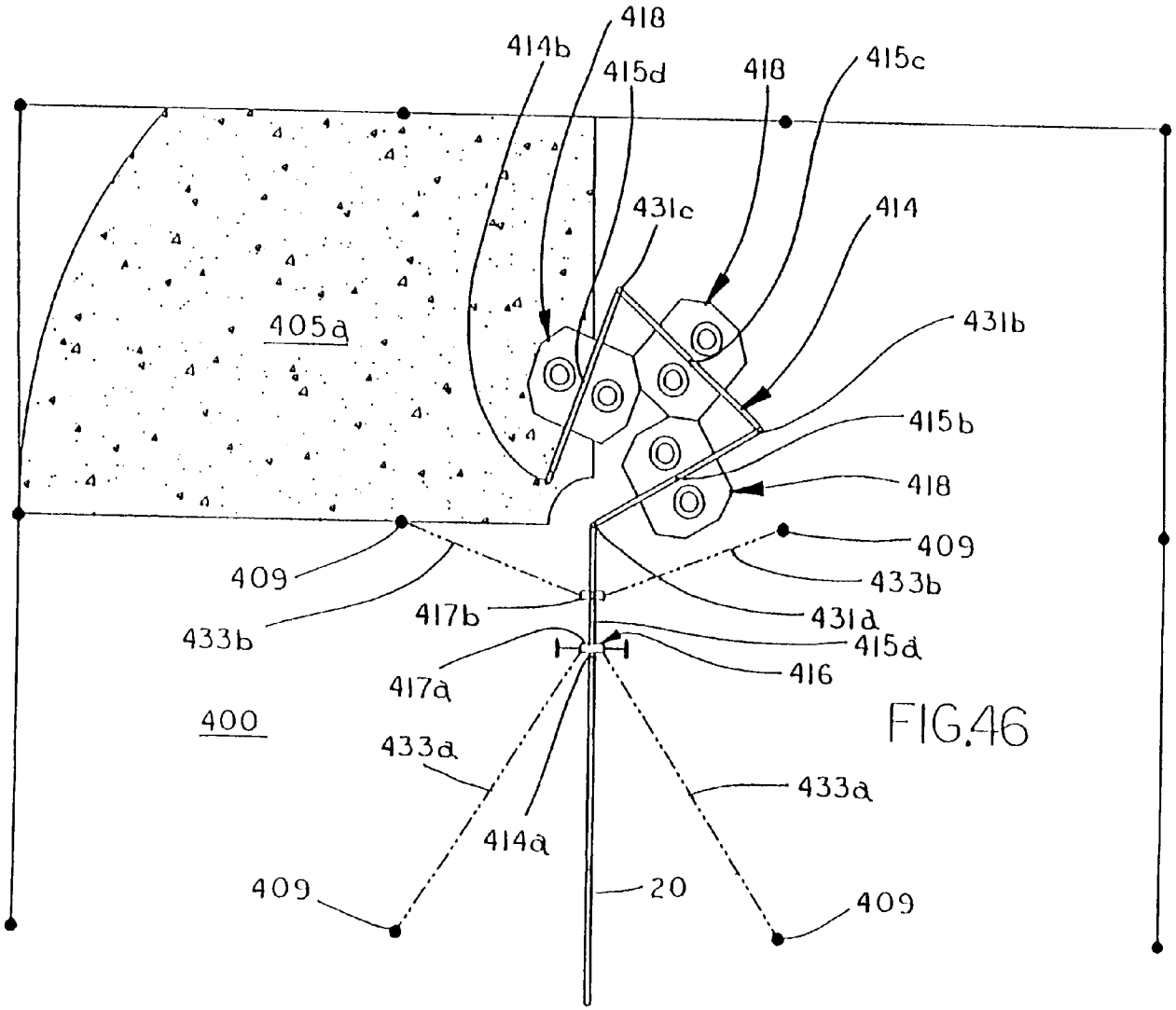

As shown in FIG. 44, after the concrete has been placed along the first arcuate path, one or both of the joints 431*b* and 431*c* may be angled to effectively shorten the extension of discharge end 414*b* from base unit 416 and joint 431*a*. Joint 431*a* is again pivoted to move discharge end 414*b* along a closer arcuate path to place concrete at a next inward region of the targeted support surface 405*a*. As shown in FIGS. 45 and 46, this process is repeated by further adjusting the angle between the respective movable units and pipe sections to further reduce the effective length of the tube assembly to shorten the distance of the discharge end 414*b* from base unit 416 and joint 431*a*. Joint 431*a* is again pivoted back and forth to again move discharge end 414*b* generally arcuately with respect to joint 431*a* to place concrete at a next inwardly position targeted area. As shown in FIG. 46, this process is repeated until joints 431*b* and 431*c* are pivoted to their maximum amount, whereby the first targeted area 405*a* of the support surface is substantially covered with the placed concrete.

Figure 47:
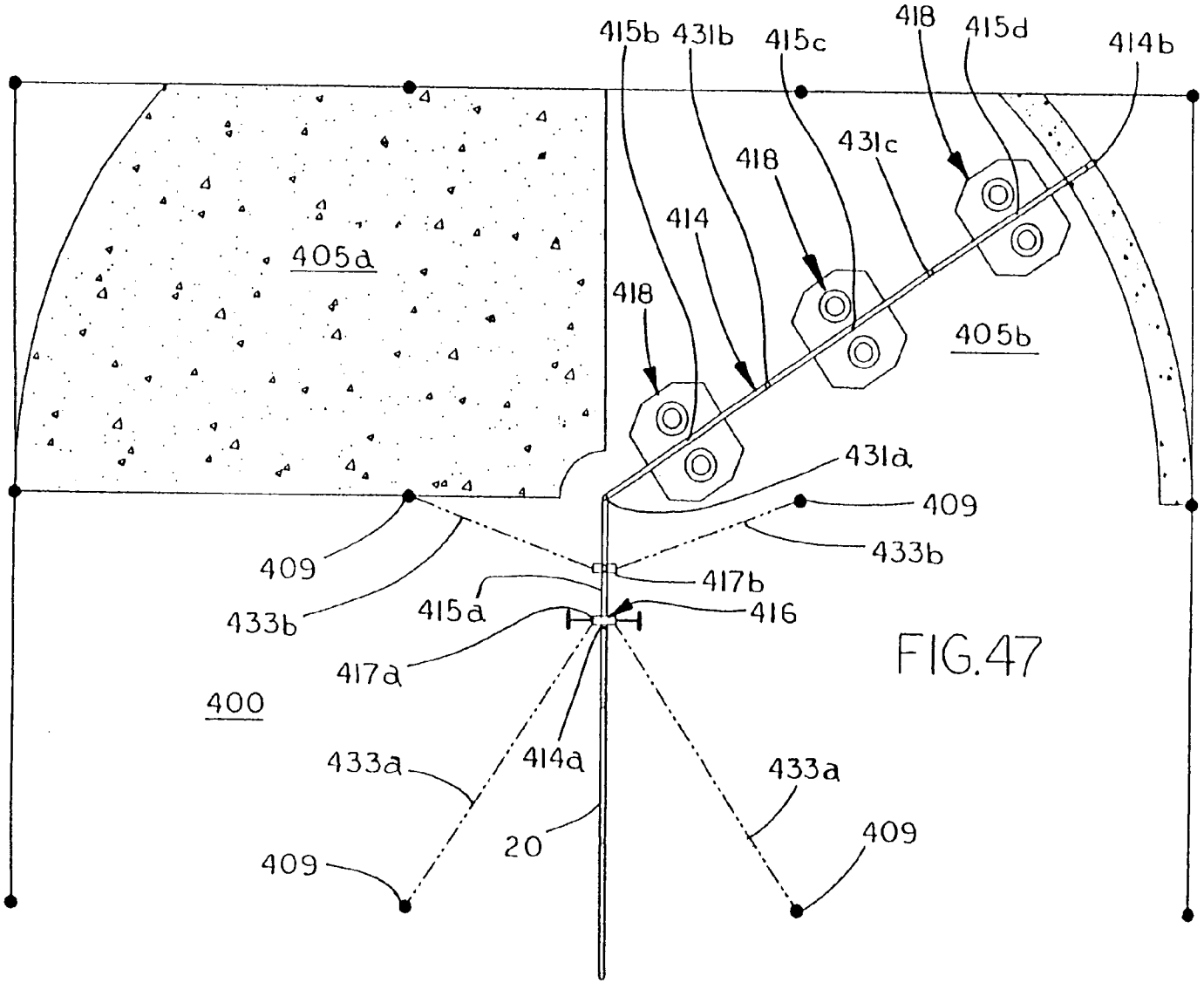
Figure 48:
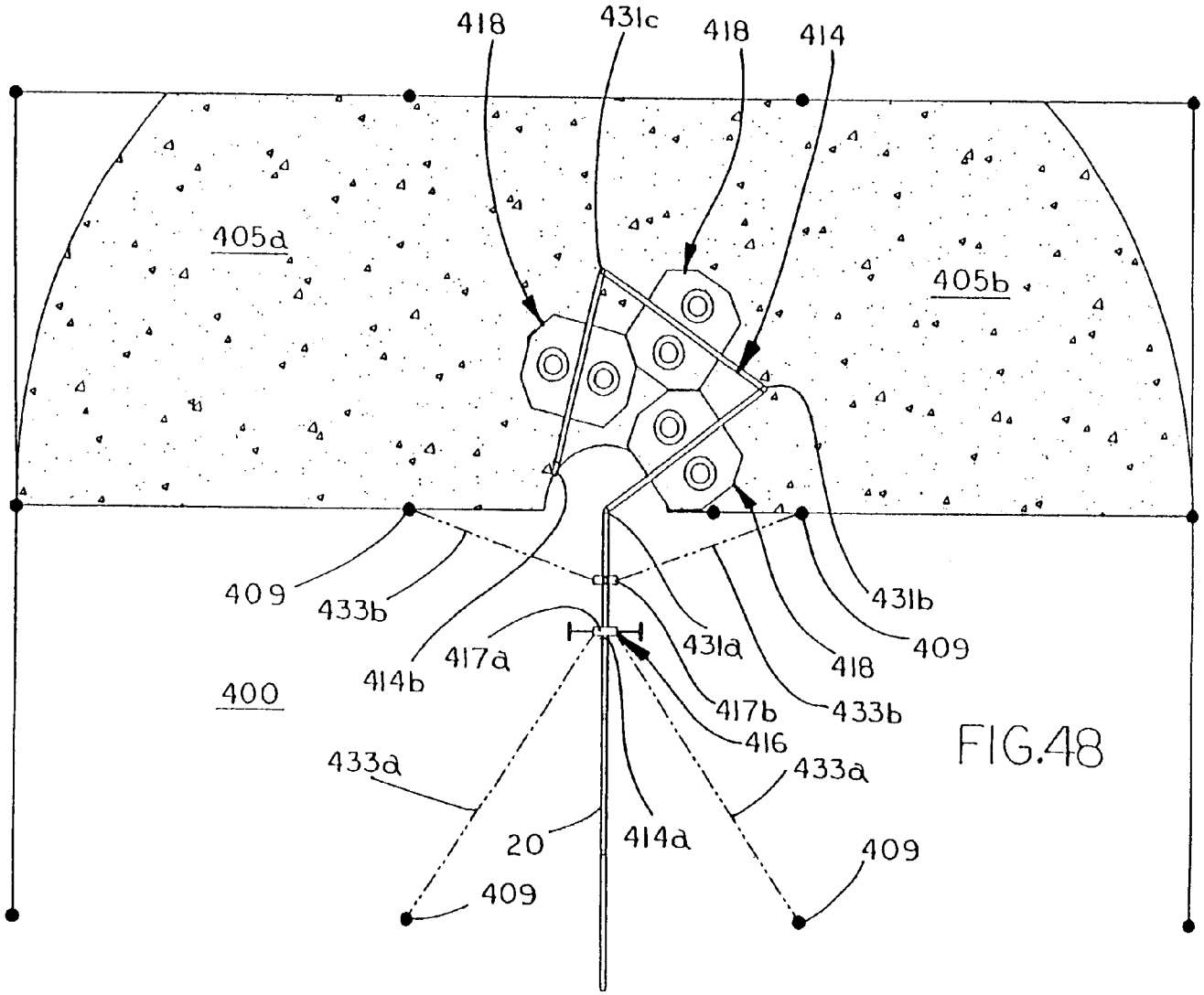

As shown in FIG. 47, the process may be continued at a next adjacent targeted area 405*b* by straightening out joints 431*b* and 431*c* to again extend discharge end 414*b* a maximum amount from inner joint 431*a* and base unit 416. Joint 431*a* may again be pivoted to place concrete at an outermost portion of the second targeted area 405*b*. The process described above with respect to FIGS. 44 through 46 is repeated for the second targeted area 405*b* until the entire area has been covered by the uncured concrete, as shown in FIG. 48. Cables 433*a* and 433*b* may then be loosened and then disconnected from the support structures. Supply end 414*a* of pipe assembly 414 may also be disconnected from supply line 20, such that base unit 416 may be repositioned to a next targeted area of the support surface.

Although the process is described above as including the steps of pivoting the outer joints 431*b* and 431*c* to set an effective distance between the discharge end 414*b* and joint 431*a*, and then pivoting joint 431*a* to arcuately move discharge end 414*b* relative thereto, the angular adjustment of the three joints for 431*a*, 431*b*, and 431*c* may be continuously adjusted while the tubes are travelling arcuately back and forth relative to the base unit. The dispensing end of the tube assembly provides concrete to every location within the targeted area, thereby uniformly distributing the concrete and substantially precluding the possibility of an insufficient amount of concrete being dispensed in any part of the targeted area of the support surface. The hydraulic cylinders 443, 444 of the apparatus may be remotely controllable or may be controlled via a programmable control to automatically move the movable supports and discharge end of the tube through a programmed process, such as the process described above, without any manual intervention. The uncured concrete being placed by discharge end 414*b* may also be controlled by a valve (not shown) in pipe assembly 414, such that the entire placing process may provide a uniform distribution of concrete throughout the entire targeted area with little or no manual intervention once the placing apparatus has been set up.

Flexible Tube Assembly

Figure 49:
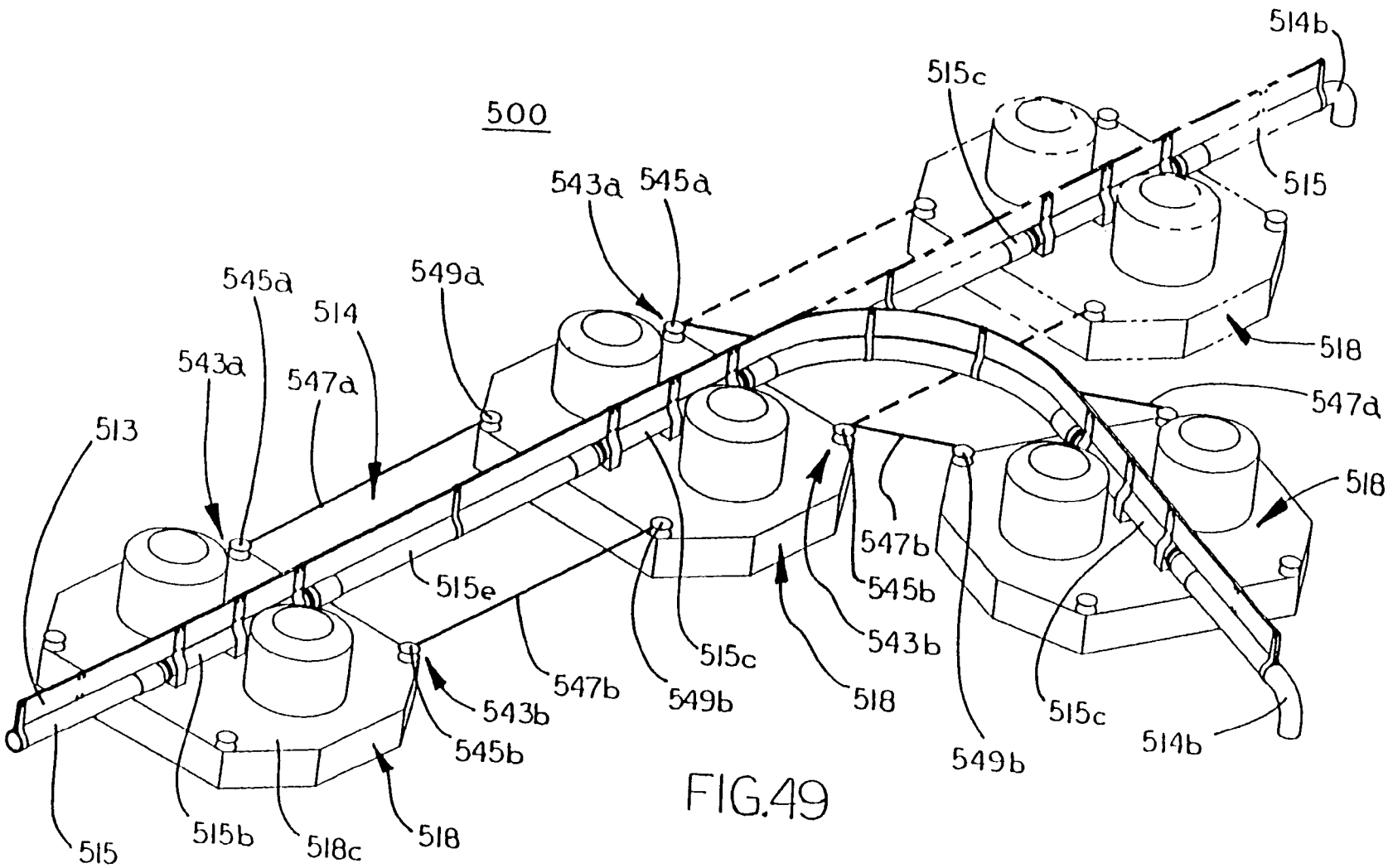
FIG. 49 is a perspective view of yet another embodiment of the present invention, with a flexible tube assembly being supported by multiple air cushion support units.

Referring now to FIG. 49, an alternate placing apparatus 500 comprises a plurality of movable air cushion supports 518, which movably support a pipe assembly 514. Preferably, pipe assembly 514 is connected to a base unit (not shown), such as a base unit of the types discussed above, and provides uncured concrete to a support surface via a discharge end 514*b*. The movable air cushion supports 518 are substantially similar to those of placing apparatus 400, discussed above, such that a detailed discussion will not be repeated herein. However, each air cushion support 518 includes a pair of winch systems 543*a* and 543*b* at at least one end of the support 518 and on generally laterally opposite sides of the air cushion support. The winch systems 543*a*, 543*b* include a spool or reel 545*a*, 545*b* and a cable 547*a*, 547*b*, respectively, and a powered winch or winding device (not shown), which is operable to extend and retract the respective cable, as discussed below. Air cushion supports 518 further include a spool or cleat 549*a*, 549*b* at an end opposite the winch systems 543*a*, 543*b* for securing an end of the cables 547*a*, 547*b* from the next adjacent support thereto.

Tube assembly 514 comprises a flexible hose or tube 515 and is secured along an upper surface 518*c* of each movable support 518. The tube assembly 514 may comprise a single, long flexible tube or hose fixedly secured to upper surface 518*c* of each movable support 518 or may comprise multiple pipe sections 515*b*, 515*c* and 515*d* mounted to the upper surface 518*c* of a respective support 518 and interconnected with one another via a flexible tube or hose assembly 515*e*, similar to pipe assembly 414, discussed above. The tube assembly 514 further includes a flexible beam member 513 which extends along tube assembly 514, such as along an upper surface of the tubes 515*e*, as shown in FIG. 49. Flexible beam 513 is flexible in the generally horizontal direction, such that the movable supports may move laterally or pivot relative to one another, yet is substantially rigid and resistant to flexing in a vertical direction. Preferably, the flexible beam is a ½"×12" beam comprising an ultra high molecular weight (UHMW) plastic, which provides flexibility in the horizontal plane, while providing substantial support or rigidity in the vertical plane. The tube assembly 514 thus vertically supports the tube or hose 515 and allows for pivotable movement of the movable supports 518 and discharge end 514*b* of tube assembly 514 relative to the other movable supports 518 and the base unit via generally horizontal flexing of the tube between each adjacent pair of movable supports.

Pivotable movement of the adjacent movable supports relative to one another preferably is accomplished via cooperative extension and retraction of cables 547*a* and 547*b* by winch systems 543*a* and 543*b*, respectively. Cables 547*a* and 547*b* extend from spools 545*a* and 545*b*, respectively, and are connected at opposite ends to cleats 549*a*, 549*b* at corresponding sides of the next adjacent movable support. Preferably, the cables 547*a*, 547*b* are wound about their respective spools 545*a*, 545*b*, which are rotatable via the winches to extend and retract the cables, 547*a* and 547*b*. The winches are cooperatively operable to extend one cable 547*a* while correspondingly retracting the other cable 547*b*, such that the operation of the winches causes pivotal movement of one movable support relative to another, as shown in FIG. 49. Tube 515 flexes horizontally as one cable 547*b* pulls at a side of the movable support, while the other cable 547*a* is extended or unwound, thereby allowing the movable supports to pivot relative to one another.

Placing apparatus 500 is operable in substantially the same manner as placing apparatus 400 discussed above. The movable supports are pivoted relative to one another via extension and retraction of the connecting cables, while the tube assembly 514 and movable supports 518 are also pivoted relative to a base unit to place concrete throughout a targeted area of the support surface. Because the tube assembly of placing apparatus 500 includes a flexible hose or tube and flexible beam, and does not include the multiple pipe sections, gear members and brackets of placing apparatus 400, placing apparatus 500 provides a lower cost and less complex means for placing concrete at the targeted area, while still providing the benefits of the air cushion supports. The flexible hose also provides a reduced mass of the placing apparatus.

Articulated Wheeled Placing Apparatus

Figure 50:
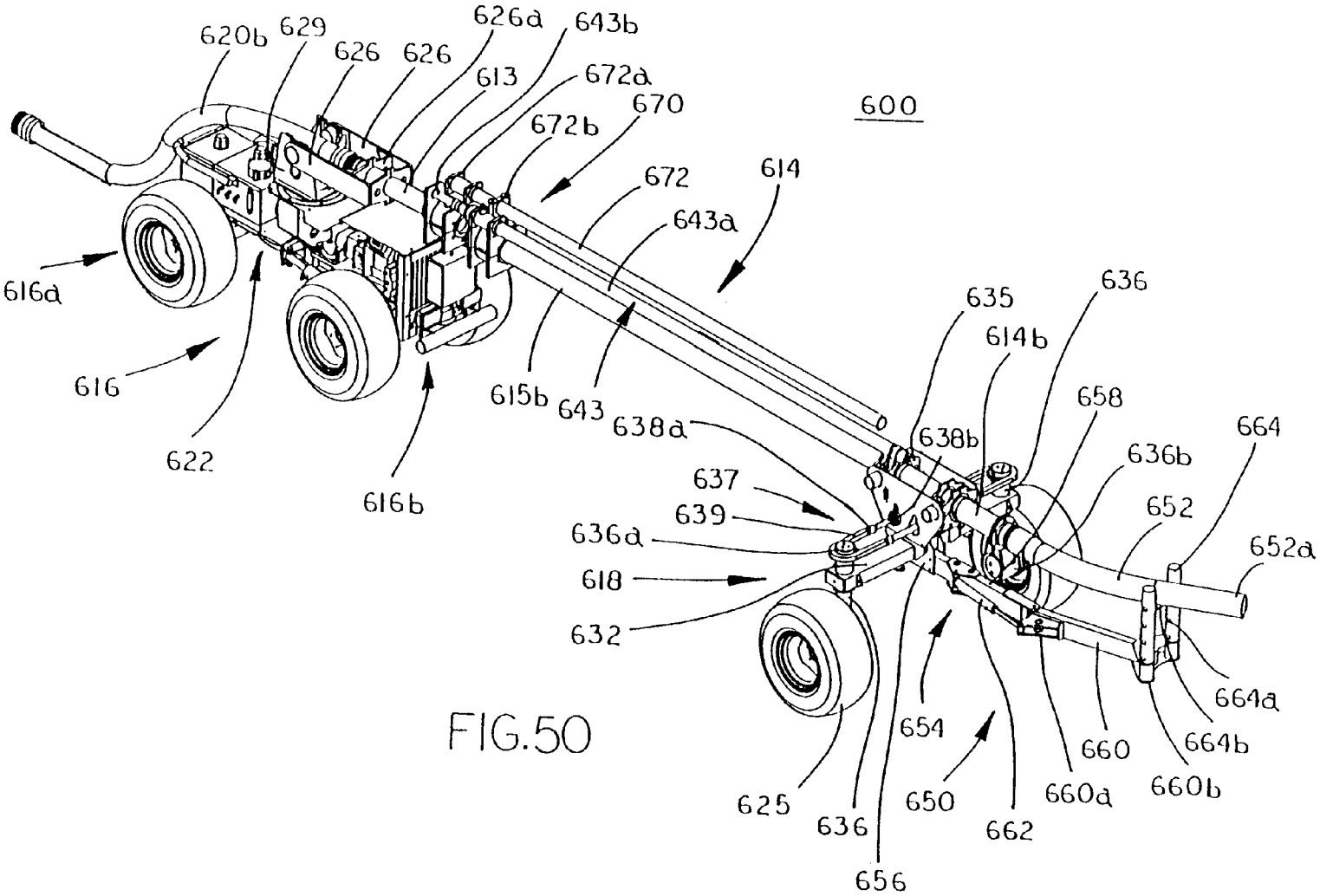
FIG. 50 a perspective view of another embodiment of the present invention, with a telescoping tube assembly supported by an articulating, wheeled base unit and a steerable wheeled movable support.
Figure 52:
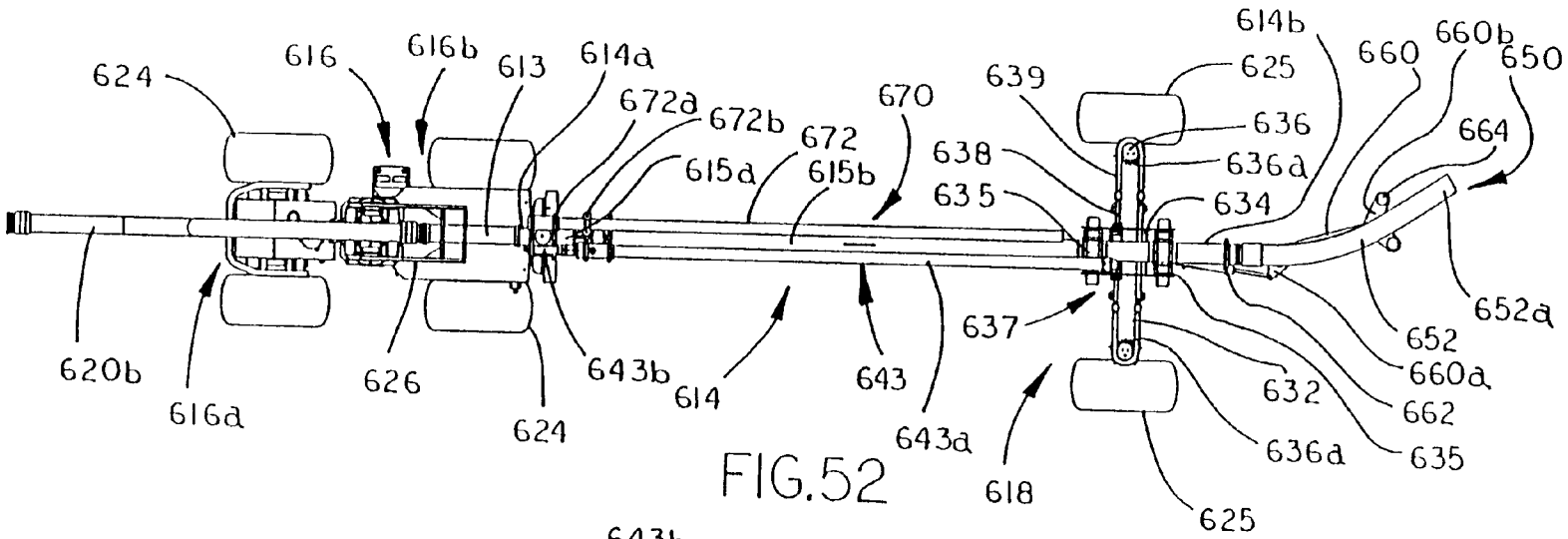
FIG. 52 is a top plan view of the embodiment of FIGS. 50 and 51.
Figure 51:
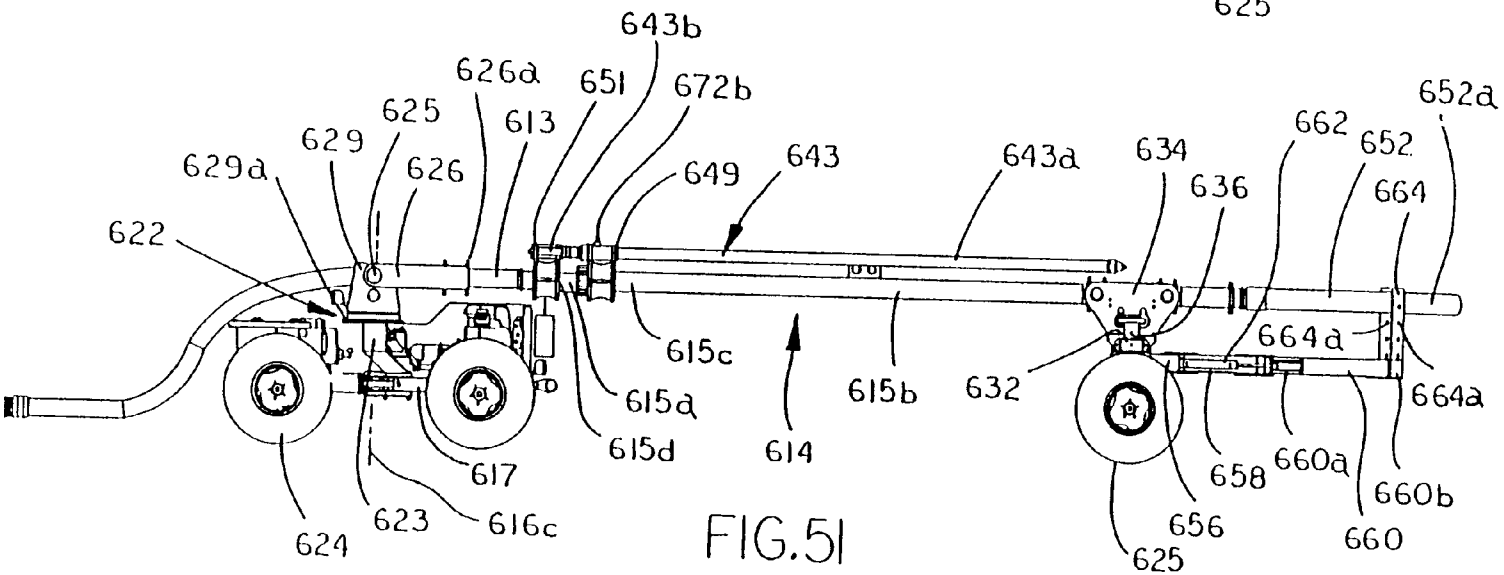
FIG. 51 is a side elevation of the embodiment of FIG. 50.

Referring now to FIGS. 50–52, a concrete placing apparatus 600 comprises a wheeled base unit 616, a wheeled movable support 618 and an extendable and retractable pipe assembly 614 supported thereon. Pipe assembly 614 is supported at or near a discharge end 614*b* by movable support 618 and at a supply end 614*a* by the wheeled base unit 616. Supply end 614*a* is connected to a connector pipe 613, which is pivotally mounted to base unit 616 at a rotatable trunnion 629 of base unit 616, as discussed below. The other end of the connector pipe 613 is connectable to a flexible supply hose or tube 620*b*, which is further connectable to the supply pipes and the pumping truck or concrete supply (not shown in FIGS. 50–52). Additionally, the discharge end 614*b* of pipe assembly 614 is connected to a discharge tube assembly 650 which is bendable or movable relative to discharge end 614*b* to place concrete in an arcuate path with respect to discharge end 614*b* of pipe assembly 614, as discussed below.

In the illustrated embodiment, pipe assembly 614 is a telescoping conduit, similar to pipe assembly 214, discussed above, such that a detailed discussion will not be repeated herein. Briefly, pipe assembly 614 includes an inner pipe or tube 615*a* and an outer pipe or tube 615*b*, which slidably receives inner pipe 615*a* therewithin as outer pipe 615*b* is extended and retracted relative to inner pipe 615*a*. Extension and retraction of pipe assembly 514 is preferably accomplished by an hydraulic cylinder 643, similar to hydraulic cylinder 243, discussed above with respect to placing apparatus 200. Hydraulic cylinder 643 includes a cylinder portion 643*a* and an extendable and retractable piston rod portion 643*b*, which is extendable and retractable within and along cylinder 643*a* via pressurized hydraulic fluid. Cylinder portion 643*a* is mounted at an inner end 615*c* of outer pipe 615*b* via brackets 649, while an outer end of piston or rod 643*b* is secured at an inner end 615*d* of inner pipe 615*a* via brackets 651. Accordingly, extension and retraction of rod 643*b* relative to cylinder 643*a* causes a corresponding extension and retraction of outer pipe 615*b* relative to inner pipe 615*a*. Additionally, suitable seals (not shown) are assembled within tube assembly 614 to prevent concrete from leaking out of the tubing assembly as the sections 615*a* and 615*b* slide in and out relative to one another.

Pipe assembly 614 also includes an anti-twist or anti-rotation device 670 which functions to limit or substantially preclude rotation or twisting of one of the pipe sections 615*a*, 615*b* relative to the other about their longitudinal axes. Anti-twist device 670 includes an elongated member 672, such as a hollow cylindrical pipe as shown in FIGS. 50 and 52, which extends alongside and generally parallel to pipe sections 615*a*, 615*b*, an inner pipe section mounting bracket or collar 672*a* and an outer pipe section slidable support or collar 672*b*. Elongated member 672 is fixedly secured to inner pipe section 615*a* at an inner end of member 672 by bracket 672*a*, while collar 672*b* is mounted or secured to the inner end of outer pipe section 615*b* and slidably mounted or connected to elongated member 672. Accordingly, as outer pipe section 615*b* is extended or retracted relative to inner pipe section 615*a*, collar 672*b* slides along member 672, while the inner end of the member 672 remains secured at inner pipe section 615*a*. Because elongated member 672 extends at least partially along pipe sections 615*a*, 615*b* and is offset from their longitudinal axes, member 672 and brackets or collars 672*a*, 672*b* substantially preclude twisting or rotating of pipe sections 615*a*, 615*b* relative to one another as the base unit 616 and/or the movable support 618 maneuver over uneven support surfaces and the like.

Wheeled base unit 616 is an articulated wheeled vehicle which is movable along the support surface by wheels 624. The articulated vehicle 616 includes a rear portion 616*a* and a front portion 616*b*, which are pivotable relative to one another about a generally vertical pivot or axis 616*c* (FIG. 51). Each of the wheels 624 of the base unit 616 are hydraulically driven via independently operable hydraulic motors or the like (not shown), and the unit 616 is articulated for steering to minimized tire scrubbing on the deck surfaces while placing apparatus 600 travels over the support surface or deck. An actuator 617 (FIG. 51), such as an hydraulic cylinder or hydraulic motor, is preferably provided at one of the front and rear portions and is operable to pivot front portion 616*b* relative to rear portion 616*a* about pivot axis 616*c*, such that the articulated vehicle pivots or bends at its middle region to turn the vehicle as the vehicle is moved along the support surface. Actuator 617 may be an hydraulic cylinder connected to a lever arm of one of the front and rear portions, 616*b* and 616*a*, respectively, such that extension or retraction of the cylinder creates a moment arm at the lever and thus causes pivotal movement of one or both portions 616*b*, 616*a* about the axis 616*c*. Turning of the vehicle 616 may also or otherwise be accomplished via independent driving of one or more of the wheels 624 relative to the others via the hydraulic motors at each wheel, without affecting the scope of the present invention.

Front portion 616*b* of articulated vehicle 616 includes a pipe assembly support 622, which includes a lower column 623 and trunnion 629 at the upper end of column 623. Trunnion 629 is pivotally mounted to support column 623 via a turntable bearing 629*a* (FIG. 51) or the like, such that connector pipe 613 and pipe assembly 614 are pivotable about the generally vertical axis 616*c* at the center region of articulated vehicle 616. A pair of mounting arms 626 support connector pipe 613 at a pair of mounting brackets or flanges 626*a* and are pivotally mounted to trunnion 629 via a pair of axles or pins 625, such that mounting arms 626 are pivotable about a generally horizontal axis defined by pins 625 with respect to trunnion 629 and articulated vehicle 616. Trunnion 629 extends upwardly a sufficient amount to provide clearance of mounting arms 626 and connecting pipe 613 over an upper portion of the articulated vehicle 616, in order to avoid interference between the vehicle 616 and pipe assembly 614 as the pipe assembly 614 is pivoted about pivot axis 616*c* at turntable 629*a*.

The rear or base unit 616 is thus operable to support and carry or drag the flexible concrete supply line 620*b* as the placing apparatus 600 is moved throughout the targeted area. The trunnion 629 and turn table bearing 629*a* allow the wheeled vehicle or tractor to rotate nearly 360 degrees under the concrete delivery lines for maneuvering the base unit about the targeted area, and further allow the pipe assembly 614 to be pivoted about the generally vertical axis via movement of movable support 618, as discussed below.

Movable support 618 includes a frame or cross member 632, which supports a pipe mounting frame 634 thereon, and a pair of wheels 625, one at each of the opposite sides of the cross member 632. Pipe support frame 634 extends upwardly from cross member 632 and supports the outer end 614*b* of pipe assembly 614 via one or more collars or brackets 635 secured or clamped at a desired location along outer pipe 615*b*.

Movable support 618 further includes a pair of vertical wheel mounts 636, which are pivotally or rotatably mounted at the lateral ends of cross member 632 and extend downwardly therefrom. Wheels 625 are rotatably mounted to the lower ends of wheel mounts 636 and are steerable via rotation of wheel mounts 636 relative to cross member 632. Wheels 625 are preferably individually rotatably drivable via an hydraulic motor 636*b* (FIG. 50) at the lower end of each vertical wheel mount 636, such that the movable support 618 may be driven in the desired direction to move discharge end 614*b* of pipe assembly 614 in a generally arcuate path about articulated vehicle 616. Additionally, movable support 618 may be movable via extension and retraction of pipe assembly 614 without operating hydraulic motors 636*b* by allowing wheels 625 to freely rotate as the pipe assembly is extended or retracted.

In the illustrated embodiment, rotation of vertical mounts 636 relative to cross member 632 is accomplished via a steering system 637, which includes a double-ended hydraulic cylinder 638, a chain or belt 639 and a pair of sprocket or gear members 636*a*, one mounted at the upper end of each of vertical wheel supports 636. Hydraulic cylinder 638 is mounted to pipe support frame 634 and extends laterally outwardly therefrom. Hydraulic cylinder 638 includes a pair of piston rods 638*a* extending from opposite ends of a cylinder portion 638*b*. An outer end of each piston rod 638*a* is connected to one of the ends of chain or belt 639, such that movement of the rod assembly 638*a* in either direction pulls the chain or belt 639 about the sprocket wheels 636*a*, thereby causing rotation of sprockets 636*a* with respect to cross member 632, and thus turning of wheels 625 in either direction with respect to cross member 632. Preferably, vertical wheel supports 636 extend downwardly from cross member 632*a* sufficient amount to allow maximum turning of the wheels 625 with respect to cross member 632, without interference between wheels 625 and cross member 632. Accordingly, the degree of turning or pivoting of the wheel mounts 636 is dependent on the stroke of the hydraulic cylinder 638 and the size of the sprockets 636*a*, and is not limited by interference of the wheels 625 with the cross member 632 of movable support 618. Although shown as a double-ended hydraulic cylinder, clearly other means for imparting rotation or pivoting of wheels 625 about a generally vertical axis with respect to cross member 632 may be implemented without affecting the scope of the present invention.

Concrete placing apparatus 600 further includes discharge tube assembly 650, which is connected to the discharge end

614*b* of tube assembly 614 and is operable to further direct the concrete being placed at the support surface to a particular targeted location. Discharge tube assembly 650 includes a flexible tube portion 652 which is connected to discharge end 614*b* of tube assembly 614, and an articulating support 654, which supports flexible tube 652 and is bendable in either direction to flex or bend tube 652 such that a discharge outlet 652*a* of tube 652 is swept through an arcuate path relative to discharge end 614*b* of pipe assembly 614 for discharging concrete along the path.

Articulating support 654 is mounted at or secured to cross member 632 of movable support 618 and includes a mounting portion 656, a mounting arm 658 extending from mounting portion 656 in a forwardly direction, and a pivoting or articulating support 660 which is pivotally mounted at an end of arm 658. An actuator, such as hydraulic cylinder 662, is mounted between mounting portion 656 and a bracket 660*a* extending laterally from support 660. Bracket 660*a* provides a bell crank mounting arrangement for hydraulic cylinder 662, such that extension or retraction of hydraulic cylinder 662 causes pivotal movement in either direction of support 660 about a generally vertical pivot axis at the forward end of mounting arm 658 for support 660.

An outer end 660*b* of support 660 includes a pair of vertical supports 664 extending upwardly therefrom. Vertical supports 664 include multiple mounting openings 664*a* therein or therethrough, which receive one or more mounting pins 664*b*, for mounting and supporting the outer end 652*a* of flexible tube 652, while the upper portions of the vertical supports 664 function to guide the tube 652 in either side to side direction as support 660 is pivoted via extension and retraction of hydraulic cylinder 662. The multiple openings 664*a* of vertical supports 664 allow for vertical adjustment of the outer end of discharge tube 652, via insertion of the mounting pin 664*b* in different openings along vertical supports 664, in order to vertically adjust the angle at which the concrete is discharged from the tube. This allows the discharge end 652*a* to be raised so that the operator may use the pressure and momentum of the pumped concrete to shoot or discharge the concrete as it emerges from the nozzle or discharge end 652*a* a short distance into areas that cannot otherwise be fully reached by the placing apparatus 600.

Preferably, placing apparatus 600 is easily disassembled and reassembled to ease transport of the various components to a targeted support surface, which may be at an elevated deck of a building or the like. Concrete placing apparatus 600 thus provides a maneuverable placing apparatus which may be easily disassembled and assembled for cleaning and for transporting and moving the apparatus between and at targeted support surfaces or decks. Preferably, the machine is designed such that the components fit into standard sized man lift elevators commonly found at construction sites, whereby the components may be individually moved to an upper or lower deck level and assembled for use at that deck level. Once assembled, the placing apparatus 600 is connectable to the concrete supply pump via hoses or tubes and is then operable to place the concrete at the targeted areas.

After assembly of placing apparatus 600 at a support surface, placing apparatus 600 is movable to a targeted location via driving and steering of articulated vehicle 616 and/or driving and steering of movable support 618. When positioned at the targeted location of the support surface, flexible supply tube 620*b* is connected to supply end 613*b* of connector pipe 613 and further connected to the supply tubes or pipes (not shown). Hydraulic cylinder 643*a* may then be extended to extend pipe assembly 614 outwardly via free rolling or corresponding driving movement of movable support 618 along the support surface. Alternately, movable support 618 may be driven away from base unit 616 to pull outer pipe 615*b* outwardly along inner pipe 615*a* to move the discharge end 614*b* of pipe assembly 614 to its extended position. As concrete is placed at the support surface, wheels 625 may be turned and driven in a desired direction, to move discharge end 614*b* of pipe assembly 614 in a generally arcuate path about pivot axis 616*c* of base unit 616. Discharge assembly 650 may also be actuated to sweep discharge end 652*a* of discharge tube 652 back and forth through a smaller, generally arcuate path about the discharge end 614*b* of pipe assembly 614. Similar to the above discussed placing processes, pipe assembly 614 may be partially retracted after each pass or sweep of the discharge end 614*b* of the pipe assembly 614, such that the next sweep of the pipe assembly 614 covers a different area of the support surface. After concrete has been placed at the entire targeted area, the supply pipes may be disconnected and the articulated vehicle and movable supports may be driven or otherwise moved to the next targeted location.

The hydraulic cylinders and hydraulic motors of placing apparatus 600 are preferably controlled via an open loop, closed center hydraulic system which is operable to control the hydraulic fluid motors and fluid cylinders on both the movable units 616 and 618 and on the pipe assembly 614 and discharge assembly 650, similar to the hydraulic systems discussed above. Preferably, the hydraulic system and controls for placing apparatus 600 are remotely controllable, such that the apparatus can be driven and maneuvered from a remote location, or programmable to move the apparatus and dispense concrete in a programmed manner.

Figure 53:
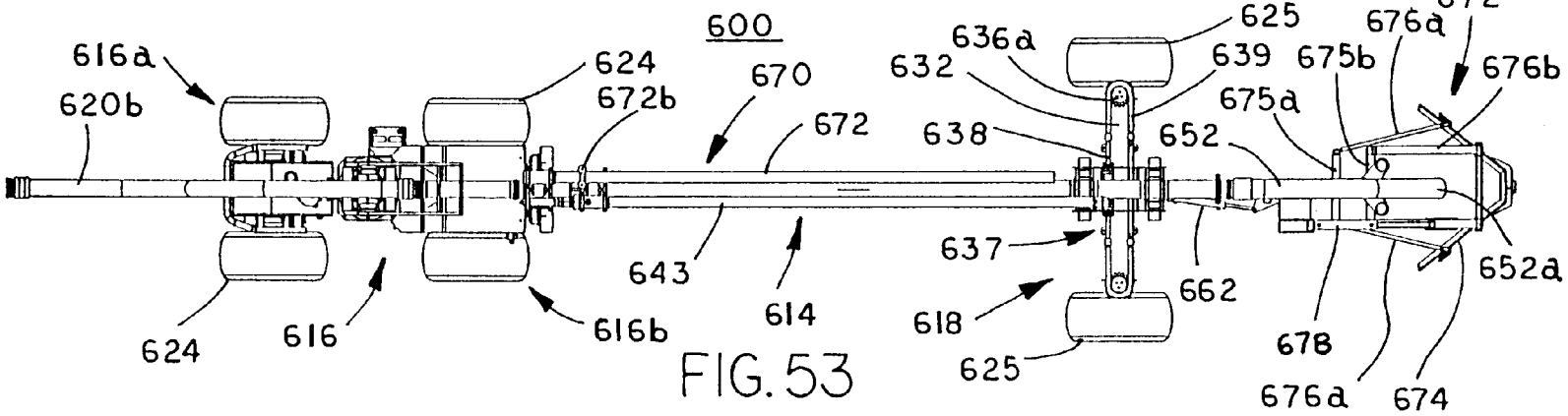
FIG. 53 is a top plan view of the embodiment of FIGS. 50–52, with a V-shaped plow assembly mounted to the lower discharge end of the tube assembly.
Figure 54:
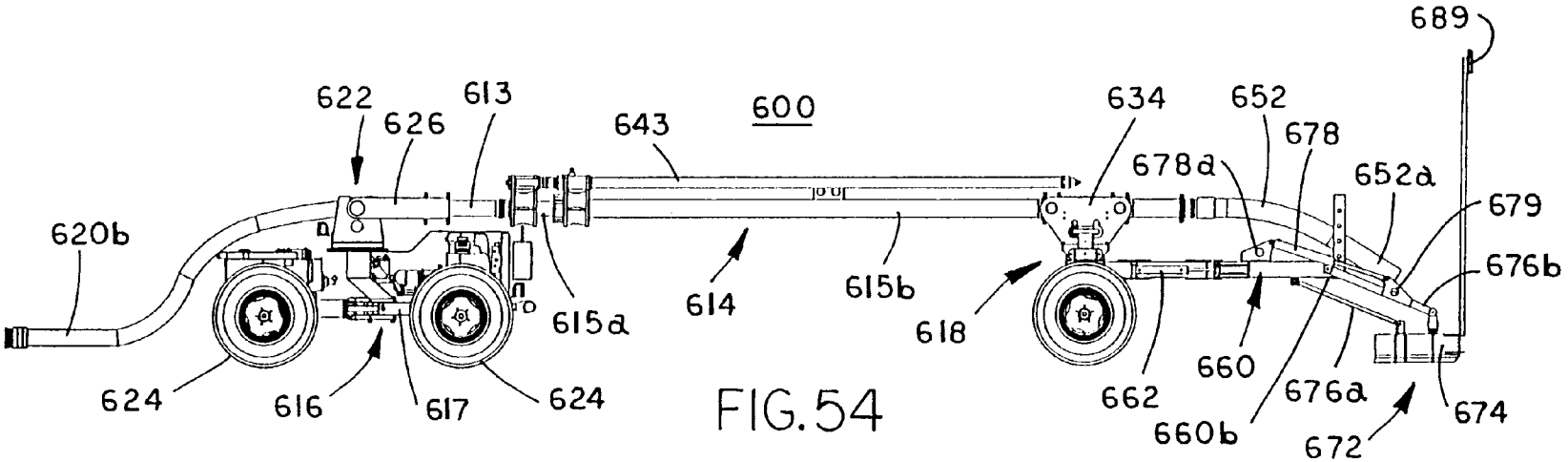
FIG. 54 is side elevation of the embodiment of FIG. 53.
Figure 55:
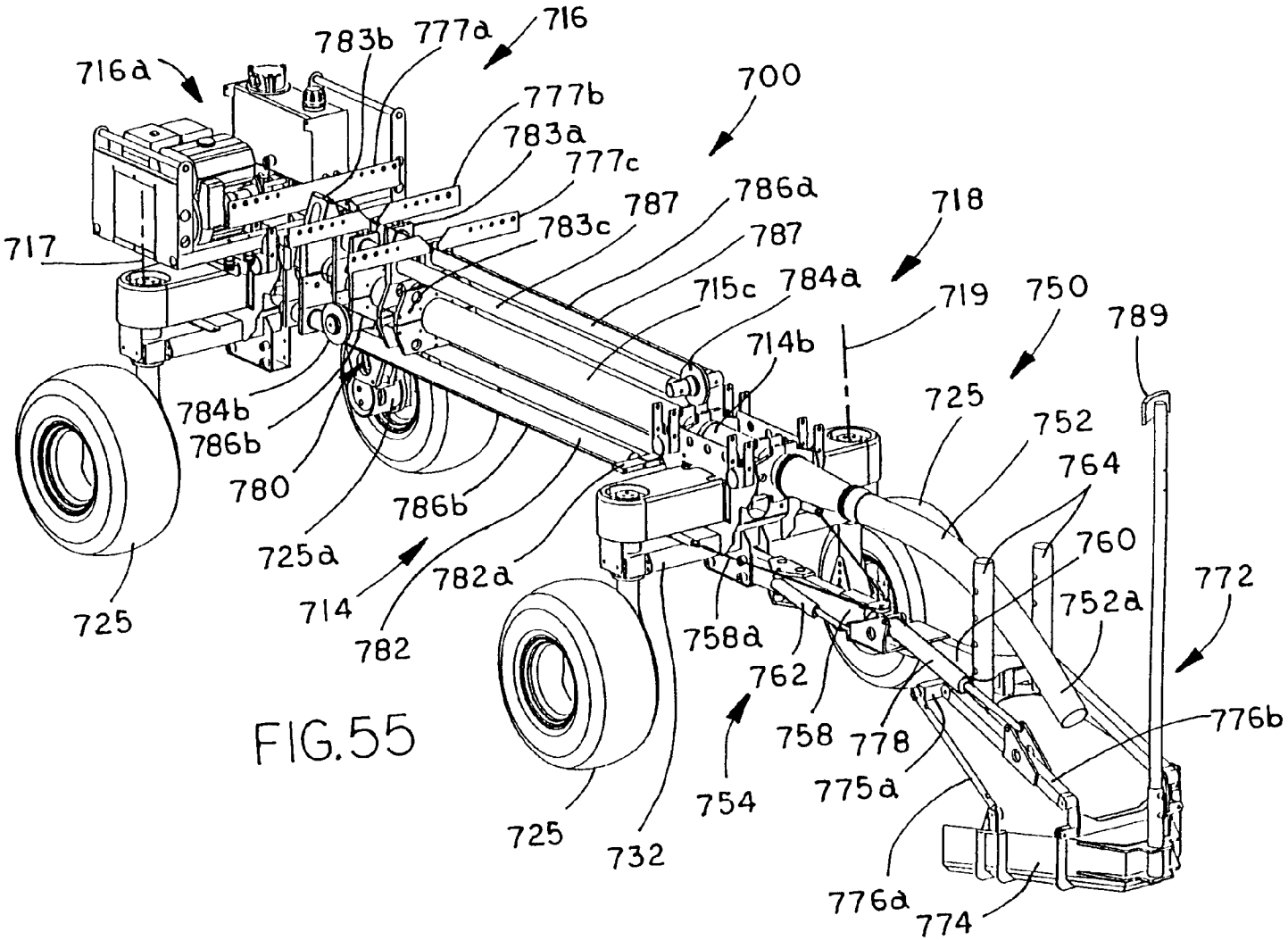
FIG. 55 is a perspective view of another embodiment of present invention, with both the base unit and support unit being two-wheeled units, and the apparatus shown in its retracted position with the wheels in their operable or laterally outward orientation.

As shown in FIGS. 53 and 54, placing apparatus 600 may include a screeding assembly or plow assembly 672 mounted at outer end 660*b* of support 660, in order to smooth or grade the uncured concrete with a plow 674 as the uncured concrete is discharged from discharge end 652*a* of discharge tube 652. In such an embodiment, discharge end 652*a* of discharge tube 652 is set to be curved downward to direct the uncured concrete at the area immediately behind the plow 674. In the illustrated embodiment, plow 674 of plow assembly 672 has a generally U or V-shaped plow portion which is vertically adjustable with respect to support 660 via a pair of pivotable linkages 676*a*, 676*b* and an actuator or hydraulic cylinder 678. Pivotable linkages 676*a*, 676*b* are pivotally mounted at each side of plow 674 and at a corresponding pair of cross members 675*a*, 675*b*, which extend laterally from outer end 660*a* of support 660. Actuator 678 is mounted between a mounting bracket 678*a* on support 660 and a mounting bracket 679 on one of the pivotable linkages 676*b*, as best shown in FIG. 54. As can be seen in FIG. 54, extension or retraction of actuator 678 results in corresponding pivoting of linkage 676*b*, which further causes corresponding generally vertical movement of plow 674 relative to support 660. The plow is maintained in a generally horizontal orientation due to the corresponding pivotal movement of linkages 676*a*. Vertical adjustment of plow 674 by actuator 678 may be in response to a manual control or may be in response to a laser leveling system or the like, which results in automatic vertical adjustment of plow 674 in response to the height of a laser beacon receiver 689 which detects the position of a laser reference plane (not shown), such as that provided by a long range rotating laser beacon projector (also not shown), as discussed above.

Accordingly, as uncured concrete is discharged from discharge tube 652, the uncured concrete is placed at the support surface within the V or U defined by plow 674. As hydraulic cylinder 662 is extended or retracted, discharge end 652*a* of discharge tube 652 is moved laterally, while plow 674 is likewise moved laterally with the discharge end 652*a*. Therefore, as the hydraulic cylinder 662 is extended and retracted to move the discharge end 652*a* of discharge tube 652 back and forth to place concrete over a support surface, plow 674 is correspondingly moved back and forth to spread out or smooth the concrete as it is placed by discharge tube 652. The U or V shaped plow 674 is configured to smooth concrete discharged therein via movement in either lateral direction of plow 674 with respect to support 660 and placing apparatus 600. The back and forth oscillation of discharge end 652*a* of discharge tube 652 and of plow 674 may be performed independently of any movement of movable support 618 or may be performed simultaneously with arcuate or other movement of movable support 618 relative to moveable base unit 616, depending on the application of concrete placing apparatus 600 and/or on the size of the surface at which the uncured concrete is to be placed.

Compact Placing Apparatus With Two-Wheeled Support Units

Figure 66:
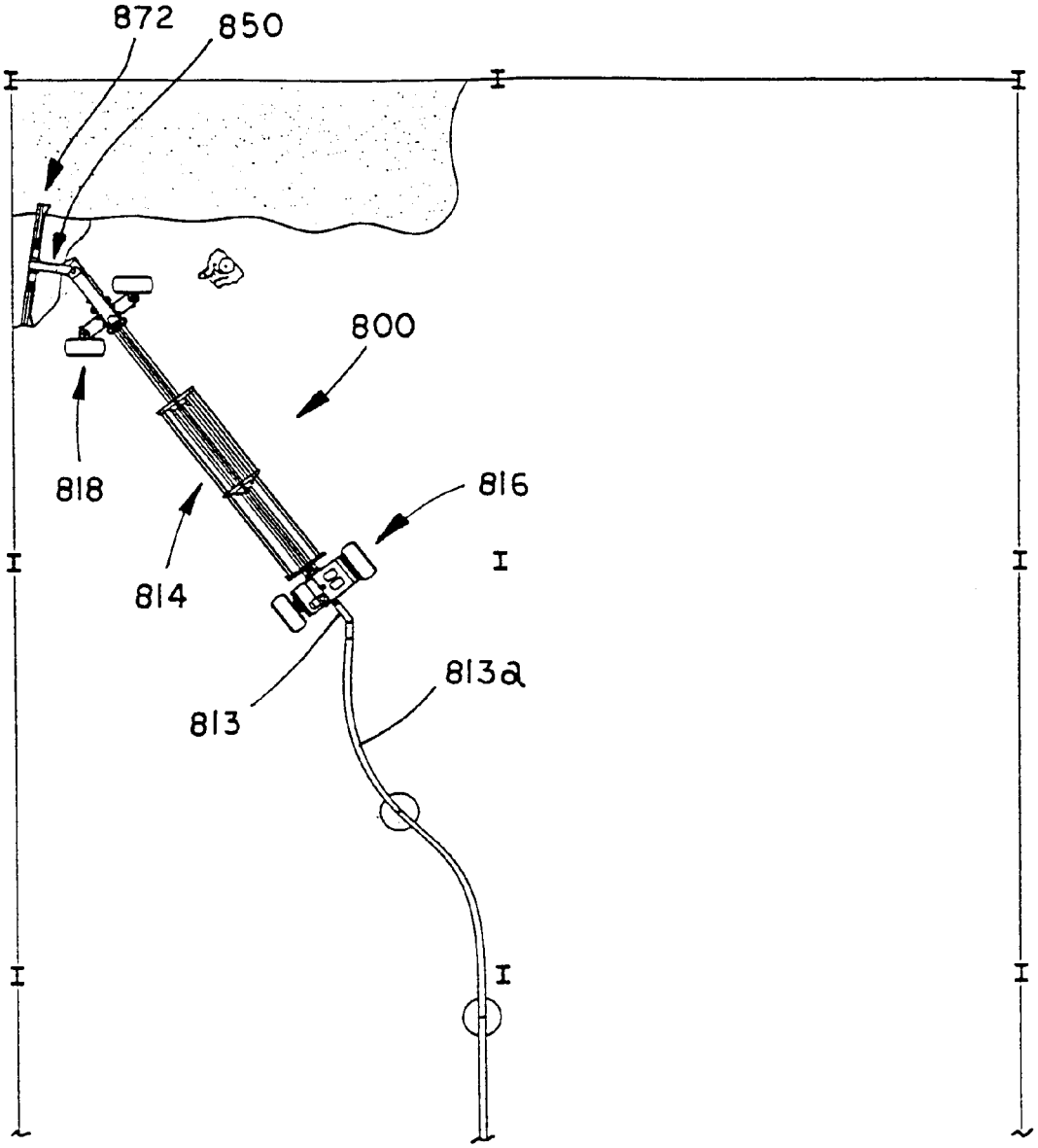
FIG. 66 is a top plan view of the placing apparatus of FIGS. 63–65 as positioned at a targeted area.

Referring now to FIGS. 55–62, a concrete placing apparatus 700 includes a two-wheeled movable base unit 716, a two-wheeled movable support unit 718 and an extendable and retractable conduit or pipe assembly 714 supported thereon. Pipe assembly 714 is supported at or near a discharge end 714*b* by movable support unit 718 and at or near a supply end 714*a* (FIGS. 56D, 57, 58, 60 and 61) by movable base unit 716. Supply end 714*a* is connected to a connector pipe 713 (FIGS. 56A and 56D), which is further connectable to the supply pipes and pumping truck or concrete supply 713*a* (FIG. 66). Additionally, placing apparatus 700 includes a discharge tube assembly 750 and a plow or screeding assembly 772 at discharge end 714*b* of pipe assembly 714 to place and smooth the uncured concrete over the targeted area, as discussed below.

Movable support unit 718 is substantially similar to movable support unit 618, discussed above, such that a detailed description of the movable support 718 will not be repeated herein. Suffice it to say that movable support unit 718 includes a pair of wheels 725 which are independently driven and pivotable about corresponding vertical axes 719 (FIG. 55) via actuation of a double ended hydraulic cylinder or the like, in order to pivot the wheels to steer the movable support unit 718 and to adjust the lateral position of the wheels between a laterally inward or inset position (FIGS. 60–62) and a laterally outward position (FIGS. 55–59).

Movable base unit 716 is similar to movable support unit 718 and is a two-wheeled unit having a pair of wheels 725 supporting a power source 716*a*, which includes an engine, a pump and a reservoir, for supplying pressurized hydraulic fluid to the various hydraulic motors and cylinders associated with placing apparatus 700. Wheels 725 of movable base unit 716 are independently driven via hydraulic motors 725*a* and are pivotable about corresponding vertical axes 717 (FIG. 55) to steer base unit 716 and to allow the wheels to be adjusted between a laterally inset or inward position (FIGS. 60–62) and a laterally outward position (FIGS. 55–59). The wheels 725 are preferably pivoted about vertical axes 717 via a double ended hydraulic cylinder or the like, similar to the wheels of movable support 618 of placing apparatus 600, such that a detailed description of the steering and pivoting apparatus of movable base unit 716 will not be discussed herein.

Figure 56:
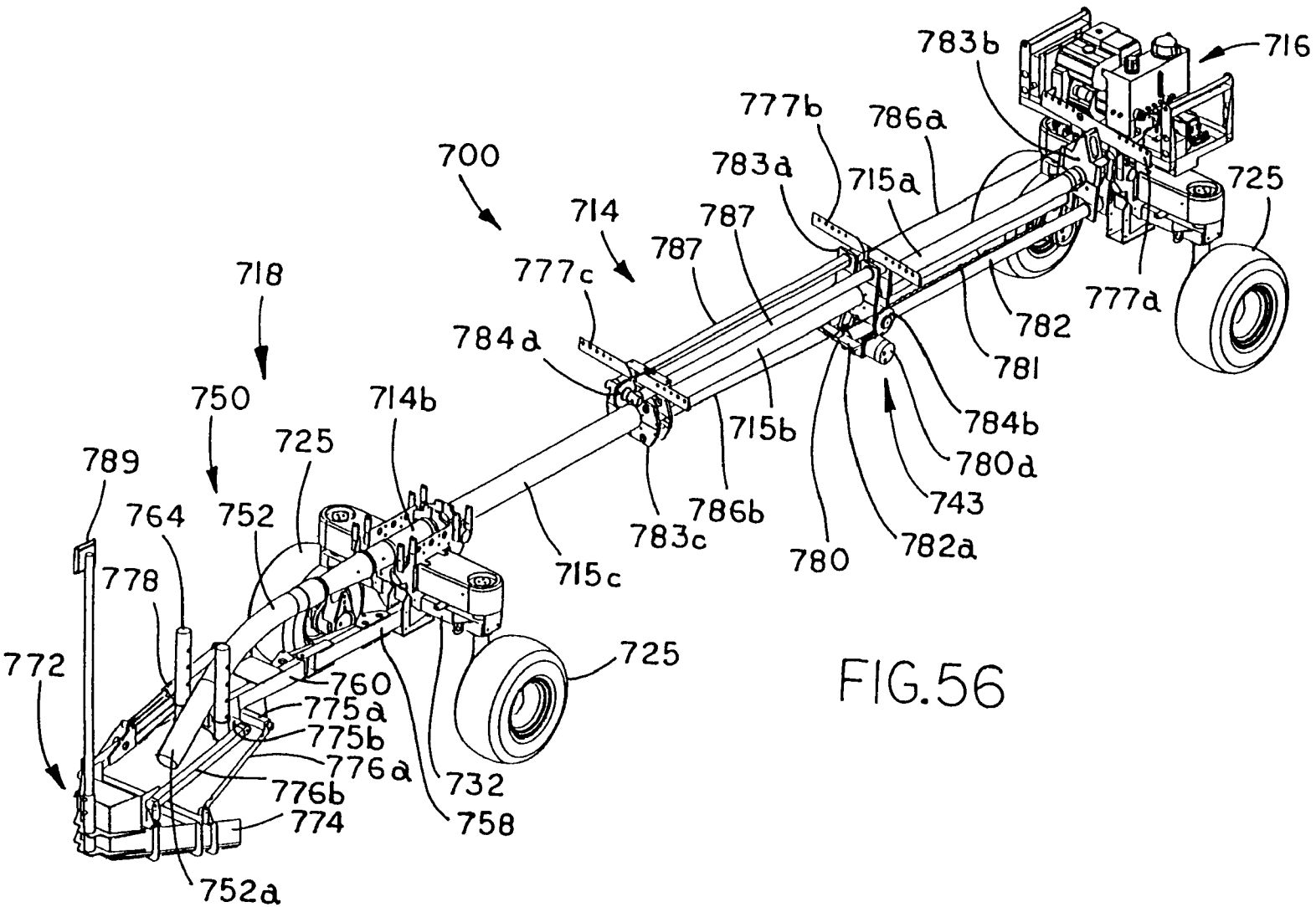
FIG. 56 is another perspective view of the embodiment of FIG. 55, with the conduit shown in its extended state.
Figure 56A:
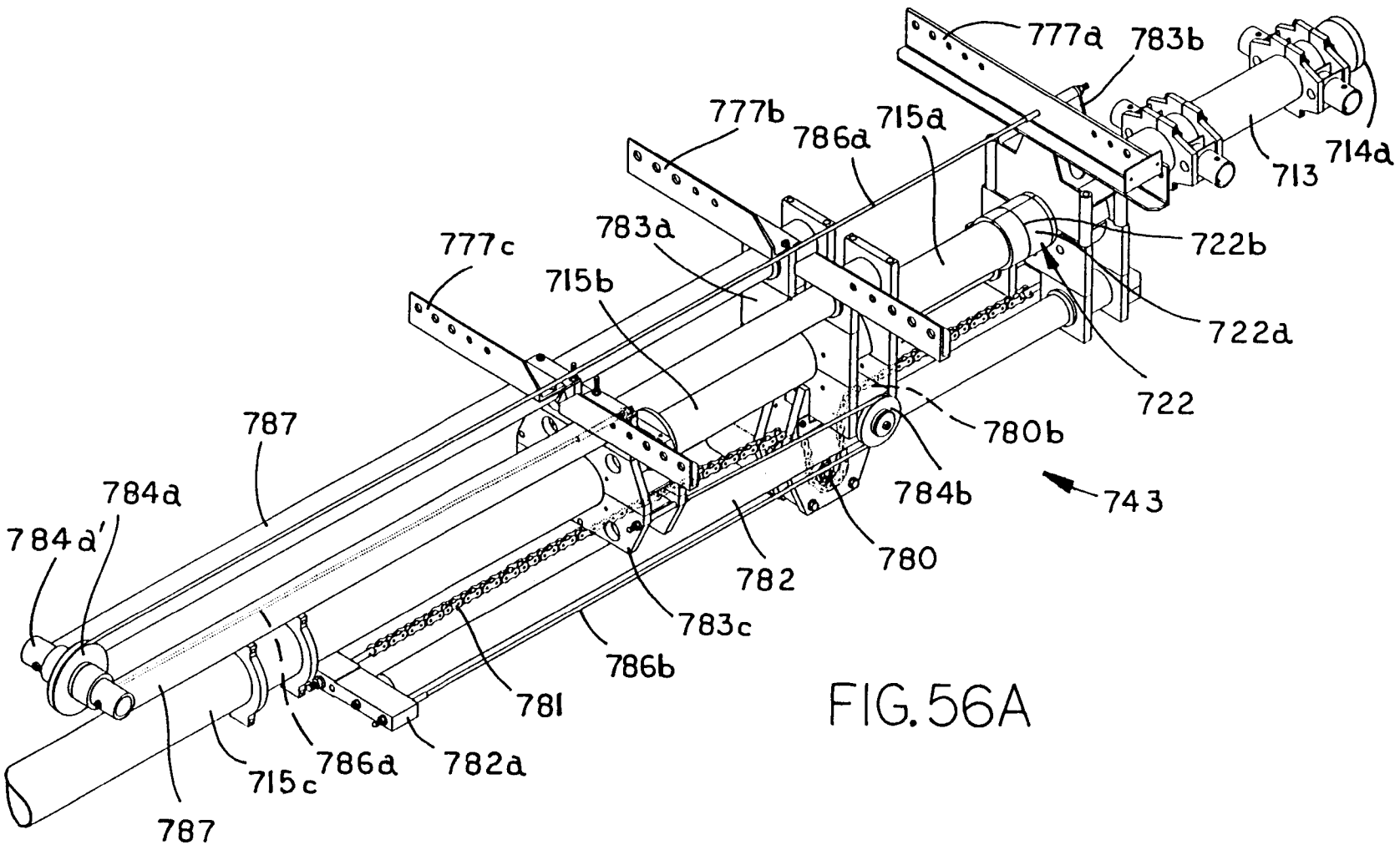
FIG. 56A is an enlarged perspective view of the pipe assembly and extension and retraction device of the placing apparatus of FIGS. 55 and 56.
Figure 57:
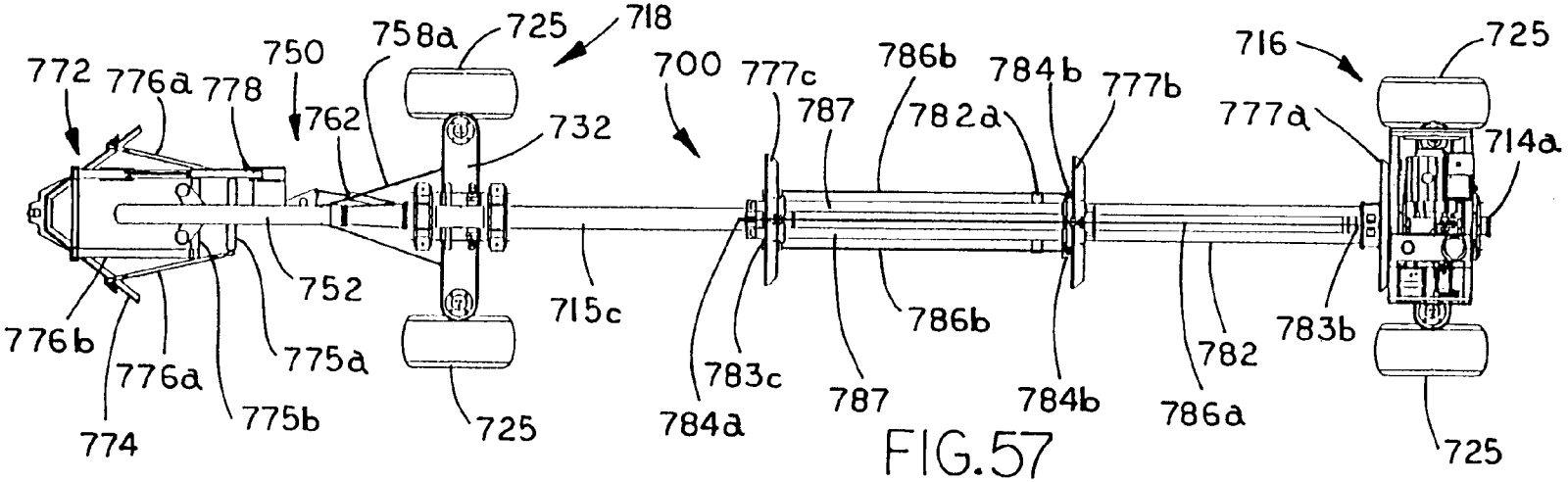
FIG. 57 is a top plan view of the placing apparatus of FIGS. 55 and 56, with the conduit shown in its extended state.
Figure 58:
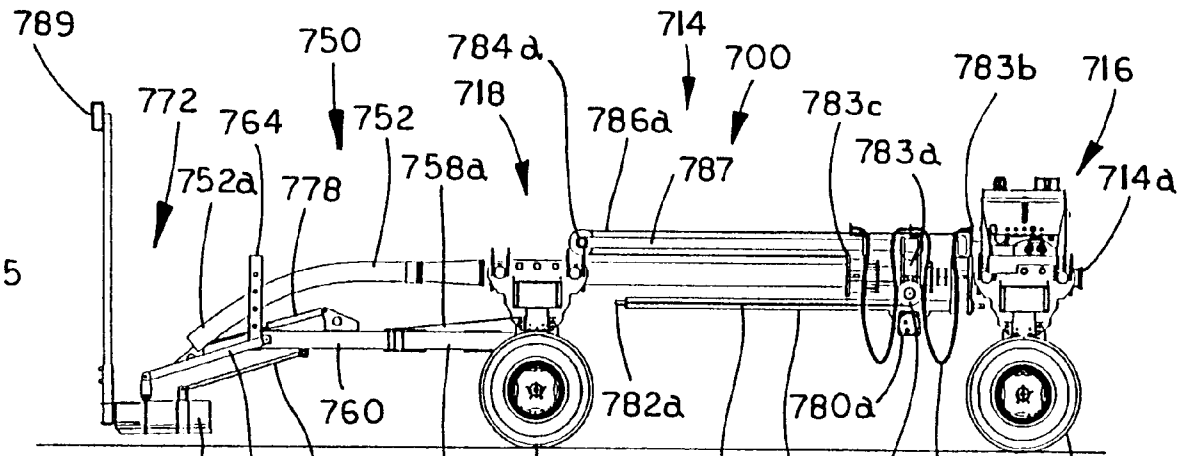
FIG. 58 is a side elevation of the placing apparatus of FIGS. 55–57, with the conduit shown in its retracted state.
Figure 59:
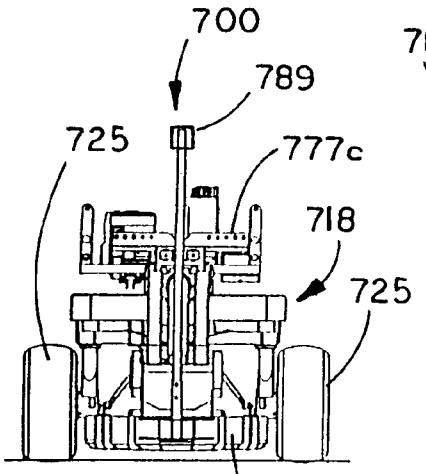
FIG. 59 is a front end view of the placing apparatus of FIGS. 55–58.

In the illustrated embodiment, and as best shown in FIGS. 56, 56A and 57, pipe assembly 714 is a telescoping conduit having an inner pipe or tube 715*a*, an intermediate or middle pipe or tube 715*b* and an outer pipe or tube 715*c*, which are slidable relative to one another as the extendable conduit 714 is extended and retracted relative to base unit 716 and movable support unit 718. More particularly, inner pipe 715*a* is slidably received within middle pipe 715*b*, which is further slidably received within outer pipe 715*c*.

Outer pipe 715*c* is extended along middle pipe 715*b*, while middle pipe 715*b* is correspondingly extended with respect to inner pipe 715*a*, via an extension and retraction device 743, which is operable to extend and retract the pipe sections relative to one another. Extension and retraction device 743 includes a motorized rotatable gear or sprocket member 780 and a generally fixed chain or track member 781 (FIGS. 56, 56A and 56D) extending between base unit 716 and an outer end bracket 782*a* of a mounting extension 782 (such as the pair of cylindrical members of the illustrated embodiment) extending from base unit 716 and along conduit assembly 714. Rotatable sprocket 780 is rotatably mounted at a collar or mounting assembly 783*a* at an inner end of middle pipe 715*b*, as best seen in FIG. 56A, and engages chain member 781 extending along mounting extensions 782. Sprocket 780 is rotatably driven via an hydraulic motor or the like 780*a*, such that as sprocket 780 rotatably engages fixed chain member 781 via actuation of motor 780*a*, sprocket 780, along with inner end of middle pipe 715*b*, moves along chain member 781 relative to base unit 716 and inner pipe 715*a*. A pair of freely rotating guide sprockets 780*b* are positioned at opposite sides of sprocket 780, such that chain member 781 is guided around guide sprockets 780*b* and downward around sprocket 780, thereby maintaining engagement of sprocket 780 with chain member 781. Extension and retraction device 743 further includes multiple pulleys 784*a*, 784*b* and flexible members 786*a*, 786*b* (such as cables, chains, belts or the like) which function to correspondingly move outer pipe 715*c* relative to middle pipe 715*b* as sprocket 780 moves in either direction along chain member 781 to cause uniform extension and retraction of pipes 715*b* and 715*c* relative to one another and to inner pipe 715*a*, as discussed in detail below.

As best shown in FIG. 56A, pulley 784*a* is rotatably mounted to a cylindrical cross member 784*a*' mounted at the outer ends of a pair of mounting members 787, which are mounted to the collar or bracket 783*a* at the inner end of middle pipe 715*b* and extend outwardly along middle pipe 715*b*. Flexible member 786*a* is routed around pulley 784*a* and has one end secured to base unit 716 (such as at a bracket 783*b*) and the other end secured to a collar or bracket 783*c* at an inner end of outer pipe 715*c*. Additionally, pulley 784*b* is mounted at collar 783*a* at the inner end of middle pipe 715*b*, while flexible member 786*b* is routed around pulley 784*b* between collar 783*c* at the inner end of outer pipe 715*c* and the outer end bracket 782*a* of mounting extensions 782. Preferably, pulley 784*b* and flexible member 786*b* comprise a pair of pulleys 784*b* and flexible members 786*b*, with one pulley and flexible member being positioned along each side of pipe assembly 714, as seen in FIG. 57.

Extension and retraction device 743 is operable to generally uniformly extend and retract the pipe sections relative to one another between a retracted state, as shown in FIGS. 55, 58, 60 and 61, and an extended state, as shown in FIGS. 56 and 57. As sprocket 780 is rotatably driven and engaged with chain member 781, sprocket 780 rolls or travels along chain member 781, which causes inner end of middle pipe 715*b* (and thus all of middle pipe 715*b*) to travel or move with respect to chain member 781 and base unit 716. Therefore, as sprocket 780 is rotated to move outwardly along chain member 781 to move away from base unit 716 (to extend the pipe sections toward their extended state), middle pipe 715*b* moves outwardly away from base unit 716, which causes pulley 784*a* to rotate and move along flexible member 786*a*, which further results in flexible member 786*a* pulling outwards on collar 783*c*. This results in outer pipe 715*c* being correspondingly pulled outwards or extended relative to middle pipe 715*b* as middle pipe 715*b* is extended from inner pipe 715*a* and base unit 716. While outer pipe 715*c* is pulled outward relative to middle pipe 715*b*, collar 783*c* pulls at flexible member 786*b* to take up any slack that may occur in flexible member 786*b* as middle pipe 715*b* moves outwardly from base unit 716.

Likewise, as sprocket 780 is rotatably driven to roll or travel inwardly along chain member 781 and toward base unit 716 (to retract the pipe sections to their retracted state), middle pipe 715*b* is moved inwardly toward base unit 716, which causes pulley 784*b* to move along flexible member 786*b*. Because one end of flexible member is fixed relative to middle pipe section 715*b* (at mounting bracket 782*a*), movement of pulley 784*b* along flexible member 786*b* causes flexible member 786*b* to pull inwards or toward base unit 716 at collar 783*c* at the inner end of outer pipe 715*c*. This results in outer pipe 715*c* being correspondingly pulled inward or retracted relative to middle pipe 715*b* as middle pipe 715*b* is retracted along inner pipe 715*a* and toward base unit 716. While outer pipe 715*c* is pulled inward relative to middle pipe 715*b*, and thus relative to pulley 784*a*, collar 783*c* pulls at flexible member 786*a* to take up any slack that may occur in flexible member 786*b* as middle pipe 715*b* moves inwardly toward base unit 716. Although shown and described with respect to placing apparatus 700, it is envisioned that an extension and retraction device of the type discussed above may be implemented to extend and retract the telescoping conduits or pipe assemblies of other placing apparatus embodiments, such as a placing apparatus of the types discussed above, or below.

Figure 56B:
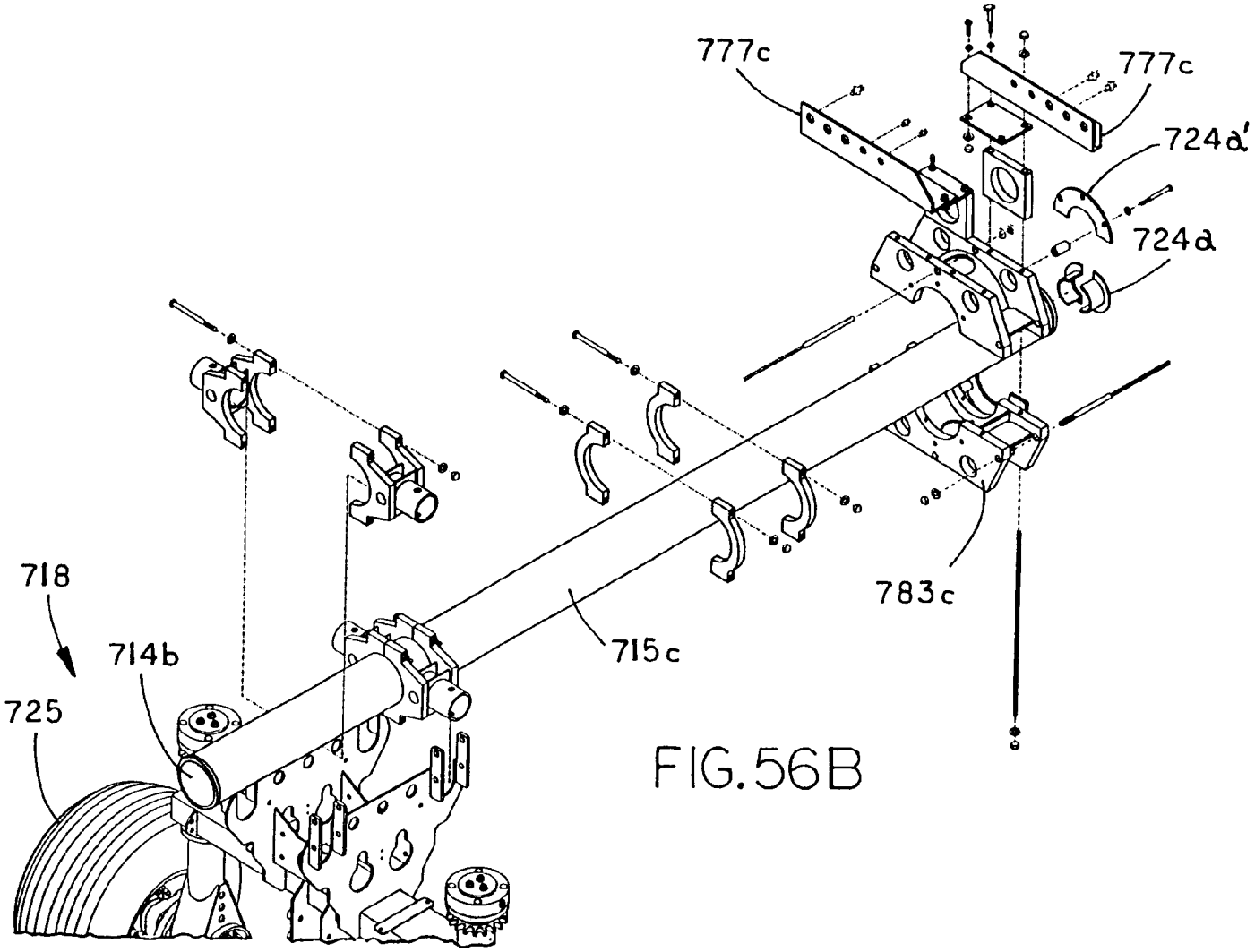
FIGS. 56B–D are exploded perspective views of the pipe sections of the pipe assembly of the placing apparatus of FIGS. 55 and 56.
Figure 56C:
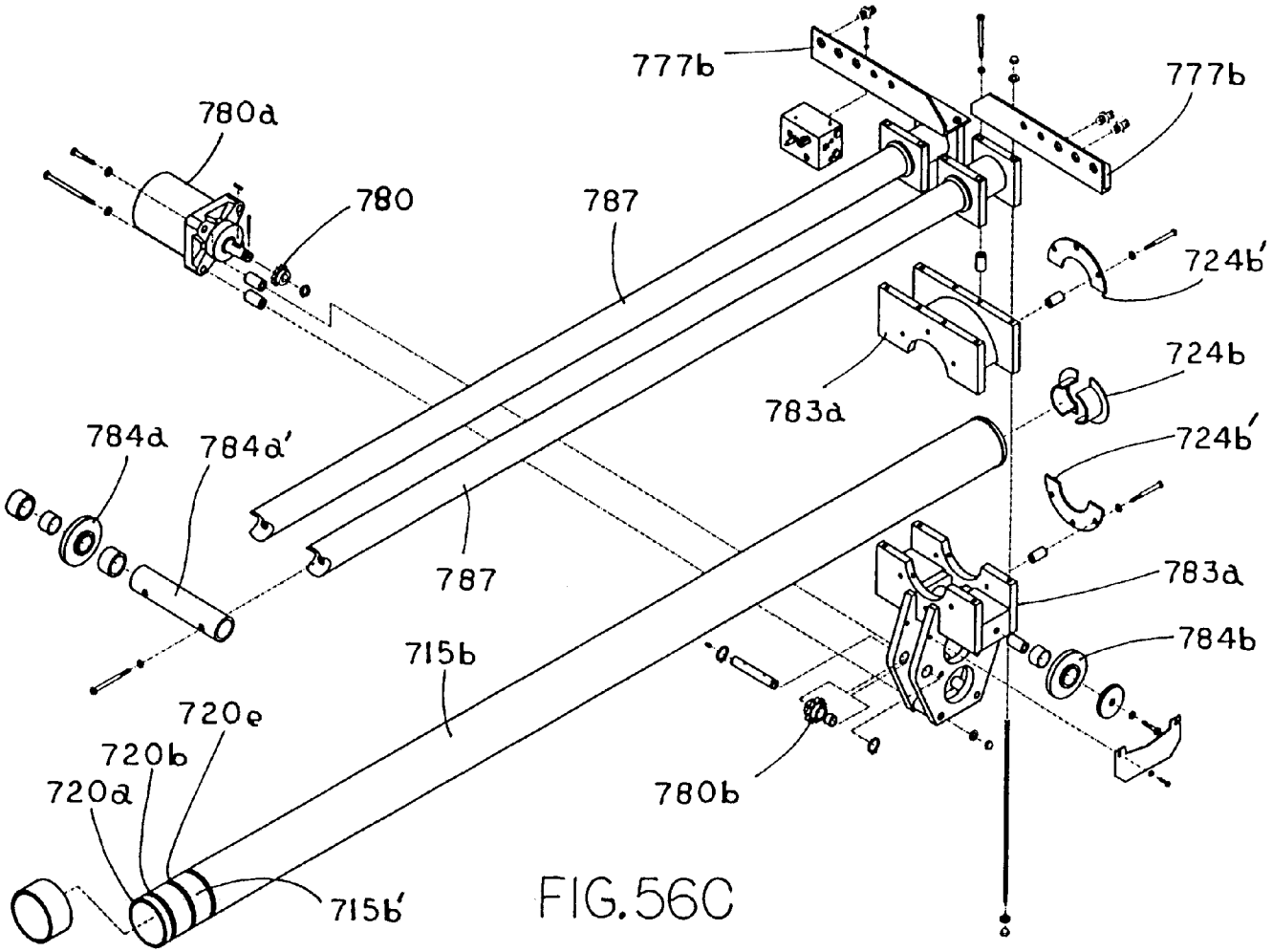
Figure 56D:
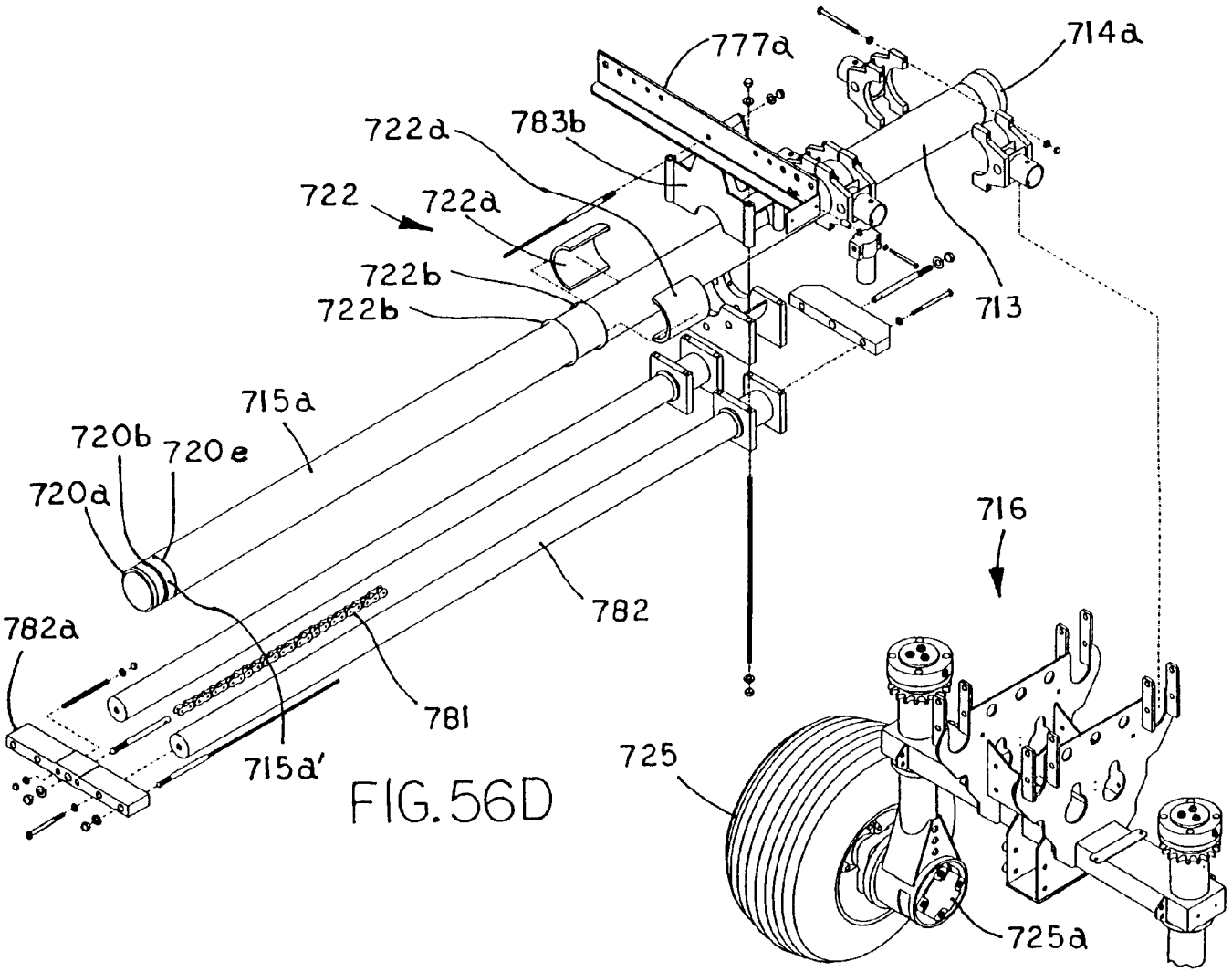
Figure 62:
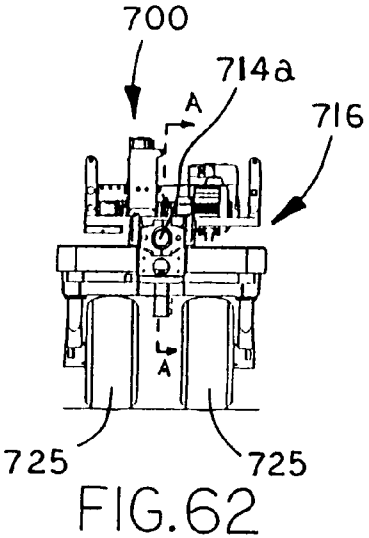
FIG. 62 is a front end view of the apparatus of FIGS. 60 and 61.
Figure 62A:
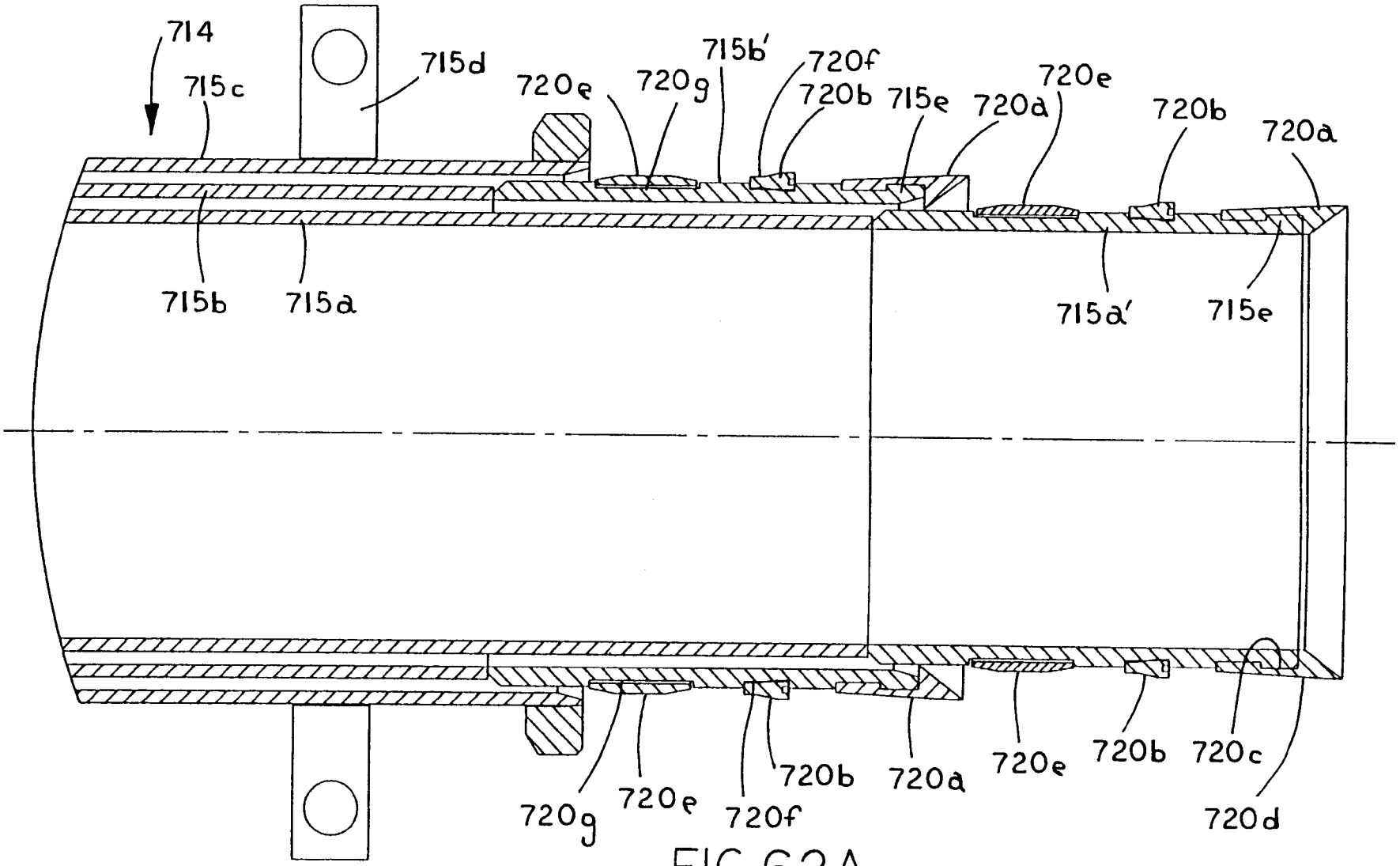
FIGS. 62A–C are sectional views of the pipes and seals of an extendable conduit in accordance with the present invention, taken along the line A—A in FIG. 62.
Figure 62C:
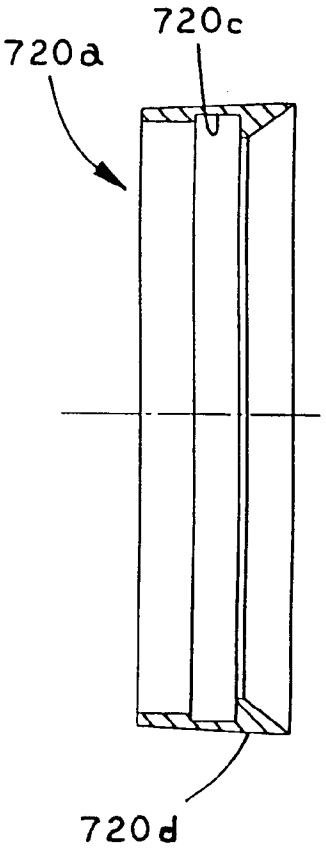
Figure 62B:
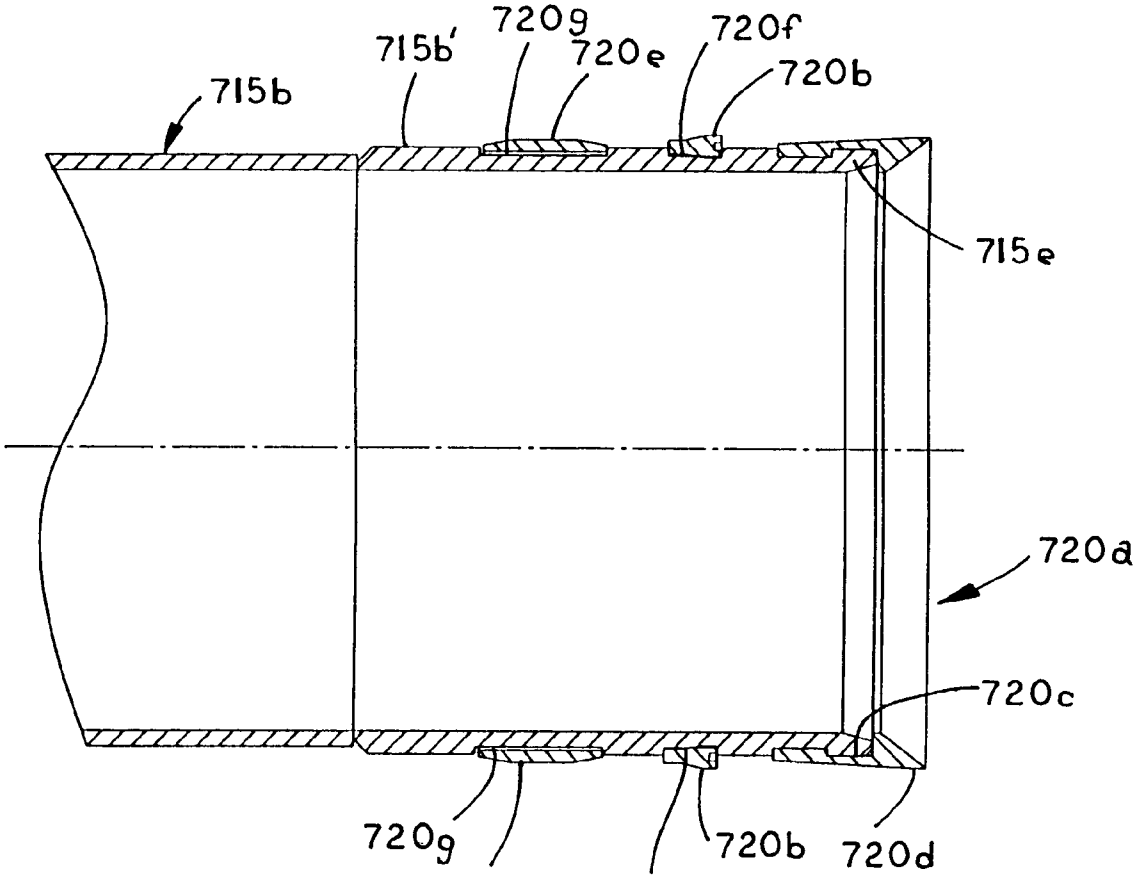

As shown in FIG. 62A, inner pipe 715*a* is slidable within middle pipe 715*b*, which is slidable within outer pipe 715*c*. An outer end of outer pipe 715*c* is secured to movable support 718 via a bracket or collar 715*d*. Outer pipe 715*c* includes a flange bearing 724*a* (FIG. 56B) secured at an inner end thereof via a retaining collar 724*a*'. Flange bearing 724*a* provides an inner cylindrical surface for slidably engaging an outer surface of middle pipe 715*b* as outer pipe 715*c* is extended and retracted along middle pipe 715*b*. Likewise, middle pipe 715*b* includes a flange bearing 724*b* (FIG. 56C), secured at an inner end of middle pipe 715*b* via a retaining collar 724*b*', for slidably engaging an outer surface of inner pipe 715*a* as middle pipe 715*b* is extended and retracted along inner pipe 715*a*.

As shown in FIGS. 56C, 56D, 62A and 62B, inner pipe 715*a* and middle pipe 715*b* each include larger diameter outer end portions 715*a*' and 715*b*', which include a concrete wiper seal 720*a* at an outer end thereof, and a secondary seal 720*b* around each end portion 715*a*', 715*b*' inward of the wiper seal 720*a*. The wiper seal 720*a* and secondary seal 720*b* of inner pipe 715*a* and middle pipe 715*b* engage an inner surface of middle pipe 715*b* and outer pipe 715*c*, respectively, to seal the pipes and limit or substantially preclude concrete from leaking between the pipes as they are extended and retracted and as concrete is pumped through extendable conduit 714. Wiper seal 720*a* is preferably made from a generally stiff urethane plastic and includes an inner recessed annular ring 720*c* for receiving an outer, raised lip or flange 715*e* of a respective pipe 715*a*, 715*b*, and an outer lip 720*d* for sliding engagement with the inner surface of a respective pipe 715*b*, 715*c*. A tube bearing or wear band 720*e* is positioned around each of inner pipe 715*a* and middle pipe 715*b* for sliding engagement of the inner surface of the respective pipe 715*b*, 715*c*, to guide the pipes within the next outer pipe and limit wear on the seals 720*a*, 720*b* as the pipes are extended and retracted relative to one another. Secondary seal is positioned within and around a recessed annular groove 720*f* around a respective end portion 715*a*', 715*b*', while wear band 720*e* is positioned within and around another recessed annular groove 720*g* around a respective end portion 715*a*', 715*b*'.

During normal operation, inner pipe 715*a* is limited or substantially precluded from extending or protruding outwardly from middle pipe 715*b* when middle pipe 715*b* is retracted toward base unit 716. When retraction of middle pipe 715*b* is stopped, retraction of outer pipe 715*c* along middle pipe 715*b* is correspondingly stopped, such that middle pipe 715*b* is also limited or substantially precluded from extending or protruding outwardly from outer pipe 715*c*. In the illustrated embodiment, the inward retraction of middle pipe 715*b* relative to inner pipe 715*a* is limited by a stop member or device 722 (FIGS. 56A and 56D) positioned at the inner end of inner pipe 715*a*. Stop member 722 includes a pair of semi-cylindrical sleeve portions 722*a* which are removably attached or mounted to inner pipe 715*a*, such as via straps or bands 722*b*. Sleeve portions 722*a* contact flange bearing 715*b*" at inner end of middle pipe 715*b* to substantially preclude further inward movement of middle pipe 715*b* along inner pipe 715*a*. In order to facilitate maintenance or inspection of the seals and bands of the inner and middle pipes, the sleeve portions 722*a* of stop member or device 722 may be removed to allow further retraction of middle pipe 715*b* relative to inner pipe 715*a*. Because the amount of retraction of outer pipe 715*c* along middle pipe 715*b* is controlled by the amount of retraction of middle pipe 715*b* along inner pipe 715*a*, the further retraction of middle pipe 715*b* along inner pipe 715*a* allows corresponding further retraction of outer pipe 715*c* relative to middle pipe 715*b* via extension and retraction device 743. The relative lengths of the pipe sections are selected to provide a desired amount of extension of the middle and inner pipe sections from the outer pipe section when the pipe assembly is fully retracted.

As shown in FIG. 62A, full retraction of the middle and outer pipe sections results in inner pipe 715*a* extending or protruding longitudinally outwardly with respect to middle pipe 715*b* and outer pipe 715*c*, while middle pipe 715*b* extends or protrudes longitudinally outwardly with respect to outer pipe 715*c*, such that the outer end portions 715*a*' and 715*b*' extend outwardly and are exposed. This allows for access to the seals 720*a*, 720*b* and wear bands 720*e* for the pipes 715*a*, 715*b*, to facilitate inspection, maintenance and/or replacement of the seals and bands without having to disassemble the pipe assembly 714. Although shown and described with respect to placing apparatus 700, it is envisioned that a stop member or device of the type discussed above may be positioned along the telescoping conduits or pipe assemblies of other placing apparatus embodiments, such as a placing apparatus of the types discussed above or below.

Placing apparatus 700 further includes a plurality of brackets 777*a*, 777*b*, 777*c*, for guiding and supporting hydraulic hoses or lines 777*d* (FIGS. 56A–D, 58 and 61), which provide pressurized hydraulic fluid to the outer movable support unit 718 and to the hydraulic cylinders of the discharge tube assembly 750 and plow assembly 772, discussed below.

Discharge end 714*b* of pipe assembly 714 is connected to a discharge tube assembly 750, which is bendable or movable relative to discharge end 714*b* to place concrete in an arcuate path with respect to movable support unit 718 and discharge end 714*b* of pipe assembly 714, similar to discharge tube assembly 650 discussed above with respect to concrete placing apparatus 600. Because discharge tube assembly 750 and plow assembly 772 are substantially similar to those of placing apparatus 600, discussed above, a detailed description of theses components will not be repeated herein. Briefly, discharge tube assembly 750 includes a flexible tube 752 which is connected to the discharge end 714*b* of pipe assembly 714, and an articulating support assembly 754, which supports the flexible tube 752 and is movable in either direction to flex or bend the tube 752 such that a discharge outlet 752*a* of tube 752 is swept through an arcuate path relative to the discharge end 714*b* of pipe assembly 714. The articulating support assembly 754 is mounted at or secured to a cross member 732 of movable support unit 718 and includes a pivoting or articulating support member 760 pivotally mounted at the end of an arm 758 extending from the cross member 732. The arm 758 may be further supported via a cable or other support member 758*a* (FIGS. 55, 57 and 58) secured to cross member 732 to limit downward deflection of articulating support assembly 754. The articulating support member 760 is pivotable via extension or retraction of an hydraulic cylinder 762 and includes a pair of vertical supports 764 extending upwardly therefrom. The vertical supports 764 function to guide the tube toward either side to side direction as the articulating support member 760 is pivoted relative to the mounting arm 758, while allowing for vertical adjustment of the discharge end 752*a* via pins and mounting openings along supports 764, as discussed above.

Screeding assembly or plow assembly 772 is mounted at an outer end of flexible tube assembly 750 for spreading out and smoothing the uncured concrete as it is discharged from the flexible tube onto the support surface. Articulating support 760 includes a pair of cross members 775*a*, 775*b*, which extend laterally outwardly from articulating support 760 for mounting a pair of mounting linkages 776*a*, 776*b*, respectively, to pivotally mount plow assembly 772 to the articulating support 760, as discussed above with respect to plow assembly 672 of placing apparatus 600. An hydraulic cylinder 778 is then extendable and retractable to lower and raise a plow 774, such that the plow 774 engages the uncured concrete at an appropriate level for spreading and smoothing the concrete at an appropriate depth on the support surface. As discussed above with respect to plow assembly 672, plow assembly 772 may be vertically adjusted in response to a manual input or an automatic control, which may further be operable in response to a laser leveling system having a laser beacon receiver 789 mounted to the plow 774 of plow assembly 772.

Figure 60:
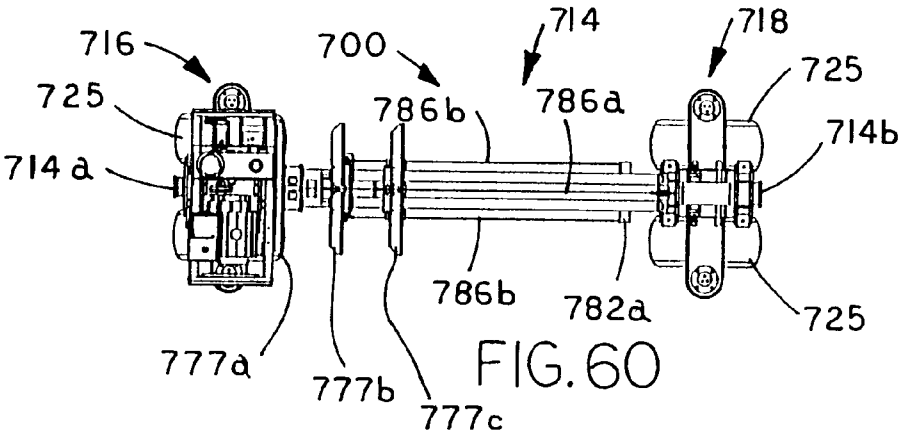
FIG. 60 is a top plan view of the placing apparatus of FIGS. 55–59, with the conduit retracted and the wheels moved to their laterally inward orientation.
Figure 61:
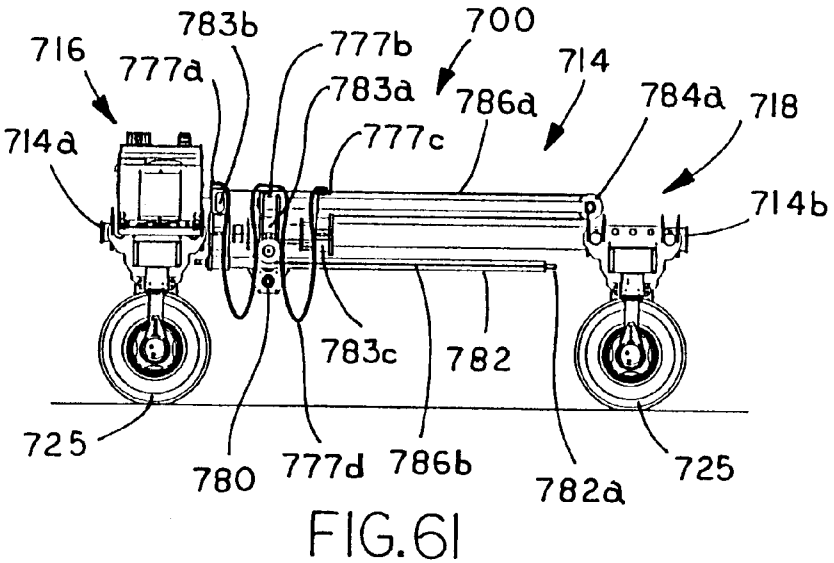
FIG. 61 is a side elevation of the placing apparatus of FIG. 60.

Concrete placing apparatus 700 thus may be converted from an operational or in use mode, as shown in FIGS. 55–59, to a transport or compact mode, as shown in FIGS. 60–62, via pivotal movement of the tires 725 of the movable base unit 716 and the movable support unit 718 about respective vertical axes, thereby narrowing the profile of apparatus 700. Additionally, the three stage boom allows for a shorter retracted length of the apparatus for entry into man lift elevators or the like commonly used at multi-story elevated deck construction sites. This substantially reduces assembly and disassembly down time for assembling and disassembling the apparatus at the worksite in order to move the apparatus from one work site to the next.

When in the operational or in use mode, with the wheels pivoted toward their laterally outward position, a pin or stop or the like (not shown) may be provided to prevent unintentional pivotal movement of the wheels to their inward position, such that wheels 725 may be limited to pivot only within an operable range when the apparatus is in its operable orientation. When it is desired to retract the wheels to their inward position, in order to move the apparatus from one worksite to the next, the pin or stop may be removed to allow pivotal movement of the wheels to their inward position and then to allow steering of the wheels at their inward position to move the apparatus to the next worksite.

The hydraulic cylinders and hydraulic motors of placing apparatus 700 are preferably controlled via an open loop, closed center hydraulic system, similar to placing apparatus 600, discussed above. The system is operable to control the hydraulic fluid motors and fluid cylinders on both of the movable units 716 and 718 and on the pipe assembly 714, discharge tube assembly 750, and plow assembly 772, similar to the hydraulic systems discussed above. Optionally, the hydraulic systems and controls for placing apparatus 700 may be remotely controllable, such that the apparatus can be driven and maneuvered from a remote location, or may be programmable to move the apparatus and dispense concrete at the support surface in a programmed manner.

When positioned at the targeted support surface, placing apparatus 700 is movable via driving and steering of movable base unit 716 and/or driving and steering of movable support unit 718. When positioned at the targeted location of the support, the supply end of the connector pipe 713 is connected to a supply tube or pipe which is further connected to the concrete supply or source (not shown). The pipe assembly 714 may then be extended outwardly via the hydraulic motor 780*a* turning or driving sprocket member 780, while the wheels 725 of movable support unit 718 may freely roll or correspondingly drive along the support surface. As uncured concrete is placed at the support surface, wheels 725 of movable support unit 718 may be turned and driven in a desired direction, in order to move the discharge end of the pipe assembly 714 in a generally arcuate path about the movable base unit 716. The discharge tube assembly 750 may also be actuated to sweep the discharge end 752*a* of the discharge tube 752 back and forth through a smaller, generally arcuate path about the discharge end 714*b* of pipe assembly 714. Similar to the above discussed placing processes, pipe assembly 714 may be partially retracted after each pass or sweep of the discharge end of the pipe assembly, such that the next sweep of the pipe assembly covers a different area of the support surface. Also, the plow assembly may generally smooth the uncured concrete at the support surface as the concrete is being placed by the discharge tube. After concrete has been placed and smoothed over the entire targeted area, the supply pipes may be disconnected and the movable base unit and movable support unit may be driven or otherwise moved to the next targeted location.

Figure 63:
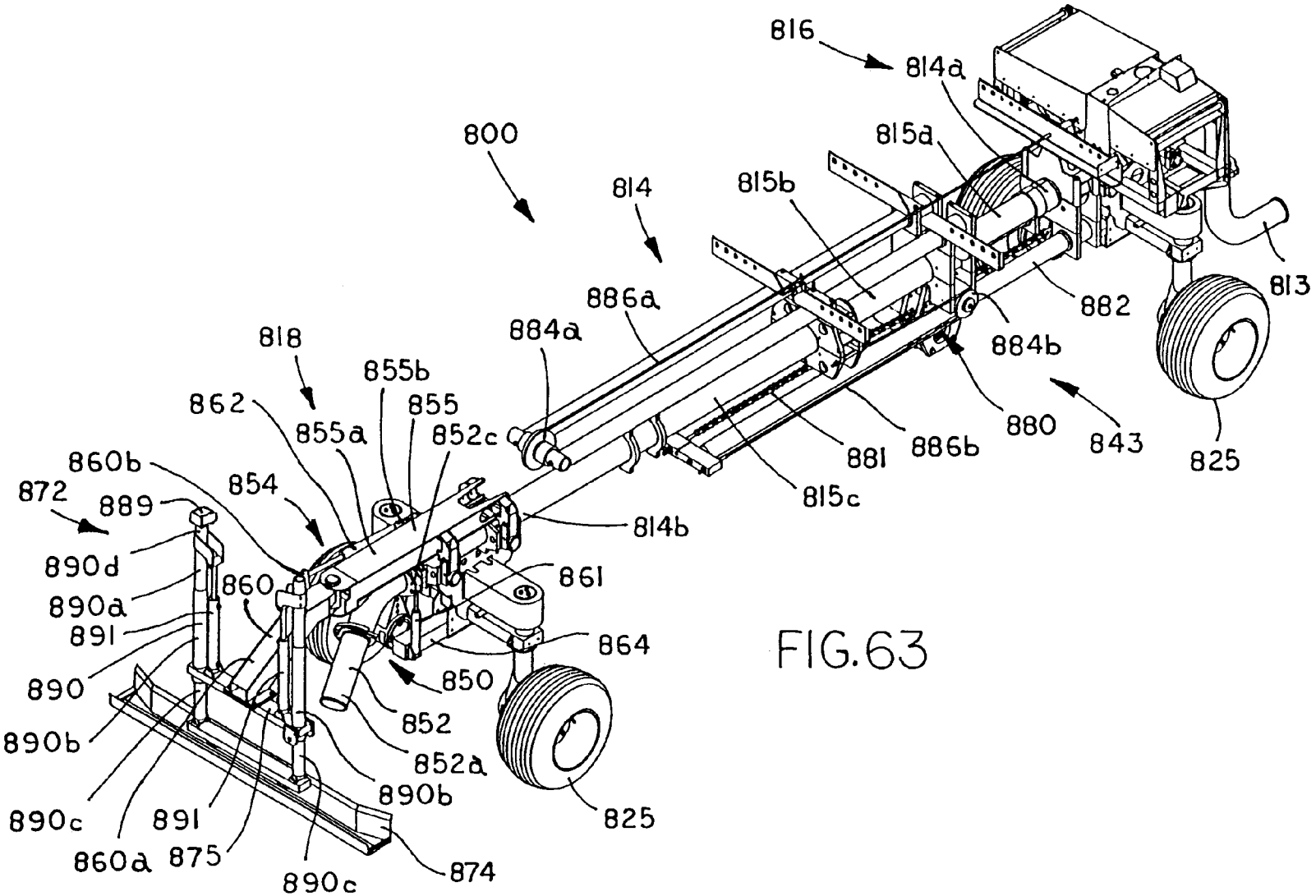
FIG. 63 is a perspective view of another placing apparatus in accordance with the present invention, with two two-wheeled units supporting an extendable conduit with a movable discharge tube and plow at a discharge end.
Figure 64:
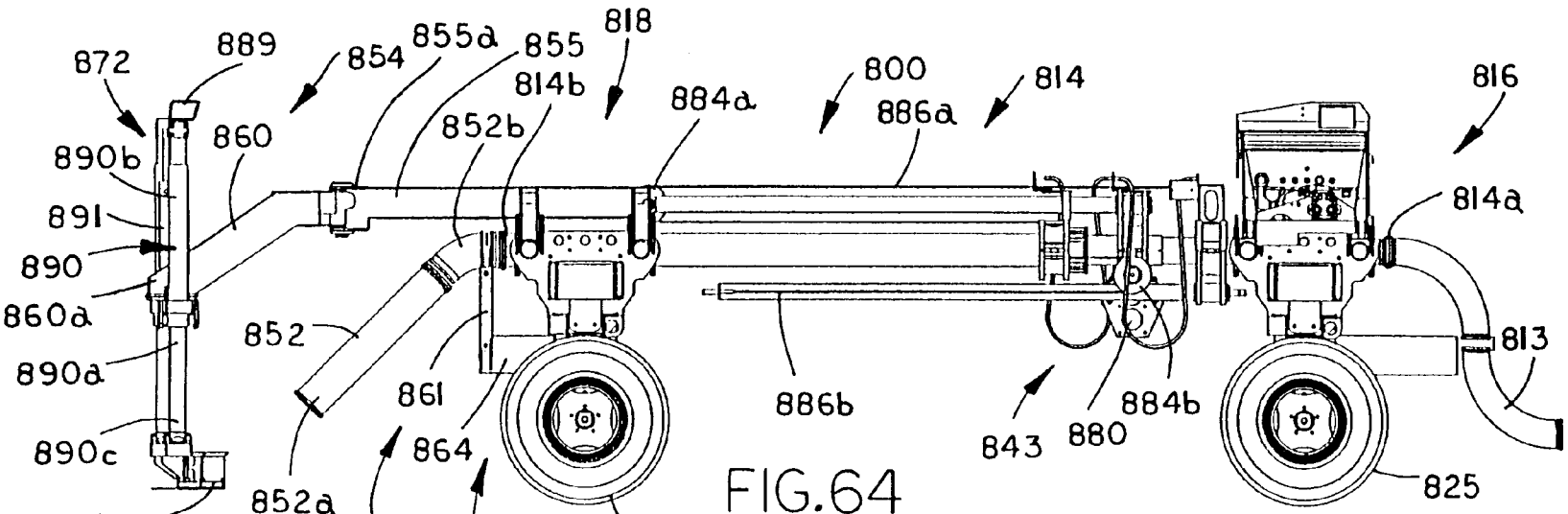
FIG. 64 is a side elevation of the placing apparatus of FIG. 63.
Figure 65:
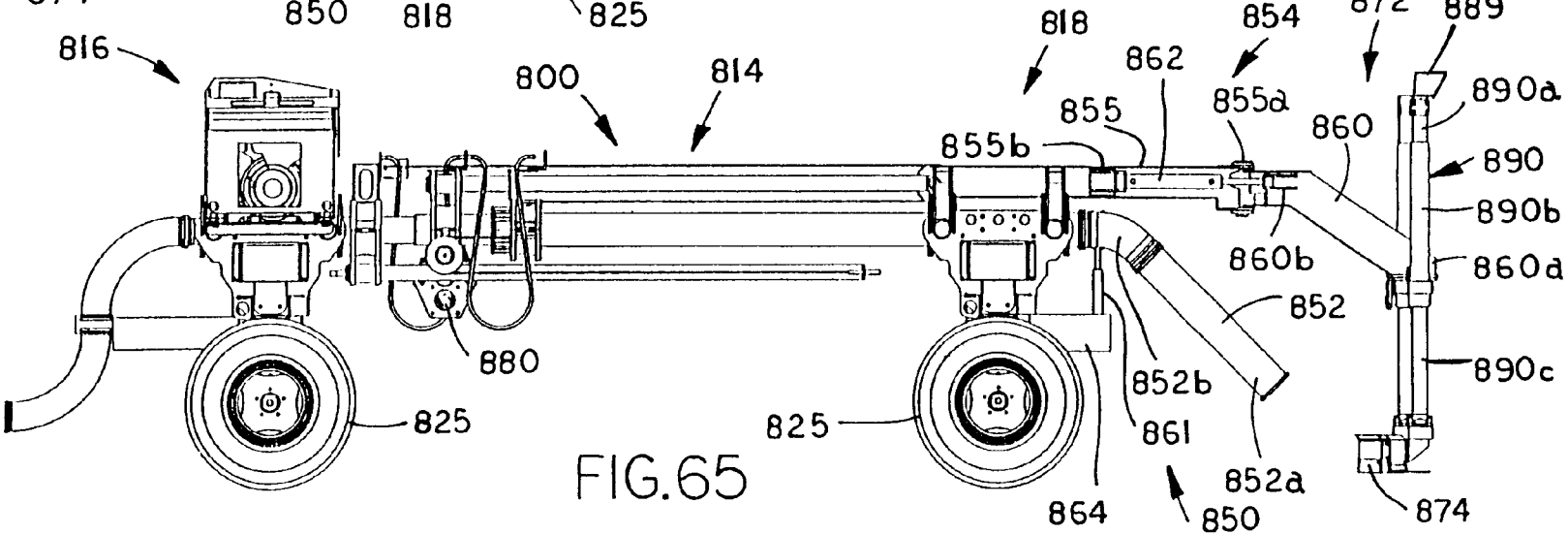
FIG. 65 is another side elevation of the placing apparatus of FIGS. 63 and 64 from the opposite side of the placing apparatus.

Referring now to FIGS. 63–66, a concrete placing apparatus 800 includes a two-wheeled movable base unit 816, a two-wheeled movable support unit 818 and an extendable and retractable conduit or pipe assembly 814 supported thereon. Pipe assembly 814 is supported at or near a discharge end 814*b* by movable support unit 818 and at or near a supply end 814*a* by movable base unit 816 (FIG. 64). Supply end 814*a* is connected to a connector pipe 813 (FIGS. 64 and 66) which is mounted to base unit 816 and extends rearwardly therefrom for connection to a supply hose or tube 813*a* (FIG. 66), which is further connectable to the supply pipes and pumping truck or concrete supply (not shown). Additionally, discharge end 814*b* of pipe assembly 814 is connected to a discharge tube assembly 850, which includes a discharge tube or pipe 852, an end 852*a* of which is laterally movable relative to discharge end 814*b* of pipe assembly 814 to place concrete in a generally arcuate or side to side path with respect to movable support unit 818 and discharge end 814*b* of pipe assembly 814, as shown in FIG. 66.

Movable base unit 816 and movable support unit 818 are substantially similar to movable units 716 and 718, discussed above, such that a detailed discussion of these units will not be repeated herein. Likewise, pipe assembly 814 is substantially similar to pipe assembly 714, discussed above, and is extended and retracted via an extension and retraction device 843. The extension and retraction device 843 is similar to extension and retraction device 743, such that a detailed discussion will not be repeated herein. Suffice it to say that extension and retraction device 843 includes a motorized sprocket member (shown generally at 880) and a chain member 881, whereby sprocket member 880 is rotated along chain member 881 to extend and retract middle pipe 815*b* relative to inner pipe 815*a* and base unit 816. A pulley 884*a* and a flexible member 886*a* cooperate (as discussed above with respect to placing apparatus 700) to extend outer pipe 815*c* relative to middle pipe 815*b* as middle pipe 815*b* is extended from inner pipe 815*a* away from base unit 816 via rotation of sprocket member 880, such as in the clockwise direction in FIG. 65. Likewise, a pair of pulleys 884*b* and a pair of flexible members 886*b* cooperate (as also discussed above with respect to placing apparatus 700) to retract outer pipe 815*c* relative to middle pipe 815*b* as middle pipe 815*b* is retracted along inner pipe 815*a* toward base unit 816 via rotation of sprocket member 880 in the opposite direction, such as in the counter-clockwise direction in FIG. 65. Therefore, pipe assembly 814 is generally uniformly extended and retracted relative to the base unit 816 by extension and retraction device 843.

Similar to concrete placing apparatus 700, discussed above, concrete placing apparatus 800 may be converted from an operational or in use mode (shown in FIGS. 63–65) to a transport or compact mode (not shown) via pivotal movement of the tires 825 of the movable base unit 816 and the movable support unit 818 about respective vertical axes, thereby narrowing the profile of apparatus 800. Additionally, the three stage boom allows for a shorter retracted length of the apparatus for entry into man lift elevators or the like commonly used at multi-story elevated deck construction sites. This substantially reduces assembly and disassembly down time for assembling and disassembling the apparatus at the worksite in order to move the apparatus from one work site to the next.

Discharge tube assembly 850 is mounted to the discharge end 814*b* of pipe assembly 814 and is operable to place concrete across an area generally in front of movable support unit 818. Discharge tube or pipe 852 of discharge tube assembly 850 includes a curved portion or elbow 852*b* at an end of tube 852 opposite discharge end 852*a*. Curved portion 852*b* is rotatably mounted to discharge end 814*b* of conduit 814 and further includes an actuator mounting collar or extension 852*c* (FIG. 63) extending radially outwardly therefrom. An actuator 861 is mounted between mounting extension 852*c* and a support arm 864 extending forwardly from support unit 818. Actuator 861 preferably comprises an hydraulic cylinder and is extendable and retractable to cause rotation of curved portion 852*b* relative to discharge end 814*b* of conduit 814 (as can be seen in FIG. 63), thereby causing corresponding lateral or arcuate movement of discharge end 852*a* of discharge tube 852 relative to conduit or pipe assembly 814.

Placing apparatus 800 preferably further includes a plow assembly 872 adjustably mounted to support unit 818. Plow assembly 872 includes a strike-off plow 874 and is adjustably mounted to support unit by a support assembly 854. Support assembly 854 includes a support member 855 mounted to an upper portion of support unit 818 and extending forwardly therefrom, and an articulating support member 860 pivotally mounted to an outer end 855*a* of support member 855 to provide for lateral adjustment of plow assembly 872. In the illustrated embodiment, articulating support member 860 is angled or bent downwardly toward an outer end 860*a* for mounting to a cross member 875 (FIG. 63) of plow assembly 872. An actuator 862 (FIGS. 63 and 65), such as an hydraulic cylinder, is mounted between a mounting bracket 855*b* of support member 855 and a mounting bracket 860*b* of articulating support member 860. Actuator 862 is extendable and retractable to cause pivotal movement of articulating support member 860 relative to support member 855, similar to actuator 762 of support assembly 754, discussed above.

Plow assembly 872 is mounted to outer end 860*a* of articulating support member 860 at cross member 875 and is laterally movable and adjustable relative to support unit 818 via articulation of support assembly 854. Similar to screeding assembly 72, discussed above, plow assembly 872 includes a pair of generally vertical adjustable supports or tube assemblies 890 which are adjustable via extension and retraction of a pair of hydraulic cylinders 891. As hydraulic cylinders 891 are extended or retracted, an inner support rod 890*a* is movable along and within an outer cylindrical sleeve 890*b*, which is fixedly secured to mounting beam or cross member 875. A lower end 890*c* of each inner support rod 890*a* is secured to strike-off plow 874, such that vertical adjustment of support rods 890*a* relative to outer sleeves 890*b* causes vertical adjustment of plow 874 with respect to beam 875 and support unit 818. Preferably, plow assembly 872 further includes a pair of laser receivers 889 mounted at an upper end 890*d* of inner support rods 890*a*, such that vertical adjustment of the inner support rods 890*a*, and thus of plow 874, is accomplished in response to the laser receivers detecting a laser plane generated by a laser plane generator (not shown) of a laser leveling system, as discussed above. It is further envisioned that plow assembly 872 may include a vibrating member or device for screeding the uncured concrete surface.

During operation, placing apparatus 800 functions substantially similar to placing apparatus 700, discussed above, such that a detailed discussion will not be repeated herein. Suffice it to say that, after placing apparatus 800 has been set up at the targeted area, the extendable conduit 814 is extended to a desired length and uncured concrete is pumped to placing apparatus 800 and discharged at the support surface at discharge tube 852. Actuation of actuator 861 causes lateral or arcuate movement of discharge end 852*a* of discharge tube 852 via rotation of tube 852 and curved portion 852*b* relative to conduit 814, while corresponding actuation of actuator 862 causes corresponding lateral adjustment or arcuate movement of plow 874 relative to support unit 818 and conduit 814. Also, actuation of actuators 891 causes vertical adjustment of plow 874 to spread and smooth the discharged uncured concrete to a desired level or grade. The support unit 818 may be moved and the conduit may be extended or retracted to further adjust the location of the discharge tube 852 and plow 874 at the support surface until uncured concrete has been placed over the entire targeted area, as discussed above.

Accordingly, the concrete placing apparatus of the present invention is a compactable and extendable placing apparatus which may be easily maneuvered and driven between worksites. Because the wheels of the movable base unit and of the movable support unit are laterally retractable via 180 degrees of pivotal movement about their vertical axes, the concrete placing apparatus is able to be configured to a narrow profile, transportation state or orientation, to allow the concrete placing apparatus to be driven through narrow openings, such as doors and man lifts or the like. Additionally, because the extendable conduit includes three telescoping sections, the extendable conduit is retractable to a shorter retracted state, while still providing sufficient extension of the conduit for placement of the concrete at the support surface. The narrow profile and shorter overall length of the placing apparatus when in its compact transportation state facilitates easier maneuvering and transporting of the placing apparatus between worksites, without requiring disassembly of the apparatus. When the apparatus is moved to and positioned at a worksite, the wheels are pivoted from their laterally inward position to their laterally outward or operable position or orientation to provide enhanced stability of the placing unit during placement of concrete at the support surface. The apparatus is then connected to the supply source of concrete and may then begin placing concrete at the support surface. The extendable conduit is extendable to a fully extended length while placing concrete at the support surface, while the movable support may be driven over the support surface in an arcuate path or other path with respect to the movable base unit, in order to place uncured concrete at the support surface. Additionally, the discharge tube is movable to be swept or moved arcuately side to side with respect to the movable support unit to further enhance placement of the uncured concrete at the support surface. The plow assembly may then spread or smooth the uncured concrete over the support surface as it is placed thereon. The plow functions to spread and smooth the uncured concrete over the support surface as the concrete is placed thereon, and may include a vibrating member for screeding the uncured concrete. The strike-off plow assembly also may include a laser control system to control the approximate height or grade of the concrete slab. This avoids the build-up of piles of concrete or low spots on the support surface or deck as the uncured concrete is placed thereon.

Additionally, because the extendable pipes are retracted and extended using a single hydraulic motor driving a sprocket or gear along a track or chain, the concrete placing apparatus of the present invention requires less hydraulic fluid for extension and retraction of the extendable conduit than an embodiment having multiple hydraulic cylinders and/or motors. Accordingly, less horsepower is required and a smaller engine may be implemented on the movable base unit, along with a smaller reservoir with lower hydraulic oil capacity, in order to reduce the overall size and weight of the movable base unit.

Therefore, the concrete placing apparatus of the present invention provides a compact and light-weight placing apparatus, which may be transported from one worksite to the next, with minimal disassembly required. The placing apparatus is retractable to a narrow profile and short length unit to allow the apparatus to be moved or driven through normal doorways and into and out from conventional manlifts, in order to transport the unit to an elevated deck or support surface with minimal or no disassembly of the unit. If necessary, the discharge tube assembly and plow assembly may be easily removed from and installed to the movable support unit when transporting the concrete placing apparatus from one site to the next.

Although shown as having a discharge end of the tube assembly for discharging uncured concrete onto a targeted area of the support surface, the placing apparatus embodiments of the present invention may also or otherwise include a screeding device at an outer end of the apparatus to grade and smooth the uncured concrete on the support surface following discharge from the discharge outlet of the pipe assembly. The screeding devices may be of the type discussed above with respect to placing and screeding apparatus 10' or placing and screeding apparatus 10", or other types of screeding devices, without affecting the scope of the present invention. Optionally, the screeding device may include a generally V-shaped or generally straight strike-off plow, such as of the type discussed above with respect to placing apparatus 600, 700 and/or 800. The screeding device may be implemented with the discharge tube, such that the screeding device or plow grades and smoothes the concrete following discharge from the discharge end of the tube. Alternately, a screeding device alone may be positioned at an outer end of a support member, which does not place uncured concrete and is movable to move the screeding device relative to the support surface, such that the screeding device is operable to grade and smooth uncured concrete which was previously placed at the support surface.

Each of the embodiments of the base units discussed above may be implemented with any of the embodiments of the lead units or movable supports. It is envisioned that in certain applications, a particular design or combination may be preferred. For example, it would be preferable to implement an air cushion lead vehicle and possibly even an air cushion base in areas where at least a portion of the concrete has already been placed, or where loading requirements dictate a low ground pressure unit, such as on decks for elevated slabs, while different units may be preferred when the concrete is to be placed over dirt or sand, since the air cushion units may kick up a substantial amount of dirt and dust over such terrain.

Likewise, each of the embodiments of the base units and support units may be implemented with any of the embodiments of the pipe assemblies or conduits. If a telescopingly extendable and retractable pipe assembly is used, such an assembly may include an extension and retraction device as discussed above with respect to placing apparatus 700, 800. The telescopingly extendable and retractable pipe assembly may also be capable of over-retracting to expose the seals and wear bands of the inner pipe sections to facilitate inspection, maintenance and replacement of the seals and wear bands.

It is further envisioned that the base and lead units of the present invention may be manually controlled, and may even include an operator station for an operator to sit at and drive the vehicles while controlling the extension and retraction of at least one of the tubes. However, and preferably, at least the lead unit of each embodiment is remotely controllable via radio or electronic wire and may even comprise a programmable control which is operable to automatically move the lead unit and the tube assembly through the steps described above with respect to FIGS. 31–34 or FIGS. 43–48 without any manual intervention required. The programmable control may also be operable to open and close a valve in the tube assembly to place concrete only in the appropriate areas to provide a generally uniform distribution of uncured concrete over the entire targeted area. The only manual intervention then is to position the base unit at the desired location and connect the supply end of the tube assembly to the supply hoses, tubes, and/or pipes, which are connected to a pumping device.

Preferably, the base unit of the present invention further includes a radio receiver and control, which are operable to receive signals from a remote control transmitter used by an operator near the machine and to control the hydraulic drive motors, steering cylinders and other hydraulic cylinders and/or motors to maneuver the placing apparatus for placement of concrete at the support surface.

Therefore, the present invention provides a placing and/or screeding apparatus which is easily maneuverable and which may easily be implemented in areas where a boom truck cannot reach, such as remote areas of buildings or areas with low overhead clearance, or raised or elevated areas where weight or ground pressure may be a concern. The apparatus may include a conduit or tube or pipe assembly which is operable to provide uncured concrete to a discharge end of the conduit. The conduit or pipe assembly may be extendable and retractable to move the discharge end throughout the targeted area of the support surface. It is envisioned that the tube or pipe assembly may be extendable via a telescoping assembly, an articulated assembly, a flexible, bending assembly, an accordion type or corrugated conduit assembly, or any other means for extending and retracting a discharge end of the apparatus relative to a base or support, without affecting the scope of the present invention. The present invention may further include a screeding device at a dispensing end of the tube assembly to grade and/or smooth and/or compact the concrete as it is placed, thereby eliminating the additional step of setting up a separate screeding apparatus and screeding the concrete after it has been placed. Alternately, various embodiments of the movable units may include only a screeding device for grading, smoothing and/or compacting previously placed uncured concrete. The screeding device may be implemented with one ore more of the wheeled units, air cushion support units and/or swing tractor units, without affecting the scope of the present invention.

Additionally, the air cushion embodiments of the base and lead units facilitate movement of the apparatus over areas which are covered with uncured concrete, in order to place additional concrete and/or to smooth and compact the already placed concrete, without disturbing the uncured concrete which has already been placed and perhaps smoothed. The air cushion supports are especially useful in placing and/or screeding concrete in areas where a wheeled unit or other type of support may be too heavy or the support force too concentrated, such as on corrugated metal decking of elevated slabs. The air cushion supports spread the support force/weight of the supports and tube assembly and/or screeding device over a larger footprint to substantially reduce the ground pressure being applied at the support surface. One or more air cushion supports may be implemented with a concrete supply unit, such as a pipe or tube assembly, a hopper, or any other device which may provide/dispense concrete or other material at a targeted location, and/or a screeding device. The air cushion support (s) may be movable via movement of a tube assembly, such as extension/retraction and/or angular adjustment of the tube assembly, or may be movable via adjustment of an angle of one or more fan units, or pivotal movement of a base or other support, or any other means for moving the air cushion support generally horizontally over the support surface.

Changes and modifications in the specifically described embodiments can be carried out without departing from the principles of the invention, which is intended to be limited only by the scope of the appended claims, as interpreted according to the principles of patent law.

The embodiments of the invention in which an exclusive property right or privilege is claimed are defined as follows:

1. A concrete placing apparatus for placing uncured concrete at a support surface, said concrete placing apparatus comprising:

a conduit having a supply end and a discharge end, said supply end being operable to receive a supply of uncured concrete, said discharge end being operable to discharge uncured concrete to the support surface;

a movable wheeled base unit which supports said supply end of said conduit; and a movable wheeled support unit which is operable to movably support said discharge end of said conduit, at least one of said movable wheeled base unit and said movable wheeled support unit having a frame and two wheels adjustably mounted to said frame, said two wheels being adjustable between a laterally outward position and a laterally inward position relative to said frame.

2. The concrete placing apparatus of claim 1, wherein said movable wheeled base unit and said movable wheeled support unit are movable when said two wheels of the respective unit are in said laterally inward position.

3. The concrete placing apparatus of claim 2, wherein said movable wheeled base unit and said movable wheeled support unit are movable when said two wheels of the respective unit are in said laterally outward position.

4. The concrete placing apparatus of claim 1, wherein said conduit comprises an extendable conduit having at least two sections extendable and retractable relative to one another.

5. The concrete placing apparatus of claim 4, wherein said extendable conduit comprises at least two sections, whereby one of said at least two sections is telescopingly extendable and retractable with respect to the other of said at least two sections, one of said at least two sections being supported by said movable base unit, another of said at least two sections being supported by said movable support unit.

6. A concrete placing apparatus for placing uncured concrete at a support surface, said concrete placing apparatus comprising:

a conduit having a supply end and a discharge end, said supply end being operable to receive a supply of uncured concrete, said discharge end being operable to discharge uncured concrete to the support surface;

a movable wheeled base unit which supports said supply end of said conduit; and a movable wheeled support unit which is operable to movably support said discharge end of said conduit, at least one of said movable wheeled base unit and said movable wheeled support unit having a frame and two wheels adjustably mounted to said frame, said two wheels being adjustable between a laterally outward position and a laterally inward position relative to said frame, wherein each of said movable wheeled base unit and said movable wheeled support unit include said frame and said two wheels adjustably mounted to said frame.

7. The concrete placing apparatus of claim 6, wherein each of said two wheels of each of said movable wheeled base unit and said movable wheeled support unit are independently drivable via a motor.

8. A concrete placing apparatus for placing uncured concrete at a support surface, said concrete placing apparatus comprising:

a conduit having a supply end and a discharge end, said supply end being operable to receive a supply of uncured concrete, said discharge end being operable to discharge uncured concrete to the support surface;

a movable wheeled base unit which supports said supply end of said conduit; and a movable wheeled support unit which is operable to movably support said discharge end of said conduit, at least one of said movable wheeled base unit and said movable wheeled support unit having a frame and two wheels adjustably mounted to said frame, said two wheels being adjustable between a laterally outward position and a laterally inward position relative to said frame, wherein said wheels are adjustable relative to said frame via pivotal movement of said wheels about a generally vertical pivot axis at opposite sides of said frame.

9. The concrete placing apparatus of claim 8, wherein said wheels are pivotally adjusted via a double ended hydraulic cylinder, whereby one end of said hydraulic cylinder is extendable and retractable to pivot one of said wheels relative to said frame and the other end of said hydraulic cylinder is correspondingly retractable and extendable to correspondingly pivot the other one of said wheels relative to said frame.

10. The concrete placing apparatus of claim 8, wherein said wheels are correspondingly adjustable about said generally vertical pivot axes to steer said at least one of said wheeled movable base unit and said wheeled movable support unit.

11. A concrete placing apparatus for placing uncured concrete at a support surface, said concrete placing apparatus comprising:

a conduit having a supply end and a discharge end, said supply end being operable to receive a supply of uncured concrete, said discharge end being operable to discharge uncured concrete to the support surface;

a movable wheeled base unit which supports said supply end of said conduit; and a movable wheeled support unit which is operable to movably support said discharge end of said conduit, at least one of said movable wheeled base unit and said movable wheeled support unit having a frame and two wheels adjustably mounted to said frame, said two wheels being adjustable between a laterally outward position and a laterally inward position relative to said frame, wherein said movable support unit is operable to movably support said discharge end of said conduit along an arcuate path relative to said movable base unit.

12. The concrete placing apparatus of claim 11, wherein said movable support unit is independently movable via a drive motor to movably support said discharge end of said conduit.

13. A concrete placing apparatus for placing uncured concrete at a support surface, said concrete placing apparatus comprising:

a conduit having a supply end and a discharge end, said supply end being operable to receive a supply of uncured concrete, said discharge end being operable to discharge uncured concrete to the support surface, said conduit comprising an extendable conduit having at least two sections extendable and retractable relative to one another;

a movable wheeled base unit which supports said supply end of said conduit; and a movable wheeled support unit which is operable to movably support said discharge end of said conduit, at least one of said movable wheeled base unit and said movable wheeled support unit having a frame and two wheels adjustably mounted to said frame, said two wheels being adjustable between a laterally outward position and a laterally inward position relative to said frame, said extendable conduit comprising at least two sections, whereby one of said at least two sections is telescopingly extendable and retractable with respect to the other of said at least two sections, one of said at least two sections being supported by said movable base unit, another of said at least two sections being supported by said movable support unit, wherein an inner one of said at least two sections is slidable within an outer one of said at least two sections, said inner one of said at least two sections including at least one seal for sealing said inner one of said at least two sections to said outer one of said at least two sections.

14. The concrete placing apparatus of claim 13, wherein said inner one of said at least two sections is extendable with respect to said outer one of said at least two sections to expose said at least one seal of said inner one of said at least two sections.

15. The concrete placing apparatus of claim 14, wherein extension of said inner one of said at least two sections is limited by an adjustable stop, said adjustable stop being adjustable to allow said inner one of said at least two sections to extend with respect to said outer one of said at least two sections to expose said at least one seal.

16. A concrete placing apparatus for placing uncured concrete at a support surface, said concrete placing apparatus comprising:

a conduit having a supply end and a discharge end, said supply end being operable to receive a supply of uncured concrete, said discharge end being operable to discharge uncured concrete to the support surface, said conduit comprising an extendable conduit having at least two sections extendable and retractable relative to one another;

a movable wheeled base unit which supports said supply end of said conduit; and a movable wheeled support unit which is operable to movably support said discharge end of said conduit, at least one of said movable wheeled base unit and said movable wheeled support unit having a frame and two wheels adjustably mounted to said frame, said two wheels being adjustable between a laterally outward position and a laterally inward position relative to said frame, wherein said extendable conduit comprises first, second and third sections which are telescopingly extendable and retractable with respect to one another, said first section being supported at said movable base unit and said third section being supported at said movable support unit, said second section being extendable and retractable relative to said first section and said third section being extendable and retractable relative to said second section.

17. The concrete placing apparatus of claim 16, wherein said extendable conduit is extended and retracted in response to actuation of an extension and retraction device.

18. The concrete placing apparatus of claim 17, wherein said extension and retraction device includes a drive member mounted at said second section and a track member extending along said first section, said drive member engaging said track member to move said second section relative to said first section.

19. The concrete placing apparatus of claim 18, wherein said extension and retraction device includes at least one pulley and at least one flexible member routed around said at least one pulley and operable to pull at said third section in response to movement of said second section relative to said first section.

20. The concrete placing apparatus of claim 19, wherein said extension and retraction device is operable to correspondingly extend said second section relative to said first section and said third section relative to said second section.

21. The concrete placing apparatus of claim 17, wherein said extension and retraction device is operable to correspondingly extend said second section relative to said first section and said third section relative to said second section.

22. A concrete placing apparatus for placing uncured concrete at a support surface, said concrete placing apparatus comprising:

a conduit having a supply end and a discharge end, said supply end being operable to receive a supply of uncured concrete, said discharge end being operable to discharge uncured concrete to the support surface;

a movable wheeled base unit which supports said supply end of said conduit;

a movable wheeled support unit which is operable to movably support said discharge end of said conduit, at least one of said movable wheeled base unit and said movable wheeled support unit having a frame and two wheels adjustably mounted to said frame, said two wheels being adjustable between a laterally outward position and a laterally inward position relative to said frame; and a discharge tube assembly mounted to said support unit at said discharge end of said conduit, said discharge tube assembly including a tube and being operable to move a discharge end of said tube along an arcuate path relative to said discharge end of said conduit.

23. The concrete placing apparatus of claim 22, wherein said discharge end of said tube is vertically adjustable relative to said discharge end of said conduit.

24. The concrete placing apparatus of claim 22, wherein said tube includes a curved portion, said discharge end of said tube being moved along the arcuate path via an actuator which is operable to rotate said curved portion of said tube relative to said conduit.

25. The concrete placing apparatus of claim 22 further including a plow assembly mounted at said discharge tube assembly, said plow assembly being operable to generally smooth and spread the uncured concrete at the support surface as it is discharged from said discharge end of said tube.

26. The concrete placing apparatus of claim 25, wherein said plow assembly is vertically adjustable relative to said support unit.

27. The concrete placing apparatus of claim 26, wherein said plow assembly is vertically adjustable in response to a laser leveling system.

28. The concrete placing apparatus of claim 26, wherein said plow assembly is laterally adjustable relative to said support unit.

29. The concrete placing apparatus of claim 28, wherein said discharge end of said tube is laterally adjustable relative to said discharge end of said conduit.

30. The concrete placing apparatus of claim 29, wherein said discharge end of said tube and said plow assembly are correspondingly laterally adjusted to place and smooth uncured concrete at the support surface.

31. The concrete placing apparatus of claim 25, wherein said plow assembly further includes a vibrating member for screeding the uncured concrete surface.

32. The concrete placing apparatus of claim 25, wherein said plow assembly comprises a generally V-shaped plow.

33. A method for placing uncured concrete at a support surface, said concrete placing apparatus comprising:

providing a concrete placing apparatus having a two-wheeled base unit and a two-wheeled support unit, said two-wheeled units supporting opposite ends of an extendable conduit assembly;

adjusting a lateral position of each of a pair of wheels for each of said two-wheeled units between an inward state and an outward state;

positioning said concrete placing apparatus at a support surface;

connecting a supply of uncured concrete to a supply end of said extendable conduit;

discharging uncured concrete from a discharge end of said extendable conduit onto the support surface; and moving at least one of said two-wheeled units while discharging the uncured concrete.

34. The method of claim 33 including plowing the uncured concrete discharged onto the support surface with a plow assembly mounted at said two-wheeled support unit.

35. The method of claim 34 including screeding the uncured concrete discharged onto the support surface with a vibrating member mounted at said two-wheeled support unit.

36. The method of claim 34, wherein plowing the uncured concrete includes vertically adjusting said plow assembly.

37. The method of claim 36, wherein vertically adjusting said plow assembly includes vertically adjusting said plow assembly in response to a laser leveling system.

38. The method of claim 33 including screeding the uncured concrete discharged onto the support surface with a vibrating member mounted at said two-wheeled support unit.

39. A method for placing uncured concrete at a support surface, said concrete apparatus comprising:

placing providing a concrete placing apparatus having a two-wheeled base unit and a two-wheeled support unit, said two-wheeled units supporting opposite ends of an extendable conduit assembly;

adjusting a lateral position of each of a pair of wheels for each of said two-wheeled units between an inward state and an outward state, wherein adjusting a lateral position of each of the pair of wheels includes pivoting each of said wheels about a pivot axis from the retracted state to the outward state at the support surface;

positioning said concrete placing apparatus at a support surface;

connecting a supply of uncured concrete to a supply end of said extendable conduit;

discharging uncured concrete from a discharge end of said extendable conduit onto the support surface; and moving at least one of said two-wheeled units while discharging the uncured concrete.

40. The method of claim 39 further including adjusting a degree of extension of said conduit assembly at least prior to discharging the uncured concrete.

41. The method of claim 40, wherein adjusting the degree of extension of said conduit assembly includes adjusting the degree of extension while discharging the uncured concrete.

42. The method of claim 40, wherein adjusting a degree of extension of said conduit assembly includes extending and retracting a first conduit supported by said two-wheeled support unit relative to a second conduit supported by said two-wheeled base unit.

43. The method of claim 42, wherein extending and retracting said first conduit relative to said second conduit includes extending and retracting said first conduit via telescopic movement of said first conduit relative to said second conduit.

44. The method of claim 43 including extending said second conduit relative to said first conduit to extend said second conduit outward from said first conduit to expose at least one seal around said second conduit.

45. The method of claim 43, wherein adjusting the degree of extension further includes extending and retracting said first conduit relative to a third conduit and extending and retracting said third conduit relative to said second conduit.

46. The method of claim 45, wherein extending and retracting said first conduit relative to said second conduit includes rotatably driving a drive member along a track member secured to said base unit, said drive member being positioned at said second conduit to move said second conduit relative to said track member and said first conduit.

47. The method of claim 46, wherein extending and retracting said conduits further includes moving at least one pulley along at least one flexible member routed around said at least one pulley to pull at said third conduit in response to movement of said second conduit relative to said first conduit.

48. The method of claim 47, wherein extending and retracting said conduits further includes correspondingly extending said first conduit from said third conduit and said third conduit from said second conduit.

49. A method for placing uncured concrete at a support surface, said concrete placing apparatus comprising:

providing a concrete placing apparatus having a two-wheeled base unit and a two-wheeled support unit, said two-wheeled units supporting opposite ends of an extendable conduit assembly;

adjusting a lateral position of each of a pair of wheels for each of said two-wheeled units between an inward state and an outward state;

positioning said concrete placing apparatus at a support surface, wherein adjusting a lateral position of each of the pair of wheels and positioning said concrete placing apparatus at a support surface includes:

adjusting the lateral position of the wheels to the inward state;

moving said concrete placing apparatus to the support surface; and adjusting the lateral position of the wheels to the outward state;

connecting a supply of uncured concrete to a supply end of said extendable conduit;

discharging uncured concrete from a discharge end of said extendable conduit onto the support surface; and moving at least one of said two-wheeled units while discharging the uncured concrete.

50. The method of claim 49, wherein moving said concrete placing apparatus to the support surface includes moving said concrete placing apparatus to an elevated support surface.

51. The method of claim 50, wherein moving at least one of said two-wheeled units includes moving both of said two-wheeled units over the elevated support surface and discharging uncured concrete while said wheels of both of said two-wheeled units are adjusted to the laterally outward state.

52. The method of claim 50, wherein prior to moving said concrete placing apparatus to the support surface, said method includes retracting said extendable conduit to a retracted state.

53. A method for placing uncured concrete at a support surface, said concrete placing apparatus comprising:

providing a concrete placing apparatus having a two-wheeled base unit and a two-wheeled support unit, said two-wheeled units supporting opposite ends of an extendable conduit assembly;

adjusting a lateral position of each of a pair of wheels for each of said two-wheeled units between an inward state and an outward state;

positioning said concrete placing apparatus at a support surface;

connecting a supply of uncured concrete to a supply end of said extendable conduit;

discharging uncured concrete from a discharge end of said extendable conduit onto the support surface;

moving at least one of said two-wheeled units while discharging the uncured concrete;

plowing the uncured concrete discharged onto the support surface with a plow assembly mounted at said two-wheeled support unit; and laterally adjusting a discharge end of said conduit with respect to said support unit and correspondingly laterally adjusting said plow assembly with respect to said support unit.

54. A method for placing uncured concrete at a support surface, said concrete placing apparatus comprising:

providing a concrete placing apparatus having a two-wheeled base unit and a two-wheeled support unit, said two-wheeled units supporting opposite ends of an extendable conduit assembly;

adjusting a lateral position of each of a pair of wheels for each of said two-wheeled units between an inward state and an outward state;

positioning said concrete placing apparatus at a support surface;

connecting a supply of uncured concrete to a supply end of said extendable conduit;

discharging uncured concrete from a discharge end of said extendable conduit onto the support surface;

moving at least one of said two-wheeled units while discharging the uncured concrete; and laterally adjusting a discharge end of said conduit relative to said support unit.

55. A concrete placing apparatus for placing uncured concrete at a support surface, said concrete placing apparatus comprising:

a conduit having a supply end and a discharge end, said supply end being operable to receive a supply of uncured concrete, said discharge end being operable to discharge uncured concrete to the support surface;

a movable wheeled base unit which supports said supply end of said conduit, said movable wheeled base unit having a base frame and two wheels adjustably mounted to said base frame, said two wheels being adjustable between a laterally outward position and a laterally inward position relative to said base frame; and a movable wheeled support unit which is operable to movably support said discharge end of said conduit, said movable wheeled support unit having a support frame and two wheels adjustably mounted to said support frame, said two wheels being adjustable between a laterally outward position and a laterally inward position relative to said support frame.

56. The concrete placing apparatus of claim 55, wherein said wheels of said base unit and said wheels of said support unit are adjustable relative to said frame via pivotal movement of said wheels about a generally vertical pivot axis at opposite sides of said base frame and said support frame, respectively.

57. The concrete placing apparatus of claim 56, wherein said wheels are pivotally adjusted via a double ended hydraulic cylinder, whereby one end of said hydraulic cylinder is extendable and retractable to pivot one of said wheels relative to said base and support frames and the other end of said hydraulic cylinder is correspondingly retractable and extendable to correspondingly pivot the other one of said wheels relative to said base and support frames.

58. The concrete placing apparatus of claim 55, wherein said wheels are correspondingly adjustable about said generally vertical pivot axes to steer said wheeled movable base unit and said wheeled movable support unit.

59. The concrete placing apparatus of claim 55, wherein said movable support is operable to movably support said discharge end of said conduit along an arcuate path relative to said base unit.

60. The concrete placing apparatus of claim 59, wherein said movable support is independently movable via a drive motor to movably support said discharge end of said conduit.

61. The concrete placing apparatus of claim 55, wherein said conduit comprises an extendable conduit having at least two sections extendable and retractable relative to one another.

62. The concrete placing apparatus of claim 61, wherein said at least two sections are telescopingly extendable and retractable with respect to the one another, one of said at least two sections being supported by said base unit, the other of said at least two sections being supported by said support unit.

63. The concrete placing apparatus of claim 62, wherein an inner one of said at least two sections is slidable within an outer one of said at least two sections, said inner one of said at least two sections including at least one seal for sealing said inner one of said at least two sections to said outer one of said at least two sections.

64. The concrete placing apparatus of claim 63, wherein said inner one of said at least two sections is extendable with respect to said outer one of said at least two sections to expose said at least one seal of said inner one of said at least two sections.

65. The concrete placing apparatus of claim 64, wherein extension of said inner one of said at least two sections is limited by an adjustable stop, said adjustable stop being adjustable to allow said inner one of said at least two sections to extend with respect to said outer one of said at least two sections to expose said at least one seal.

66. The concrete placing apparatus of claim 61, wherein said extendable conduit comprises first, second and third sections which are telescopingly extendable and retractable with respect to one another, said first section being supported at said base unit and said third section being supported at said support unit, said second section being extendable and retractable relative to said first section and said third section being extendable and retractable relative to said second section.

67. The concrete placing apparatus of claim 66, wherein said sections of said extendable conduit are correspondingly extendable and retractable relative to one another.

68. The concrete placing apparatus of claim 55 further including a discharge tube assembly mounted to said support unit at said discharge end of said conduit, said discharge tube assembly including a tube and being operable to move a discharge end of said tube laterally relative to said discharge end of said conduit.

69. The concrete placing apparatus of claim 68, wherein said tube comprises a flexible tube which is flexed to move said discharge end of said tube laterally.

70. The concrete placing apparatus of claim 68, wherein said tube includes a curved portion, said discharge end of said tube being laterally moved via rotation of said curved portion relative to said conduit.

71. The concrete placing apparatus of claim 68, wherein said discharge end of said tube is vertically adjustable relative to said discharge end of said conduit.

72. The concrete placing apparatus of claim 68 further including a plow assembly mounted at said discharge tube assembly, said plow assembly being operable to generally smoothing and spreading the uncured concrete at the support surface as it is discharged from said discharge end of said tube.

73. The concrete placing apparatus of claim 72, wherein said plow assembly is vertically adjustable relative to said support unit.

74. The concrete placing apparatus of claim 73, wherein said plow assembly is vertically adjustable in response to a laser leveling system.

75. The concrete placing apparatus of claim 73, wherein said plow assembly is laterally adjustable relative to said support unit as said discharge end of said tube is laterally adjusted relative to said discharge end of said conduit.

76. The concrete placing apparatus of claim 72, wherein said plow assembly further includes a vibrating member for screeding the uncured concrete.

* * * * *

UNITED STATES PATENT AND TRADEMARK OFFICE

CERTIFICATE OF CORRECTION

PATENT NO. : 6,588,976 B2 
DATED : July 8, 2003
INVENTOR(S) : Philip J. Quenzi et al.

It is certified that error appears in the above-identified patent and that said Letters Patent is hereby corrected as shown below:

Column 54,
Line 37, insert -- placing -- after "concrete"
Line 38, delete "placing" before "providing"

Signed and Sealed this

Eighth Day of March, 2005

JON W. DUDAS
*Director of the United States Patent and Trademark Office*